US007855621B2

(12) United States Patent
Guan

(10) Patent No.: US 7,855,621 B2
(45) Date of Patent: Dec. 21, 2010

(54) REFLECTION-TYPE BANDPASS FILTER

(75) Inventor: Ning Guan, Sakura (JP)

(73) Assignee: Fujikura Ltd., Tokyo (JP)

( * ) Notice: Subject to any disclaimer, the term of this patent is extended or adjusted under 35 U.S.C. 154(b) by 233 days.

(21) Appl. No.: 11/867,440

(22) Filed: Oct. 4, 2007

(65) Prior Publication Data

US 2008/0106355 A1 May 8, 2008

(30) Foreign Application Priority Data

Oct. 5, 2006 (JP) ..... 2006-274322
Nov. 29, 2006 (JP) ..... 2006-321596

(51) Int. Cl.
*H01P 1/203* (2006.01)

(52) U.S. Cl. ..... 333/204

(58) Field of Classification Search ..... 333/202, 333/204, 238, 166–168, 175, 176, 185
See application file for complete search history.

(56) References Cited

U.S. PATENT DOCUMENTS

| | | | | |
|---|---|---|---|---|
| 2,411,555 | A | 11/1946 | Rogers | |
| 3,617,877 | A * | 11/1971 | Hobson | 324/642 |
| 4,371,853 | A | 2/1983 | Makimoto et al. | |
| 4,992,760 | A | 2/1991 | Takeda et al. | |
| 5,418,507 | A * | 5/1995 | Keane et al. | 333/202 |
| 5,525,953 | A | 6/1996 | Okada et al. | |
| 5,923,295 | A | 7/1999 | Nakano et al. | |
| 6,323,740 | B1 | 11/2001 | Ishikawa et al. | |
| 6,353,371 | B1 | 3/2002 | Kadota et al. | |
| 6,563,403 | B2 | 5/2003 | Kanba et al. | |
| 6,577,211 | B1 * | 6/2003 | Tsujiguchi | 333/204 |
| 6,603,376 | B1 | 8/2003 | Handforth et al. | |
| 6,686,808 | B1 | 2/2004 | Sugawara et al. | |

(Continued)

FOREIGN PATENT DOCUMENTS

| | | | |
|---|---|---|---|
| CH | 663 690 | A5 | 12/1987 |
| CN | 1097082 | A | 1/1995 |
| JP | 56-64501 | A | 6/1981 |
| JP | 9-172318 | A | 6/1997 |
| JP | 9-232820 | A | 9/1997 |

(Continued)

OTHER PUBLICATIONS

Xiao, et al., "A New Numerical Method for Synthesis of Arbitrarily Terminated Lossless Nonuniform Transmission Lines", IEEE Transactions on Microwave Theory and Techniques, Feb. 2001, pp. 369-376, vol. 49, No. 2, IEEE Service Center, Piscataway, NJ, US, XP011038268.

(Continued)

*Primary Examiner*—Benny Lee
*Assistant Examiner*—Gerald Stevens
(74) *Attorney, Agent, or Firm*—Sughrue Mion, PLLC

(57) ABSTRACT

A reflection-type bandpass filter for ultra-wideband (UWB) radio data communications is provided. The reflection-type bandpass filter includes a substrate formed by laminating a conducting layer and a dielectric layer, and a microstrip line made of a conductor of a non-uniform width and provided on the dielectric layer. The width distribution of the microstrip line in the lengthwise direction is set such that the absolute value of the difference in reflectivity at the frequency f in the regions f<3.1 GHz and f>10.6 GHz and the reflectivity in the region 3.7 GHz≦f≦10.0 GHz is not less than 10 dB, and the variation of the group delay in the region 3.7 GHz≦f≦10.0 GHz is between −0.2 and 0.2 ns.

11 Claims, 24 Drawing Sheets

U.S. PATENT DOCUMENTS

| | | | | |
|---|---|---|---|---|
| 6,924,714 | B2 * | 8/2005 | Jain | 333/123 |
| 2005/0140472 | A1 * | 6/2005 | Ko et al. | 333/204 |
| 2006/0061438 | A1 | 3/2006 | Toncich | |
| 2006/0255886 | A1 | 11/2006 | Ninomiya et al. | |
| 2007/0159276 | A1 | 7/2007 | Han et al. | |
| 2007/0210880 | A1 | 9/2007 | Bobier et al. | |

FOREIGN PATENT DOCUMENTS

| | | | |
|---|---|---|---|
| JP | 10-65402 | A | 3/1998 |
| JP | 10-242746 | A | 9/1998 |
| JP | 2000-4108 | A | 1/2000 |
| JP | 2000-101301 | A | 4/2000 |
| JP | 2002-43810 | A | 2/2002 |
| SU | 1 728 904 | A1 | 4/1992 |

OTHER PUBLICATIONS

Xiao, et al., "Impedance Matching for Complex Loads Through Nonuniform Transmission Lines", IEEE Transactions on Microwave Theory and Techniques, Jun. 2002, pp. 1520-1525, vol. 50, No. 6, IEEE Service Center, Piscataway, NJ, US, XP011076613.

Chang, et al., "Wide-Band Equal-Ripple Filters in Nonuniform Transmission Lines", IEEE Transactions on Microwave Theory and Techniques, Apr. 2002, pp. 1114-1119, vol. 50, No. 4, IEEE Service Center, Piscataway, NJ, US, XP011076539.

Moreira, et al., "Direct Synthesis of Microwave Filters Using Inverse Scattering Transmission-Line Matrix Method", IEEE Transactions on Microwave Theory and Techniques, Dec. 2000, pp. 2271-2276, vol. 48, No. 12, IEEE Service Center, Piscataway, NJ, US, XP011038181.

A. V. Oppenheim and R. W. Schafer, "Discrete-time signal processing," pp. 465-478, Prenticehall, 1998.

G-B. Xiao, K. Yashiro, N, Guan, and S. Ohokawa, "An effective method for designing nonuniformly coupled transmission-line filters," IEEE Trans. Microwave Theory tech.,vol. 49,pp. 1027-1031,Jun. 2001.

C-Y. Chen and C-Y. Hsu, "Design of a UWB low insertion loss bandpass filter with spurious response suppression," Microwave J.,pp. 112-116, Feb. 2006.

Le Roy et al., "Novel Circuit Models of Arbitrary-Shape Line: Application to Parallel Coupled Microstrip Filters with Suppression of Multi-Harmonic Responses", 2005 European Microwave Conference CNIT La Defense Paris, France Oct. 4-6, 2005, pp. 921-924, IEEE, Piscataway, NJ, USA, XP010903914, English.

Le Roy et al., "A New Design of Microwave Filters by Using Continuously Varying Transmission Lines", Microwave Symposium Digest 1997, IEEE MTT-S International Denver, CO, USA Jun. 8-13, 1997, pp. 639-642, vol. 2, IEEE, New York, NY, US, XP010228412, English.

Le Roy et al., "The Continuously Varying Transmission-Line Technique-Application to Filter Design", IEEE Transactions on Microwave Theory and Techniques, Sep. 1999, pp. 1680-1687, vol. 47, No. 9, IEEE, XP 11037721, English.

Pan et al., "Arbitrary Filter Design by Using Nonuniform Transmission Lines", IEEE Microwave and Guided Wave Letters, Feb. 1999, pp. 60-62, vol. 9, No. 2, IEEE, XP 011035415, English.

Konishi, "Microwave integrated circuits", 1991, pp. 19-21, Marcel Dekker, English.

Yang et al., "Design of Dual Passband Filter Based on Zakharov-Shabat Inverse Scattering Problem", APMC2005 Proceedings, Dec. 4-7, 2005, pp. 1-3, IEEE, XP 10901861, English.

Huang, "Quasi-Transversal Synthesis of Microwave Chirped Filters", Electronics Letters, May 21, 1992, pp. 1062-1064, vol. 28, No. 11, IEE Stevenage, GB, XP000305900, English.

Deng et al., "Multiple-Mode Resonance Bands in Periodically Nonuniform Conductor-Backed Coplanar Waveguides", Microwave Conference, 1999 Asia Pacific Singapore Nov. 30-Dec. 3, 1999, pp. 5-8. vol. 1, IEEE, Piscataway, NJ, USA, XP010374097, English.

Xiao et al, "An Efficient Algorithm for Solving Zakharov-Shabat Inverse Scattering Problem", IEEE Transactions on Antennas and Propagation, Jun. 2002, pp. 807-811, vol. 50, No. 6, IEEE, English.

Tan et al., "Analysis and design of conductor-backed asymmetric coplanar waveguide lines using conformal mapping techniques and their application to end-coupled filters," IEICE Trans. Electron., Jul. 1999, pp. 1098-1103, vol. E82-C, No. 7, English.

Sun et al., "Guided-Wave Characteristics of Periodically Nonuniform Coupled Microstrip Lines-Even and Odd Modes" IEEE Transaction on Microwave Theory and Techniques, IEEE Service Center. Piscataway, NJ, US, vol. 53, No. 4 Apr. 2005, pp. 1221-1227, English.

Cheng et al., "Inverse Scattering of Nonuniform, Symmetrical Coupled Lines" IEEE Microwave and Guided Wave Letters, IEEE Inc, New York, US, vol. 8, No. 7, July (Jul. 1998), pp. 260-262, English.

Ma et al., "Experimentally investigating slow-wave transmission lines and filters based on conductor-backed CPW periodic cells" Microwave Symposium Digest, 2005 IEEE MTT-S International Long Beach, CA, USA Jun. 12-17, 2005, Piscataway, NJ, USA IEEE, Jun. 12, 2005, pp. 1653-1656, English.

Young et al., "Accurate non-uniform transmission line model and its application to the de-embedding of on-wafer measurements" IEE Proceedings H. Microwaves, Antennas & Propagation, Institution of Electrical Engineers. Stevenage , GB, vol. 148, No. 3, Jun. 11, 2001 , pp. 153-156, XP006016881, English.

Boulejfen et al., "A robust and efficient method for the frequency domain analysis of non-uniform, lossy multi-line transmission structures" Microwave Symposium Digest, 1998 IEEE MTT-S International Baltimore, MD, USA Jun. 7-12, 1998, pp. 1763-1766, XP01029010, English.

Y. Konishi, "Microwave Integrated Circuits", 1991, pp. 9-11, Marcel Dekker, English.

Mirshekar-Syahkal et al., "Accurate Analysis of Tapered Planar Transmission Lines for Microwave Integrated Circuits", IEEE Transactions on Microwave Theory and Techniques, Feb. 1981, pp. 123-128, vol. 29, No. 2, IEEE, English.

Wang et al., "Ultra-Wideband Bandpass Filter with Hybrid Microstrip/CPW Structure", IEEE Microwave and Wireless Components Letters, Dec. 2005, pp. 844-846, vol. 15, No. 12, IEEE, English.

Japanese Office Action issued in related Japanese Patent Application No. 2006-274327 with English translation mailed Jun. 22, 2010.

Japanese Office Action issued in related Japanese Patent Application No. 2006-274326 with English language translation mailed Jun. 22, 2010.

Japanese Office Action issued in related Japanese Patent Application No. 2006-274324 with English language translation mailed Jun. 22, 2010.

Y. Qian and E. Yamashita, "Additional Approximate Formulas and Experimental Data on Micro-Coplanar Striplines," IEEE Transaction on Microwave Theory and Techniques, IEEE, Apr. 1990, vol. 38, No. 4 pp. 443-445.

J. Svacina, Special Types of Coplanar Transmission Lines Suitable Up to mm-Wave Bands, 6th Topical Meeting on Electrical Performance of Electronic Packaging, IEEE, Oct. 1997, pp. 99-102.

P. Ghanipour et al., "Suppression Mode Coupling in Conductor-Backer Asymmetric Coplanar Strips Using Slow-Wave Electrodes", IEEE Microwave and Wireless Components Letters, May 2006, vol. 16, No. 5, 272-274.

L. Vegni et al., "Tapered Stripline Embedded in Inhomogeneous Media as Microwave Matching Line", IEEE Transaction on Microwave Theory and Techniques, IEEE, May 2001, vol. 49, No. 5, pp. 970-978.

* cited by examiner

REFLECTION-TYPE BANDPASS FILTER

CROSS-REFERENCE TO RELATED PATENT APPLICATIONS

The present application claims priority from Japanese Patent Application No. 2006-274322, filed Oct. 5, 2006, and Japanese Patent Application No. 2006-321596, filed Nov. 29, 2006, the contents of which are incorporated herein by reference.

BACKGROUND OF THE INVENTION

1. Field of the Invention

Apparatuses consistent with the present invention relate to a reflection-type bandpass filter for use in ultra-wideband (UWB) radio data communications. By using this reflection-type bandpass filter for UWB, the spectrum mask established by the Federal Communications Commission (FCC) can be satisfied.

2. Description of the Related Art

The following documents describe the related art for the current invention:

[Document 1] U.S. Pat. No. 2,411,555 Specification

[Document 2] Japanese Unexamined Patent Application, First Publication No. S56-64501

[Document 3] Japanese Unexamined Patent Application, First Publication No. H9-172318

[Document 4] Japanese Unexamined Patent Application, First Publication No. H9-232820

[Document 5] Japanese Unexamined Patent Application, First Publication No. H10-65402

[Document 6] Japanese Unexamined Patent Application, First Publication No. H10-242746

[Document 7] Japanese Unexamined Patent Application, First Publication No. 2000-4108

[Document 8] Japanese Unexamined Patent Application, First Publication No. 2000-101301

[Document 9] Japanese Unexamined Patent Application, First Publication No. 2002-43810

[Document 10] A. V. Oppenheim and R. W. Schafer, "Discrete-time signal processing," pp. 465-478, Prenticehall, 1998

[Document 11] G-B. Xiao, K. Yashiro, N, Guan, and S. Ohokawa, "An effective method for designing non-uniformly coupled transmission-line filters," IEEE Trans. Microwave Theory tech., vol. 49, pp. 1027-1031, June 2001.

[Document 12] C-Y. Chen and C-Y. Hsu, "Design of a UWB low insertion loss bandpass filter with spurious response suppression," Microwave J., pp. 112-116, February 2006

In bandpass filters of the related art, the stop band rejection (difference between the reflectivity in the pass band and reflectivity in the stop band) was not set at an adequately large value in the design stage. Thus, these filters may not satisfy the FCC regulations because of manufacturing errors and the like.

For example, if a microstrip line as in FIG. 1 having a distribution as shown in FIG. 2, which is a distribution in the lengthwise direction of width of a microstrip line is used (when substrate with thickness h=0.635 mm, relative dielectric constant $\in_r$=10.2 is used), as shown in FIG. 3, the absolute value of the difference between the reflectivity when the frequency f is in the region 3.4 GHz≦f≦10.3 GHz, and the reflectivity when f<3.1 GHz or f>10.6 GHz, that is, the stop band rejection, becomes 10 dB approximately. Therefore, because of a small manufacturing error, the stop band rejection may drop below 10 dB. Also, as shown in FIG. 4, the variation of the group delay frequency characteristics is large near the transition frequency.

In Document 12, a bandpass filter provided with a dual mode-type microstrip is reported as wide-band bandpass filter for UWB. However, the pass band of the bandpass filter disclosed in Document 12 is between 3 GHz and 5.5 GHz approximately. Compared to the band prescribed by the FCC, the pass band is narrow, and it does not cover the entire region of the UWB. The design method for the bandpass filter disclosed in Document 12 is complicated, and difficult to realize.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

An object of the present invention is to offer a high-performance reflection-type bandpass filter for UWB satisfying the FCC regulations.

The first aspect of the present invention relates to a reflection-type bandpass filter for ultra-wideband radio data communications comprising a substrate formed by laminating a conducting layer and dielectric layer, and a microstrip line made of a conductor of non-uniform width and provided on the dielectric layer, wherein the distribution in the lengthwise direction of width of the microstrip line is set such that the absolute value of the difference in reflectivity at the frequency f in the region f<3.1 GHz and f>10.6 GHz and the reflectivity in the region 3.7 GHz≦f≦10.0 GHz becomes equal or greater than 10 dB, and the variation in the group delay in the region 3.7 GHz≦f≦10.0 GHz becomes within ±0.2 ns.

The second aspect of the present invention relates to a reflection-type bandpass filter for ultra-wideband radio data communications comprising a substrate formed by laminating a conducting layer and dielectric layer, and a microstrip line made of a conductor of non-uniform width and provided on the dielectric layer, wherein the distribution in the lengthwise direction of width of the microstrip line is set such that the absolute value of the difference in reflectivity at the frequency f in the region f<3.1 GHz and f>10.6 GHz and the reflectivity in the region 4.0 GHz≦f≦9.8 GHz becomes equal or greater than 10 dB, and the variation in the group delay in the region 4.0 GHz≦f≦9.8 GHz becomes within ±0.1 ns.

The third aspect of the present invention relates to a reflection-type bandpass filter for ultra-wideband radio data communications comprising a substrate formed by laminating a conducting layer and dielectric layer, and a microstrip line made of a conductor of non-uniform width and provided on the dielectric layer, wherein the distribution in the lengthwise direction of width of the microstrip line is set such that the absolute value of the difference in reflectivity at the frequency f in the region f<3.1 GHz and f>10.6 GHz and the reflectivity in the region 3.5 GHz≦f≦10.1 GHz becomes equal or greater than 10 dB, and the variation in the group delay in the region 3.5 GHz≦f≦10.1 GHz becomes within ±0.2 ns.

The fourth aspect of the present invention relates to a reflection-type bandpass filter for ultra-wideband radio data communications comprising a substrate formed by laminating a conducting layer and dielectric layer, and a microstrip line made of a conductor of non-uniform width and provided on the dielectric layer, wherein the distribution in the lengthwise direction of width of the microstrip line is set such that the absolute value of the difference in reflectivity at the frequency f in the region f<3.1 GHz and f>10.6 GHz and the reflectivity in the region 4.0 GHz≦f≦9.6 GHz becomes equal or greater than 10 dB, and the variation in the group delay in the region 4.0 GHz≦f≦9.6 GHz becomes within ±0.07 ns.

The fifth aspect of the present invention relates to a reflection-type bandpass filter for ultra-wideband radio data communications comprising a substrate formed by laminating a conducting layer and dielectric layer, and a microstrip line made of a conductor of non-uniform width and provided on the dielectric layer, wherein the distribution in the lengthwise direction of width of the microstrip line is set such that the absolute value of the difference in reflectivity at the frequency f in the region f<3.1 GHz and f>10.6 GHz and the reflectivity in the region 4.2 GHz≦f≦9.5 GHz becomes equal or greater than 10 dB, and the variation in the group delay in the region 4.2 GHz≦f≦9.5 GHz becomes within ±0.2 ns.

In the reflection-type bandpass filter of the first to fifth aspects of the present invention, the characteristic impedance Zc of the input terminal transmission line may be such that 10Ω≦Zc≦200Ω.

In the reflection-type bandpass filter of the first to fifth aspects of the present invention, a resistance having the same impedance as the characteristic impedance, or a non-reflecting terminator, may be provided on the terminating side.

In the reflection-type bandpass filter of the first to fifth aspects of the present invention, the conducting layer and the conductor of the microstrip line may be made of a metal plate of thickness equal or greater than the skin depth at f=1 GHz.

In the reflection-type bandpass filter of the first to fifth aspects of the present invention, the dielectric layer of the substrate may have a thickness h such that 0.5 mm≦h≦5 mm, a relative dielectric constant $\in_r$ such that $1 \leqq \in_r \leqq 200$, a width W such that 2 mm≦W≦100 mm, and a length L such that 2 mm≦L≦300 mm.

In the reflection-type bandpass filter of the first to fifth aspects of the present invention, the lengthwise distribution of width of the microstrip line may be set using a design method based on inverse problem leading to potential from spectral data in the Zakharov-Shabat equation.

In the reflection-type bandpass filter of the first to fifth aspects of the present invention, the distribution in the lengthwise direction of width of the microstrip line may be set using a window function method.

In the reflection-type bandpass filter of the first to fifth aspects of the present invention, the distribution in the lengthwise direction of width of the microstrip line may be set using the Kaiser window function method.

The sixth aspect of the present invention relates to a reflection-type bandpass filter for ultra-wideband radio data communications comprising a substrate formed by laminating a conducting layer and dielectric layer, and a microstrip line made of a conductor of non-uniform width and provided on the dielectric layer, wherein the distribution in the lengthwise direction of width of the microstrip line is set such that the absolute value of the difference in reflectivity at the frequency f in the region f<3.1 GHz and f>10.6 GHz and the reflectivity in the region 3.4 GHz≦f≦10.3 GHz becomes equal or greater than 10 dB, and the variation in the group delay in the region 3.4 GHz≦f≦10.3 GHz becomes within ±0.2 ns, and the conducting layer and the microstrip line are made of copper foil of thickness equal or greater than 2.1 μm.

The seventh aspect of the present invention relates to a reflection-type bandpass filter for ultra-wideband radio data communications comprising a substrate formed by laminating a conducting layer and dielectric layer, and a microstrip line made of a conductor of non-uniform width and provided on the dielectric layer, wherein the distribution in the lengthwise direction of width of the microstrip line is set such that the absolute value of the difference in reflectivity at the frequency f in the region f<3.1 GHz and f>10.6 GHz and the reflectivity in the region 3.6 GHz≦f≦10.1 GHz becomes equal or greater than 10 dB, and the variation in the group delay in the region 3.6 GHz≦f≦10.1 GHz becomes within ±0.2 ns, and the conducting layer and the microstrip line are made of copper foil of thickness equal or greater than 2.1 μm.

The eighth aspect of the present invention relates to a reflection-type bandpass filter for ultra-wideband radio data communications comprising a substrate formed by laminating a conducting layer and dielectric layer, and a microstrip line made of a conductor of non-uniform width and provided on the dielectric layer, wherein the distribution in the lengthwise direction of width of the microstrip line is set such that the absolute value of the difference in reflectivity at the frequency f in the region f<3.1 GHz and f>10.6 GHz and the reflectivity in the region 4.0 GHz≦f≦9.7 GHz becomes equal or greater than 10 dB, and the variation in the group delay in the region 4.0 GHz≦f≦9.7 GHz becomes within ±0.2 ns, and the conducting layer and the microstrip line are made of copper foil of thickness equal or greater than 2.1 μm.

In the reflection-type bandpass filter of the sixth to eighth aspects of the present invention, the characteristic impedance Zc of the input terminal transmission line may be such that 10Ω≦Zc≦300Ω.

In the reflection-type bandpass filter of the sixth to eighth aspects of the present invention, a resistance having the same impedance as the characteristic impedance, or a non-reflecting terminator, may be provided on the terminating side.

In the reflection-type bandpass filter of the sixth to eighth aspects of the present invention, the dielectric layer of the substrate may have a thickness h such that 0.5 mm≦h≦10 mm, and relative dielectric constant $\in_r$ such that $1 \leqq \in_r \leqq 500$.

According to the reflection-type bandpass filter of exemplary embodiments of the present invention, a bandpass filter for UWB satisfying the FCC regulations with a stop band rejection equal or greater than 10 dB and the variation of the group delay within ±0.2 ns can be offered.

Furthermore, according to the reflection-type bandpass filter of exemplary embodiments of the present invention, by applying the window function method and designing a bandpass filter that includes a non-uniform microstrip line, even if a manufacturing error occurs, a bandpass filter with larger stop band rejection and smaller variation of the group delay within the pass band compared to related art filters can be offered. Therefore, the allowable range of manufacturing errors of the bandpass filter can be set larger compared to that of the related art bandpass filter.

DETAILED DESCRIPTION OF EXEMPLARY EMBODIMENTS OF THE PRESENT INVENTION

Figure 1:
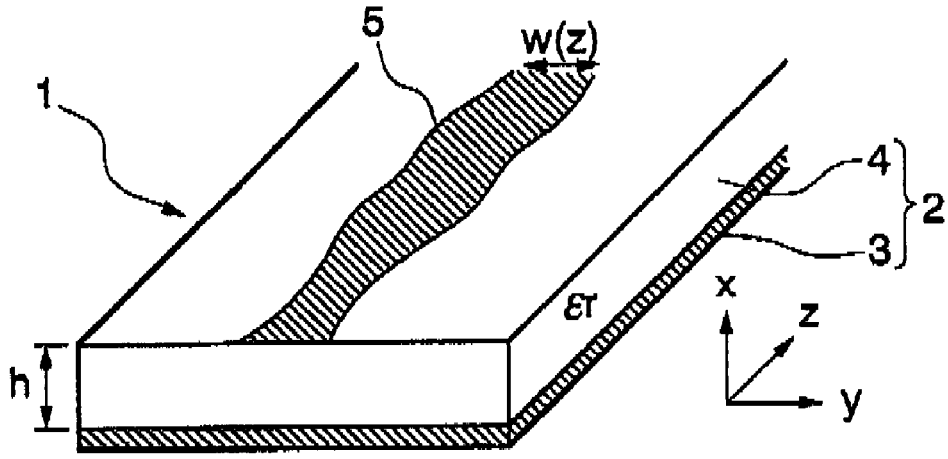
FIG. 1 is a perspective view showing the first embodiment of the reflection-type bandpass filter of the present invention.
Figure 2:
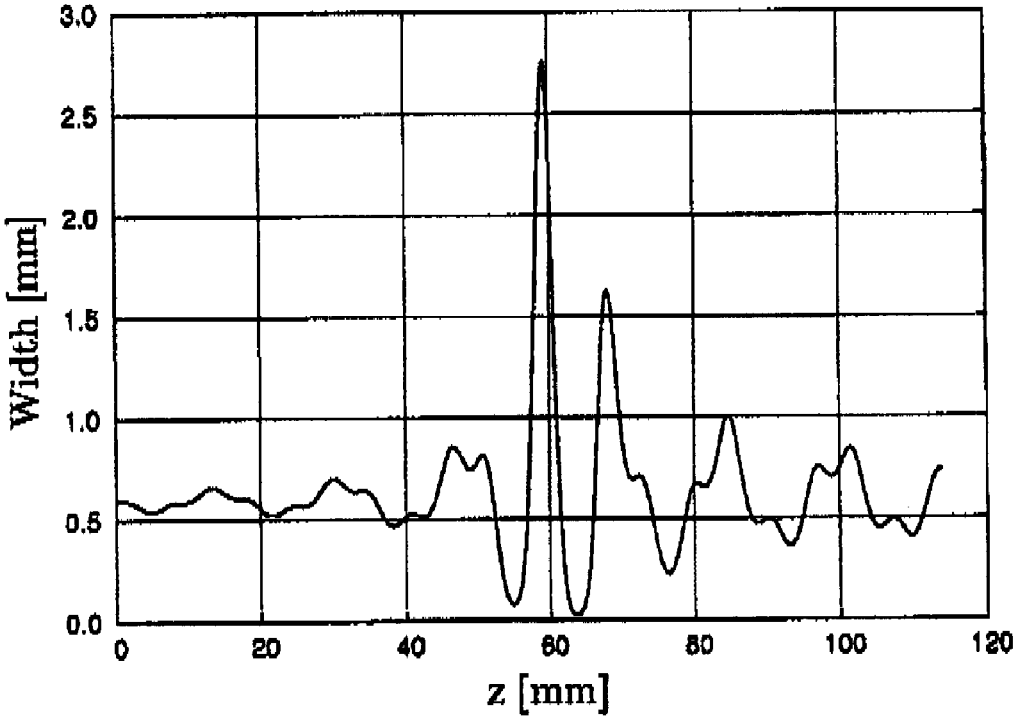
FIG. 2 is a graph illustrating the width distribution of a microstrip line designed based on a related art design method.
Figure 3:
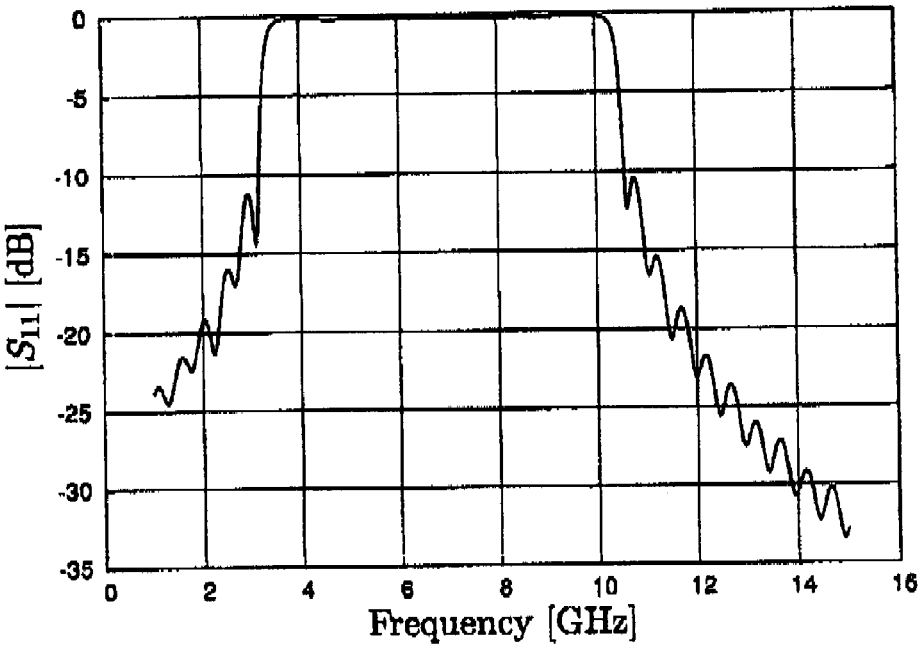
FIG. 3 is a graph showing the amplitude characteristics of the reflective wave in the microstrip line shown in FIG. 2.
Figure 4:
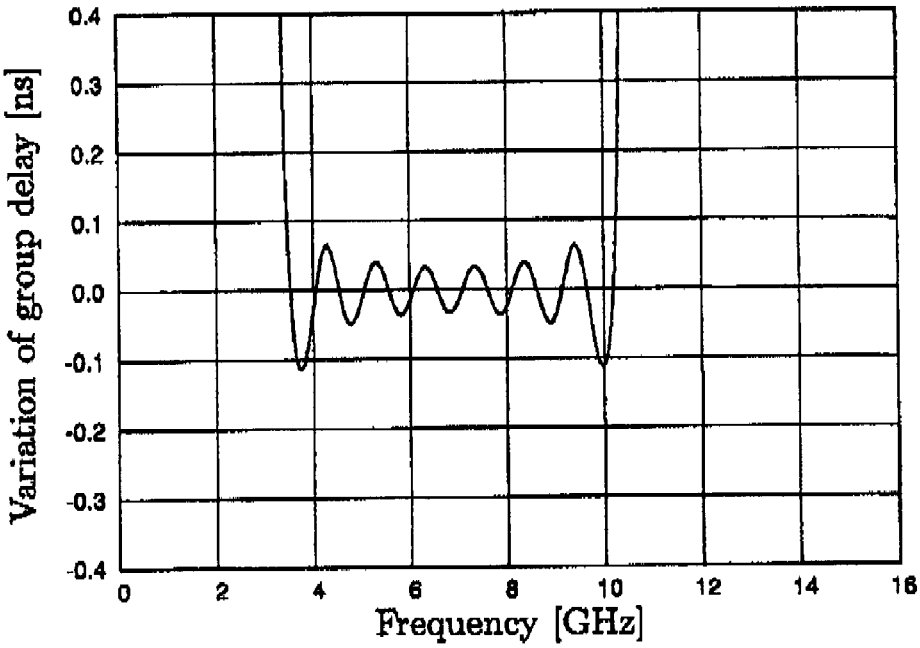
FIG. 4 is a graph showing the group delay frequency characteristics of the reflective wave in the microstrip line shown in FIG. 2.

Exemplary embodiments of the present invention are described here, referring to the drawings.

FIG. 1 is a perspective view showing the schematic configuration of the reflection-type bandpass filter of exemplary embodiments of the present invention. In the same figure, reference numeral 1 represents the reflection-type bandpass filter, 2 the substrate, 3 the conducting layer, 4 the dielectric layer, and 5 the microstrip line. Also, as shown in FIG. 1, the z axis is taken along the lengthwise direction of the microstrip line 5, the y-axis perpendicular to the z-axis and along a direction parallel to the surface of the substrate 2, and the x-axis perpendicular to both the y-axis and the z-axis. From the end face on the input side, the length along the z-axis direction is taken as z.

The reflection-type bandpass filter 1 has a substrate 2 laminated by a conducting layer 3 and dielectric layer 4, and a microstrip line 5 constituted by a conductor having non-uniform width and provided on the dielectric layer 4. The distribution in the lengthwise direction of width of the microstrip line 5 is set such that: (1) the absolute value of the difference in reflectivity at the frequency f in the region f<3.1 GHz and f>10.6 GHz and the reflectivity in the region 3.7 GHz≦f≦10.0 GHz becomes equal or greater than 10 dB, the variation of the group delay in the region 3.7 GHz≦f≦10.0 GHz becomes within ±0.2 ns; or (2) the absolute value of the difference in reflectivity at the frequency f in the region f<3.1 GHz and f>10.6 GHz and the reflectivity in the region 4.0 GHz≦f≦9.8 GHz becomes equal or greater than 10 dB, the variation of the group delay in the region 4.0 GHz≦f≦9.8 GHz becomes within ±0.1 ns; or (3) the absolute value of the difference in reflectivity at the frequency f in the region f<3.1 GHz and f>10.6 GHz and the reflectivity in the region 3.5 GHz≦f≦10.1 GHz becomes equal or greater than 10 dB, the variation of the group delay in the region 3.5 GHz≦f≦10.1 GHz becomes within ±0.2 ns; or (4) the absolute value of the difference in reflectivity at the frequency f in the region f<3.1 GHz and f>10.6 GHz and the reflectivity in the region 4.0 GHz≦f≦9.6 GHz becomes equal or greater than 10 dB, the variation of the group delay in the region 4.0 GHz≦f≦9.6 GHz becomes within ±0.07 ns; or (5) the absolute value of the difference in reflectivity at the frequency f in the region f<3.1 GHz and f>10.6 GHz and the reflectivity in the region 4.2 GHz≦f≦9.5 GHz becomes equal or greater than 10 dB, and the variation of the group delay in the region 4.2 GHz≦f≦9.5 GHz becomes within ±0.2 ns.

Also, the distribution in the lengthwise direction of width of the microstrip line 5 is set such that (1) the absolute value of the difference in reflectivity at the frequency f in the region f<3.1 GHz and f>10.6 GHz and the reflectivity in the region 3.4 GHz≦f≦10.3 GHz becomes equal or greater than 10 dB, the variation of the group delay in the region 3.4 GHz≦f≦10.3 GHz becomes within ±0.2 ns; or (2) the absolute value of the difference in reflectivity at the frequency f in the region f<3.1 GHz and f>10.6 GHz and the reflectivity in the region 3.6 GHz≦f≦10.1 GHz becomes equal or greater than 10 dB, the variation of the group delay in the region 3.6 GHz≦f≦10.1 GHz becomes within ±0.2 ns; or (3) the absolute value of the difference in reflectivity at the frequency f in the region f<3.1 GHz and f>10.6 GHz and the reflectivity in the region 4.0 GHz≦f≦9.7 GHz becomes equal or greater than 10 dB, the variation of the group delay in the region 4.0 GHz≦f≦9.7 GHz becomes within ±0.2 ns; and the conducting layer 3 and the microstrip line 5 are made of copper foil of thickness equal or greater than 2.1 μm.

The reflection-type bandpass filter of exemplary embodiments of the present invention is configured with increased stop band rejection by using the window function method (see Document 10) used in the design of digital filters. As a result, instead of an expansion in the transition frequency region (region between the boundaries of the pass band and the stop band), the stop band rejection can be increased. Therefore, manufacturing tolerances can be increased. The variation in the group delay frequency within the pass band will become small.

More specifically, an example of the implementation method is described below.

Figure 5:
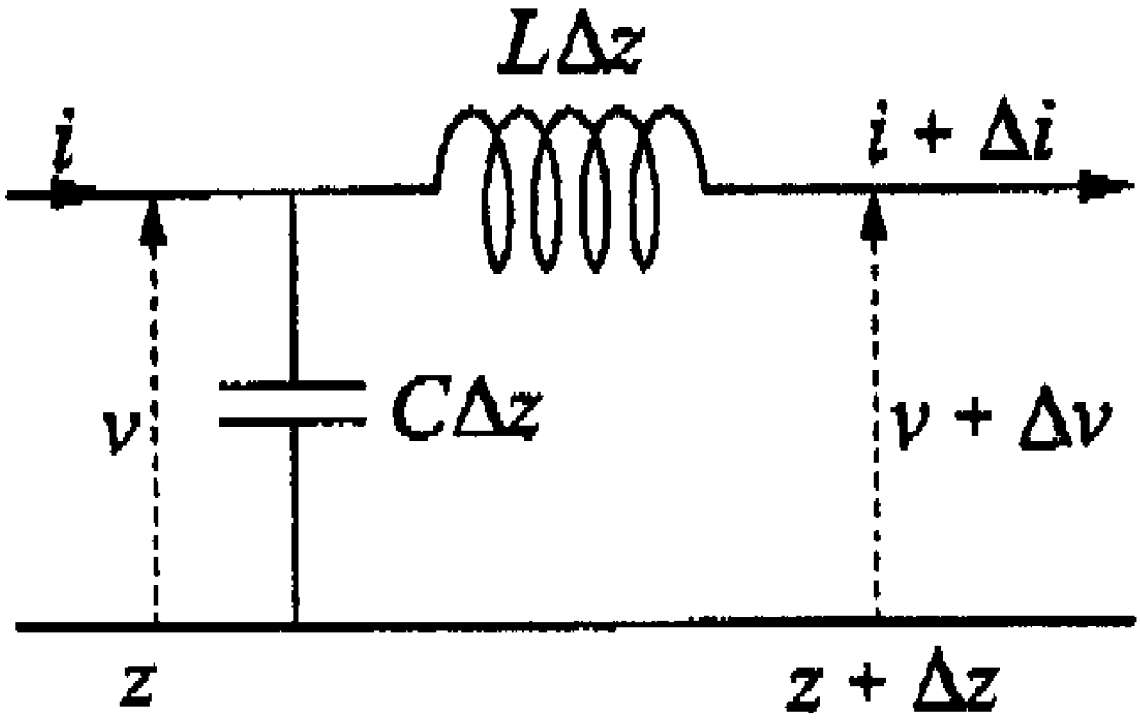
FIG. 5 is an equivalent circuit diagram of a non-uniform transmission line.

The transmission line of the reflection-type bandpass filter 1 of exemplary embodiments of the present invention can be expressed as a non-uniformly distributed parameter circuit, as shown in FIG. 5.

From FIG. 5, the following relational expression (1) can be obtained in terms of the line voltage v(z,t) and the line current i(z, t).

$$\begin{cases} -\dfrac{\partial u(z,t)}{\partial z} = L(z)\dfrac{\partial i(z,t)}{\partial t}, \\ -\dfrac{\partial i(z,t)}{\partial z} = C(z)\dfrac{\partial u(z,t)}{\partial t}. \end{cases} \quad \text{[Equation 1]}$$

Here, L(z) and C(z) are the inductance and capacitance per unit length respectively in the transmission line. Here, the function of equation (2) is introduced.

$$\begin{cases} \dfrac{\partial \phi_1(z,t)}{\partial z} = -\dfrac{1}{c(z)}\dfrac{\partial \phi_1(z,t)}{\partial t} - \dfrac{1}{2}\dfrac{d\ln Z(z)}{dz}\phi_2(z,t), \\ \dfrac{\partial \phi_2(z,t)}{\partial z} = \dfrac{1}{c(z)}\dfrac{\partial \phi_2(z,t)}{\partial t} - \dfrac{1}{2}\dfrac{d\ln Z(z)}{dz}\phi_1(z,t). \end{cases} \quad \text{[Equation 2]}$$

Here, $Z(z)=\sqrt{\{L(z)/C(z)\}}$ is the local characteristic impedance, and $\phi_1$, $\phi_2$ are the power wave amplitudes propagating in the +z and −z directions respectively.

If these are substituted in equation 1, then the following equation (3) is obtained:

$$\begin{cases} \dfrac{\partial \phi_1(z,t)}{\partial z} = -\dfrac{1}{c(z)}\dfrac{\partial \phi_1(z,t)}{\partial t} - \dfrac{1}{2}\dfrac{d\ln Z(z)}{dz}\phi_2(z,t), \\ \dfrac{\partial \phi_2(z,t)}{\partial z} = \dfrac{1}{c(z)}\dfrac{\partial \phi_2(z,t)}{\partial t} - \dfrac{1}{2}\dfrac{d\ln Z(z)}{dz}\phi_1(z,t). \end{cases} \quad \text{[Equation 3]}$$

Here, $c(z)=1/\sqrt{\{L(z)/C(z)\}}$. Here the time factor is taken as $\exp(j\omega t)$, and if variable transformation is performed as in the following equation (4), then the Zakharov-Shabat equation as shown in the equation (5) can be obtained.

$$x(z) = \int_0^z \frac{ds}{c(s)} \quad \text{[Equation 4]}$$

$$\begin{cases} \dfrac{\partial \phi_1(x)}{\partial x} + j\omega\phi_1(x) = -q(x)\phi_2(x), \\ \dfrac{\partial \phi_2(x)}{\partial x} - j\omega\phi_2(x) = -q(x)\phi_1(x). \end{cases} \quad \text{[Equation 5]}$$

Here, q(x) is as given by the following equation (6):

$$q(x) = \frac{1}{2}\frac{d\ln Z(x)}{dx}. \quad \text{[Equation 6]}$$

The inverse problem of Zakharov-Shabat is the synthesis of the potential q(x) from the spectral data of the solution satisfying the equation above (see Document 11). If the potential q(x) is determined, then the local characteristic impedance can be found from equation (7) below.

$$Z(x) = Z(0)\exp\left[2\int_0^x q(s)\,ds\right]. \quad \text{[Equation 7]}$$

Here, generally in the process to determine the potential q(x), the reflection coefficient r(x) of x space is calculated from the spectral data reflection coefficient R(ω) using the following equation (8), and q(x) is obtained from r(x).

$$r(x) = \frac{1}{2\pi}\int_{-\infty}^{\infty} R(\omega)e^{-j\omega x}\,d\omega \quad \text{[Equation 8]}$$

In the present invention, instead of obtaining r(x) from R(ω) of the ideal spectral data, r'(x) is determined by multiplying with the window function, as given by the equation (9).

$$r'(x)=\omega(x)r(x) \quad \text{[Equation 9]}$$

Here, ω(x) is a window function. If the window function is correctly selected, the level of the stop band rejection can be appropriately controlled. The Kaiser window is used here as an example. The Kaiser window is defined as in the equation (10) below. (See Document 10).

$$w[n] = \begin{cases} \dfrac{I_0\left[\beta(1-[(n-\alpha)/\alpha]^2)^{1/2}\right]}{I_0(\beta)}, & 0 \le n \le M, \\ 0, & \text{otherwise} \end{cases} \quad \text{[Equation 10]}$$

Here α=M/2, and β is decided from experience as in equation (11) below.

$$\beta = \begin{cases} 0.1102(A-8.7), & A > 50, \\ 0.5842(A-21)^{0.4} + 0.07886(A-21), & 21 \le A \le 50, \\ 0, & A < 21 \end{cases} \quad \text{[Equation 11]}$$

Here A=−20 $\log_{10}$, δ expresses the peak approximation error in the pass band and in the stop band.

From the above, q(x) is determined, and the local characteristic impedance Z(x) is determined from equation (7). The local characteristic impedance and the width w of the microstrip line 5 are related to each other. The width w of the microstrip line 5 can be calculated from the value of the local characteristic impedance. By designing the microstrip line 5 according to the calculated width w of the microstrip line 5, a reflection-type bandpass filter having the desired pass band can be obtained.

Exemplary embodiments of the present invention are described below in further detail. Each of the exemplary embodiments described below is merely an illustrative example of the present invention, and the present invention is not limited to these embodiments.

Embodiment 1

A Kaiser window was used for which the reflectivity is 1 at the frequency f in the region 3.4 GHz≦f≦10.3 GHz, and is 0 elsewhere, and for which A=30. Taking one wavelength at frequency f=1 GHz of the signal transmitted within the microstrip line as the waveguide length, the system characteristic impedance was taken as 50Ω, and the design was carried out. Here, the characteristic impedance should be set such that it coincides with the impedance of the system being used. Generally, in circuits that handle high frequency signals, the system impedance of 50Ω, 75Ω, 300Ω, or similar is used. The characteristic impedance Zc should preferably be in the following range: 10Ω≦Zc≦300Ω. If the characteristic impedance is less than 10Ω, the loss due to conductor or dielectric will become relatively high. If the characteristic impedance is greater than 300Ω, matching with the system impedance is not possible.

Figure 6:
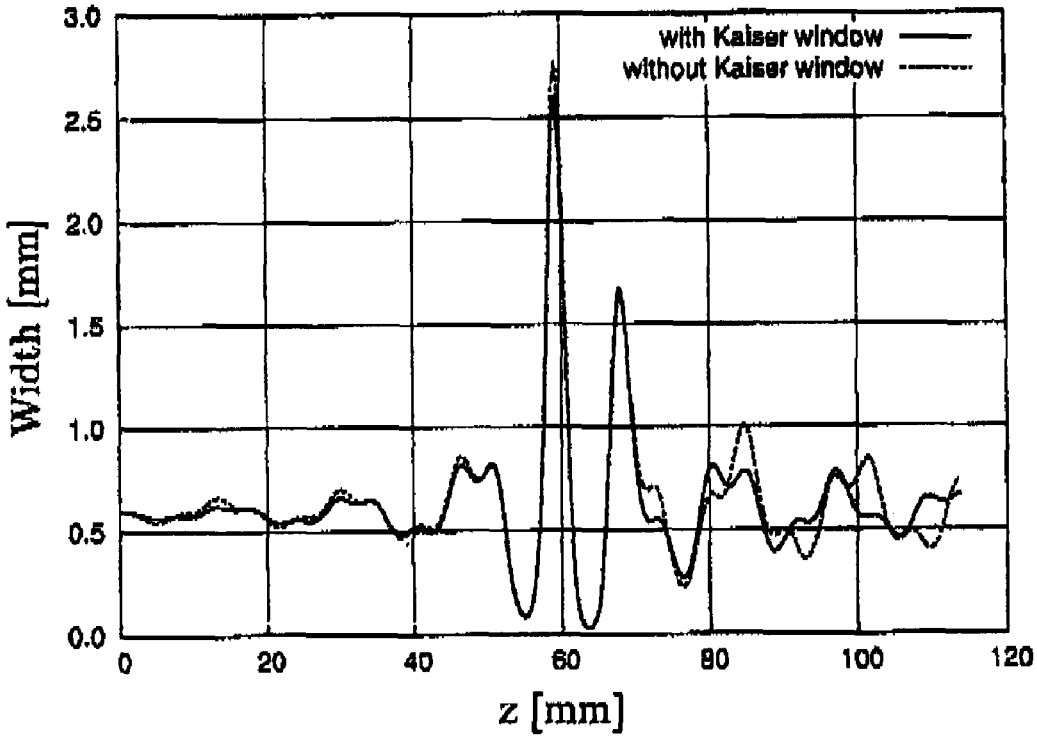
FIG. 6 is a graph showing the distribution in the width direction of the microstrip line in the reflection-type bandpass filter of the first embodiment.

FIG. 6 shows the distribution of the width w of the microstrip line 5 in the z-axis direction when a dielectric layer 4 of thickness h=0.635 mm, and relative dielectric constant $\in_r$=10.2 (for example, RT/Duroid (registered trademark) 6010LM) was used, together with the width when the Kaiser window was not used. Tables 1 through 3 list the widths w of the microstrip line 5 when the Kaiser window was used.

TABLE 1

Widths of the microstrip line

| | z[mm] | | | | | | | | | | | |
|---|---|---|---|---|---|---|---|---|---|---|---|---|
| | 0.00 | 0.11 | 0.23 | 0.34 | 0.46 | 0.57 | 0.68 | 0.80 | 0.91 | 1.02 | 1.14 | 1.25 |
| | w[mm] | | | | | | | | | | | |
| | 0.60 | 0.60 | 0.60 | 0.60 | 0.60 | 0.60 | 0.60 | 0.60 | 0.60 | 0.60 | 0.60 | 0.60 |
| #2 | 1.37 | 1.48 | 1.59 | 1.71 | 1.82 | 1.93 | 2.05 | 2.16 | 2.28 | 2.39 | 2.50 | 2.62 |
| — | 0.60 | 0.60 | 0.60 | 0.59 | 0.59 | 0.59 | 0.59 | 0.59 | 0.59 | 0.59 | 0.59 | 0.59 |
| #3 | 2.73 | 2.85 | 2.96 | 3.07 | 3.19 | 3.30 | 3.42 | 3.53 | 3.64 | 3.76 | 3.87 | 3.99 |
| — | 0.58 | 0.58 | 0.58 | 0.58 | 0.58 | 0.58 | 0.58 | 0.57 | 0.57 | 0.57 | 0.57 | 0.57 |
| #4 | 4.10 | 4.21 | 4.33 | 4.44 | 4.56 | 4.67 | 4.78 | 4.90 | 5.01 | 5.13 | 5.24 | 5.35 |
| — | 0.57 | 0.57 | 0.57 | 0.57 | 0.57 | 0.57 | 0.57 | 0.57 | 0.56 | 0.57 | 0.57 | 0.57 |
| #5 | 5.47 | 5.58 | 5.70 | 5.81 | 5.93 | 6.04 | 6.15 | 6.27 | 6.38 | 6.50 | 6.61 | 6.72 |
| — | 0.57 | 0.57 | 0.57 | 0.57 | 0.57 | 0.57 | 0.57 | 0.57 | 0.57 | 0.57 | 0.57 | 0.57 |
| #6 | 6.84 | 6.95 | 7.07 | 7.18 | 7.29 | 7.41 | 7.52 | 7.64 | 7.75 | 7.86 | 7.98 | 8.09 |
| — | 0.57 | 0.57 | 0.57 | 0.57 | 0.57 | 0.57 | 0.57 | 0.57 | 0.57 | 0.57 | 0.57 | 0.57 |
| #7 | 8.21 | 8.32 | 8.43 | 8.55 | 8.66 | 8.78 | 8.89 | 9.00 | 9.12 | 9.23 | 9.35 | 9.46 |
| — | 0.57 | 0.57 | 0.57 | 0.57 | 0.57 | 0.57 | 0.57 | 0.57 | 0.57 | 0.57 | 0.57 | 0.57 |
| #8 | 9.57 | 9.69 | 9.80 | 9.92 | 10.03 | 10.14 | 10.26 | 10.37 | 10.49 | 10.60 | 10.71 | 10.83 |
| — | 0.57 | 0.57 | 0.57 | 0.57 | 0.57 | 0.57 | 0.58 | 0.58 | 0.58 | 0.58 | 0.58 | 0.58 |
| #9 | 10.94 | 11.06 | 11.17 | 11.28 | 11.40 | 11.51 | 11.62 | 11.74 | 11.85 | 11.97 | 12.08 | 12.19 |
| — | 0.59 | 0.59 | 0.59 | 0.59 | 0.60 | 0.60 | 0.60 | 0.60 | 0.60 | 0.61 | 0.61 | 0.61 |

TABLE 1-continued

| Widths of the microstrip line | | | | | | | | | | | | |
|---|---|---|---|---|---|---|---|---|---|---|---|---|
| | z[mm] | | | | | | | | | | | |
| | 0.00 | 0.11 | 0.23 | 0.34 | 0.46 | 0.57 | 0.68 | 0.80 | 0.91 | 1.02 | 1.14 | 1.25 |
| | w[mm] | | | | | | | | | | | |
| | 0.60 | 0.60 | 0.60 | 0.60 | 0.60 | 0.60 | 0.60 | 0.60 | 0.60 | 0.60 | 0.60 | 0.60 |
| #10 | 12.31 | 12.42 | 12.53 | 12.65 | 12.76 | 12.88 | 12.99 | 13.10 | 13.22 | 13.33 | 13.44 | 13.56 |
| — | 0.61 | 0.61 | 0.62 | 0.62 | 0.62 | 0.62 | 0.62 | 0.62 | 0.62 | 0.62 | 0.62 | 0.62 |
| #11 | 13.67 | 13.78 | 13.90 | 14.01 | 14.13 | 14.24 | 14.35 | 14.47 | 14.58 | 14.69 | 14.81 | 14.92 |
| — | 0.62 | 0.62 | 0.62 | 0.62 | 0.62 | 0.62 | 0.61 | 0.61 | 0.61 | 0.61 | 0.61 | 0.61 |
| #12 | 15.03 | 15.15 | 15.26 | 15.38 | 15.49 | 15.60 | 15.72 | 15.83 | 15.94 | 16.06 | 16.17 | 16.29 |
| — | 0.61 | 0.61 | 0.61 | 0.61 | 0.61 | 0.61 | 0.61 | 0.61 | 0.61 | 0.61 | 0.61 | 0.61 |
| #13 | 16.40 | 16.51 | 16.63 | 16.74 | 16.85 | 16.97 | 17.08 | 17.20 | 17.31 | 17.42 | 17.54 | 17.65 |
| — | 0.61 | 0.61 | 0.61 | 0.61 | 0.61 | 0.61 | 0.61 | 0.61 | 0.61 | 0.61 | 0.61 | 0.61 |
| #14 | 17.76 | 17.88 | 17.99 | 18.10 | 18.22 | 18.33 | 18.45 | 18.56 | 18.67 | 18.79 | 18.90 | 19.01 |
| — | 0.61 | 0.61 | 0.61 | 0.61 | 0.61 | 0.61 | 0.61 | 0.60 | 0.60 | 0.60 | 0.60 | 0.59 |
| #15 | 19.13 | 19.24 | 19.36 | 19.47 | 19.58 | 19.70 | 19.81 | 19.93 | 20.04 | 20.15 | 20.27 | 20.38 |
| — | 0.59 | 0.59 | 0.58 | 0.58 | 0.58 | 0.57 | 0.57 | 0.57 | 0.56 | 0.56 | 0.56 | 0.56 |
| #16 | 20.50 | 20.61 | 20.73 | 20.84 | 20.95 | 21.07 | 21.18 | 21.30 | 21.41 | 21.53 | 21.64 | 21.75 |
| — | 0.55 | 0.55 | 0.55 | 0.55 | 0.55 | 0.54 | 0.54 | 0.54 | 0.54 | 0.54 | 0.54 | 0.54 |
| #17 | 21.87 | 21.98 | 22.10 | 22.21 | 22.33 | 22.44 | 22.55 | 22.67 | 22.78 | 22.90 | 23.01 | 23.13 |
| — | 0.54 | 0.54 | 0.54 | 0.54 | 0.54 | 0.55 | 0.55 | 0.55 | 0.55 | 0.55 | 0.55 | 0.55 |
| #18 | 23.24 | 23.35 | 23.47 | 23.58 | 23.70 | 23.81 | 23.92 | 24.04 | 24.15 | 24.27 | 24.38 | 24.50 |
| — | 0.55 | 0.55 | 0.56 | 0.56 | 0.56 | 0.56 | 0.56 | 0.56 | 0.56 | 0.56 | 0.56 | 0.56 |
| #19 | 24.61 | 24.72 | 24.84 | 24.95 | 25.07 | 25.18 | 25.29 | 25.41 | 25.52 | 25.64 | 25.75 | 25.87 |
| — | 0.55 | 0.55 | 0.55 | 0.55 | 0.55 | 0.55 | 0.55 | 0.55 | 0.55 | 0.55 | 0.55 | 0.55 |
| #20 | 25.98 | 26.09 | 26.21 | 26.32 | 26.44 | 26.55 | 26.67 | 26.78 | 26.89 | 27.01 | 27.12 | 27.24 |
| — | 0.55 | 0.55 | 0.55 | 0.55 | 0.55 | 0.55 | 0.56 | 0.56 | 0.56 | 0.56 | 0.57 | 0.57 |
| #21 | 27.35 | 27.46 | 27.58 | 27.69 | 27.81 | 27.92 | 28.03 | 28.15 | 28.26 | 28.37 | 28.49 | 28.60 |
| — | 0.58 | 0.58 | 0.59 | 0.59 | 0.59 | 0.60 | 0.61 | 0.61 | 0.62 | 0.62 | 0.63 | 0.63 |
| #22 | 28.71 | 28.83 | 28.94 | 29.05 | 29.17 | 29.28 | 29.39 | 29.51 | 29.62 | 29.73 | 29.85 | 29.96 |
| — | 0.63 | 0.64 | 0.64 | 0.65 | 0.65 | 0.65 | 0.65 | 0.66 | 0.66 | 0.66 | 0.66 | 0.66 |
| #23 | 30.07 | 30.19 | 30.30 | 30.41 | 30.53 | 30.64 | 30.75 | 30.87 | 30.98 | 31.09 | 31.21 | 31.32 |
| — | 0.66 | 0.66 | 0.66 | 0.66 | 0.65 | 0.65 | 0.65 | 0.65 | 0.65 | 0.64 | 0.64 | 0.64 |
| #24 | 31.44 | 31.55 | 31.66 | 31.78 | 31.89 | 32.00 | 32.12 | 32.23 | 32.34 | 32.46 | 32.57 | 32.68 |
| — | 0.64 | 0.64 | 0.64 | 0.64 | 0.63 | 0.63 | 0.63 | 0.63 | 0.63 | 0.63 | 0.63 | 0.64 |
| #25 | 32.80 | 32.91 | 33.02 | 33.14 | 33.25 | 33.36 | 33.48 | 33.59 | 33.70 | 33.82 | 33.93 | 34.04 |
| — | 0.64 | 0.64 | 0.64 | 0.64 | 0.64 | 0.64 | 0.65 | 0.65 | 0.65 | 0.65 | 0.65 | 0.65 |
| #26 | 34.16 | 34.27 | 34.38 | 34.50 | 34.61 | 34.72 | 34.84 | 34.95 | 35.07 | 35.18 | 35.29 | 35.41 |
| — | 0.65 | 0.65 | 0.65 | 0.65 | 0.65 | 0.64 | 0.64 | 0.64 | 0.63 | 0.63 | 0.62 | 0.62 |
| #27 | 35.52 | 35.63 | 35.75 | 35.86 | 35.98 | 36.09 | 36.20 | 36.32 | 36.43 | 36.55 | 36.66 | 36.77 |
| — | 0.61 | 0.60 | 0.60 | 0.59 | 0.58 | 0.57 | 0.57 | 0.56 | 0.55 | 0.54 | 0.54 | 0.53 |
| #28 | 36.89 | 37.00 | 37.12 | 37.23 | 37.35 | 37.46 | 37.58 | 37.69 | 37.81 | 37.92 | 38.04 | 38.15 |
| — | 0.52 | 0.52 | 0.51 | 0.51 | 0.50 | 0.50 | 0.49 | 0.49 | 0.49 | 0.49 | 0.49 | 0.48 |
| #29 | 38.27 | 38.38 | 38.50 | 38.61 | 38.73 | 38.84 | 38.95 | 39.07 | 39.18 | 39.30 | 39.41 | 39.53 |
| — | 0.48 | 0.48 | 0.49 | 0.49 | 0.49 | 0.49 | 0.49 | 0.49 | 0.50 | 0.50 | 0.50 | 0.50 |
| #30 | 39.64 | 39.76 | 39.87 | 39.99 | 40.10 | 40.22 | 40.33 | 40.44 | 40.56 | 40.67 | 40.79 | 40.90 |
| — | 0.51 | 0.51 | 0.51 | 0.51 | 0.51 | 0.52 | 0.52 | 0.52 | 0.52 | 0.52 | 0.51 | 0.51 |

TABLE 2

| Widths of the microstrip line | | | | | | | | | | | | |
|---|---|---|---|---|---|---|---|---|---|---|---|---|
| #31 | 41.02 | 41.13 | 41.25 | 41.36 | 41.48 | 41.59 | 41.71 | 41.82 | 41.93 | 42.05 | 42.16 | 42.28 |
| — | 0.51 | 0.51 | 0.51 | 0.51 | 0.50 | 0.50 | 0.50 | 0.50 | 0.49 | 0.49 | 0.49 | 0.49 |
| #32 | 42.39 | 42.51 | 42.62 | 42.74 | 42.85 | 42.97 | 43.08 | 43.20 | 43.31 | 43.43 | 43.54 | 43.66 |
| — | 0.49 | 0.49 | 0.49 | 0.49 | 0.49 | 0.50 | 0.50 | 0.51 | 0.51 | 0.52 | 0.53 | 0.53 |
| #33 | 43.77 | 43.88 | 44.00 | 44.11 | 44.23 | 44.34 | 44.45 | 44.57 | 44.68 | 44.79 | 44.91 | 45.02 |
| — | 0.54 | 0.55 | 0.57 | 0.58 | 0.59 | 0.60 | 0.62 | 0.63 | 0.65 | 0.66 | 0.68 | 0.69 |
| #34 | 45.13 | 45.24 | 45.36 | 45.47 | 45.58 | 45.70 | 45.81 | 45.92 | 46.03 | 46.14 | 46.26 | 46.37 |
| — | 0.71 | 0.72 | 0.74 | 0.75 | 0.76 | 0.77 | 0.78 | 0.79 | 0.80 | 0.80 | 0.81 | 0.81 |
| #35 | 46.48 | 46.59 | 46.71 | 46.82 | 46.93 | 47.04 | 47.15 | 47.27 | 47.38 | 47.49 | 47.60 | 47.72 |
| — | 0.81 | 0.81 | 0.81 | 0.81 | 0.81 | 0.80 | 0.80 | 0.79 | 0.79 | 0.78 | 0.77 | 0.77 |
| #36 | 47.83 | 47.94 | 48.05 | 48.17 | 48.28 | 48.39 | 48.51 | 48.62 | 48.73 | 48.84 | 48.96 | 49.07 |
| — | 0.76 | 0.76 | 0.75 | 0.75 | 0.74 | 0.74 | 0.74 | 0.74 | 0.74 | 0.74 | 0.74 | 0.74 |
| #37 | 49.18 | 49.29 | 49.41 | 49.52 | 49.63 | 49.74 | 49.86 | 49.97 | 50.08 | 50.19 | 50.31 | 50.42 |
| — | 0.75 | 0.75 | 0.76 | 0.76 | 0.77 | 0.78 | 0.79 | 0.79 | 0.80 | 0.81 | 0.81 | 0.82 |
| #38 | 50.53 | 50.64 | 50.75 | 50.87 | 50.98 | 51.09 | 51.20 | 51.32 | 51.43 | 51.54 | 51.65 | 51.77 |
| — | 0.82 | 0.82 | 0.82 | 0.82 | 0.82 | 0.81 | 0.80 | 0.78 | 0.77 | 0.75 | 0.72 | 0.70 |
| #39 | 51.88 | 51.99 | 52.11 | 52.22 | 52.34 | 52.45 | 52.56 | 52.68 | 52.80 | 52.91 | 53.03 | 53.15 |
| — | 0.67 | 0.64 | 0.61 | 0.57 | 0.54 | 0.50 | 0.47 | 0.43 | 0.39 | 0.36 | 0.33 | 0.30 |
| #40 | 53.26 | 53.38 | 53.50 | 53.62 | 53.74 | 53.86 | 53.98 | 54.10 | 54.22 | 54.34 | 54.46 | 54.58 |
| — | 0.27 | 0.24 | 0.22 | 0.19 | 0.17 | 0.16 | 0.14 | 0.13 | 0.12 | 0.11 | 0.10 | 0.09 |

TABLE 2-continued

| Widths of the microstrip line | | | | | | | | | | | | |
|---|---|---|---|---|---|---|---|---|---|---|---|---|
| #41 | 54.70 | 54.82 | 54.94 | 55.06 | 55.18 | 55.31 | 55.43 | 55.55 | 55.67 | 55.79 | 55.91 | 56.03 |
| — | 0.09 | 0.09 | 0.09 | 0.09 | 0.09 | 0.09 | 0.10 | 0.10 | 0.11 | 0.13 | 0.14 | 0.16 |
| #42 | 56.15 | 56.26 | 56.38 | 56.50 | 56.61 | 56.73 | 56.85 | 56.96 | 57.07 | 57.19 | 57.30 | 57.41 |
| — | 0.19 | 0.21 | 0.25 | 0.29 | 0.33 | 0.39 | 0.45 | 0.52 | 0.59 | 0.68 | 0.77 | 0.87 |
| #43 | 57.52 | 57.63 | 57.74 | 57.85 | 57.96 | 58.07 | 58.18 | 58.29 | 58.39 | 58.50 | 58.61 | 58.71 |
| — | 0.97 | 1.09 | 1.21 | 1.33 | 1.46 | 1.59 | 1.72 | 1.86 | 1.98 | 2.11 | 2.22 | 2.32 |
| #44 | 58.82 | 58.92 | 59.03 | 59.14 | 59.24 | 59.35 | 59.45 | 59.56 | 59.66 | 59.77 | 59.88 | 59.98 |
| — | 2.41 | 2.48 | 2.54 | 2.58 | 2.59 | 2.58 | 2.56 | 2.51 | 2.44 | 2.35 | 2.25 | 2.14 |
| #45 | 60.09 | 60.20 | 60.31 | 60.41 | 60.52 | 60.63 | 60.74 | 60.85 | 60.96 | 61.08 | 61.19 | 61.30 |
| — | 2.01 | 1.88 | 1.74 | 1.61 | 1.47 | 1.33 | 1.20 | 1.07 | 0.94 | 0.83 | 0.72 | 0.62 |
| #46 | 61.42 | 61.53 | 61.65 | 61.76 | 61.88 | 62.00 | 62.12 | 62.24 | 62.36 | 62.48 | 62.60 | 62.72 |
| — | 0.53 | 0.45 | 0.38 | 0.32 | 0.26 | 0.22 | 0.18 | 0.15 | 0.12 | 0.10 | 0.08 | 0.07 |
| #47 | 62.85 | 62.97 | 63.09 | 63.21 | 63.34 | 63.46 | 63.58 | 63.71 | 63.83 | 63.95 | 64.08 | 64.20 |
| — | 0.06 | 0.05 | 0.04 | 0.04 | 0.03 | 0.03 | 0.03 | 0.03 | 0.03 | 0.03 | 0.04 | 0.04 |
| #48 | 64.32 | 64.44 | 64.56 | 64.69 | 64.81 | 64.93 | 65.05 | 65.17 | 65.29 | 65.40 | 65.52 | 65.64 |
| — | 0.05 | 0.06 | 0.07 | 0.08 | 0.09 | 0.11 | 0.14 | 0.17 | 0.20 | 0.24 | 0.28 | 0.33 |
| #49 | 65.75 | 65.87 | 65.98 | 66.10 | 66.21 | 66.32 | 66.43 | 66.55 | 66.66 | 66.77 | 66.88 | 66.99 |
| — | 0.39 | 0.45 | 0.52 | 0.60 | 0.68 | 0.76 | 0.84 | 0.93 | 1.02 | 1.10 | 1.19 | 1.27 |
| #50 | 67.10 | 67.21 | 67.31 | 67.42 | 67.53 | 67.64 | 67.75 | 67.86 | 67.96 | 68.07 | 68.18 | 68.29 |
| — | 1.35 | 1.42 | 1.48 | 1.54 | 1.58 | 1.62 | 1.65 | 1.67 | 1.67 | 1.67 | 1.65 | 1.63 |
| #51 | 68.40 | 68.51 | 68.61 | 68.72 | 68.83 | 68.94 | 69.05 | 69.16 | 69.27 | 69.38 | 69.49 | 69.60 |
| — | 1.60 | 1.56 | 1.51 | 1.46 | 1.41 | 1.35 | 1.29 | 1.23 | 1.17 | 1.11 | 1.06 | 1.00 |
| #52 | 69.71 | 69.83 | 69.94 | 70.05 | 70.16 | 70.28 | 70.39 | 70.50 | 70.62 | 70.73 | 70.84 | 70.96 |
| — | 0.95 | 0.90 | 0.85 | 0.81 | 0.77 | 0.74 | 0.70 | 0.67 | 0.65 | 0.62 | 0.61 | 0.59 |
| #53 | 71.07 | 71.18 | 71.30 | 71.41 | 71.53 | 71.64 | 71.76 | 71.87 | 71.98 | 72.10 | 72.21 | 72.33 |
| — | 0.57 | 0.56 | 0.55 | 0.55 | 0.54 | 0.54 | 0.54 | 0.54 | 0.54 | 0.54 | 0.54 | 0.54 |
| #54 | 72.44 | 72.56 | 72.67 | 72.78 | 72.90 | 73.01 | 73.13 | 73.24 | 73.36 | 73.47 | 73.58 | 73.70 |
| — | 0.55 | 0.55 | 0.55 | 0.55 | 0.55 | 0.55 | 0.55 | 0.55 | 0.54 | 0.54 | 0.53 | 0.52 |
| #55 | 73.81 | 73.93 | 74.04 | 74.16 | 74.27 | 74.39 | 74.50 | 74.62 | 74.73 | 74.85 | 74.97 | 75.08 |
| — | 0.51 | 0.50 | 0.49 | 0.47 | 0.46 | 0.44 | 0.43 | 0.41 | 0.40 | 0.38 | 0.37 | 0.35 |
| #56 | 75.20 | 75.32 | 75.43 | 75.55 | 75.67 | 75.78 | 75.90 | 76.02 | 76.14 | 76.25 | 76.37 | 76.49 |
| — | 0.34 | 0.33 | 0.32 | 0.31 | 0.30 | 0.29 | 0.28 | 0.28 | 0.28 | 0.27 | 0.27 | 0.27 |
| #57 | 76.61 | 76.72 | 76.84 | 76.96 | 77.07 | 77.19 | 77.31 | 77.42 | 77.54 | 77.66 | 77.77 | 77.89 |
| — | 0.28 | 0.28 | 0.28 | 0.29 | 0.30 | 0.31 | 0.32 | 0.34 | 0.35 | 0.37 | 0.39 | 0.41 |
| #58 | 78.00 | 78.12 | 78.23 | 78.35 | 78.46 | 78.58 | 78.69 | 78.80 | 78.92 | 79.03 | 79.14 | 79.26 |
| — | 0.43 | 0.45 | 0.47 | 0.50 | 0.52 | 0.55 | 0.57 | 0.60 | 0.62 | 0.65 | 0.67 | 0.69 |
| #59 | 79.37 | 79.48 | 79.60 | 79.71 | 79.82 | 79.93 | 80.05 | 80.16 | 80.27 | 80.38 | 80.49 | 80.61 |
| — | 0.72 | 0.73 | 0.75 | 0.77 | 0.78 | 0.79 | 0.80 | 0.81 | 0.81 | 0.81 | 0.81 | 0.81 |
| #60 | 80.72 | 80.83 | 80.94 | 81.06 | 81.17 | 81.28 | 81.39 | 81.51 | 81.62 | 81.73 | 81.84 | 81.96 |
| — | 0.81 | 0.80 | 0.80 | 0.79 | 0.78 | 0.77 | 0.77 | 0.76 | 0.75 | 0.74 | 0.73 | 0.73 |

TABLE 3

| Widths of the microstrip line | | | | | | | | | | | | |
|---|---|---|---|---|---|---|---|---|---|---|---|---|
| #61 | 82.07 | 82.18 | 82.29 | 82.41 | 82.52 | 82.63 | 82.75 | 82.86 | 82.97 | 83.09 | 83.20 | 83.31 |
| — | 0.72 | 0.72 | 0.71 | 0.71 | 0.71 | 0.71 | 0.71 | 0.71 | 0.71 | 0.71 | 0.72 | 0.72 |
| #62 | 83.42 | 83.54 | 83.65 | 83.76 | 83.87 | 83.99 | 84.10 | 84.21 | 84.32 | 84.44 | 84.55 | 84.66 |
| — | 0.73 | 0.73 | 0.74 | 0.74 | 0.75 | 0.76 | 0.76 | 0.77 | 0.77 | 0.78 | 0.78 | 0.78 |
| #63 | 84.77 | 84.89 | 85.00 | 85.11 | 85.22 | 85.34 | 85.45 | 85.56 | 85.67 | 85.79 | 85.90 | 86.01 |
| — | 0.78 | 0.78 | 0.78 | 0.78 | 0.77 | 0.76 | 0.76 | 0.75 | 0.73 | 0.72 | 0.71 | 0.69 |
| #64 | 86.13 | 86.24 | 86.35 | 86.47 | 86.58 | 86.69 | 86.81 | 86.92 | 87.04 | 87.15 | 87.27 | 87.38 |
| — | 0.67 | 0.66 | 0.64 | 0.62 | 0.60 | 0.59 | 0.57 | 0.55 | 0.53 | 0.52 | 0.50 | 0.49 |
| #65 | 87.50 | 87.61 | 87.73 | 87.84 | 87.96 | 88.07 | 88.19 | 88.30 | 88.42 | 88.54 | 88.65 | 88.77 |
| — | 0.47 | 0.46 | 0.45 | 0.44 | 0.43 | 0.42 | 0.41 | 0.41 | 0.40 | 0.40 | 0.40 | 0.40 |
| #66 | 88.88 | 89.00 | 89.11 | 89.23 | 89.35 | 89.46 | 89.58 | 89.69 | 89.81 | 89.92 | 90.04 | 90.15 |
| — | 0.40 | 0.40 | 0.40 | 0.40 | 0.41 | 0.41 | 0.42 | 0.43 | 0.43 | 0.44 | 0.45 | 0.46 |
| #67 | 90.27 | 90.38 | 90.50 | 90.61 | 90.73 | 90.84 | 90.96 | 91.07 | 91.19 | 91.30 | 91.41 | 91.53 |
| — | 0.46 | 0.47 | 0.48 | 0.49 | 0.50 | 0.50 | 0.51 | 0.52 | 0.52 | 0.53 | 0.53 | 0.54 |
| #68 | 91.64 | 91.76 | 91.87 | 91.99 | 92.10 | 92.21 | 92.33 | 92.44 | 92.56 | 92.67 | 92.79 | 92.90 |
| — | 0.54 | 0.54 | 0.54 | 0.54 | 0.55 | 0.54 | 0.54 | 0.54 | 0.54 | 0.54 | 0.54 | 0.54 |
| #69 | 93.01 | 93.13 | 93.24 | 93.36 | 93.47 | 93.59 | 93.70 | 93.82 | 93.93 | 94.04 | 94.16 | 94.27 |
| — | 0.54 | 0.54 | 0.54 | 0.53 | 0.54 | 0.54 | 0.54 | 0.54 | 0.54 | 0.55 | 0.55 | 0.56 |
| #70 | 94.39 | 94.50 | 94.61 | 94.73 | 94.84 | 94.96 | 95.07 | 95.18 | 95.30 | 95.41 | 95.52 | 95.64 |
| — | 0.56 | 0.57 | 0.58 | 0.59 | 0.60 | 0.61 | 0.62 | 0.63 | 0.64 | 0.65 | 0.66 | 0.67 |
| #71 | 95.75 | 95.86 | 95.98 | 96.09 | 96.20 | 96.31 | 96.43 | 96.54 | 96.65 | 96.76 | 96.88 | 96.99 |
| — | 0.69 | 0.70 | 0.71 | 0.72 | 0.73 | 0.74 | 0.75 | 0.76 | 0.77 | 0.77 | 0.78 | 0.78 |
| #72 | 97.10 | 97.21 | 97.33 | 97.44 | 97.55 | 97.66 | 97.78 | 97.89 | 98.00 | 98.11 | 98.23 | 98.34 |
| — | 0.78 | 0.78 | 0.78 | 0.78 | 0.77 | 0.77 | 0.76 | 0.76 | 0.75 | 0.74 | 0.73 | 0.72 |
| #73 | 98.45 | 98.57 | 98.68 | 98.79 | 98.90 | 99.02 | 99.13 | 99.24 | 99.36 | 99.47 | 99.59 | 99.70 |
| — | 0.71 | 0.70 | 0.69 | 0.67 | 0.66 | 0.65 | 0.64 | 0.63 | 0.62 | 0.61 | 0.60 | 0.60 |
| #74 | 99.81 | 99.93 | 100.04 | 100.16 | 100.27 | 100.38 | 100.50 | 100.61 | 100.73 | 100.84 | 100.95 | 101.07 |
| — | 0.59 | 0.58 | 0.58 | 0.57 | 0.57 | 0.56 | 0.56 | 0.56 | 0.56 | 0.56 | 0.56 | 0.56 |

TABLE 3-continued

| Widths of the microstrip line | | | | | | | | | | | | |
|---|---|---|---|---|---|---|---|---|---|---|---|---|
| #75 | 101.18 | 101.30 | 101.41 | 101.53 | 101.64 | 101.75 | 101.87 | 101.98 | 102.10 | 102.21 | 102.32 | 102.44 |
| — | 0.56 | 0.56 | 0.56 | 0.56 | 0.56 | 0.56 | 0.56 | 0.57 | 0.57 | 0.57 | 0.57 | 0.57 |
| #76 | 102.55 | 102.67 | 102.78 | 102.89 | 103.01 | 103.12 | 103.24 | 103.35 | 103.47 | 103.58 | 103.69 | 103.81 |
| — | 0.57 | 0.56 | 0.56 | 0.56 | 0.56 | 0.55 | 0.55 | 0.55 | 0.54 | 0.54 | 0.53 | 0.52 |
| #77 | 103.92 | 104.04 | 104.15 | 104.27 | 104.38 | 104.50 | 104.61 | 104.73 | 104.84 | 104.96 | 105.07 | 105.19 |
| — | 0.52 | 0.51 | 0.51 | 0.50 | 0.50 | 0.49 | 0.48 | 0.48 | 0.48 | 0.47 | 0.47 | 0.47 |
| #78 | 105.30 | 105.42 | 105.53 | 105.65 | 105.76 | 105.88 | 105.99 | 106.11 | 106.22 | 106.34 | 106.45 | 106.57 |
| — | 0.46 | 0.46 | 0.46 | 0.46 | 0.46 | 0.47 | 0.47 | 0.47 | 0.47 | 0.48 | 0.48 | 0.49 |
| #79 | 106.68 | 106.80 | 106.91 | 107.02 | 107.14 | 107.25 | 107.37 | 107.48 | 107.60 | 107.71 | 107.82 | 107.94 |
| — | 0.50 | 0.50 | 0.51 | 0.52 | 0.53 | 0.54 | 0.55 | 0.56 | 0.57 | 0.57 | 0.58 | 0.59 |
| #80 | 108.05 | 108.16 | 108.28 | 108.39 | 108.51 | 108.62 | 108.73 | 108.85 | 108.96 | 109.07 | 109.19 | 109.30 |
| — | 0.60 | 0.61 | 0.62 | 0.62 | 0.63 | 0.64 | 0.64 | 0.65 | 0.65 | 0.65 | 0.66 | 0.66 |
| #81 | 109.41 | 109.53 | 109.64 | 109.75 | 109.87 | 109.98 | 110.09 | 110.21 | 110.32 | 110.43 | 110.55 | 110.66 |
| — | 0.66 | 0.66 | 0.66 | 0.66 | 0.66 | 0.65 | 0.65 | 0.65 | 0.65 | 0.64 | 0.64 | 0.64 |
| #82 | 110.77 | 110.89 | 111.00 | 111.11 | 111.23 | 111.34 | 111.45 | 111.57 | 111.68 | 111.79 | 111.91 | 112.02 |
| — | 0.64 | 0.64 | 0.63 | 0.63 | 0.63 | 0.63 | 0.63 | 0.63 | 0.63 | 0.63 | 0.63 | 0.63 |
| #83 | 112.14 | 112.25 | 112.36 | 112.48 | 112.59 | 112.70 | 112.82 | 112.93 | 113.04 | 113.16 | 113.27 | 113.38 |
| — | 0.64 | 0.64 | 0.64 | 0.64 | 0.65 | 0.65 | 0.65 | 0.66 | 0.66 | 0.66 | 0.66 | 0.67 |
| #84 | 113.50 | 113.61 | 113.72 | 113.83 | 113.95 | | | | | | | |
| — | 0.67 | 0.67 | 0.67 | 0.67 | 0.67 | | | | | | | |

Figure 7:
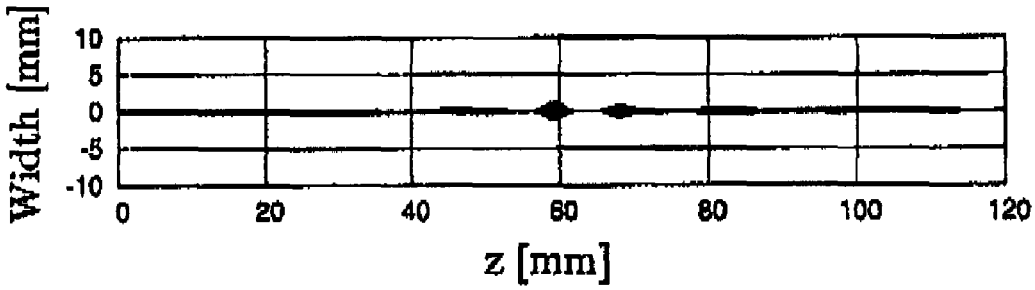
FIG. 7 is a graph showing the surface form of the microstrip line in the reflection-type bandpass filter of the first embodiment.

FIG. 7 shows the shape of the microstrip line 5 in the reflection-type bandpass filter 1 of the first embodiment. A non-reflecting terminator, or an R=50Ω resistance, is provided at the terminating side (the face at z=113.95 mm) of the reflection-type bandpass filter 1. The non-reflecting terminator or resistance may be connected in series with the terminating end of the reflection-type bandpass filter 1. The thickness of the metal films used in the conducting layer 3 and of the conductor constituting the microstrip line 5 should be adequately greater than the skin depth $\delta s=\sqrt{2/(\omega\mu 0\sigma)}$ at f=1 GHz. Here, $\omega$, $\mu_0$, and $\sigma$ each represent the angular frequency, the magnetic permeability in vacuum, and the conductivity of the metal. For example if copper is used, the thickness of the conducting layer 3 and of the conductor of the microstrip line 5 should be taken as 2.1 μm or greater. This reflection-type bandpass filter is used in a system where the characteristic impedance is 50Ω.

Figure 8:
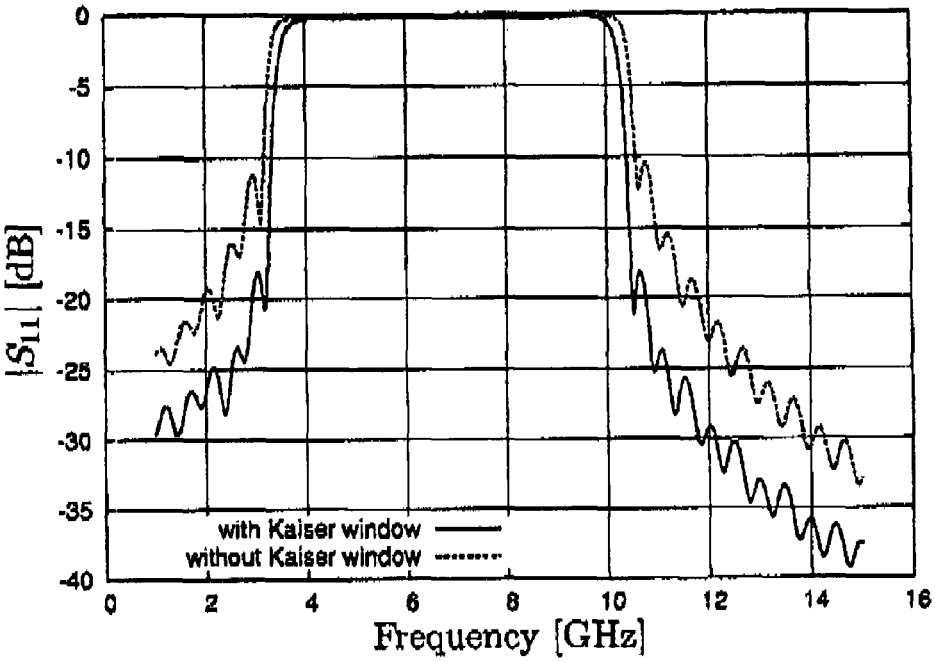
FIG. 8 is a graph showing the amplitude characteristics of the reflective wave in the reflection-type bandpass filter of the first embodiment.
Figure 9:
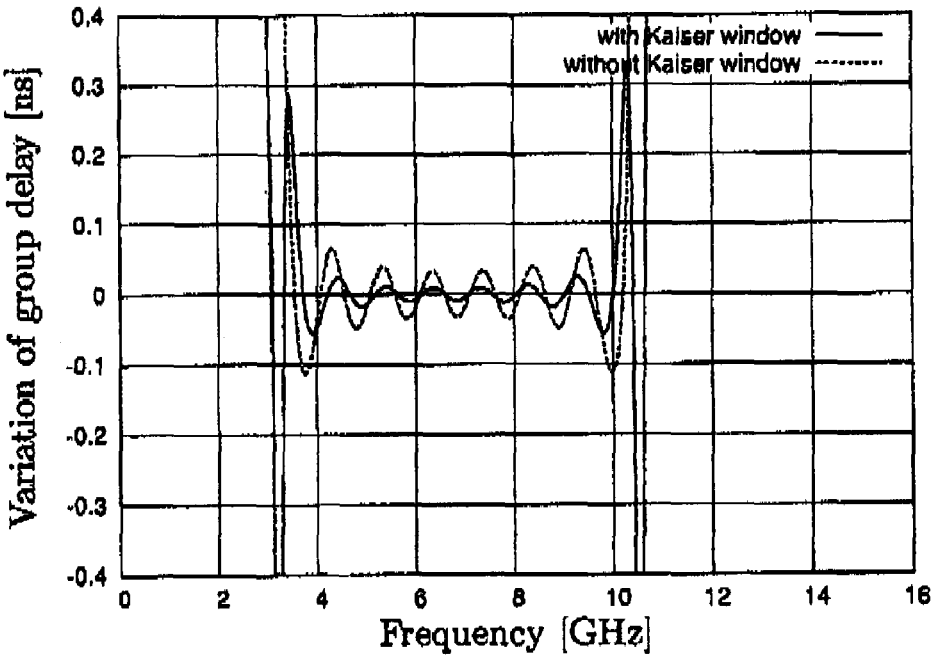
FIG. 9 is a graph showing the group delay frequency characteristics of the reflective wave in the reflection-type bandpass filter of the first embodiment.

FIG. 8 and FIG. 9 express the amplitude characteristics and group delay frequency characteristics respectively of the reflective wave (S11) in the bandpass filter of the first embodiment. For comparison, the characteristics when the Kaiser window is not used, are also shown. As shown in the figures, in the region of frequency f for which 3.7 GHz≦f≦10.0 GHz, the reflectivity is −1 dB or greater and the variation of the group delay is within ±0.05 ns. In the region f<3.1 GHz and f>10.6 GHz, the reflectivity is −17 dB or lower. Compared to the case when the Kaiser window is not used, the region of transition frequency becomes wider, but the stop band rejection increases to 15 dB, and the variation of group delay within the pass band decreases.

Embodiment 2

A Kaiser window was used for which the reflectivity is 1 at the frequency f in the region 3.6 GHz≦f≦10.1 GHz, and is 0 elsewhere, and for which A=40. Taking one wavelength at frequency f=1 GHz of the signal transmitted within the microstrip line as the waveguide length, the system characteristic impedance was taken as 50Ω, and the design was carried out.

Figure 10:
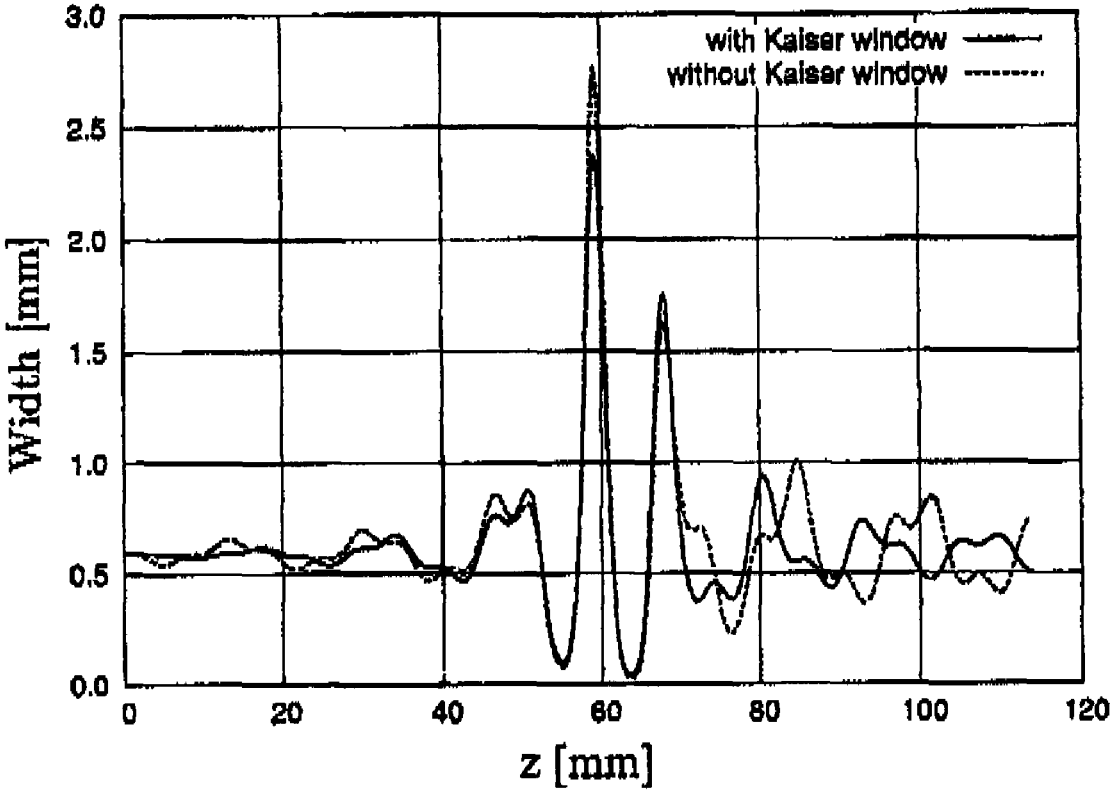
FIG. 10 is a graph showing the distribution in the width direction of the microstrip line in the reflection-type bandpass filter of the second embodiment.

FIG. 10 shows the distribution of the width w of the microstrip line 5 in the z-axis direction when a dielectric layer 4 of thickness h=0.635 mm, and relative dielectric constant $\in_r$=10.2 (for example, RT/Duroid (registered trademark) 6010LM) was used, together with the width when the Kaiser window was not used. Tables 4 through 6 list the widths w of the microstrip line 5 when the Kaiser window was used.

TABLE 4

| Widths of the microstrip line | | | | | | | | | | | | |
|---|---|---|---|---|---|---|---|---|---|---|---|---|
| | z[mm] | | | | | | | | | | | |
| | 0.00 | 0.11 | 0.23 | 0.34 | 0.46 | 0.57 | 0.68 | 0.80 | 0.91 | 1.02 | 1.14 | 1.25 |
| | w[mm] | | | | | | | | | | | |
| | 0.60 | 0.60 | 0.60 | 0.60 | 0.60 | 0.60 | 0.60 | 0.60 | 0.60 | 0.60 | 0.60 | 0.60 |
| #2 | 1.37 | 1.48 | 1.59 | 1.71 | 1.82 | 1.93 | 2.05 | 2.16 | 2.28 | 2.39 | 2.50 | 2.62 |
| — | 0.60 | 0.60 | 0.60 | 0.60 | 0.60 | 0.60 | 0.59 | 0.59 | 0.59 | 0.59 | 0.59 | 0.59 |
| #3 | 2.73 | 2.85 | 2.96 | 3.07 | 3.19 | 3.30 | 3.41 | 3.53 | 3.64 | 3.76 | 3.87 | 3.98 |
| — | 0.59 | 0.59 | 0.59 | 0.59 | 0.59 | 0.59 | 0.59 | 0.59 | 0.59 | 0.59 | 0.59 | 0.59 |
| #4 | 4.10 | 4.21 | 4.33 | 4.44 | 4.55 | 4.67 | 4.78 | 4.90 | 5.01 | 5.12 | 5.24 | 5.35 |
| — | 0.59 | 0.59 | 0.59 | 0.59 | 0.59 | 0.59 | 0.59 | 0.59 | 0.59 | 0.59 | 0.59 | 0.59 |
| #5 | 5.46 | 5.58 | 5.69 | 5.81 | 5.92 | 6.03 | 6.15 | 6.26 | 6.38 | 6.49 | 6.60 | 6.72 |
| — | 0.59 | 0.59 | 0.59 | 0.59 | 0.59 | 0.59 | 0.59 | 0.59 | 0.59 | 0.59 | 0.59 | 0.59 |
| #6 | 6.83 | 6.95 | 7.06 | 7.17 | 7.29 | 7.40 | 7.51 | 7.63 | 7.74 | 7.86 | 7.97 | 8.08 |
| — | 0.59 | 0.58 | 0.58 | 0.58 | 0.58 | 0.58 | 0.58 | 0.58 | 0.58 | 0.58 | 0.58 | 0.58 |

TABLE 4-continued

| | Widths of the microstrip line | | | | | | | | | | | |
|---|---|---|---|---|---|---|---|---|---|---|---|---|
| | z[mm] | | | | | | | | | | | |
| | 0.00 | 0.11 | 0.23 | 0.34 | 0.46 | 0.57 | 0.68 | 0.80 | 0.91 | 1.02 | 1.14 | 1.25 |
| | w[mm] | | | | | | | | | | | |
| | 0.60 | 0.60 | 0.60 | 0.60 | 0.60 | 0.60 | 0.60 | 0.60 | 0.60 | 0.60 | 0.60 | 0.60 |
| #7 | 8.20 | 8.31 | 8.43 | 8.54 | 8.65 | 8.77 | 8.88 | 9.00 | 9.11 | 9.22 | 9.34 | 9.45 |
| — | 0.58 | 0.58 | 0.57 | 0.57 | 0.57 | 0.57 | 0.57 | 0.57 | 0.57 | 0.57 | 0.57 | 0.57 |
| #8 | 9.57 | 9.68 | 9.79 | 9.91 | 10.02 | 10.14 | 10.25 | 10.36 | 10.48 | 10.59 | 10.71 | 10.82 |
| — | 0.57 | 0.57 | 0.57 | 0.57 | 0.58 | 0.58 | 0.58 | 0.58 | 0.58 | 0.58 | 0.58 | 0.58 |
| #9 | 10.93 | 11.05 | 11.16 | 11.28 | 11.39 | 11.50 | 11.62 | 11.73 | 11.85 | 11.96 | 12.07 | 12.19 |
| — | 0.58 | 0.58 | 0.58 | 0.58 | 0.59 | 0.59 | 0.59 | 0.59 | 0.59 | 0.59 | 0.59 | 0.59 |
| #10 | 12.30 | 12.41 | 12.53 | 12.64 | 12.76 | 12.87 | 12.98 | 13.10 | 13.21 | 13.33 | 13.44 | 13.55 |
| — | 0.59 | 0.59 | 0.59 | 0.59 | 0.59 | 0.59 | 0.59 | 0.59 | 0.59 | 0.59 | 0.59 | 0.59 |
| #11 | 13.67 | 13.78 | 13.90 | 14.01 | 14.12 | 14.24 | 14.35 | 14.46 | 14.58 | 14.69 | 14.81 | 14.92 |
| — | 0.59 | 0.59 | 0.59 | 0.59 | 0.59 | 0.59 | 0.59 | 0.59 | 0.59 | 0.59 | 0.60 | 0.60 |
| #12 | 15.03 | 15.15 | 15.26 | 15.37 | 15.49 | 15.60 | 15.72 | 15.83 | 15.94 | 16.06 | 16.17 | 16.28 |
| — | 0.60 | 0.60 | 0.60 | 0.60 | 0.60 | 0.60 | 0.61 | 0.61 | 0.61 | 0.61 | 0.61 | 0.61 |
| #13 | 16.40 | 16.51 | 16.63 | 16.74 | 16.85 | 16.97 | 17.08 | 17.19 | 17.31 | 17.42 | 17.53 | 17.65 |
| — | 0.61 | 0.62 | 0.62 | 0.62 | 0.62 | 0.62 | 0.62 | 0.62 | 0.62 | 0.62 | 0.62 | 0.62 |
| #14 | 17.76 | 17.88 | 17.99 | 18.10 | 18.22 | 18.33 | 18.44 | 18.56 | 18.67 | 18.78 | 18.90 | 19.01 |
| — | 0.62 | 0.62 | 0.62 | 0.62 | 0.62 | 0.62 | 0.61 | 0.61 | 0.61 | 0.61 | 0.61 | 0.61 |
| #15 | 19.13 | 19.24 | 19.35 | 19.47 | 19.58 | 19.69 | 19.81 | 19.92 | 20.04 | 20.15 | 20.26 | 20.38 |
| — | 0.60 | 0.60 | 0.60 | 0.60 | 0.60 | 0.59 | 0.59 | 0.59 | 0.59 | 0.59 | 0.59 | 0.59 |
| #16 | 20.49 | 20.61 | 20.72 | 20.83 | 20.95 | 21.06 | 21.18 | 21.29 | 21.40 | 21.52 | 21.63 | 21.75 |
| — | 0.58 | 0.58 | 0.58 | 0.58 | 0.58 | 0.58 | 0.58 | 0.58 | 0.58 | 0.58 | 0.58 | 0.58 |
| #17 | 21.86 | 21.97 | 22.09 | 22.20 | 22.32 | 22.43 | 22.54 | 22.66 | 22.77 | 22.88 | 23.00 | 23.11 |
| — | 0.58 | 0.58 | 0.58 | 0.58 | 0.58 | 0.58 | 0.58 | 0.58 | 0.58 | 0.58 | 0.58 | 0.58 |
| #18 | 23.23 | 23.34 | 23.45 | 23.57 | 23.68 | 23.80 | 23.91 | 24.03 | 24.14 | 24.25 | 24.37 | 24.48 |
| — | 0.57 | 0.57 | 0.57 | 0.57 | 0.57 | 0.57 | 0.56 | 0.56 | 0.56 | 0.56 | 0.56 | 0.55 |
| #19 | 24.60 | 24.71 | 24.82 | 24.94 | 25.05 | 25.17 | 25.28 | 25.40 | 25.51 | 25.62 | 25.74 | 25.85 |
| — | 0.55 | 0.55 | 0.55 | 0.55 | 0.54 | 0.54 | 0.54 | 0.54 | 0.54 | 0.54 | 0.54 | 0.54 |
| #20 | 25.97 | 26.08 | 26.20 | 26.31 | 26.42 | 26.54 | 26.65 | 26.77 | 26.88 | 27.00 | 27.11 | 27.22 |
| — | 0.54 | 0.54 | 0.54 | 0.54 | 0.54 | 0.55 | 0.55 | 0.55 | 0.55 | 0.56 | 0.56 | 0.56 |
| #21 | 27.34 | 27.45 | 27.57 | 27.68 | 27.79 | 27.91 | 28.02 | 28.14 | 28.25 | 28.36 | 28.48 | 28.59 |
| — | 0.57 | 0.57 | 0.57 | 0.58 | 0.58 | 0.58 | 0.59 | 0.59 | 0.59 | 0.60 | 0.60 | 0.60 |
| #22 | 28.70 | 28.82 | 28.93 | 29.05 | 29.16 | 29.27 | 29.39 | 29.50 | 29.61 | 29.73 | 29.84 | 29.96 |
| — | 0.60 | 0.61 | 0.61 | 0.61 | 0.61 | 0.61 | 0.61 | 0.61 | 0.62 | 0.62 | 0.62 | 0.62 |
| #23 | 30.07 | 30.18 | 30.30 | 30.41 | 30.52 | 30.64 | 30.75 | 30.86 | 30.98 | 31.09 | 31.21 | 31.32 |
| — | 0.62 | 0.62 | 0.62 | 0.62 | 0.61 | 0.61 | 0.61 | 0.61 | 0.62 | 0.62 | 0.62 | 0.62 |
| #24 | 31.43 | 31.55 | 31.66 | 31.77 | 31.89 | 32.00 | 32.11 | 32.23 | 32.34 | 32.45 | 32.57 | 32.68 |
| — | 0.62 | 0.62 | 0.62 | 0.62 | 0.63 | 0.63 | 0.63 | 0.63 | 0.64 | 0.64 | 0.64 | 0.65 |
| #25 | 32.80 | 32.91 | 33.02 | 33.14 | 33.25 | 33.36 | 33.47 | 33.59 | 33.70 | 33.81 | 33.93 | 34.04 |
| — | 0.65 | 0.65 | 0.66 | 0.66 | 0.66 | 0.67 | 0.67 | 0.67 | 0.67 | 0.67 | 0.67 | 0.68 |
| #26 | 34.15 | 34.27 | 34.38 | 34.49 | 34.61 | 34.72 | 34.83 | 34.95 | 35.06 | 35.17 | 35.29 | 35.40 |
| — | 0.68 | 0.67 | 0.67 | 0.67 | 0.67 | 0.67 | 0.66 | 0.66 | 0.65 | 0.65 | 0.64 | 0.64 |
| #27 | 35.51 | 35.63 | 35.74 | 35.85 | 33.97 | 30.08 | 36.20 | 36.31 | 36.42 | 36.54 | 36.65 | 36.77 |
| — | 0.63 | 0.63 | 0.62 | 0.61 | 0.61 | 0.60 | 0.59 | 0.59 | 0.58 | 0.57 | 0.57 | 0.56 |
| #28 | 36.88 | 36.99 | 37.11 | 37.22 | 37.34 | 37.45 | 37.57 | 37.68 | 37.79 | 37.91 | 38.02 | 38.14 |
| — | 0.56 | 0.55 | 0.55 | 0.54 | 0.54 | 0.54 | 0.54 | 0.53 | 0.53 | 0.53 | 0.53 | 0.53 |
| #29 | 38.25 | 38.37 | 38.48 | 38.60 | 38.71 | 38.82 | 38.94 | 39.05 | 39.17 | 39.28 | 39.40 | 39.51 |
| — | 0.53 | 0.53 | 0.53 | 0.53 | 0.53 | 0.53 | 0.53 | 0.53 | 0.53 | 0.53 | 0.53 | 0.53 |
| #30 | 39.62 | 39.74 | 39.85 | 39.97 | 40.08 | 40.20 | 40.31 | 40.43 | 40.54 | 40.65 | 40.77 | 40.88 |
| — | 0.53 | 0.53 | 0.53 | 0.53 | 0.53 | 0.53 | 0.52 | 0.52 | 0.52 | 0.52 | 0.51 | 0.51 |

TABLE 5

| | Widths of the microstrip line | | | | | | | | | | | |
|---|---|---|---|---|---|---|---|---|---|---|---|---|
| #31 | 41.00 | 41.11 | 41.23 | 41.34 | 41.46 | 41.57 | 41.69 | 41.80 | 41.92 | 42.03 | 42.15 | 42.26 |
| — | 0.50 | 0.50 | 0.49 | 0.49 | 0.49 | 0.48 | 0.48 | 0.48 | 0.47 | 0.47 | 0.47 | 0.47 |
| #32 | 42.38 | 42.49 | 42.61 | 42.72 | 42.84 | 42.95 | 43.07 | 43.18 | 43.30 | 43.41 | 43.53 | 43.64 |
| — | 0.47 | 0.47 | 0.47 | 0.47 | 0.47 | 0.48 | 0.48 | 0.48 | 0.49 | 0.50 | 0.51 | 0.51 |
| #33 | 43.75 | 43.87 | 43.98 | 44.10 | 44.21 | 44.33 | 44.44 | 44.55 | 44.67 | 44.78 | 44.89 | 45.01 |
| — | 0.52 | 0.53 | 0.55 | 0.56 | 0.57 | 0.58 | 0.59 | 0.61 | 0.62 | 0.63 | 0.65 | 0.66 |
| #34 | 45.12 | 45.23 | 45.35 | 45.46 | 45.57 | 45.68 | 45.80 | 45.91 | 46.02 | 46.14 | 46.25 | 46.36 |
| — | 0.67 | 0.69 | 0.70 | 0.71 | 0.72 | 0.73 | 0.74 | 0.74 | 0.75 | 0.75 | 0.76 | 0.76 |
| #35 | 46.47 | 46.59 | 46.70 | 46.81 | 46.92 | 47.04 | 47.15 | 47.26 | 47.37 | 47.49 | 47.60 | 47.71 |
| — | 0.76 | 0.76 | 0.76 | 0.76 | 0.76 | 0.75 | 0.75 | 0.75 | 0.74 | 0.74 | 0.74 | 0.73 |
| #36 | 47.82 | 47.94 | 48.05 | 48.16 | 48.28 | 48.39 | 48.50 | 48.61 | 48.73 | 48.84 | 48.95 | 49.06 |
| — | 0.73 | 0.73 | 0.73 | 0.73 | 0.73 | 0.73 | 0.73 | 0.73 | 0.74 | 0.74 | 0.75 | 0.76 |
| #37 | 49.18 | 49.29 | 49.40 | 49.51 | 49.63 | 49.74 | 49.85 | 49.96 | 50.08 | 50.19 | 50.30 | 50.41 |
| — | 0.77 | 0.77 | 0.78 | 0.79 | 0.80 | 0.82 | 0.83 | 0.84 | 0.85 | 0.85 | 0.86 | 0.87 |

TABLE 5-continued

| Widths of the microstrip line | | | | | | | | | | | | |
|---|---|---|---|---|---|---|---|---|---|---|---|---|
| #38 | 50.52 | 50.63 | 50.75 | 50.86 | 50.97 | 51.08 | 51.19 | 51.31 | 51.42 | 51.53 | 51.64 | 51.76 |
| — | 0.87 | 0.87 | 0.87 | 0.87 | 0.86 | 0.85 | 0.84 | 0.83 | 0.81 | 0.79 | 0.76 | 0.73 |
| #39 | 51.87 | 51.98 | 52.10 | 52.21 | 52.32 | 52.44 | 52.55 | 52.67 | 52.78 | 52.90 | 53.02 | 53.13 |
| — | 0.70 | 0.67 | 0.64 | 0.60 | 0.57 | 0.53 | 0.49 | 0.46 | 0.42 | 0.38 | 0.35 | 0.32 |
| #40 | 53.25 | 53.37 | 53.48 | 53.60 | 53.72 | 53.84 | 53.96 | 54.08 | 54.20 | 54.32 | 54.44 | 54.56 |
| — | 0.29 | 0.26 | 0.24 | 0.21 | 0.19 | 0.17 | 0.16 | 0.14 | 0.13 | 0.12 | 0.11 | 0.11 |
| #41 | 54.68 | 54.80 | 54.92 | 55.04 | 55.16 | 55.29 | 55.41 | 55.53 | 55.65 | 55.77 | 55.88 | 56.00 |
| — | 0.10 | 0.10 | 0.10 | 0.10 | 0.10 | 0.11 | 0.11 | 0.12 | 0.13 | 0.14 | 0.16 | 0.18 |
| #42 | 56.12 | 56.24 | 56.36 | 56.47 | 56.59 | 56.71 | 56.82 | 56.94 | 57.05 | 57.16 | 57.28 | 57.39 |
| — | 0.20 | 0.23 | 0.27 | 0.30 | 0.35 | 0.40 | 0.46 | 0.52 | 0.60 | 0.67 | 0.76 | 0.85 |
| #43 | 57.50 | 57.61 | 57.72 | 57.83 | 57.94 | 58.05 | 58.16 | 58.26 | 58.37 | 58.48 | 58.59 | 58.69 |
| — | 0.95 | 1.06 | 1.16 | 1.28 | 1.39 | 1.51 | 1.63 | 1.75 | 1.86 | 1.96 | 2.06 | 2.15 |
| #44 | 58.80 | 58.90 | 59.01 | 59.12 | 59.22 | 59.33 | 59.44 | 59.54 | 59.65 | 59.75 | 59.86 | 59.97 |
| — | 2.22 | 2.29 | 2.33 | 2.36 | 2.37 | 2.36 | 2.33 | 2.28 | 2.22 | 2.14 | 2.05 | 1.95 |
| #45 | 60.08 | 60.18 | 60.29 | 60.40 | 60.51 | 60.62 | 60.73 | 60.84 | 60.95 | 61.07 | 61.18 | 61.29 |
| — | 1.84 | 1.72 | 1.60 | 1.47 | 1.35 | 1.23 | 1.11 | 0.99 | 0.88 | 0.78 | 0.68 | 0.59 |
| #46 | 61.41 | 61.52 | 61.64 | 61.76 | 61.87 | 61.99 | 62.11 | 62.23 | 62.35 | 62.47 | 62.59 | 62.71 |
| — | 0.51 | 0.44 | 0.37 | 0.31 | 0.26 | 0.22 | 0.18 | 0.15 | 0.13 | 0.11 | 0.09 | 0.08 |
| #47 | 62.84 | 62.96 | 63.08 | 63.20 | 63.33 | 63.45 | 63.57 | 63.69 | 63.82 | 63.94 | 64.06 | 64.18 |
| — | 0.07 | 0.06 | 0.05 | 0.05 | 0.04 | 0.04 | 0.04 | 0.04 | 0.04 | 0.05 | 0.05 | 0.06 |
| #48 | 64.31 | 64.43 | 64.55 | 64.67 | 64.79 | 64.91 | 65.03 | 65.15 | 65.26 | 65.38 | 65.50 | 65.61 |
| — | 0.06 | 0.07 | 0.09 | 0.10 | 0.12 | 0.14 | 0.17 | 0.20 | 0.24 | 0.28 | 0.33 | 0.39 |
| #49 | 65.73 | 65.84 | 65.96 | 66.07 | 66.18 | 66.29 | 66.41 | 66.52 | 66.63 | 66.74 | 66.85 | 66.96 |
| — | 0.45 | 0.52 | 0.59 | 0.67 | 0.75 | 0.84 | 0.92 | 1.01 | 1.10 | 1.19 | 1.28 | 1.36 |
| #50 | 67.07 | 67.17 | 67.28 | 67.39 | 67.50 | 67.61 | 67.72 | 67.82 | 67.93 | 68.04 | 68.15 | 68.25 |
| — | 1.44 | 1.51 | 1.58 | 1.63 | 1.68 | 1.71 | 1.74 | 1.75 | 1.75 | 1.74 | 1.72 | 1.69 |
| #51 | 68.36 | 68.47 | 68.58 | 68.69 | 68.80 | 68.91 | 69.02 | 69.13 | 69.24 | 69.35 | 69.46 | 69.57 |
| — | 1.65 | 1.60 | 1.55 | 1.49 | 1.43 | 1.36 | 1.29 | 1.22 | 1.15 | 1.08 | 1.02 | 0.95 |
| #52 | 69.68 | 69.79 | 69.91 | 70.02 | 70.13 | 70.25 | 70.36 | 70.47 | 70.59 | 70.70 | 70.82 | 70.93 |
| — | 0.89 | 0.83 | 0.78 | 0.73 | 0.68 | 0.64 | 0.60 | 0.56 | 0.53 | 0.50 | 0.47 | 0.45 |
| #53 | 71.05 | 71.16 | 71.28 | 71.39 | 71.51 | 71.63 | 71.74 | 71.86 | 71.97 | 72.09 | 72.21 | 72.32 |
| — | 0.43 | 0.42 | 0.40 | 0.39 | 0.38 | 0.38 | 0.37 | 0.37 | 0.37 | 0.37 | 0.37 | 0.38 |
| #54 | 72.44 | 72.55 | 72.67 | 72.79 | 72.90 | 73.02 | 73.13 | 73.25 | 73.36 | 73.48 | 73.59 | 73.71 |
| — | 0.38 | 0.39 | 0.39 | 0.40 | 0.41 | 0.41 | 0.42 | 0.43 | 0.43 | 0.44 | 0.44 | 0.45 |
| #55 | 73.82 | 73.94 | 74.05 | 74.17 | 74.29 | 74.40 | 74.52 | 74.63 | 74.75 | 74.86 | 74.98 | 75.09 |
| — | 0.45 | 0.45 | 0.46 | 0.46 | 0.46 | 0.45 | 0.45 | 0.45 | 0.44 | 0.44 | 0.43 | 0.43 |
| #56 | 75.21 | 75.32 | 75.44 | 75.55 | 75.67 | 75.79 | 75.90 | 76.02 | 76.13 | 76.25 | 76.37 | 76.48 |
| — | 0.42 | 0.42 | 0.41 | 0.40 | 0.40 | 0.39 | 0.39 | 0.39 | 0.38 | 0.38 | 0.38 | 0.38 |
| #57 | 76.60 | 76.71 | 76.83 | 76.94 | 77.06 | 77.18 | 77.29 | 77.41 | 77.52 | 77.64 | 77.75 | 77.87 |
| — | 0.38 | 0.39 | 0.39 | 0.40 | 0.41 | 0.41 | 0.42 | 0.44 | 0.45 | 0.47 | 0.48 | 0.50 |
| #58 | 77.98 | 78.10 | 78.21 | 78.32 | 78.44 | 78.55 | 78.66 | 78.78 | 78.89 | 79.00 | 79.11 | 79.23 |
| — | 0.52 | 0.54 | 0.56 | 0.59 | 0.61 | 0.64 | 0.66 | 0.69 | 0.71 | 0.74 | 0.77 | 0.79 |
| #59 | 79.34 | 79.45 | 79.56 | 79.68 | 79.79 | 79.90 | 80.01 | 80.12 | 80.23 | 80.34 | 80.46 | 80.57 |
| — | 0.81 | 0.84 | 0.86 | 0.87 | 0.89 | 0.90 | 0.92 | 0.92 | 0.93 | 0.93 | 0.94 | 0.93 |
| #60 | 80.68 | 80.79 | 80.90 | 81.01 | 81.13 | 81.24 | 81.35 | 81.46 | 81.57 | 81.69 | 81.80 | 81.91 |
| — | 0.93 | 0.92 | 0.91 | 0.90 | 0.89 | 0.87 | 0.86 | 0.84 | 0.82 | 0.80 | 0.78 | 0.76 |

TABLE 6

| Widths of the microstrip line | | | | | | | | | | | | |
|---|---|---|---|---|---|---|---|---|---|---|---|---|
| #61 | 82.02 | 82.14 | 82.25 | 82.36 | 82.47 | 82.59 | 82.70 | 82.82 | 82.93 | 83.04 | 83.16 | 83.27 |
| — | 0.75 | 0.73 | 0.71 | 0.69 | 0.67 | 0.66 | 0.64 | 0.63 | 0.62 | 0.60 | 0.59 | 0.59 |
| #62 | 83.38 | 83.50 | 83.61 | 83.73 | 83.84 | 83.95 | 84.07 | 84.18 | 84.30 | 84.41 | 84.53 | 84.64 |
| — | 0.58 | 0.57 | 0.56 | 0.56 | 0.56 | 0.55 | 0.55 | 0.55 | 0.55 | 0.55 | 0.55 | 0.55 |
| #63 | 84.75 | 84.87 | 84.98 | 85.10 | 85.21 | 85.33 | 85.44 | 85.55 | 85.67 | 85.78 | 85.90 | 86.01 |
| — | 0.55 | 0.55 | 0.56 | 0.56 | 0.56 | 0.56 | 0.56 | 0.56 | 0.56 | 0.56 | 0.56 | 0.56 |
| #64 | 86.12 | 86.24 | 86.35 | 86.47 | 86.58 | 86.70 | 86.81 | 86.92 | 87.04 | 87.15 | 87.27 | 87.38 |
| — | 0.55 | 0.55 | 0.55 | 0.54 | 0.54 | 0.53 | 0.52 | 0.52 | 0.51 | 0.50 | 0.50 | 0.49 |
| #65 | 87.50 | 87.61 | 87.73 | 87.84 | 87.96 | 88.07 | 88.19 | 88.30 | 88.42 | 88.53 | 88.65 | 88.77 |
| — | 0.48 | 0.47 | 0.47 | 0.46 | 0.46 | 0.45 | 0.44 | 0.44 | 0.44 | 0.43 | 0.43 | 0.43 |
| #66 | 88.88 | 89.00 | 89.11 | 89.23 | 89.34 | 89.46 | 89.57 | 89.69 | 89.80 | 89.92 | 90.03 | 90.15 |
| — | 0.43 | 0.43 | 0.43 | 0.44 | 0.44 | 0.45 | 0.45 | 0.46 | 0.47 | 0.48 | 0.49 | 0.50 |
| #67 | 90.26 | 90.38 | 90.49 | 90.60 | 90.72 | 90.83 | 90.95 | 91.06 | 91.17 | 91.29 | 91.40 | 91.51 |
| — | 0.51 | 0.52 | 0.53 | 0.54 | 0.56 | 0.57 | 0.59 | 0.60 | 0.61 | 0.63 | 0.64 | 0.65 |
| #68 | 91.63 | 91.74 | 91.85 | 91.97 | 92.08 | 92.19 | 92.31 | 92.42 | 92.53 | 92.64 | 92.76 | 92.87 |
| — | 0.67 | 0.68 | 0.69 | 0.70 | 0.71 | 0.72 | 0.72 | 0.73 | 0.73 | 0.74 | 0.74 | 0.74 |
| #69 | 92.98 | 93.09 | 93.21 | 93.32 | 93.43 | 93.55 | 93.66 | 93.77 | 93.88 | 94.00 | 94.11 | 94.22 |
| — | 0.74 | 0.74 | 0.73 | 0.73 | 0.73 | 0.72 | 0.72 | 0.71 | 0.70 | 0.70 | 0.69 | 0.68 |
| #70 | 94.34 | 94.45 | 94.56 | 94.68 | 94.79 | 94.90 | 95.02 | 95.13 | 95.24 | 95.36 | 95.47 | 95.58 |
| — | 0.68 | 0.67 | 0.66 | 0.66 | 0.65 | 0.65 | 0.64 | 0.64 | 0.63 | 0.63 | 0.63 | 0.62 |
| #71 | 95.70 | 95.81 | 95.93 | 96.04 | 96.15 | 96.27 | 96.38 | 96.49 | 96.61 | 96.72 | 96.83 | 96.95 |
| — | 0.62 | 0.62 | 0.62 | 0.62 | 0.62 | 0.62 | 0.62 | 0.62 | 0.62 | 0.62 | 0.63 | 0.63 |

TABLE 6-continued

| Widths of the microstrip line | | | | | | | | | | | | |
|---|---|---|---|---|---|---|---|---|---|---|---|---|
| #72 | 97.06 | 97.18 | 97.29 | 97.40 | 97.52 | 97.63 | 97.74 | 97.86 | 97.97 | 98.08 | 98.20 | 98.31 |
| — | 0.63 | 0.63 | 0.63 | 0.63 | 0.63 | 0.63 | 0.63 | 0.63 | 0.62 | 0.62 | 0.62 | 0.61 |
| #73 | 98.42 | 98.54 | 98.65 | 98.77 | 98.88 | 98.99 | 99.11 | 99.22 | 99.34 | 99.45 | 99.57 | 99.68 |
| — | 0.61 | 0.60 | 0.60 | 0.59 | 0.58 | 0.58 | 0.57 | 0.56 | 0.55 | 0.55 | 0.54 | 0.53 |
| #74 | 99.79 | 99.91 | 100.02 | 100.14 | 100.25 | 100.37 | 100.48 | 100.60 | 100.71 | 100.83 | 100.94 | 101.06 |
| — | 0.52 | 0.51 | 0.51 | 0.50 | 0.49 | 0.49 | 0.48 | 0.48 | 0.48 | 0.47 | 0.47 | 0.47 |
| #75 | 101.17 | 101.29 | 101.40 | 101.52 | 101.63 | 101.75 | 101.86 | 101.98 | 102.09 | 102.21 | 102.32 | 102.44 |
| — | 0.47 | 0.47 | 0.47 | 0.47 | 0.47 | 0.47 | 0.48 | 0.48 | 0.49 | 0.49 | 0.50 | 0.50 |
| #76 | 102.55 | 102.66 | 102.78 | 102.89 | 103.01 | 103.12 | 103.24 | 103.35 | 103.46 | 103.58 | 103.69 | 103.81 |
| — | 0.51 | 0.52 | 0.53 | 0.53 | 0.54 | 0.55 | 0.56 | 0.57 | 0.58 | 0.58 | 0.59 | 0.60 |
| #77 | 103.92 | 104.03 | 104.15 | 104.26 | 104.37 | 104.49 | 104.60 | 104.71 | 104.83 | 104.94 | 105.05 | 105.17 |
| — | 0.61 | 0.61 | 0.62 | 0.62 | 0.63 | 0.63 | 0.64 | 0.64 | 0.64 | 0.64 | 0.64 | 0.65 |
| #78 | 105.28 | 105.39 | 105.51 | 105.62 | 105.74 | 105.85 | 105.96 | 106.08 | 106.19 | 106.30 | 106.42 | 106.53 |
| — | 0.65 | 0.65 | 0.64 | 0.64 | 0.64 | 0.64 | 0.64 | 0.64 | 0.63 | 0.63 | 0.63 | 0.63 |
| #79 | 106.64 | 106.76 | 106.87 | 106.98 | 107.10 | 107.21 | 107.32 | 107.44 | 107.55 | 107.67 | 107.78 | 107.89 |
| — | 0.63 | 0.63 | 0.62 | 0.62 | 0.62 | 0.62 | 0.62 | 0.62 | 0.63 | 0.63 | 0.63 | 0.63 |
| #80 | 108.01 | 108.12 | 108.23 | 108.35 | 108.46 | 108.57 | 108.69 | 108.80 | 108.91 | 109.03 | 109.14 | 109.25 |
| — | 0.63 | 0.64 | 0.64 | 0.64 | 0.64 | 0.65 | 0.65 | 0.65 | 0.66 | 0.66 | 0.66 | 0.66 |
| #81 | 109.37 | 109.48 | 109.59 | 109.71 | 109.82 | 109.93 | 110.05 | 110.16 | 110.27 | 110.39 | 110.50 | 110.61 |
| — | 0.66 | 0.67 | 0.67 | 0.67 | 0.67 | 0.66 | 0.66 | 0.66 | 0.66 | 0.66 | 0.65 | 0.65 |
| #82 | 110.73 | 110.84 | 110.95 | 111.07 | 111.18 | 111.29 | 111.41 | 111.52 | 111.64 | 111.75 | 111.86 | 111.98 |
| — | 0.64 | 0.64 | 0.63 | 0.62 | 0.62 | 0.61 | 0.60 | 0.60 | 0.59 | 0.58 | 0.57 | 0.57 |
| #83 | 112.09 | 112.21 | 112.32 | 112.43 | 112.55 | 112.66 | 112.78 | 112.89 | 113.01 | 113.12 | 113.24 | 113.35 |
| — | 0.56 | 0.55 | 0.55 | 0.54 | 0.54 | 0.53 | 0.53 | 0.52 | 0.52 | 0.52 | 0.51 | 0.51 |
| #84 | 113.46 | 113.58 | 113.69 | 113.81 | 113.92 | | | | | | | |
| — | 0.51 | 0.51 | 0.51 | 0.51 | 0.51 | | | | | | | |

Figure 11:
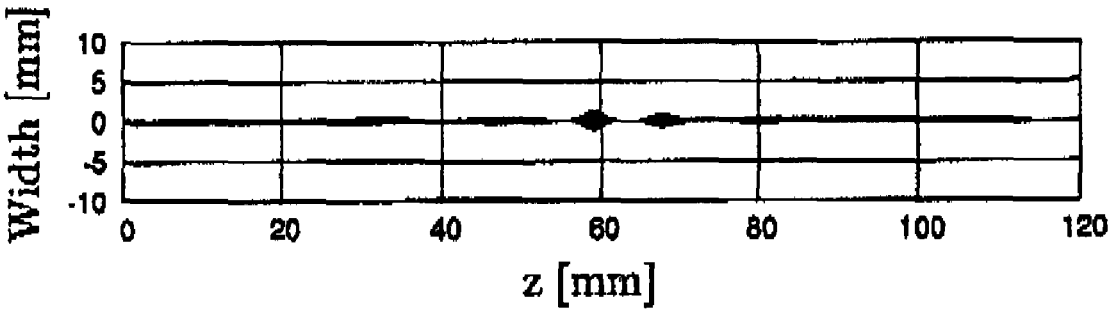
FIG. 11 is a graph showing the surface form of the microstrip line in the reflection-type bandpass filter of the second embodiment.

FIG. 11 shows the shape of the microstrip line 5 in the reflection-type bandpass filter 1 of the second embodiment. A non-reflecting terminator, or an R=50Ω resistance, is provided at the terminating side (the face at z=113.92 mm) of the reflection-type bandpass filter 1. The thickness of the metal films used in the conducting layer 3 and of the conductor constituting the microstrip line 5 should be adequately greater than the skin depth $\delta s=\sqrt{\{2/(\omega\mu 0\sigma)\}}$ at f=1 GHz. For example if copper is used, the thickness of the conducting layer 3 and of the conductor of the microstrip line 5 should be taken as 2.1 μm or greater. This reflection-type bandpass filter is used in a system where the characteristic impedance is 50Ω.

Figure 12:
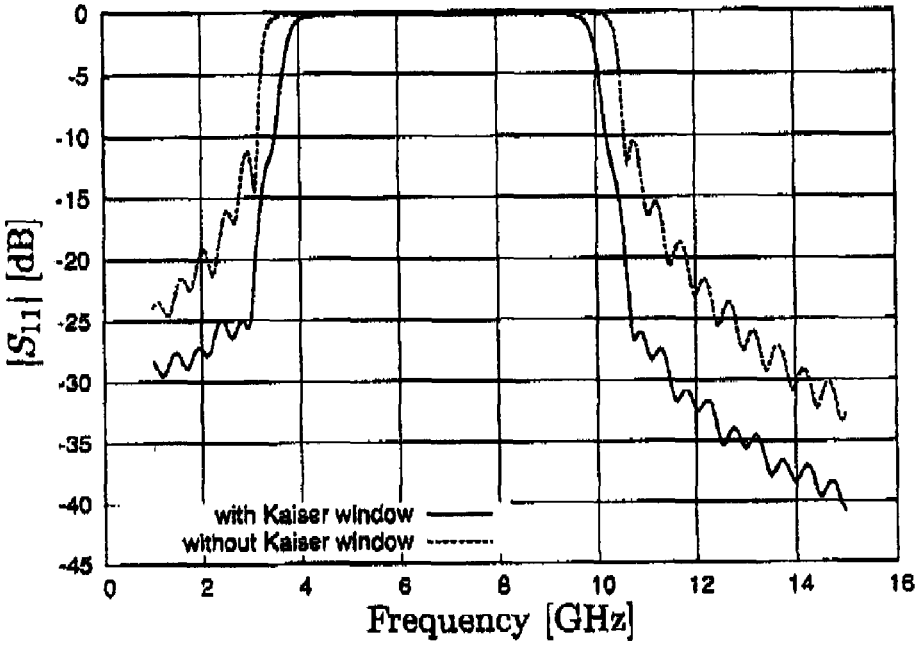
FIG. 12 is a graph showing the amplitude characteristics of the reflective wave in the reflection-type bandpass filter of the second embodiment.
Figure 13:
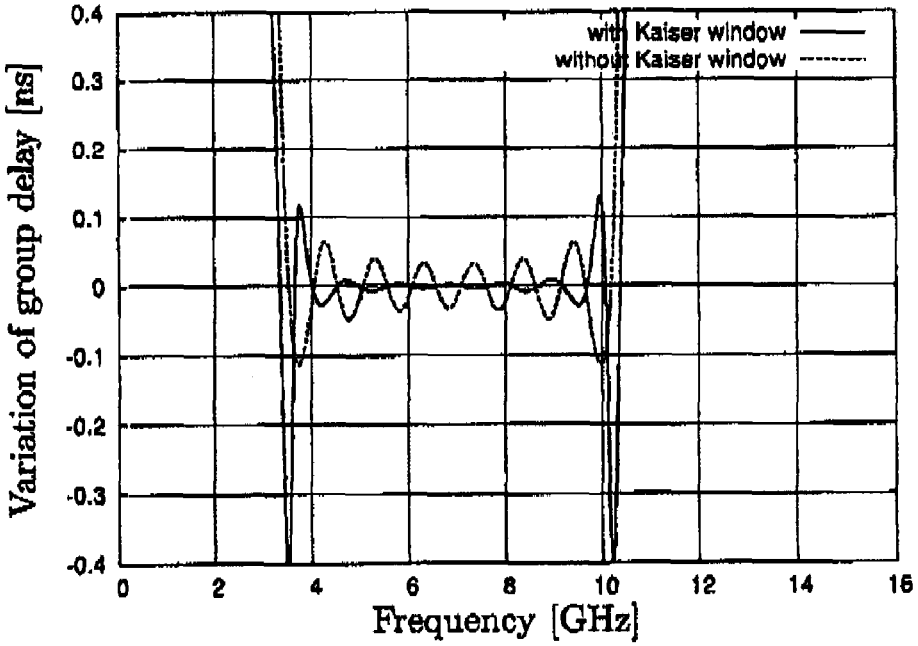
FIG. 13 is a graph showing the group delay frequency characteristics of the reflective wave in the reflection-type bandpass filter of the second embodiment.

FIG. 12 and FIG. 13 express the amplitude characteristics and group delay frequency characteristics respectively of the reflective wave (S11) in the bandpass filter of the second embodiment. For comparison, the characteristics when the Kaiser window is not used, are also shown. As shown in the figures, in the region of frequency f for which 4.0 GHz≦f≦9.8 GHz, the reflectivity is −2 dB or greater and the variation of the group delay is within ±0.03 ns. In the region f<3.1 GHz and f>10.6 GHz, the reflectivity is −20 dB or lower. Compared to the case when the Kaiser window is not used, the region of transition frequency becomes wider, but the stop band rejection increases to 18 dB, and the variation of group delay within the pass band decreases.

Embodiment 3

A Kaiser window was used for which the reflectivity is 1 at the frequency f in the region 3.4 GHz≦f≦10.3 GHz, and is 0 elsewhere, and for which A=25. Taking one wavelength at frequency f=1 GHz of the signal transmitted within the microstrip line as the waveguide length, the system characteristic impedance was taken as 30Ω, and the design was carried out.

Figure 14:
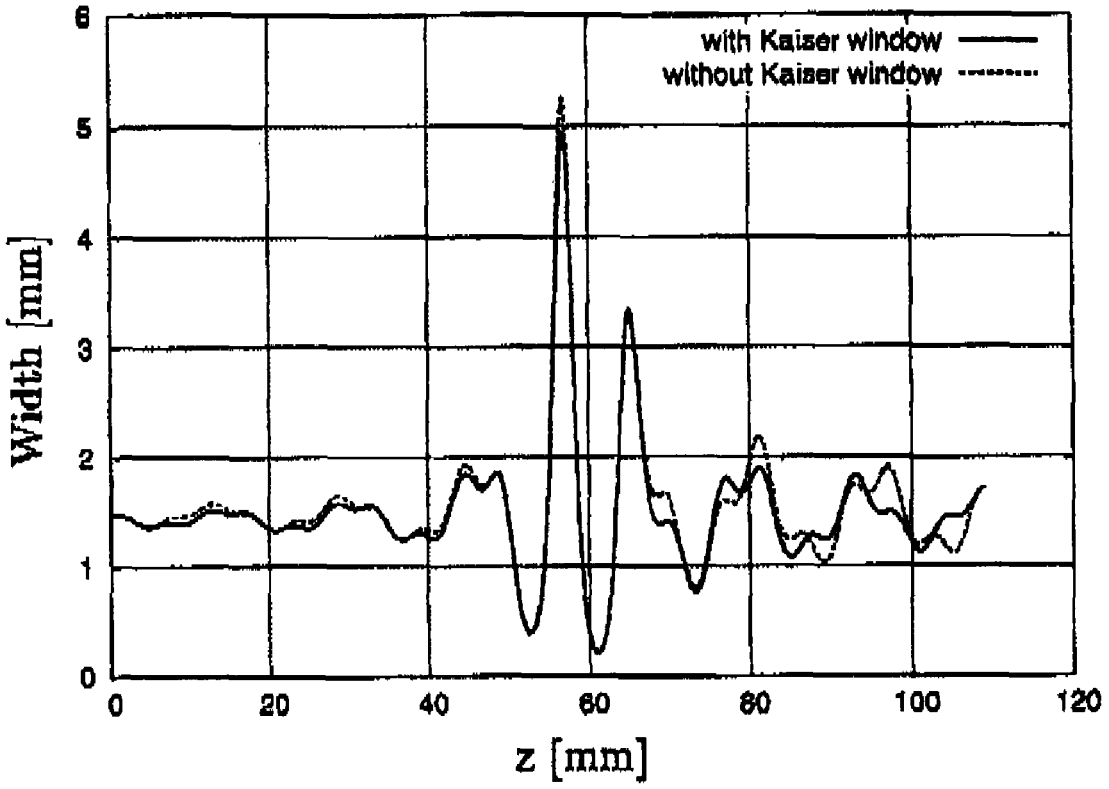
FIG. 14 is a graph showing the distribution in the width direction of the microstrip line in the reflection-type bandpass filter of the third embodiment.

FIG. 14 shows the distribution of the width w of the microstrip line 5 in the z-axis direction when a dielectric layer 4 of thickness h=0.635 mm, and relative dielectric constant $\in_r$=10.2 (for example, RT/Duroid (registered trademark) 6010LM) was used, together with the width when the Kaiser window was not used. Tables 7 through 9 list the widths w of the microstrip line 5 when the Kaiser window was used.

TABLE 7

| Widths of the microstrip line | | | | | | | | | | | | |
|---|---|---|---|---|---|---|---|---|---|---|---|---|
| | z[mm] | | | | | | | | | | | |
| | 0.00 | 0.11 | 0.22 | 0.33 | 0.44 | 0.54 | 0.65 | 0.76 | 0.87 | 0.98 | 1.09 | 1.20 |
| | w[mm] | | | | | | | | | | | |
| | 1.47 | 1.47 | 1.47 | 1.47 | 1.47 | 1.47 | 1.47 | 1.47 | 1.47 | 1.47 | 1.47 | 1.47 |
| #2 | 1.31 | 1.42 | 1.52 | 1.63 | 1.74 | 1.85 | 1.96 | 2.07 | 2.18 | 2.29 | 2.40 | 2.50 |
| — | 1.47 | 1.47 | 1.47 | 1.47 | 1.47 | 1.46 | 1.46 | 1.46 | 1.45 | 1.45 | 1.45 | 1.44 |
| #3 | 2.61 | 2.72 | 2.83 | 2.94 | 3.05 | 3.16 | 3.27 | 3.38 | 3.49 | 3.59 | 3.70 | 3.81 |
| — | 1.44 | 1.44 | 1.43 | 1.43 | 1.42 | 1.42 | 1.42 | 1.41 | 1.41 | 1.40 | 1.40 | 1.40 |
| #4 | 3.92 | 4.03 | 4.14 | 4.25 | 4.36 | 4.47 | 4.58 | 4.69 | 4.80 | 4.90 | 5.01 | 5.12 |
| — | 1.40 | 1.39 | 1.39 | 1.39 | 1.39 | 1.39 | 1.39 | 1.39 | 1.39 | 1.39 | 1.39 | 1.39 |
| #5 | 5.23 | 5.34 | 5.45 | 5.56 | 5.67 | 5.78 | 5.89 | 6.00 | 6.11 | 6.21 | 6.32 | 6.43 |
| — | 1.39 | 1.39 | 1.39 | 1.39 | 1.39 | 1.39 | 1.40 | 1.40 | 1.40 | 1.40 | 1.40 | 1.40 |

TABLE 7-continued

| Widths of the microstrip line | | | | | | | | | | | | |
|---|---|---|---|---|---|---|---|---|---|---|---|---|
| | z[mm] | | | | | | | | | | | |
| | 0.00 | 0.11 | 0.22 | 0.33 | 0.44 | 0.54 | 0.65 | 0.76 | 0.87 | 0.98 | 1.09 | 1.20 |
| | w[mm] | | | | | | | | | | | |
| | 1.47 | 1.47 | 1.47 | 1.47 | 1.47 | 1.47 | 1.47 | 1.47 | 1.47 | 1.47 | 1.47 | 1.47 |
| #6 | 6.54 | 6.65 | 6.76 | 6.87 | 6.98 | 7.09 | 7.20 | 7.31 | 7.42 | 7.52 | 7.63 | 7.74 |
| — | 1.40 | 1.41 | 1.41 | 1.41 | 1.41 | 1.41 | 1.41 | 1.41 | 1.41 | 1.41 | 1.41 | 1.40 |
| #7 | 7.85 | 7.96 | 8.07 | 8.18 | 8.29 | 8.40 | 8.51 | 8.62 | 8.72 | 8.83 | 8.94 | 9.05 |
| — | 1.40 | 1.40 | 1.40 | 1.40 | 1.40 | 1.40 | 1.40 | 1.40 | 1.40 | 1.40 | 1.40 | 1.40 |
| #8 | 9.16 | 9.27 | 9.38 | 9.49 | 9.60 | 9.71 | 9.82 | 9.93 | 10.03 | 10.14 | 10.25 | 10.36 |
| — | 1.40 | 1.40 | 1.40 | 1.41 | 1.41 | 1.41 | 1.41 | 1.42 | 1.42 | 1.43 | 1.43 | 1.43 |
| #9 | 10.47 | 10.58 | 10.69 | 10.80 | 10.91 | 11.02 | 11.12 | 11.23 | 11.34 | 11.45 | 11.56 | 11.67 |
| — | 1.44 | 1.44 | 1.45 | 1.46 | 1.46 | 1.47 | 1.47 | 1.48 | 1.48 | 1.49 | 1.49 | 1.50 |
| #10 | 11.78 | 11.89 | 11.99 | 12.10 | 12.21 | 12.32 | 12.43 | 12.54 | 12.65 | 12.75 | 12.86 | 12.97 |
| — | 1.50 | 1.50 | 1.51 | 1.51 | 1.51 | 1.52 | 1.52 | 1.52 | 1.52 | 1.52 | 1.52 | 1.52 |
| #11 | 13.08 | 13.19 | 13.30 | 13.41 | 13.52 | 13.62 | 13.73 | 13.84 | 13.95 | 14.06 | 14.17 | 14.28 |
| — | 1.52 | 1.52 | 1.51 | 1.51 | 1.51 | 1.51 | 1.51 | 1.50 | 1.50 | 1.50 | 1.50 | 1.50 |
| #12 | 14.39 | 14.49 | 14.60 | 14.71 | 14.82 | 14.93 | 15.04 | 15.15 | 15.26 | 15.36 | 15.47 | 15.58 |
| — | 1.49 | 1.49 | 1.49 | 1.49 | 1.49 | 1.49 | 1.49 | 1.49 | 1.49 | 1.49 | 1.49 | 1.49 |
| #13 | 15.69 | 15.80 | 15.91 | 16.02 | 16.13 | 16.23 | 16.34 | 16.45 | 16.56 | 16.67 | 16.78 | 16.89 |
| — | 1.49 | 1.50 | 1.50 | 1.50 | 1.50 | 1.50 | 1.50 | 1.50 | 1.50 | 1.50 | 1.50 | 1.50 |
| #14 | 17.00 | 17.10 | 17.21 | 17.32 | 17.43 | 17.54 | 17.65 | 17.76 | 17.87 | 17.97 | 18.08 | 18.19 |
| — | 1.50 | 1.50 | 1.50 | 1.50 | 1.49 | 1.49 | 1.49 | 1.48 | 1.48 | 1.47 | 1.47 | 1.46 |
| #15 | 18.30 | 18.41 | 18.52 | 18.53 | 18.74 | 18.85 | 18.96 | 19.06 | 19.17 | 19.28 | 19.39 | 19.50 |
| — | 1.45 | 1.45 | 1.44 | 1.43 | 1.42 | 1.42 | 1.41 | 1.40 | 1.40 | 1.39 | 1.38 | 1.38 |
| #16 | 19.61 | 19.72 | 19.83 | 19.94 | 20.05 | 20.16 | 20.27 | 20.38 | 20.49 | 20.60 | 20.70 | 20.81 |
| — | 1.37 | 1.37 | 1.36 | 1.36 | 1.35 | 1.35 | 1.35 | 1.35 | 1.35 | 1.35 | 1.35 | 1.35 |
| #17 | 20.92 | 21.03 | 21.14 | 21.25 | 21.36 | 21.47 | 21.58 | 21.69 | 21.80 | 21.91 | 22.02 | 22.13 |
| — | 1.35 | 1.35 | 1.35 | 1.35 | 1.35 | 1.36 | 1.36 | 1.36 | 1.36 | 1.37 | 1.37 | 1.37 |
| #18 | 22.23 | 22.34 | 22.45 | 22.56 | 22.67 | 22.78 | 22.89 | 23.00 | 23.11 | 23.22 | 23.33 | 23.44 |
| — | 1.37 | 1.37 | 1.38 | 1.38 | 1.38 | 1.38 | 1.38 | 1.38 | 1.38 | 1.38 | 1.38 | 1.38 |
| #19 | 23.55 | 23.66 | 23.76 | 23.87 | 23.98 | 24.09 | 24.20 | 24.31 | 24.42 | 24.53 | 24.64 | 24.75 |
| — | 1.37 | 1.37 | 1.37 | 1.37 | 1.37 | 1.37 | 1.36 | 1.36 | 1.36 | 1.36 | 1.36 | 1.36 |
| #20 | 24.86 | 24.97 | 25.08 | 25.19 | 25.29 | 25.40 | 25.51 | 25.62 | 25.73 | 25.84 | 25.95 | 26.06 |
| — | 1.36 | 1.36 | 1.36 | 1.37 | 1.37 | 1.37 | 1.38 | 1.38 | 1.39 | 1.39 | 1.40 | 1.41 |
| #21 | 26.17 | 26.28 | 26.39 | 26.49 | 26.60 | 26.71 | 26.82 | 26.93 | 27.04 | 27.15 | 27.26 | 27.37 |
| — | 1.42 | 1.43 | 1.44 | 1.45 | 1.46 | 1.47 | 1.48 | 1.49 | 1.50 | 1.51 | 1.52 | 1.53 |
| #22 | 27.47 | 27.58 | 27.69 | 27.80 | 27.91 | 28.02 | 28.12 | 28.23 | 28.34 | 28.45 | 28.56 | 28.67 |
| — | 1.53 | 1.54 | 1.55 | 1.56 | 1.56 | 1.57 | 1.57 | 1.58 | 1.58 | 1.58 | 1.58 | 1.58 |
| #23 | 28.78 | 28.88 | 28.99 | 29.10 | 29.21 | 29.32 | 29.43 | 29.53 | 29.64 | 29.75 | 29.86 | 29.97 |
| — | 1.58 | 1.58 | 1.58 | 1.58 | 1.57 | 1.57 | 1.57 | 1.56 | 1.56 | 1.56 | 1.55 | 1.55 |
| #24 | 30.08 | 30.19 | 30.29 | 30.40 | 30.51 | 30.62 | 30.73 | 30.84 | 30.95 | 31.05 | 31.16 | 31.27 |
| — | 1.55 | 1.54 | 1.54 | 1.54 | 1.54 | 1.53 | 1.53 | 1.53 | 1.53 | 1.54 | 1.54 | 1.54 |
| #25 | 31.38 | 31.49 | 31.60 | 31.71 | 31.81 | 31.92 | 32.03 | 32.14 | 32.25 | 32.36 | 32.47 | 32.57 |
| — | 1.54 | 1.54 | 1.55 | 1.55 | 1.55 | 1.56 | 1.56 | 1.56 | 1.56 | 1.57 | 1.57 | 1.57 |
| #26 | 32.68 | 32.79 | 32.90 | 33.01 | 33.12 | 33.23 | 33.33 | 33.44 | 33.55 | 33.66 | 33.77 | 33.88 |
| — | 1.57 | 1.57 | 1.56 | 1.56 | 1.56 | 1.55 | 1.55 | 1.54 | 1.53 | 1.52 | 1.51 | 1.50 |
| #27 | 33.99 | 34.10 | 34.20 | 34.31 | 34.42 | 34.53 | 34.64 | 34.75 | 34.86 | 34.97 | 35.08 | 35.19 |
| — | 1.49 | 1.47 | 1.46 | 1.45 | 1.43 | 1.42 | 1.40 | 1.39 | 1.38 | 1.36 | 1.35 | 1.33 |
| #28 | 35.30 | 35.41 | 35.52 | 35.62 | 35.73 | 35.84 | 35.95 | 36.06 | 36.17 | 36.28 | 36.39 | 36.50 |
| — | 1.32 | 1.31 | 1.30 | 1.29 | 1.28 | 1.27 | 1.27 | 1.26 | 1.26 | 1.25 | 1.25 | 1.25 |
| #29 | 36.61 | 36.72 | 36.83 | 36.94 | 37.05 | 37.16 | 37.27 | 37.38 | 37.49 | 37.60 | 37.71 | 37.82 |
| — | 1.25 | 1.25 | 1.25 | 1.25 | 1.26 | 1.26 | 1.26 | 1.27 | 1.27 | 1.28 | 1.28 | 1.29 |
| #30 | 37.93 | 38.04 | 38.15 | 38.26 | 38.37 | 38.48 | 38.59 | 38.70 | 38.81 | 38.92 | 39.02 | 39.13 |
| — | 1.29 | 1.30 | 1.30 | 1.30 | 1.31 | 1.31 | 1.31 | 1.31 | 1.31 | 1.31 | 1.31 | 1.30 |

TABLE 8

| Widths of the microstrip line | | | | | | | | | | | | |
|---|---|---|---|---|---|---|---|---|---|---|---|---|
| #31 | 39.24 | 39.35 | 39.46 | 39.57 | 39.68 | 39.79 | 39.90 | 40.01 | 40.12 | 40.23 | 40.34 | 40.45 |
| — | 1.30 | 1.30 | 1.29 | 1.29 | 1.28 | 1.28 | 1.28 | 1.27 | 1.27 | 1.26 | 1.26 | 1.26 |
| #32 | 40.56 | 40.67 | 40.78 | 40.89 | 41.00 | 41.11 | 41.22 | 41.33 | 41.44 | 41.55 | 41.66 | 41.77 |
| — | 1.26 | 1.26 | 1.26 | 1.26 | 1.27 | 1.27 | 1.28 | 1.29 | 1.30 | 1.31 | 1.33 | 1.34 |
| #33 | 41.88 | 41.98 | 42.09 | 42.20 | 42.31 | 42.42 | 42.53 | 42.64 | 42.75 | 42.85 | 42.96 | 43.07 |
| — | 1.36 | 1.38 | 1.40 | 1.42 | 1.45 | 1.47 | 1.50 | 1.52 | 1.55 | 1.58 | 1.61 | 1.63 |
| #34 | 43.18 | 43.29 | 43.40 | 43.50 | 43.61 | 43.72 | 43.83 | 43.93 | 44.04 | 44.15 | 44.26 | 44.36 |
| — | 1.66 | 1.69 | 1.71 | 1.73 | 1.76 | 1.78 | 1.79 | 1.81 | 1.82 | 1.83 | 1.84 | 1.85 |
| #35 | 44.47 | 44.58 | 44.69 | 44.79 | 44.90 | 45.01 | 45.12 | 45.23 | 45.33 | 45.44 | 45.55 | 45.66 |
| — | 1.85 | 1.85 | 1.85 | 1.85 | 1.84 | 1.83 | 1.83 | 1.82 | 1.80 | 1.79 | 1.78 | 1.77 |
| #36 | 45.76 | 45.87 | 45.98 | 46.09 | 46.20 | 46.30 | 46.41 | 46.52 | 46.63 | 46.74 | 46.84 | 46.95 |
| — | 1.76 | 1.75 | 1.74 | 1.73 | 1.72 | 1.72 | 1.71 | 1.71 | 1.71 | 1.71 | 1.72 | 1.72 |

TABLE 8-continued

| Widths of the microstrip line | | | | | | | | | | | | |
|---|---|---|---|---|---|---|---|---|---|---|---|---|
| #37 | 47.06 | 47.17 | 47.27 | 47.38 | 47.49 | 47.60 | 47.71 | 47.81 | 47.92 | 48.03 | 48.14 | 48.24 |
| — | 1.73 | 1.74 | 1.75 | 1.76 | 1.77 | 1.79 | 1.80 | 1.81 | 1.83 | 1.84 | 1.85 | 1.86 |
| #38 | 48.35 | 48.46 | 48.57 | 48.67 | 48.78 | 48.89 | 49.00 | 49.10 | 49.21 | 49.32 | 49.43 | 49.54 |
| — | 1.87 | 1.87 | 1.87 | 1.86 | 1.85 | 1.84 | 1.82 | 1.80 | 1.77 | 1.73 | 1.69 | 1.64 |
| #39 | 49.64 | 49.75 | 49.86 | 49.97 | 50.08 | 50.19 | 50.30 | 50.41 | 50.52 | 50.63 | 50.74 | 50.85 |
| — | 1.59 | 1.54 | 1.48 | 1.42 | 1.35 | 1.29 | 1.22 | 1.15 | 1.09 | 1.02 | 0.96 | 0.89 |
| #40 | 50.97 | 51.08 | 51.19 | 51.30 | 51.42 | 51.53 | 51.65 | 51.76 | 51.88 | 51.99 | 52.11 | 52.22 |
| — | 0.84 | 0.78 | 0.72 | 0.67 | 0.63 | 0.59 | 0.55 | 0.52 | 0.49 | 0.46 | 0.44 | 0.43 |
| #41 | 52.34 | 52.45 | 52.57 | 52.68 | 52.80 | 52.92 | 53.03 | 53.15 | 53.26 | 53.38 | 53.49 | 53.60 |
| — | 0.41 | 0.41 | 0.40 | 0.40 | 0.41 | 0.42 | 0.44 | 0.46 | 0.48 | 0.52 | 0.56 | 0.60 |
| #42 | 53.72 | 53.83 | 53.94 | 54.05 | 54.16 | 54.28 | 54.39 | 54.49 | 54.60 | 54.71 | 54.82 | 54.93 |
| — | 0.66 | 0.72 | 0.79 | 0.88 | 0.97 | 1.07 | 1.18 | 1.31 | 1.45 | 1.60 | 1.76 | 1.94 |
| #43 | 55.03 | 55.14 | 55.25 | 55.35 | 55.46 | 55.56 | 55.66 | 55.77 | 55.87 | 55.97 | 56.08 | 56.18 |
| — | 2.12 | 2.32 | 2.53 | 2.75 | 2.97 | 3.20 | 3.43 | 3.66 | 3.88 | 4.09 | 4.29 | 4.47 |
| #44 | 56.28 | 56.38 | 56.49 | 56.59 | 56.69 | 56.79 | 56.89 | 57.00 | 57.10 | 57.20 | 57.30 | 57.41 |
| — | 4.62 | 4.75 | 4.85 | 4.91 | 4.94 | 4.93 | 4.88 | 4.79 | 4.68 | 4.53 | 4.36 | 4.16 |
| #45 | 57.51 | 57.61 | 57.72 | 57.82 | 57.93 | 58.03 | 58.14 | 58.24 | 58.35 | 58.46 | 58.57 | 58.68 |
| — | 3.94 | 3.71 | 3.48 | 3.23 | 2.99 | 2.75 | 2.52 | 2.29 | 2.08 | 1.88 | 1.69 | 1.51 |
| #46 | 58.78 | 58.89 | 59.01 | 59.12 | 59.23 | 59.34 | 59.46 | 59.57 | 59.68 | 59.80 | 59.92 | 60.03 |
| — | 1.35 | 1.20 | 1.06 | 0.94 | 0.83 | 0.73 | 0.64 | 0.56 | 0.49 | 0.44 | 0.39 | 0.34 |
| #47 | 60.15 | 60.27 | 60.38 | 60.50 | 60.62 | 60.74 | 60.86 | 60.97 | 61.09 | 61.21 | 61.33 | 61.45 |
| — | 0.31 | 0.28 | 0.26 | 0.24 | 0.23 | 0.22 | 0.22 | 0.22 | 0.22 | 0.23 | 0.24 | 0.26 |
| #48 | 61.56 | 61.68 | 61.80 | 61.91 | 62.03 | 62.14 | 62.26 | 62.37 | 62.48 | 62.60 | 62.71 | 62.82 |
| — | 0.28 | 0.30 | 0.34 | 0.38 | 0.42 | 0.47 | 0.53 | 0.60 | 0.68 | 0.76 | 0.86 | 0.96 |
| #49 | 62.93 | 63.04 | 63.15 | 63.26 | 63.37 | 63.48 | 63.58 | 63.69 | 63.80 | 63.90 | 64.01 | 64.11 |
| — | 1.07 | 1.19 | 1.32 | 1.45 | 1.59 | 1.74 | 1.89 | 2.04 | 2.19 | 2.35 | 2.49 | 2.64 |
| #50 | 64.22 | 64.32 | 64.43 | 64.53 | 64.64 | 64.74 | 64.85 | 64.95 | 65.05 | 65.16 | 65.26 | 65.37 |
| — | 2.77 | 2.90 | 3.01 | 3.11 | 3.19 | 3.26 | 3.31 | 3.34 | 3.35 | 3.34 | 3.32 | 3.28 |
| #51 | 65.47 | 65.58 | 65.68 | 65.78 | 65.89 | 65.99 | 66.10 | 66.21 | 66.31 | 66.42 | 66.52 | 66.63 |
| — | 3.22 | 3.16 | 3.08 | 2.99 | 2.90 | 2.80 | 2.70 | 2.59 | 2.49 | 2.39 | 2.29 | 2.20 |
| #52 | 66.74 | 66.84 | 66.95 | 67.06 | 67.17 | 67.27 | 67.38 | 67.49 | 67.60 | 67.71 | 67.82 | 67.93 |
| — | 2.11 | 2.02 | 1.94 | 1.87 | 1.80 | 1.73 | 1.68 | 1.63 | 1.58 | 1.54 | 1.51 | 1.48 |
| #53 | 68.03 | 68.14 | 68.25 | 68.36 | 68.47 | 68.58 | 68.69 | 68.80 | 68.91 | 69.02 | 69.13 | 69.23 |
| — | 1.46 | 1.44 | 1.42 | 1.41 | 1.40 | 1.40 | 1.40 | 1.40 | 1.40 | 1.40 | 1.40 | 1.41 |
| #54 | 69.34 | 69.45 | 69.56 | 69.67 | 69.78 | 69.89 | 70.00 | 70.11 | 70.22 | 70.33 | 70.43 | 70.54 |
| — | 1.41 | 1.41 | 1.42 | 1.42 | 1.42 | 1.41 | 1.41 | 1.40 | 1.39 | 1.37 | 1.35 | 1.33 |
| #55 | 70.65 | 70.76 | 70.87 | 70.98 | 71.09 | 71.20 | 71.31 | 71.42 | 71.53 | 71.65 | 71.76 | 71.87 |
| — | 1.31 | 1.29 | 1.26 | 1.23 | 1.20 | 1.17 | 1.14 | 1.11 | 1.07 | 1.04 | 1.01 | 0.98 |
| #56 | 71.98 | 72.09 | 72.20 | 72.31 | 72.43 | 72.54 | 72.65 | 72.76 | 72.87 | 72.99 | 73.10 | 73.21 |
| — | 0.95 | 0.93 | 0.90 | 0.88 | 0.86 | 0.84 | 0.83 | 0.82 | 0.81 | 0.81 | 0.81 | 0.81 |
| #57 | 73.32 | 73.44 | 73.55 | 73.66 | 73.77 | 73.88 | 73.99 | 74.11 | 74.22 | 74.33 | 74.44 | 74.55 |
| — | 0.81 | 0.82 | 0.83 | 0.85 | 0.86 | 0.89 | 0.91 | 0.94 | 0.97 | 1.00 | 1.04 | 1.08 |
| #58 | 74.66 | 74.77 | 74.88 | 74.99 | 75.10 | 75.21 | 75.32 | 75.43 | 75.54 | 75.64 | 75.75 | 75.86 |
| — | 1.12 | 1.16 | 1.21 | 1.25 | 1.30 | 1.35 | 1.39 | 1.44 | 1.48 | 1.53 | 1.57 | 1.61 |
| #59 | 75.97 | 76.08 | 76.19 | 76.29 | 76.40 | 76.51 | 76.62 | 76.72 | 76.83 | 76.94 | 77.05 | 77.16 |
| — | 1.64 | 1.68 | 1.71 | 1.73 | 1.76 | 1.77 | 1.79 | 1.80 | 1.81 | 1.81 | 1.81 | 1.81 |
| #60 | 77.26 | 77.37 | 77.48 | 77.59 | 77.69 | 77.80 | 77.91 | 78.02 | 78.13 | 78.23 | 78.34 | 78.45 |
| — | 1.80 | 1.79 | 1.79 | 1.77 | 1.76 | 1.75 | 1.74 | 1.73 | 1.72 | 1.70 | 1.70 | 1.69 |

TABLE 9

| Widths of the microstrip line | | | | | | | | | | | | |
|---|---|---|---|---|---|---|---|---|---|---|---|---|
| #61 | 78.56 | 78.67 | 78.77 | 78.88 | 78.99 | 79.10 | 79.21 | 79.31 | 79.42 | 79.53 | 79.64 | 79.75 |
| — | 1.68 | 1.68 | 1.67 | 1.67 | 1.68 | 1.68 | 1.69 | 1.69 | 1.70 | 1.72 | 1.73 | 1.74 |
| #62 | 79.85 | 79.96 | 80.07 | 80.18 | 80.28 | 80.39 | 80.50 | 80.61 | 80.71 | 80.82 | 80.93 | 81.04 |
| — | 1.76 | 1.78 | 1.79 | 1.81 | 1.83 | 1.84 | 1.86 | 1.87 | 1.88 | 1.89 | 1.90 | 1.90 |
| #63 | 81.14 | 81.25 | 81.36 | 81.47 | 81.57 | 81.68 | 81.79 | 81.90 | 82.00 | 82.11 | 82.22 | 82.33 |
| — | 1.90 | 1.90 | 1.89 | 1.89 | 1.87 | 1.86 | 1.84 | 1.81 | 1.79 | 1.76 | 1.73 | 1.69 |
| #64 | 82.44 | 82.54 | 82.65 | 82.76 | 82.87 | 82.98 | 83.09 | 83.20 | 83.31 | 83.42 | 83.53 | 83.64 |
| — | 1.66 | 1.62 | 1.59 | 1.55 | 1.51 | 1.47 | 1.43 | 1.40 | 1.36 | 1.33 | 1.30 | 1.26 |
| #65 | 83.75 | 83.85 | 83.97 | 84.08 | 84.19 | 84.30 | 84.41 | 84.52 | 84.63 | 84.74 | 84.85 | 84.96 |
| — | 1.24 | 1.21 | 1.19 | 1.17 | 1.15 | 1.13 | 1.12 | 1.11 | 1.10 | 1.09 | 1.09 | 1.09 |
| #66 | 85.07 | 85.18 | 85.29 | 85.40 | 85.51 | 85.62 | 85.73 | 85.84 | 85.95 | 86.06 | 86.17 | 86.28 |
| — | 1.09 | 1.09 | 1.09 | 1.10 | 1.11 | 1.12 | 1.13 | 1.14 | 1.15 | 1.16 | 1.18 | 1.19 |
| #67 | 86.39 | 86.50 | 86.61 | 86.72 | 86.83 | 86.94 | 87.05 | 87.16 | 87.27 | 87.38 | 87.49 | 87.60 |
| — | 1.20 | 1.22 | 1.23 | 1.24 | 1.25 | 1.26 | 1.27 | 1.28 | 1.28 | 1.29 | 1.29 | 1.29 |
| #68 | 87.71 | 87.82 | 87.93 | 88.04 | 88.15 | 88.26 | 88.37 | 88.48 | 88.59 | 88.70 | 88.81 | 88.92 |
| — | 1.29 | 1.29 | 1.29 | 1.29 | 1.28 | 1.28 | 1.27 | 1.27 | 1.26 | 1.26 | 1.26 | 1.25 |
| #69 | 89.03 | 89.14 | 89.25 | 89.36 | 89.47 | 89.58 | 89.69 | 89.80 | 89.90 | 90.01 | 90.12 | 90.23 |
| — | 1.25 | 1.25 | 1.25 | 1.25 | 1.25 | 1.25 | 1.26 | 1.27 | 1.28 | 1.29 | 1.30 | 1.31 |
| #70 | 90.34 | 90.45 | 90.56 | 90.67 | 90.78 | 90.89 | 91.00 | 91.11 | 91.22 | 91.32 | 91.43 | 91.54 |
| — | 1.33 | 1.35 | 1.37 | 1.39 | 1.42 | 1.44 | 1.47 | 1.49 | 1.52 | 1.55 | 1.58 | 1.61 |

TABLE 9-continued

| Widths of the microstrip line | | | | | | | | | | | | |
|---|---|---|---|---|---|---|---|---|---|---|---|---|
| #71 | 91.65 | 91.76 | 91.86 | 91.97 | 92.08 | 92.19 | 92.30 | 92.40 | 92.51 | 92.62 | 92.73 | 92.83 |
| — | 1.64 | 1.66 | 1.69 | 1.71 | 1.74 | 1.76 | 1.78 | 1.80 | 1.81 | 1.82 | 1.83 | 1.84 |
| #72 | 92.94 | 93.05 | 93.16 | 93.26 | 93.37 | 93.48 | 93.59 | 93.70 | 93.80 | 93.91 | 94.02 | 94.13 |
| — | 1.84 | 1.84 | 1.84 | 1.83 | 1.83 | 1.82 | 1.80 | 1.79 | 1.77 | 1.76 | 1.74 | 1.72 |
| #73 | 94.23 | 94.34 | 94.45 | 94.56 | 94.67 | 94.78 | 94.88 | 94.99 | 95.10 | 95.21 | 95.32 | 95.43 |
| — | 1.70 | 1.68 | 1.66 | 1.64 | 1.62 | 1.61 | 1.59 | 1.57 | 1.56 | 1.55 | 1.53 | 1.52 |
| #74 | 95.54 | 95.64 | 95.75 | 95.86 | 95.97 | 96.08 | 96.19 | 96.30 | 96.41 | 96.51 | 96.62 | 96.73 |
| — | 1.51 | 1.51 | 1.50 | 1.50 | 1.49 | 1.49 | 1.49 | 1.49 | 1.49 | 1.49 | 1.49 | 1.50 |
| #75 | 96.84 | 96.95 | 97.06 | 97.17 | 97.28 | 97.38 | 97.49 | 97.60 | 97.71 | 97.82 | 97.93 | 98.04 |
| — | 1.50 | 1.50 | 1.50 | 1.51 | 1.51 | 1.51 | 1.51 | 1.50 | 1.50 | 1.50 | 1.49 | 1.49 |
| #76 | 98.15 | 98.25 | 98.36 | 98.47 | 98.58 | 98.69 | 98.80 | 98.91 | 99.02 | 99.13 | 99.24 | 99.35 |
| — | 1.48 | 1.47 | 1.46 | 1.44 | 1.43 | 1.41 | 1.40 | 1.38 | 1.37 | 1.35 | 1.33 | 1.31 |
| #77 | 99.46 | 99.57 | 99.68 | 99.79 | 99.90 | 100.01 | 100.12 | 100.23 | 100.34 | 100.45 | 100.56 | 100.67 |
| — | 1.29 | 1.28 | 1.26 | 1.24 | 1.23 | 1.21 | 1.20 | 1.19 | 1.17 | 1.16 | 1.16 | 1.15 |
| #78 | 100.78 | 100.89 | 101.00 | 101.11 | 101.22 | 101.33 | 101.44 | 101.55 | 101.66 | 101.77 | 101.88 | 101.99 |
| — | 1.15 | 1.14 | 1.14 | 1.14 | 1.15 | 1.15 | 1.16 | 1.16 | 1.17 | 1.18 | 1.19 | 1.21 |
| #79 | 102.10 | 102.21 | 102.32 | 102.43 | 102.54 | 102.65 | 102.76 | 102.87 | 102.98 | 103.09 | 103.19 | 103.30 |
| — | 1.22 | 1.24 | 1.25 | 1.27 | 1.28 | 1.30 | 1.32 | 1.33 | 1.35 | 1.36 | 1.38 | 1.39 |
| #80 | 103.41 | 103.52 | 103.63 | 103.74 | 103.85 | 103.96 | 104.07 | 104.18 | 104.28 | 104.39 | 104.50 | 104.61 |
| — | 1.41 | 1.42 | 1.43 | 1.44 | 1.45 | 1.45 | 1.46 | 1.46 | 1.47 | 1.47 | 1.47 | 1.47 |
| #81 | 104.72 | 104.83 | 104.94 | 105.05 | 105.16 | 105.26 | 105.37 | 105.48 | 105.59 | 105.70 | 105.81 | 105.92 |
| — | 1.47 | 1.47 | 1.47 | 1.46 | 1.46 | 1.46 | 1.46 | 1.46 | 1.45 | 1.45 | 1.45 | 1.46 |
| #82 | 106.03 | 106.14 | 106.24 | 106.35 | 106.46 | 106.57 | 106.68 | 106.79 | 106.90 | 107.01 | 107.11 | 107.22 |
| — | 1.46 | 1.46 | 1.47 | 1.47 | 1.48 | 1.48 | 1.49 | 1.50 | 1.51 | 1.53 | 1.54 | 1.55 |
| #83 | 107.33 | 107.44 | 107.55 | 107.66 | 107.76 | 107.87 | 107.98 | 108.09 | 108.20 | 108.31 | 108.41 | 108.52 |
| — | 1.57 | 1.58 | 1.60 | 1.61 | 1.63 | 1.64 | 1.65 | 1.67 | 1.68 | 1.69 | 1.70 | 1.71 |
| #84 | 108.63 | 108.74 | 108.85 | 108.95 | 109.06 | | | | | | | |
| — | 1.71 | 1.72 | 1.72 | 1.72 | 1.72 | | | | | | | |

Figure 15:
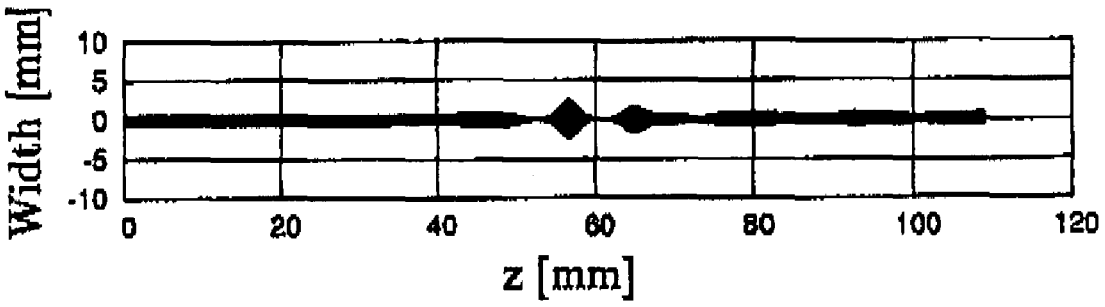
FIG. 15 is a graph showing the surface form of the microstrip line in the reflection-type bandpass filter of the third embodiment.

FIG. 15 shows the shape of the microstrip line 5 in the reflection-type bandpass filter 1 of the third embodiment. A non-reflecting terminator, or an R=30Ω resistance, is provided at the terminating side (the face at z=109.06 mm) of the reflection-type bandpass filter 1. The thickness of the metal films used in the conducting layer 3 and of the conductor constituting the microstrip line 5 should be adequately greater than the skin depth $\delta s=\sqrt{\{2/(\omega\mu 0\sigma)\}}$ at f=1 GHz. For example if copper is used, the thickness of the conducting layer 3 and of the conductor of the microstrip line 5 should be taken as 2.1 μm or greater. This reflection-type bandpass filter is used in a system where the characteristic impedance is 30Ω.

Figure 16:
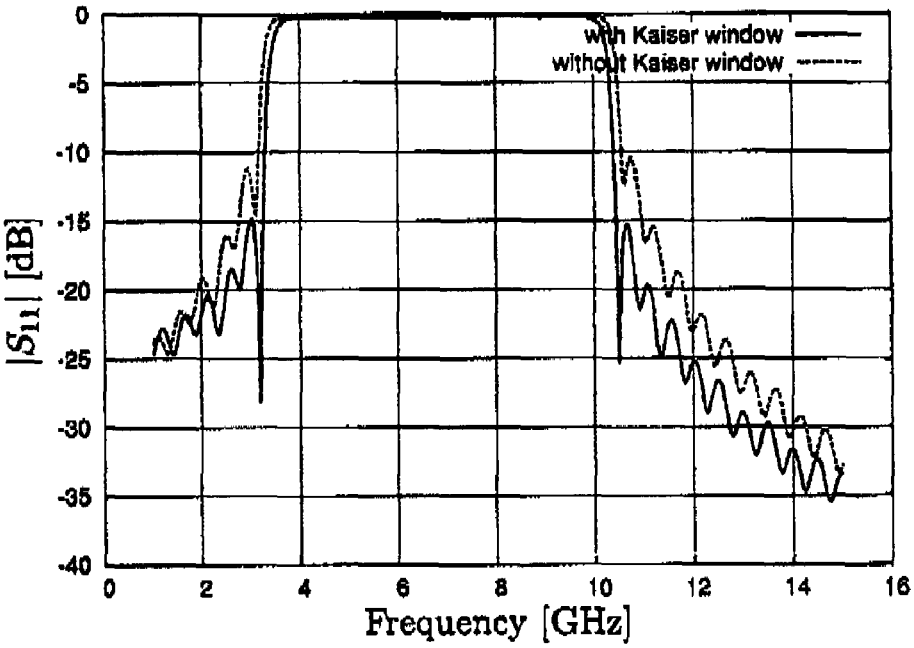
FIG. 16 is a graph showing the amplitude characteristics of the reflective wave in the reflection-type bandpass filter of the third embodiment.
Figure 17:
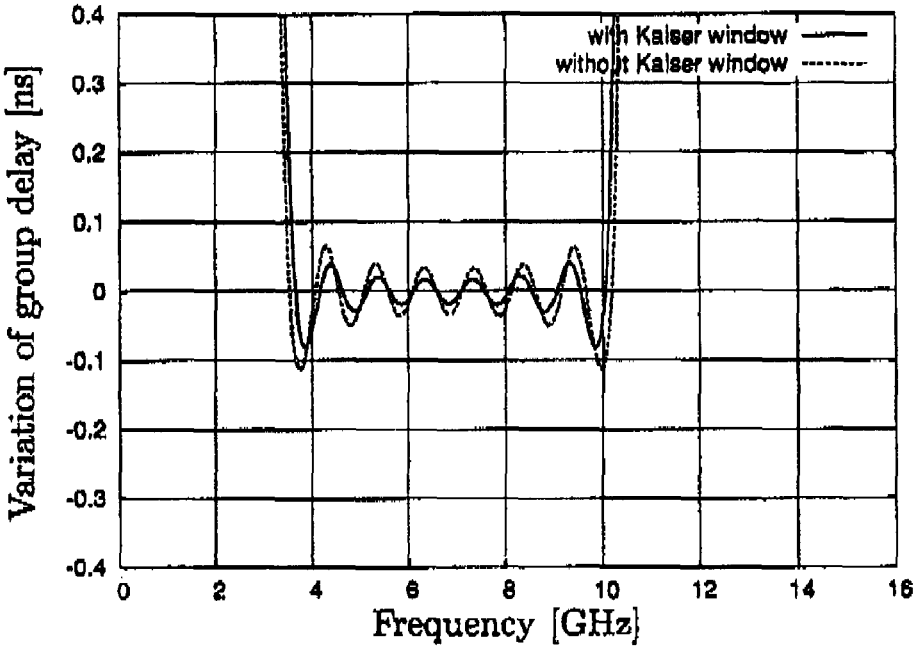
FIG. 17 is a graph showing the group delay frequency characteristics of the reflective wave in the reflection-type bandpass filter of the third embodiment.

FIG. 16 and FIG. 17 express the amplitude characteristics and group delay frequency characteristics respectively of the reflective wave (S11) in the bandpass filter of the third embodiment. For comparison, the characteristics when the Kaiser window is not used, are also shown. As shown in the figures, in the region of frequency f for which 3.5 GHz≦f≦10.1 GHz, the reflectivity is −1 dB or greater and the variation of the group delay is within ±0.1 ns. In the region f<3.1 GHz and f>10.6 GHz, the reflectivity is −15 dB or lower. Compared to the case when the Kaiser window is not used, the region of transition frequency becomes wider, but the stop band rejection increases to 13 dB, and the variation of group delay within the pass band decreases.

Embodiment 4

A Kaiser window was used for which the reflectivity is 1 at the frequency f in the region 3.6 GHz≦f≦10.1 GHz, and is 0 elsewhere, and for which A=35. Taking one wavelength at frequency f=1 GHz of the signal transmitted within the microstrip line as the waveguide length, the system characteristic impedance was taken as 30Ω, and the design was carried out.

Figure 18:
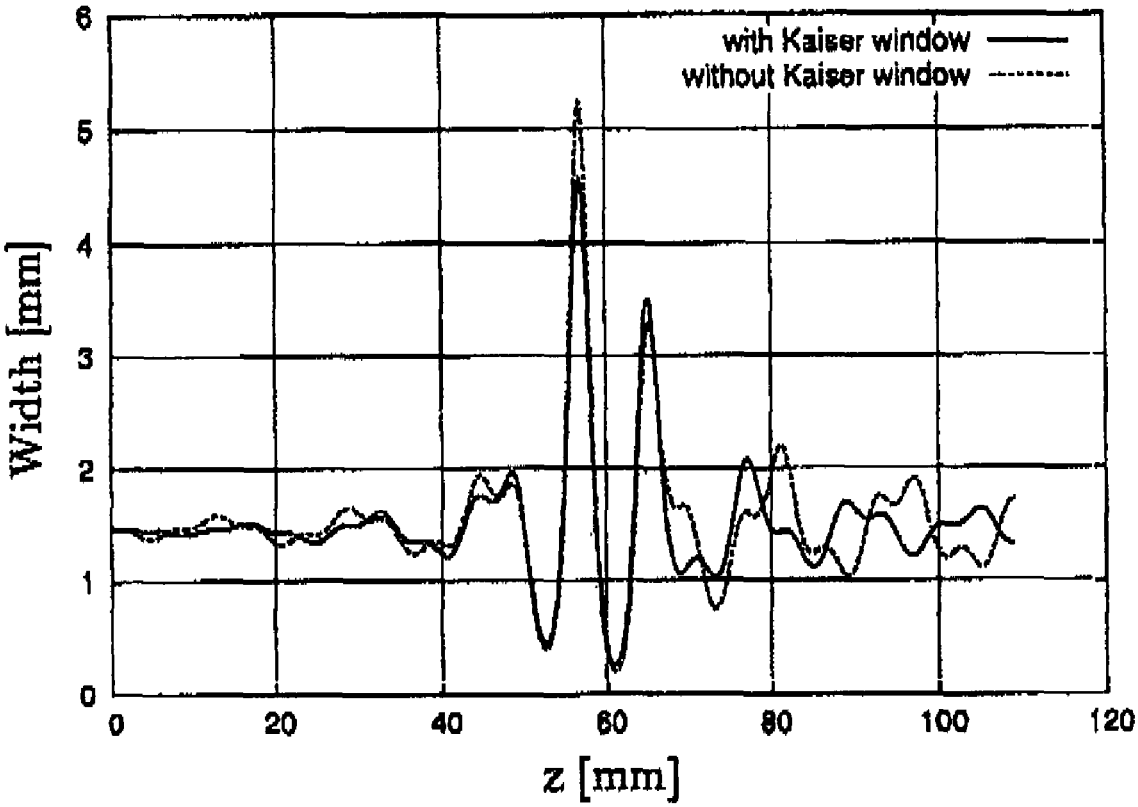
FIG. 18 is a graph showing the distribution in the width direction of the microstrip line in the reflection-type bandpass filter of the fourth embodiment.

FIG. 18 shows the distribution of the width w of the microstrip line 5 in the z-axis direction when a dielectric layer 4 of thickness h=0.635 mm, and relative dielectric constant $\in_r$=10.2 (for example, RT/Duroid (registered trademark) 6010LM) was used, together with the width when the Kaiser window was not used. Tables 10 through 12 list the widths w of the microstrip line 5 when the Kaiser window was used.

TABLE 10

| Widths of the microstrip line | | | | | | | | | | | | |
|---|---|---|---|---|---|---|---|---|---|---|---|---|
| | z[mm] | | | | | | | | | | | |
| | 0.00 | 0.11 | 0.22 | 0.33 | 0.44 | 0.54 | 0.65 | 0.76 | 0.87 | 0.98 | 1.09 | 1.20 |
| | w[mm] | | | | | | | | | | | |
| | 1.47 | 1.47 | 1.47 | 1.47 | 1.47 | 1.47 | 1.47 | 1.47 | 1.47 | 1.47 | 1.47 | 1.47 |
| #2 | 1.31 | 1.42 | 1.52 | 1.63 | 1.74 | 1.85 | 1.96 | 2.07 | 2.18 | 2.29 | 2.39 | 2.50 |
| — | 1.47 | 1.47 | 1.47 | 1.47 | 1.47 | 1.47 | 1.47 | 1.47 | 1.47 | 1.47 | 1.46 | 1.46 |
| #3 | 2.61 | 2.72 | 2.83 | 2.94 | 3.05 | 3.16 | 3.27 | 3.37 | 3.48 | 3.59 | 3.70 | 3.81 |
| — | 1.46 | 1.46 | 1.46 | 1.46 | 1.46 | 1.46 | 1.46 | 1.46 | 1.46 | 1.46 | 1.46 | 1.46 |
| #4 | 3.92 | 4.03 | 4.14 | 4.25 | 4.36 | 4.46 | 4.57 | 4.68 | 4.79 | 4.90 | 5.01 | 5.12 |
| — | 1.46 | 1.45 | 1.45 | 1.45 | 1.45 | 1.45 | 1.45 | 1.45 | 1.45 | 1.45 | 1.45 | 1.45 |

TABLE 10-continued

| Widths of the microstrip line | | | | | | | | | | | | |
|---|---|---|---|---|---|---|---|---|---|---|---|---|
| | z[mm] | | | | | | | | | | | |
| | 0.00 | 0.11 | 0.22 | 0.33 | 0.44 | 0.54 | 0.65 | 0.76 | 0.87 | 0.98 | 1.09 | 1.20 |
| | w[mm] | | | | | | | | | | | |
| | 1.47 | 1.47 | 1.47 | 1.47 | 1.47 | 1.47 | 1.47 | 1.47 | 1.47 | 1.47 | 1.47 | 1.47 |
| #5 | 5.23 | 5.34 | 5.44 | 5.55 | 5.66 | 5.77 | 5.88 | 5.99 | 6.10 | 6.21 | 6.32 | 6.42 |
| — | 1.45 | 1.45 | 1.45 | 1.45 | 1.45 | 1.45 | 1.45 | 1.45 | 1.45 | 1.45 | 1.45 | 1.44 |
| #6 | 6.53 | 6.64 | 6.75 | 6.86 | 6.97 | 7.08 | 7.19 | 7.30 | 7.41 | 7.51 | 7.62 | 7.73 |
| — | 1.44 | 1.44 | 1.44 | 1.44 | 1.44 | 1.43 | 1.43 | 1.43 | 1.43 | 1.43 | 1.42 | 1.42 |
| #7 | 7.84 | 7.95 | 8.06 | 8.17 | 8.28 | 8.39 | 8.50 | 8.61 | 8.71 | 8.82 | 8.93 | 9.04 |
| — | 1.42 | 1.42 | 1.42 | 1.42 | 1.41 | 1.41 | 1.41 | 1.41 | 1.41 | 1.41 | 1.41 | 1.41 |
| #8 | 9.15 | 9.26 | 9.37 | 9.48 | 9.59 | 9.70 | 9.81 | 9.91 | 10.02 | 10.13 | 10.24 | 10.35 |
| — | 1.41 | 1.41 | 1.42 | 1.42 | 1.42 | 1.42 | 1.42 | 1.42 | 1.43 | 1.43 | 1.43 | 1.43 |
| #9 | 10.46 | 10.57 | 10.68 | 10.79 | 10.90 | 11.00 | 11.11 | 11.22 | 11.33 | 11.44 | 11.55 | 11.66 |
| — | 1.43 | 1.44 | 1.44 | 1.44 | 1.44 | 1.44 | 1.45 | 1.45 | 1.45 | 1.45 | 1.45 | 1.45 |
| #10 | 11.77 | 11.88 | 11.99 | 12.09 | 12.20 | 12.31 | 12.42 | 12.53 | 12.64 | 12.75 | 12.86 | 12.97 |
| — | 1.45 | 1.45 | 1.45 | 1.46 | 1.46 | 1.46 | 1.46 | 1.46 | 1.46 | 1.46 | 1.46 | 1.46 |
| #11 | 13.07 | 13.18 | 13.29 | 13.40 | 13.51 | 13.62 | 13.73 | 13.84 | 13.95 | 14.05 | 14.16 | 14.27 |
| — | 1.46 | 1.46 | 1.46 | 1.46 | 1.46 | 1.46 | 1.46 | 1.46 | 1.46 | 1.46 | 1.47 | 1.47 |
| #12 | 14.38 | 14.49 | 14.60 | 14.71 | 14.82 | 14.93 | 15.03 | 15.14 | 15.25 | 15.36 | 15.47 | 15.58 |
| — | 1.47 | 1.47 | 1.47 | 1.48 | 1.48 | 1.48 | 1.49 | 1.49 | 1.49 | 1.50 | 1.50 | 1.50 |
| #13 | 15.69 | 15.80 | 15.90 | 16.01 | 16.12 | 16.23 | 16.34 | 16.45 | 16.56 | 16.66 | 16.77 | 16.88 |
| — | 1.51 | 1.51 | 1.51 | 1.51 | 1.52 | 1.52 | 1.52 | 1.52 | 1.52 | 1.52 | 1.52 | 1.52 |
| #14 | 16.99 | 17.10 | 17.21 | 17.32 | 17.43 | 17.53 | 17.64 | 17.75 | 17.86 | 17.97 | 18.08 | 18.19 |
| — | 1.52 | 1.52 | 1.52 | 1.51 | 1.51 | 1.51 | 1.51 | 1.50 | 1.50 | 1.50 | 1.49 | 1.49 |
| #15 | 18.30 | 18.40 | 18.51 | 18.62 | 18.73 | 18.84 | 18.95 | 19.06 | 19.17 | 19.28 | 19.38 | 19.49 |
| — | 1.48 | 1.48 | 1.48 | 1.47 | 1.47 | 1.46 | 1.46 | 1.46 | 1.45 | 1.45 | 1.45 | 1.45 |
| #16 | 19.60 | 19.71 | 19.82 | 19.93 | 20.04 | 20.15 | 20.26 | 20.37 | 20.47 | 20.58 | 20.69 | 20.80 |
| — | 1.44 | 1.44 | 1.44 | 1.44 | 1.44 | 1.44 | 1.44 | 1.44 | 1.43 | 1.43 | 1.43 | 1.43 |
| #17 | 20.91 | 21.02 | 21.13 | 21.24 | 21.35 | 21.46 | 21.56 | 21.67 | 21.78 | 21.89 | 22.00 | 22.11 |
| — | 1.43 | 1.43 | 1.43 | 1.43 | 1.43 | 1.43 | 1.43 | 1.43 | 1.43 | 1.43 | 1.43 | 1.43 |
| #18 | 22.22 | 22.33 | 22.44 | 22.55 | 22.65 | 22.76 | 22.87 | 22.98 | 23.09 | 23.20 | 23.31 | 23.42 |
| — | 1.42 | 1.42 | 1.42 | 1.41 | 1.41 | 1.41 | 1.40 | 1.40 | 1.39 | 1.39 | 1.39 | 1.38 |
| #19 | 23.53 | 23.64 | 23.75 | 23.86 | 23.97 | 24.07 | 24.18 | 24.29 | 24.40 | 24.51 | 24.62 | 24.73 |
| — | 1.38 | 1.37 | 1.37 | 1.36 | 1.36 | 1.36 | 1.36 | 1.35 | 1.35 | 1.35 | 1.35 | 1.35 |
| #20 | 24.84 | 24.95 | 25.06 | 25.17 | 25.28 | 25.39 | 25.50 | 25.61 | 25.71 | 25.82 | 25.93 | 26.04 |
| — | 1.35 | 1.35 | 1.35 | 1.36 | 1.36 | 1.36 | 1.37 | 1.37 | 1.38 | 1.38 | 1.39 | 1.40 |
| #21 | 26.15 | 26.26 | 26.37 | 26.48 | 26.59 | 26.70 | 26.81 | 26.91 | 27.02 | 27.13 | 27.24 | 27.35 |
| — | 1.40 | 1.41 | 1.42 | 1.42 | 1.43 | 1.44 | 1.44 | 1.45 | 1.46 | 1.46 | 1.47 | 1.47 |
| #22 | 27.46 | 27.57 | 27.68 | 27.78 | 27.89 | 28.00 | 28.11 | 28.22 | 28.33 | 28.44 | 28.55 | 28.65 |
| — | 1.48 | 1.48 | 1.49 | 1.49 | 1.49 | 1.50 | 1.50 | 1.50 | 1.50 | 1.50 | 1.50 | 1.50 |
| #23 | 28.76 | 28.87 | 28.98 | 29.09 | 29.20 | 29.31 | 29.42 | 29.52 | 29.63 | 29.74 | 29.85 | 29.96 |
| — | 1.50 | 1.50 | 1.50 | 1.50 | 1.50 | 1.50 | 1.50 | 1.50 | 1.50 | 1.50 | 1.50 | 1.51 |
| #24 | 30.07 | 30.18 | 30.29 | 30.39 | 30.50 | 30.61 | 30.72 | 30.83 | 30.94 | 31.05 | 31.15 | 31.26 |
| — | 1.51 | 1.51 | 1.51 | 1.52 | 1.52 | 1.53 | 1.53 | 1.54 | 1.54 | 1.55 | 1.55 | 1.56 |
| #25 | 31.37 | 31.48 | 31.59 | 31.70 | 31.81 | 31.91 | 32.02 | 32.13 | 32.24 | 32.35 | 32.46 | 32.56 |
| — | 1.57 | 1.57 | 1.58 | 1.59 | 1.59 | 1.60 | 1.60 | 1.61 | 1.61 | 1.61 | 1.62 | 1.62 |
| #26 | 32.67 | 32.78 | 32.89 | 33.00 | 33.11 | 33.21 | 33.32 | 33.43 | 33.54 | 33.65 | 33.76 | 33.86 |
| — | 1.62 | 1.61 | 1.61 | 1.61 | 1.60 | 1.60 | 1.59 | 1.58 | 1.58 | 1.57 | 1.56 | 1.55 |
| #27 | 33.97 | 34.08 | 34.19 | 34.30 | 34.41 | 34.52 | 34.63 | 34.73 | 34.84 | 34.95 | 35.06 | 35.17 |
| — | 1.53 | 1.52 | 1.51 | 1.50 | 1.48 | 1.47 | 1.46 | 1.45 | 1.43 | 1.42 | 1.41 | 1.40 |
| #28 | 35.28 | 35.39 | 35.50 | 35.61 | 35.72 | 35.83 | 35.94 | 36.05 | 36.15 | 36.26 | 36.37 | 36.48 |
| — | 1.39 | 1.38 | 1.38 | 1.37 | 1.36 | 1.36 | 1.35 | 1.35 | 1.35 | 1.34 | 1.34 | 1.34 |
| #29 | 36.59 | 36.70 | 36.81 | 36.92 | 37.03 | 37.14 | 37.25 | 37.36 | 37.47 | 37.58 | 37.69 | 37.80 |
| — | 1.34 | 1.34 | 1.34 | 1.34 | 1.34 | 1.35 | 1.35 | 1.35 | 1.35 | 1.35 | 1.35 | 1.35 |
| #30 | 37.90 | 38.01 | 38.12 | 38.23 | 38.34 | 38.45 | 38.56 | 38.67 | 38.78 | 38.89 | 39.00 | 39.11 |
| — | 1.35 | 1.35 | 1.35 | 1.34 | 1.34 | 1.34 | 1.33 | 1.33 | 1.32 | 1.31 | 1.31 | 1.30 |

TABLE 11

| Widths of the microstrip line | | | | | | | | | | | | |
|---|---|---|---|---|---|---|---|---|---|---|---|---|
| #31 | 39.22 | 39.33 | 39.44 | 39.55 | 39.66 | 39.77 | 39.88 | 39.99 | 40.10 | 40.21 | 40.32 | 40.43 |
| — | 1.29 | 1.28 | 1.28 | 1.27 | 1.26 | 1.25 | 1.25 | 1.24 | 1.23 | 1.23 | 1.23 | 1.22 |
| #32 | 40.54 | 40.65 | 40.76 | 40.87 | 40.98 | 41.09 | 41.20 | 41.31 | 41.41 | 41.52 | 41.63 | 41.74 |
| — | 1.22 | 1.22 | 1.22 | 1.23 | 1.23 | 1.24 | 1.25 | 1.26 | 1.27 | 1.28 | 1.30 | 1.31 |
| #33 | 41.85 | 41.96 | 42.07 | 42.18 | 42.29 | 42.40 | 42.51 | 42.62 | 42.73 | 42.83 | 42.94 | 43.05 |
| — | 1.33 | 1.35 | 1.37 | 1.39 | 1.41 | 1.44 | 1.46 | 1.48 | 1.51 | 1.53 | 1.56 | 1.58 |
| #34 | 43.16 | 43.27 | 43.38 | 43.48 | 43.59 | 43.70 | 43.81 | 43.92 | 44.02 | 44.13 | 44.24 | 44.35 |
| — | 1.61 | 1.63 | 1.65 | 1.67 | 1.69 | 1.70 | 1.72 | 1.73 | 1.74 | 1.75 | 1.75 | 1.76 |
| #35 | 44.46 | 44.56 | 44.67 | 44.78 | 44.89 | 44.99 | 45.10 | 45.21 | 45.32 | 45.43 | 45.53 | 45.64 |
| — | 1.76 | 1.76 | 1.76 | 1.76 | 1.75 | 1.75 | 1.74 | 1.74 | 1.73 | 1.73 | 1.72 | 1.71 |

TABLE 11-continued

| Widths of the microstrip line | | | | | | | | | | | | |
|---|---|---|---|---|---|---|---|---|---|---|---|---|
| #36 | 45.7.5 | 45.86 | 45.97 | 46.07 | 46.18 | 46.29 | 46.40 | 46.51 | 46.61 | 46.72 | 46.83 | 46.94 |
| — | 1.71 | 1.71 | 1.70 | 1.70 | 1.70 | 1.70 | 1.71 | 1.71 | 1.72 | 1.73 | 1.74 | 1.75 |
| #37 | 47.04 | 47.15 | 47.26 | 47.37 | 47.48 | 47.58 | 47.69 | 47.80 | 47.91 | 48.01 | 48.12 | 48.23 |
| — | 1.77 | 1.78 | 1.80 | 1.82 | 1.84 | 1.86 | 1.88 | 1.89 | 1.91 | 1.93 | 1.94 | 1.95 |
| #38 | 48.33 | 48.44 | 48.55 | 48.66 | 48.76 | 48.87 | 48.98 | 49.08 | 49.19 | 49.30 | 49.41 | 49.52 |
| — | 1.96 | 1.96 | 1.96 | 1.95 | 1.94 | 1.93 | 1.91 | 1.88 | 1.85 | 1.81 | 1.76 | 1.72 |
| #39 | 49.62 | 49.73 | 49.84 | 49.95 | 50.06 | 50.17 | 50.28 | 50.39 | 50.50 | 50.61 | 50.72 | 50.83 |
| — | 1.66 | 1.60 | 1.54 | 1.48 | 1.41 | 1.35 | 1.28 | 1.21 | 1.14 | 1.07 | 1.01 | 0.94 |
| #40 | 50.94 | 51.06 | 51.17 | 51.28 | 51.39 | 51.51 | 51.62 | 51.74 | 51.85 | 51.96 | 52.08 | 52.19 |
| — | 0.88 | 0.83 | 0.77 | 0.72 | 0.68 | 0.63 | 0.59 | 0.56 | 0.53 | 0.51 | 0.49 | 0.47 |
| #41 | 52.31 | 52.42 | 52.54 | 52.65 | 52.77 | 52.88 | 53.00 | 53.11 | 53.23 | 53.34 | 53.46 | 53.57 |
| — | 0.46 | 0.45 | 0.45 | 0.45 | 0.45 | 0.46 | 0.48 | 0.50 | 0.53 | 0.56 | 0.60 | 0.65 |
| #42 | 53.68 | 53.80 | 53.91 | 54.02 | 54.13 | 54.24 | 54.35 | 54.46 | 54.57 | 54.68 | 54.79 | 54.89 |
| — | 0.70 | 0.76 | 0.83 | 0.91 | 1.00 | 1.10 | 1.21 | 1.33 | 1.46 | 1.60 | 1.76 | 1.92 |
| #43 | 55.00 | 55.11 | 55.21 | 55.32 | 55.42 | 55.53 | 55.63 | 55.73 | 55.84 | 55.94 | 56.04 | 56.15 |
| — | 2.09 | 2.28 | 2.47 | 2.66 | 2.87 | 3.07 | 3.28 | 3.48 | 3.67 | 3.86 | 4.03 | 4.18 |
| #44 | 56.25 | 56.35 | 56.46 | 56.56 | 56.66 | 56.76 | 56.87 | 56.97 | 57.07 | 57.17 | 57.28 | 57.38 |
| — | 4.31 | 4.41 | 4.49 | 4.54 | 4.55 | 4.54 | 4.49 | 4.41 | 4.30 | 4.17 | 4.01 | 3.83 |
| #45 | 57.48 | 57.59 | 57.69 | 57.80 | 57.90 | 58.01 | 58.11 | 58.22 | 58.33 | 58.44 | 58.54 | 58.65 |
| — | 3.64 | 3.44 | 3.22 | 3.01 | 2.79 | 2.58 | 2.37 | 2.16 | 1.97 | 1.79 | 1.62 | 1.45 |
| #46 | 58.76 | 58.87 | 58.98 | 59.09 | 59.21 | 59.32 | 59.43 | 59.55 | 59.66 | 59.78 | 59.89 | 60.01 |
| — | 1.31 | 1.17 | 1.04 | 0.93 | 0.83 | 0.73 | 0.65 | 0.58 | 0.52 | 0.46 | 0.41 | 0.38 |
| #47 | 60.12 | 60.24 | 60.36 | 60.48 | 60.59 | 60.71 | 60.83 | 60.95 | 61.06 | 61.18 | 61.30 | 61.41 |
| — | 0.34 | 0.32 | 0.29 | 0.28 | 0.27 | 0.26 | 0.26 | 0.26 | 0.27 | 0.28 | 0.29 | 0.31 |
| #48 | 61.53 | 61.65 | 61.76 | 61.88 | 61.99 | 62.11 | 62.22 | 62.33 | 62.45 | 62.56 | 62.67 | 62.78 |
| — | 0.34 | 0.37 | 0.40 | 0.45 | 0.50 | 0.56 | 0.62 | 0.70 | 0.78 | 0.87 | 0.97 | 1.08 |
| #49 | 62.89 | 63.00 | 63.11 | 63.22 | 63.32 | 63.43 | 63.54 | 63.64 | 63.75 | 63.86 | 63.96 | 64.07 |
| — | 1.19 | 1.32 | 1.45 | 1.59 | 1.74 | 1.89 | 2.05 | 2.20 | 2.36 | 2.52 | 2.67 | 2.82 |
| #50 | 64.17 | 64.28 | 64.38 | 64.49 | 64.59 | 64.69 | 64.80 | 64.90 | 65.00 | 65.11 | 65.21 | 65.32 |
| — | 2.95 | 3.08 | 3.19 | 3.29 | 3.37 | 3.43 | 3.48 | 3.50 | 3.50 | 3.49 | 3.45 | 3.40 |
| #51 | 65.42 | 65.53 | 65.63 | 65.73 | 65.84 | 65.94 | 66.05 | 66.16 | 66.26 | 66.37 | 66.47 | 66.58 |
| — | 3.33 | 3.25 | 3.16 | 3.05 | 2.94 | 2.83 | 2.71 | 2.58 | 2.46 | 2.34 | 2.23 | 2.11 |
| #52 | 66.69 | 66.79 | 66.90 | 67.01 | 67.12 | 67.23 | 67.34 | 67.45 | 67.55 | 67.66 | 67.77 | 67.88 |
| — | 2.00 | 1.90 | 1.80 | 1.71 | 1.63 | 1.55 | 1.48 | 1.41 | 1.35 | 1.30 | 1.25 | 1.21 |
| #53 | 67.99 | 68.10 | 68.21 | 68.33 | 68.44 | 68.55 | 68.66 | 68.77 | 68.88 | 68.99 | 69.10 | 69.21 |
| — | 1.18 | 1.15 | 1.12 | 1.10 | 1.09 | 1.08 | 1.07 | 1.06 | 1.06 | 1.06 | 1.07 | 1.07 |
| #54 | 69.32 | 69.43 | 69.54 | 69.65 | 69.76 | 69.87 | 69.98 | 70.09 | 70.20 | 70.31 | 70.42 | 70.53 |
| — | 1.08 | 1.09 | 1.10 | 1.12 | 1.13 | 1.14 | 1.15 | 1.16 | 1.17 | 1.18 | 1.19 | 1.20 |
| #55 | 70.64 | 70.75 | 70.86 | 70.97 | 71.08 | 71.19 | 71.30 | 71.41 | 71.52 | 71.64 | 71.75 | 71.86 |
| — | 1.20 | 1.20 | 1.20 | 1.20 | 1.20 | 1.19 | 1.18 | 1.18 | 1.17 | 1.15 | 1.14 | 1.13 |
| #56 | 71.97 | 72.08 | 72.19 | 72.30 | 72.41 | 72.52 | 72.63 | 72.74 | 72.85 | 72.96 | 73.07 | 73.18 |
| — | 1.12 | 1.10 | 1.09 | 1.08 | 1.07 | 1.06 | 1.05 | 1.04 | 1.03 | 1.03 | 1.03 | 1.03 |
| #57 | 73.30 | 73.41 | 73.52 | 73.63 | 73.74 | 73.85 | 73.96 | 74.07 | 74.18 | 74.29 | 74.40 | 74.51 |
| — | 1.04 | 1.04 | 1.05 | 1.06 | 1.08 | 1.10 | 1.12 | 1.14 | 1.17 | 1.20 | 1.23 | 1.27 |
| #58 | 74.62 | 74.73 | 74.84 | 74.95 | 75.06 | 75.16 | 75.27 | 75.38 | 75.49 | 75.60 | 75.70 | 75.81 |
| — | 1.31 | 1.35 | 1.39 | 1.44 | 1.48 | 1.53 | 1.58 | 1.63 | 1.68 | 1.72 | 1.77 | 1.82 |
| #59 | 75.92 | 76.03 | 76.13 | 76.24 | 76.35 | 76.46 | 76.56 | 76.67 | 76.78 | 76.88 | 76.99 | 77.10 |
| — | 1.86 | 1.90 | 1.94 | 1.97 | 2.00 | 2.03 | 2.05 | 2.06 | 2.08 | 2.08 | 2.08 | 2.08 |
| #60 | 77.20 | 77.31 | 77.42 | 77.52 | 77.63 | 77.74 | 77.85 | 77.95 | 78.06 | 78.17 | 78.28 | 78.38 |
| — | 2.07 | 2.06 | 2.04 | 2.02 | 2.00 | 1.97 | 1.94 | 1.91 | 1.88 | 1.85 | 1.82 | 1.78 |

TABLE 12

| Widths of the microstrip line | | | | | | | | | | | | |
|---|---|---|---|---|---|---|---|---|---|---|---|---|
| #61 | 78.49 | 78.60 | 78.71 | 78.82 | 78.92 | 79.03 | 79.14 | 79.25 | 79.36 | 79.47 | 79.58 | 79.68 |
| — | 1.75 | 1.72 | 1.68 | 1.65 | 1.63 | 1.60 | 1.57 | 1.55 | 1.53 | 1.51 | 1.49 | 1.48 |
| #62 | 79.79 | 79.90 | 80.01 | 80.12 | 80.23 | 80.34 | 80.45 | 80.56 | 80.66 | 80.77 | 80.88 | 80.99 |
| — | 1.46 | 1.45 | 1.44 | 1.44 | 1.43 | 1.43 | 1.43 | 1.42 | 1.42 | 1.43 | 1.43 | 1.43 |
| #63 | 81.10 | 81.21 | 81.32 | 81.43 | 81.54 | 81.65 | 81.76 | 81.86 | 81.97 | 82.08 | 82.19 | 82.30 |
| — | 1.43 | 1.43 | 1.44 | 1.44 | 1.44 | 1.44 | 1.44 | 1.44 | 1.43 | 1.43 | 1.42 | 1.42 |
| #64 | 82.41 | 82.52 | 82.63 | 82.74 | 82.85 | 82.96 | 83.07 | 83.17 | 83.28 | 83.39 | 83.50 | 83.61 |
| — | 1.41 | 1.40 | 1.39 | 1.37 | 1.36 | 1.35 | 1.33 | 1.31 | 1.30 | 1.28 | 1.26 | 1.25 |
| #65 | 83.72 | 83.83 | 83.94 | 84.05 | 84.16 | 84.27 | 84.38 | 84.49 | 84.60 | 84.72 | 84.83 | 84.94 |
| — | 1.23 | 1.21 | 1.20 | 1.19 | 1.17 | 1.16 | 1.15 | 1.14 | 1.13 | 1.13 | 1.12 | 1.12 |
| #66 | 85.05 | 85.16 | 85.27 | 85.38 | 85.49 | 85.60 | 85.71 | 85.82 | 85.93 | 86.04 | 86.15 | 86.26 |
| — | 1.12 | 1.12 | 1.13 | 1.13 | 1.14 | 1.15 | 1.16 | 1.18 | 1.19 | 1.21 | 1.23 | 1.25 |
| #67 | 86.37 | 86.48 | 86.59 | 86.70 | 86.81 | 86.91 | 87.02 | 87.13 | 87.24 | 87.35 | 87.46 | 87.57 |
| — | 1.27 | 1.30 | 1.32 | 1.35 | 1.37 | 1.40 | 1.43 | 1.45 | 1.48 | 1.50 | 1.53 | 1.55 |
| #68 | 87.68 | 87.78 | 87.89 | 88.00 | 88.11 | 88.22 | 88.33 | 88.43 | 88.54 | 88.65 | 88.76 | 88.87 |
| — | 1.57 | 1.60 | 1.61 | 1.63 | 1.65 | 1.66 | 1.67 | 1.68 | 1.69 | 1.69 | 1.70 | 1.70 |
| #69 | 88.97 | 89.08 | 89.19 | 89.30 | 89.41 | 89.51 | 89.62 | 89.73 | 89.84 | 89.95 | 90.05 | 90.16 |
| — | 1.70 | 1.69 | 1.69 | 1.68 | 1.68 | 1.67 | 1.66 | 1.65 | 1.64 | 1.63 | 1.62 | 1.61 |

TABLE 12-continued

| Widths of the microstrip line | | | | | | | | | | | | |
|---|---|---|---|---|---|---|---|---|---|---|---|---|
| #70 | 90.27 | 90.38 | 90.49 | 90.60 | 90.71 | 90.81 | 90.92 | 91.03 | 91.14 | 91.25 | 91.36 | 91.47 |
| — | 1.60 | 1.59 | 1.58 | 1.58 | 1.57 | 1.56 | 1.56 | 1.55 | 1.55 | 1.55 | 1.55 | 1.55 |
| #71 | 91.57 | 91.68 | 91.79 | 91.90 | 92.01 | 92.12 | 92.22 | 92.33 | 92.44 | 92.55 | 92.66 | 92.77 |
| — | 1.55 | 1.55 | 1.55 | 1.55 | 1.56 | 1.56 | 1.57 | 1.57 | 1.57 | 1.58 | 1.58 | 1.58 |
| #72 | 92.88 | 92.98 | 93.09 | 93.20 | 93.31 | 93.42 | 93.53 | 93.63 | 93.74 | 93.85 | 93.96 | 94.07 |
| — | 1.59 | 1.59 | 1.59 | 1.59 | 1.59 | 1.58 | 1.58 | 1.57 | 1.57 | 1.56 | 1.55 | 1.54 |
| #73 | 94.18 | 94.29 | 94.39 | 94.50 | 94.61 | 94.72 | 94.83 | 94.94 | 95.05 | 95.16 | 95.27 | 95.38 |
| — | 1.52 | 1.51 | 1.50 | 1.48 | 1.46 | 1.45 | 1.43 | 1.41 | 1.39 | 1.38 | 1.36 | 1.34 |
| #74 | 95.49 | 95.60 | 95.71 | 95.82 | 95.92 | 96.03 | 96.14 | 96.25 | 96.36 | 96.47 | 96.58 | 96.69 |
| — | 1.33 | 1.31 | 1.30 | 1.28 | 1.27 | 1.26 | 1.25 | 1.24 | 1.23 | 1.22 | 1.22 | 1.21 |
| #75 | 96.80 | 96.91 | 97.02 | 97.13 | 97.24 | 97.35 | 97.46 | 97.57 | 97.68 | 97.79 | 97.90 | 98.01 |
| — | 1.21 | 1.21 | 1.21 | 1.22 | 1.22 | 1.22 | 1.23 | 1.24 | 1.25 | 1.26 | 1.27 | 1.28 |
| #76 | 98.12 | 98.23 | 98.34 | 98.45 | 98.56 | 98.67 | 98.78 | 98.89 | 99.00 | 99.11 | 99.21 | 99.32 |
| — | 1.29 | 1.31 | 1.32 | 1.34 | 1.35 | 1.36 | 1.38 | 1.39 | 1.41 | 1.42 | 1.43 | 1.44 |
| #77 | 99.43 | 99.54 | 99.65 | 99.76 | 99.87 | 99.98 | 100.09 | 100.19 | 100.30 | 100.41 | 100.52 | 100.63 |
| — | 1.45 | 1.46 | 1.47 | 1.48 | 1.48 | 1.49 | 1.49 | 1.50 | 1.50 | 1.50 | 1.50 | 1.50 |
| #78 | 100.74 | 100.85 | 100.96 | 101.06 | 101.17 | 101.28 | 101.39 | 101.50 | 101.61 | 101.72 | 101.83 | 101.93 |
| — | 1.50 | 1.50 | 1.50 | 1.50 | 1.50 | 1.49 | 1.49 | 1.49 | 1.49 | 1.49 | 1.49 | 1.49 |
| #79 | 102.04 | 102.15 | 102.26 | 102.37 | 102.48 | 102.59 | 102.70 | 102.80 | 102.91 | 103.02 | 103.13 | 103.24 |
| — | 1.49 | 1.49 | 1.49 | 1.49 | 1.50 | 1.50 | 1.51 | 1.51 | 1.52 | 1.53 | 1.53 | 1.54 |
| #80 | 103.35 | 103.46 | 103.56 | 103.67 | 103.78 | 103.89 | 104.00 | 104.11 | 104.21 | 104.32 | 104.43 | 104.54 |
| — | 1.55 | 1.56 | 1.57 | 1.58 | 1.59 | 1.60 | 1.60 | 1.61 | 1.62 | 1.63 | 1.63 | 1.64 |
| #81 | 104.65 | 104.76 | 104.86 | 104.97 | 105.08 | 105.19 | 105.30 | 105.41 | 105.51 | 105.62 | 105.73 | 105.84 |
| — | 1.64 | 1.64 | 1.64 | 1.64 | 1.64 | 1.64 | 1.64 | 1.63 | 1.62 | 1.62 | 1.61 | 1.60 |
| #82 | 105.95 | 106.06 | 106.16 | 106.27 | 106.38 | 106.49 | 106.60 | 106.71 | 106.82 | 106.93 | 107.03 | 107.14 |
| — | 1.59 | 1.57 | 1.56 | 1.55 | 1.53 | 1.52 | 1.50 | 1.49 | 1.47 | 1.46 | 1.45 | 1.43 |
| #83 | 107.25 | 107.36 | 107.47 | 107.58 | 107.69 | 107.80 | 107.91 | 108.02 | 108.13 | 108.24 | 108.35 | 108.45 |
| — | 1.42 | 1.41 | 1.39 | 1.38 | 1.37 | 1.36 | 1.36 | 1.35 | 1.34 | 1.34 | 1.33 | 1.33 |
| #84 | 108.56 | 108.67 | 108.78 | 108.89 | 109.00 | | | | | | | |
| — | 1.33 | 1.33 | 1.32 | 1.33 | 1.33 | | | | | | | |

Figure 19:
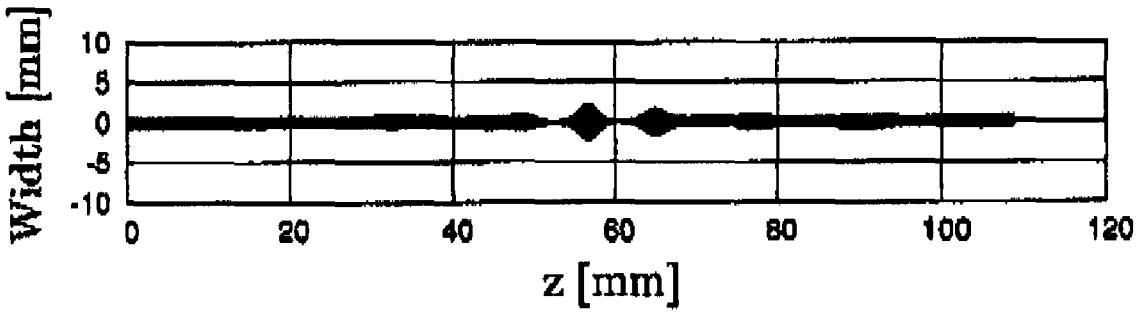
FIG. 19 is a graph showing the surface form of the microstrip line in the reflection-type bandpass filter of the fourth embodiment.

FIG. 19 shows the shape of the microstrip line 5 in the reflection-type bandpass filter 1 of the fourth embodiment. A non-reflecting terminator, or an R=30Ω resistance, is provided at the terminating side (the face at z=109.00 mm) of the reflection-type bandpass filter 1. The thickness of the metal films used in the conducting layer 3 and of the conductor constituting the microstrip line 5 should be adequately greater than the skin depth $\delta s=\sqrt{\{2/(\omega\mu 0\sigma)\}}$ at f=1 GHz. For example if copper is used, the thickness of the conducting layer 3 and of the conductor of the microstrip line 5 should be taken as 2.1 μm or greater. This reflection-type bandpass filter is used in a system where the characteristic impedance is 30Ω.

Figure 20:
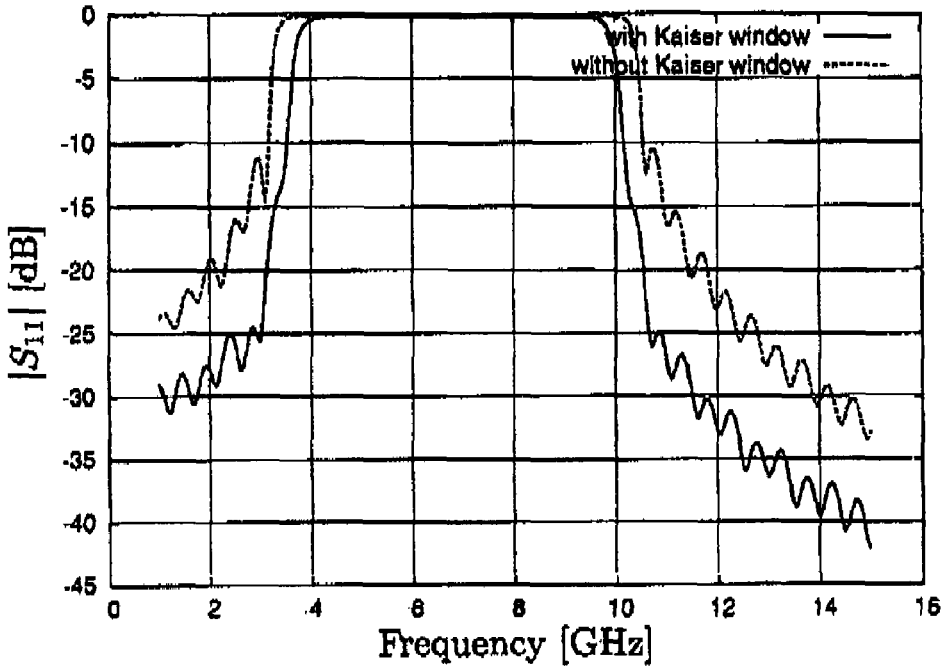
FIG. 20 is a graph showing the amplitude characteristics of the reflective wave in the reflection-type bandpass filter of the fourth embodiment.
Figure 21:
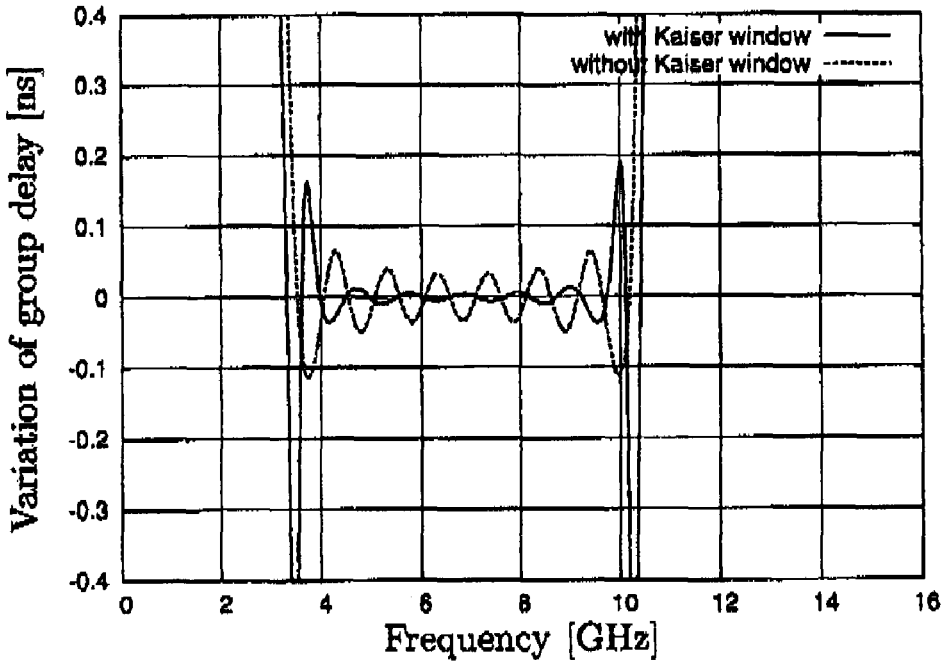
FIG. 21 is a graph showing the group delay frequency characteristics of the reflective wave in the reflection-type bandpass filter of the fourth embodiment.

FIG. 20 and FIG. 21 express the amplitude characteristics and group delay frequency characteristics respectively of the reflective wave (S11) in the bandpass filter of the fourth embodiment. For comparison, the characteristics when the Kaiser window is not used, are also shown. As shown in the figures, in the region of frequency f for which 4.0 GHz≦f≦9.7 GHz, the reflectivity is −2 dB or greater and the variation of the group delay is within ±0.1 ns. In the region f<3.1 GHz and f>10.6 GHz, the reflectivity is −20 dB or lower. Compared to the case when the Kaiser window is not used, the region of transition frequency becomes wider, but the stop band rejection increases to 18 dB, and the variation of group delay within the pass band decreases.

Embodiment 5

A Kaiser window was used for which the reflectivity is 0.95 at the frequency f in the region 3.6 GHz≦f≦10.1 GHz, and is 0 elsewhere, and for which A=40. Taking one wavelength at frequency f=1 GHz of the signal transmitted within the microstrip line as the waveguide length, the system characteristic impedance was taken as 50Ω, and the design was carried out.

Figure 22:
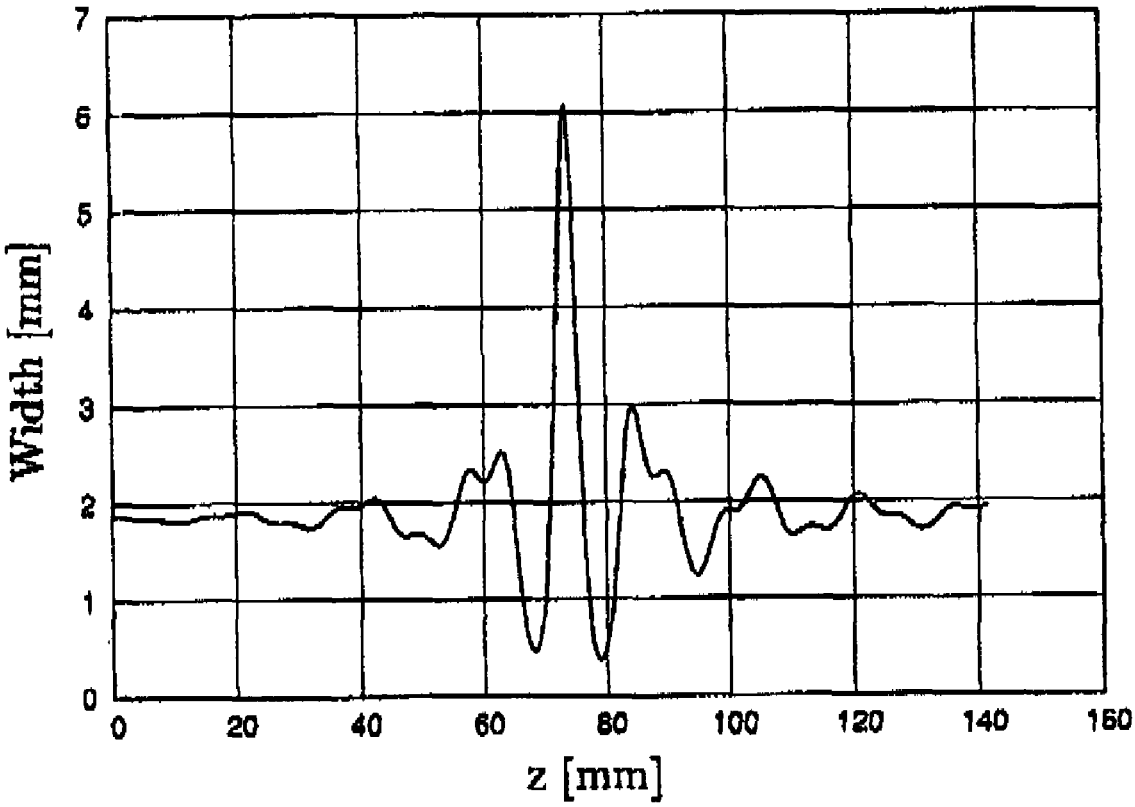
FIG. 22 is a graph showing the distribution in the width direction of the microstrip line in the reflection-type bandpass filter of the fifth embodiment.

FIG. 22 shows the distribution of the width w of the microstrip line 5 in the z-axis direction when a dielectric layer 4 of thickness h=1.27 mm, and relative dielectric constant $\epsilon_r$=6.15 was used, together with the width when the Kaiser window was not used. Tables 13 through 15 list the widths w of the microstrip line 5 when the Kaiser window was used.

TABLE 13

| Widths of the microstrip line | | | | | | | | | | | | |
|---|---|---|---|---|---|---|---|---|---|---|---|---|
| z[mm] | 0.00 | 0.14 | 0.28 | 0.42 | 0.57 | 0.71 | 0.85 | 0.99 | 1.13 | 1.27 | 1.41 | 1.56 |
| w[mm] | 1.87 | 1.87 | 1.87 | 1.87 | 1.87 | 1.87 | 1.87 | 1.87 | 1.87 | 1.87 | 1.87 | 1.87 |
| #2 | 1.70 | 1.84 | 1.98 | 2.12 | 2.26 | 2.40 | 2.55 | 2.69 | 2.83 | 2.97 | 3.11 | 3.25 |
| — | 1.87 | 1.87 | 1.87 | 1.86 | 1.86 | 1.86 | 1.86 | 1.86 | 1.86 | 1.86 | 1.86 | 1.85 |
| #3 | 3.40 | 3.54 | 3.68 | 3.82 | 3.96 | 4.10 | 4.24 | 4.39 | 4.53 | 4.67 | 4.81 | 4.95 |
| — | 1.85 | 1.85 | 1.85 | 1.85 | 1.85 | 1.85 | 1.85 | 1.85 | 1.84 | 1.84 | 1.84 | 1.84 |

TABLE 13-continued

| Widths of the microstrip line | | | | | | | | | | | | |
|---|---|---|---|---|---|---|---|---|---|---|---|---|
| | z[mm] | | | | | | | | | | | |
| | 0.00 | 0.14 | 0.28 | 0.42 | 0.57 | 0.71 | 0.85 | 0.99 | 1.13 | 1.27 | 1.41 | 1.56 |
| | w[mm] | | | | | | | | | | | |
| | 1.87 | 1.87 | 1.87 | 1.87 | 1.87 | 1.87 | 1.87 | 1.87 | 1.87 | 1.87 | 1.87 | 1.87 |
| #4 | 5.09 | 5.24 | 5.38 | 5.52 | 5.66 | 5.80 | 5.94 | 6.08 | 6.23 | 6.37 | 6.51 | 6.65 |
| — | 1.84 | 1.84 | 1.84 | 1.84 | 1.84 | 1.84 | 1.84 | 1.84 | 1.84 | 1.84 | 1.84 | 1.84 |
| #5 | 6.79 | 6.93 | 7.08 | 7.22 | 7.36 | 7.50 | 7.64 | 7.78 | 7.93 | 8.07 | 8.21 | 8.35 |
| — | 1.84 | 1.84 | 1.84 | 1.84 | 1.84 | 1.84 | 1.84 | 1.84 | 1.84 | 1.84 | 1.84 | 1.84 |
| #6 | 8.49 | 8.53 | 8.77 | 8.92 | 9.06 | 9.20 | 9.34 | 9.48 | 9.62 | 9.77 | 9.91 | 10.05 |
| — | 1.83 | 1.83 | 1.83 | 1.83 | 1.83 | 1.83 | 1.83 | 1.82 | 1.82 | 1.82 | 1.82 | 1.82 |
| #7 | 10.19 | 10.33 | 10.47 | 10.62 | 10.76 | 10.90 | 11.04 | 11.18 | 11.32 | 11.47 | 11.61 | 11.75 |
| — | 1.82 | 1.82 | 1.82 | 1.82 | 1.81 | 1.81 | 1.81 | 1.81 | 1.82 | 1.82 | 1.82 | 1.82 |
| #8 | 11.89 | 12.03 | 12.17 | 12.32 | 12.46 | 12.60 | 12.74 | 12.88 | 13.02 | 13.10 | 13.31 | 13.45 |
| — | 1.82 | 1.82 | 1.82 | 1.83 | 1.83 | 1.83 | 1.83 | 1.84 | 1.84 | 1.84 | 1.84 | 1.85 |
| #9 | 13.59 | 13.73 | 13.87 | 14.01 | 14.16 | 14.30 | 14.44 | 14.58 | 14.72 | 14.86 | 15.00 | 15.15 |
| — | 1.85 | 1.85 | 1.86 | 1.86 | 1.86 | 1.86 | 1.87 | 1.87 | 1.87 | 1.87 | 1.87 | 1.87 |
| #10 | 15.29 | 15.43 | 15.57 | 15.71 | 15.85 | 15.99 | 16.14 | 16.28 | 16.42 | 16.56 | 16.70 | 16.84 |
| — | 1.88 | 1.88 | 1.88 | 1.88 | 1.88 | 1.88 | 1.88 | 1.88 | 1.88 | 1.88 | 1.88 | 1.88 |
| #11 | 16.98 | 17.13 | 17.27 | 17.41 | 17.55 | 17.69 | 17.83 | 17.97 | 18.12 | 18.26 | 18.40 | 18.54 |
| — | 1.88 | 1.88 | 1.88 | 1.88 | 1.88 | 1.88 | 1.88 | 1.88 | 1.88 | 1.88 | 1.88 | 1.88 |
| #12 | 18.68 | 18.82 | 18.96 | 19.11 | 19.25 | 19.39 | 19.53 | 19.67 | 19.81 | 19.95 | 20.10 | 20.24 |
| — | 1.89 | 1.89 | 1.89 | 1.89 | 1.90 | 1.90 | 1.90 | 1.90 | 1.91 | 1.91 | 1.91 | 1.91 |
| #13 | 20.38 | 20.52 | 20.66 | 20.80 | 20.94 | 21.08 | 21.23 | 21.37 | 21.51 | 21.65 | 21.79 | 21.93 |
| — | 1.92 | 1.92 | 1.92 | 1.92 | 1.92 | 1.92 | 1.93 | 1.93 | 1.93 | 1.92 | 1.92 | 1.92 |
| #14 | 22.07 | 22.21 | 22.36 | 22.50 | 22.64 | 22.78 | 22.92 | 23.06 | 23.20 | 23.35 | 23.49 | 23.63 |
| — | 1.92 | 1.92 | 1.91 | 1.91 | 1.91 | 1.90 | 1.90 | 1.89 | 1.89 | 1.88 | 1.88 | 1.87 |
| #15 | 23.77 | 23.91 | 24.05 | 24.19 | 24.34 | 24.48 | 24.62 | 24.76 | 24.90 | 25.04 | 25.19 | 25.33 |
| — | 1.87 | 1.86 | 1.85 | 1.85 | 1.84 | 1.84 | 1.83 | 1.83 | 1.82 | 1.82 | 1.82 | 1.81 |
| #16 | 25.47 | 25.61 | 25.75 | 25.89 | 26.04 | 26.18 | 26.32 | 26.46 | 26.60 | 26.74 | 26.89 | 27.03 |
| — | 1.81 | 1.81 | 1.81 | 1.80 | 1.80 | 1.80 | 1.80 | 1.80 | 1.80 | 1.80 | 1.80 | 1.80 |
| #17 | 27.17 | 27.31 | 27.45 | 27.59 | 27.74 | 27.88 | 28.02 | 28.16 | 28.30 | 28.44 | 28.59 | 28.73 |
| — | 1.80 | 1.80 | 1.80 | 1.80 | 1.81 | 1.81 | 1.81 | 1.80 | 1.80 | 1.80 | 1.80 | 1.80 |
| #18 | 28.87 | 29.01 | 29.15 | 29.29 | 29.44 | 29.58 | 29.72 | 29.86 | 30.00 | 30.15 | 30.29 | 30.43 |
| — | 1.80 | 1.80 | 1.79 | 1.79 | 1.79 | 1.78 | 1.78 | 1.78 | 1.77 | 1.77 | 1.76 | 1.76 |
| #19 | 30.57 | 30.71 | 30.85 | 31.00 | 31.14 | 31.28 | 31.42 | 31.56 | 31.71 | 31.85 | 31.99 | 32.13 |
| — | 1.76 | 1.75 | 1.75 | 1.75 | 1.74 | 1.74 | 1.74 | 1.74 | 1.74 | 1.74 | 1.74 | 1.74 |
| #20 | 32.27 | 32.42 | 32.56 | 32.70 | 32.84 | 32.98 | 33.12 | 33.27 | 33.41 | 33.55 | 33.69 | 33.83 |
| — | 1.74 | 1.75 | 1.75 | 1.75 | 1.76 | 1.76 | 1.77 | 1.78 | 1.79 | 1.80 | 1.80 | 1.81 |
| #21 | 33.97 | 34.12 | 34.26 | 34.40 | 34.54 | 34.68 | 34.82 | 34.97 | 35.11 | 35.25 | 35.39 | 35.53 |
| — | 1.82 | 1.83 | 1.84 | 1.85 | 1.86 | 1.87 | 1.88 | 1.89 | 1.90 | 1.91 | 1.92 | 1.92 |
| #22 | 35.67 | 35.81 | 35.95 | 36.10 | 36.24 | 36.38 | 36.52 | 36.66 | 36.80 | 36.94 | 37.08 | 37.22 |
| — | 1.93 | 1.94 | 1.94 | 1.95 | 1.95 | 1.95 | 1.95 | 1.96 | 1.96 | 1.96 | 1.96 | 1.96 |
| #23 | 37.37 | 37.51 | 37.65 | 37.79 | 37.93 | 38.07 | 38.21 | 38.35 | 38.50 | 38.64 | 38.78 | 38.92 |
| — | 1.95 | 1.95 | 1.95 | 1.95 | 1.95 | 1.95 | 1.95 | 1.95 | 1.95 | 1.94 | 1.95 | 1.95 |
| #24 | 39.06 | 39.20 | 39.34 | 39.48 | 39.63 | 39.77 | 39.91 | 40.05 | 40.19 | 40.33 | 40.47 | 40.61 |
| — | 1.95 | 1.95 | 1.95 | 1.95 | 1.96 | 1.96 | 1.97 | 1.97 | 1.98 | 1.99 | 1.99 | 2.00 |
| #25 | 40.75 | 40.89 | 41.04 | 41.18 | 41.32 | 41.46 | 41.60 | 41.74 | 41.88 | 42.02 | 42.16 | 42.30 |
| — | 2.01 | 2.01 | 2.02 | 2.02 | 2.03 | 2.04 | 2.04 | 2.04 | 2.05 | 2.05 | 2.05 | 2.05 |
| #26 | 42.44 | 42.59 | 42.73 | 42.87 | 43.01 | 43.15 | 43.29 | 43.43 | 43.57 | 43.71 | 43.86 | 44.00 |
| — | 2.04 | 2.04 | 2.04 | 2.03 | 2.02 | 2.01 | 2.00 | 1.99 | 1.98 | 1.97 | 1.95 | 1.94 |
| #27 | 44.14 | 44.28 | 44.42 | 44.56 | 44.70 | 44.85 | 44.99 | 45.13 | 45.27 | 45.41 | 45.55 | 45.70 |
| — | 1.92 | 1.90 | 1.88 | 1.87 | 1.85 | 1.83 | 1.82 | 1.80 | 1.78 | 1.77 | 1.75 | 1.74 |
| #28 | 45.84 | 45.98 | 46.12 | 46.26 | 46.41 | 46.55 | 46.69 | 46.83 | 46.97 | 47.12 | 47.26 | 47.40 |
| — | 1.73 | 1.71 | 1.70 | 1.69 | 1.69 | 1.68 | 1.67 | 1.67 | 1.66 | 1.66 | 1.66 | 1.66 |
| #29 | 47.54 | 47.69 | 47.83 | 47.97 | 48.11 | 48.25 | 48.40 | 48.54 | 48.68 | 48.82 | 48.96 | 49.11 |
| — | 1.66 | 1.66 | 1.67 | 1.67 | 1.67 | 1.67 | 1.68 | 1.68 | 1.68 | 1.69 | 1.69 | 1.69 |
| #30 | 49.25 | 49.39 | 49.53 | 49.68 | 49.82 | 49.96 | 50.10 | 50.24 | 50.39 | 50.53 | 50.67 | 50.81 |
| — | 1.69 | 1.69 | 1.69 | 1.69 | 1.69 | 1.68 | 1.68 | 1.67 | 1.67 | 1.66 | 1.65 | 1.64 |

TABLE 14

| Widths of the microstrip line | | | | | | | | | | | | |
|---|---|---|---|---|---|---|---|---|---|---|---|---|
| #31 | 50.96 | 51.10 | 51.24 | 51.38 | 51.52 | 51.67 | 51.81 | 51.95 | 52.09 | 52.24 | 52.38 | 52.52 |
| — | 1.64 | 1.63 | 1.62 | 1.61 | 1.60 | 1.59 | 1.58 | 1.58 | 1.57 | 1.57 | 1.56 | 1.56 |
| #32 | 52.66 | 52.81 | 52.95 | 53.09 | 53.24 | 53.38 | 53.52 | 53.66 | 53.80 | 53.95 | 54.09 | 54.23 |
| — | 1.56 | 1.56 | 1.57 | 1.57 | 1.58 | 1.59 | 1.61 | 1.62 | 1.64 | 1.66 | 1.68 | 1.70 |
| #33 | 54.37 | 54.51 | 54.66 | 54.80 | 54.94 | 55.08 | 55.22 | 55.36 | 55.50 | 55.65 | 55.79 | 55.93 |
| — | 1.73 | 1.76 | 1.79 | 1.82 | 1.85 | 1.88 | 1.92 | 1.95 | 1.99 | 2.02 | 2.06 | 2.09 |
| #34 | 56.07 | 56.21 | 56.35 | 56.49 | 56.63 | 56.77 | 56.91 | 57.05 | 57.19 | 57.33 | 57.47 | 57.61 |
| — | 2.12 | 2.16 | 2.18 | 2.21 | 2.24 | 2.26 | 2.28 | 2.30 | 2.31 | 2.32 | 2.33 | 2.33 |

TABLE 14-continued

| Widths of the microstrip line | | | | | | | | | | | | |
|---|---|---|---|---|---|---|---|---|---|---|---|---|
| #35 | 57.75 | 57.89 | 58.03 | 58.17 | 58.31 | 58.45 | 58.59 | 58.73 | 58.87 | 59.01 | 59.15 | 59.29 |
| — | 2.33 | 2.33 | 2.33 | 2.32 | 2.32 | 2.31 | 2.30 | 2.29 | 2.28 | 2.27 | 2.25 | 2.24 |
| #36 | 59.43 | 59.57 | 59.71 | 59.85 | 59.99 | 60.13 | 60.27 | 60.41 | 60.56 | 60.70 | 60.84 | 60.98 |
| — | 2.24 | 2.23 | 2.22 | 2.22 | 2.22 | 2.22 | 2.22 | 2.22 | 2.23 | 2.24 | 2.25 | 2.27 |
| #37 | 61.12 | 61.26 | 61.40 | 61.54 | 61.68 | 61.82 | 61.96 | 62.10 | 62.24 | 62.37 | 62.51 | 62.65 |
| — | 2.29 | 2.31 | 2.33 | 2.35 | 2.37 | 2.40 | 2.42 | 2.44 | 2.46 | 2.48 | 2.50 | 2.51 |
| #38 | 62.79 | 62.93 | 63.07 | 63.21 | 63.35 | 63.49 | 63.63 | 63.77 | 63.91 | 64.05 | 64.19 | 64.33 |
| — | 2.52 | 2.52 | 2.52 | 2.51 | 2.49 | 2.47 | 2.43 | 2.39 | 2.35 | 2.29 | 2.23 | 2.16 |
| #39 | 64.47 | 64.61 | 64.76 | 64.90 | 65.04 | 65.18 | 65.32 | 65.47 | 65.61 | 65.75 | 65.90 | 66.04 |
| — | 2.09 | 2.01 | 1.92 | 1.83 | 1.74 | 1.65 | 1.55 | 1.46 | 1.37 | 1.27 | 1.18 | 1.10 |
| #40 | 66.19 | 66.33 | 66.48 | 66.63 | 66.77 | 66.92 | 67.07 | 67.21 | 67.36 | 67.51 | 67.66 | 67.81 |
| — | 1.02 | 0.94 | 0.87 | 0.80 | 0.74 | 0.69 | 0.64 | 0.60 | 0.56 | 0.53 | 0.51 | 0.49 |
| #41 | 67.96 | 68.11 | 68.25 | 68.40 | 68.55 | 68.70 | 68.85 | 69.00 | 69.15 | 69.29 | 69.44 | 69.59 |
| — | 0.47 | 0.47 | 0.46 | 0.46 | 0.47 | 0.49 | 0.51 | 0.54 | 0.57 | 0.62 | 0.67 | 0.73 |
| #42 | 69.73 | 69.88 | 70.03 | 70.17 | 70.31 | 70.46 | 70.60 | 70.74 | 70.88 | 71.02 | 71.16 | 71.30 |
| — | 0.80 | 0.89 | 0.99 | 1.10 | 1.22 | 1.36 | 1.51 | 1.68 | 1.87 | 2.07 | 2.28 | 2.51 |
| #43 | 71.44 | 71.58 | 71.72 | 71.86 | 71.99 | 72.13 | 72.27 | 72.40 | 72.54 | 72.67 | 72.80 | 72.94 |
| — | 2.75 | 3.01 | 3.27 | 3.54 | 3.82 | 4.10 | 4.38 | 4.65 | 4.91 | 5.16 | 5.39 | 5.59 |
| #44 | 73.07 | 73.21 | 73.34 | 73.47 | 73.61 | 73.74 | 73.88 | 74.01 | 74.14 | 74.28 | 74.41 | 74.55 |
| — | 5.76 | 5.90 | 6.00 | 6.06 | 6.08 | 6.05 | 5.99 | 5.88 | 5.74 | 5.56 | 5.36 | 5.13 |
| #45 | 74.68 | 74.82 | 74.95 | 75.09 | 75.23 | 75.36 | 75.50 | 75.64 | 75.78 | 75.92 | 76.06 | 76.20 |
| — | 4.87 | 4.60 | 4.33 | 4.04 | 3.75 | 3.47 | 3.19 | 2.92 | 2.66 | 2.42 | 2.19 | 1.97 |
| #46 | 76.34 | 76.49 | 76.63 | 76.77 | 76.92 | 77.06 | 77.21 | 77.35 | 77.50 | 77.65 | 77.80 | 77.94 |
| — | 1.77 | 1.58 | 1.41 | 1.26 | 1.12 | 1.00 | 0.89 | 0.79 | 0.71 | 0.63 | 0.57 | 0.52 |
| #47 | 78.09 | 78.24 | 78.39 | 78.54 | 78.69 | 78.84 | 78.99 | 79.14 | 79.29 | 79.44 | 79.59 | 79.74 |
| — | 0.48 | 0.45 | 0.42 | 0.40 | 0.39 | 0.38 | 0.38 | 0.38 | 0.39 | 0.40 | 0.42 | 0.44 |
| #48 | 79.89 | 80.04 | 80.18 | 80.33 | 80.48 | 80.63 | 80.77 | 80.92 | 81.06 | 81.21 | 81.35 | 81.50 |
| — | 0.48 | 0.51 | 0.56 | 0.61 | 0.67 | 0.73 | 0.81 | 0.89 | 0.98 | 1.07 | 1.17 | 1.28 |
| #49 | 81.64 | 81.78 | 81.92 | 82.07 | 82.21 | 82.35 | 82.49 | 82.63 | 82.77 | 82.91 | 83.05 | 83.19 |
| — | 1.39 | 1.51 | 1.63 | 1.75 | 1.87 | 1.99 | 2.11 | 2.23 | 2.34 | 2.45 | 2.54 | 2.63 |
| #50 | 83.33 | 83.47 | 83.60 | 83.74 | 83.88 | 84.02 | 84.16 | 84.30 | 84.44 | 84.57 | 84.71 | 84.85 |
| — | 2.72 | 2.79 | 2.85 | 2.90 | 2.93 | 2.96 | 2.98 | 2.98 | 2.98 | 2.97 | 2.95 | 2.92 |
| #51 | 84.99 | 85.13 | 85.27 | 85.41 | 85.55 | 85.68 | 85.82 | 85.96 | 86.10 | 86.24 | 86.38 | 86.52 |
| — | 2.89 | 2.85 | 2.81 | 2.76 | 2.72 | 2.67 | 2.62 | 2.58 | 2.53 | 2.49 | 2.45 | 2.42 |
| #52 | 86.66 | 86.80 | 86.94 | 87.08 | 87.22 | 87.36 | 87.50 | 87.64 | 87.78 | 87.92 | 88.06 | 88.20 |
| — | 2.38 | 2.35 | 2.33 | 2.31 | 2.29 | 2.28 | 2.26 | 2.26 | 2.25 | 2.25 | 2.25 | 2.26 |
| #53 | 88.34 | 88.48 | 88.62 | 88.76 | 88.90 | 89.04 | 89.18 | 89.32 | 89.46 | 89.60 | 89.74 | 89.88 |
| — | 2.26 | 2.27 | 2.28 | 2.29 | 2.30 | 2.30 | 2.31 | 2.31 | 2.32 | 2.32 | 2.31 | 2.31 |
| #54 | 90.03 | 90.17 | 90.31 | 90.45 | 90.59 | 90.73 | 90.87 | 91.01 | 91.15 | 91.29 | 91.43 | 91.57 |
| — | 2.30 | 2.28 | 2.27 | 2.25 | 2.22 | 2.19 | 2.16 | 2.12 | 2.08 | 2.04 | 2.00 | 1.95 |
| #55 | 91.71 | 91.85 | 92.00 | 92.14 | 92.28 | 92.42 | 92.56 | 92.71 | 92.85 | 92.99 | 93.14 | 93.28 |
| — | 1.90 | 1.86 | 1.81 | 1.76 | 1.71 | 1.66 | 1.61 | 1.57 | 1.53 | 1.49 | 1.45 | 1.41 |
| #56 | 93.42 | 93.57 | 93.71 | 93.85 | 94.00 | 94.14 | 94.28 | 94.43 | 94.57 | 94.72 | 94.86 | 95.00 |
| — | 1.38 | 1.35 | 1.33 | 1.30 | 1.29 | 1.27 | 1.26 | 1.25 | 1.25 | 1.24 | 1.25 | 1.25 |
| #57 | 95.15 | 95.29 | 95.44 | 95.58 | 95.72 | 95.87 | 96.01 | 96.15 | 96.30 | 96.44 | 96.58 | 96.72 |
| — | 1.26 | 1.27 | 1.29 | 1.30 | 1.32 | 1.35 | 1.37 | 1.40 | 1.42 | 1.45 | 1.48 | 1.51 |
| #58 | 96.87 | 97.01 | 97.15 | 97.29 | 97.44 | 97.58 | 97.72 | 97.86 | 98.00 | 98.15 | 98.29 | 98.43 |
| — | 1.55 | 1.58 | 1.61 | 1.64 | 1.67 | 1.70 | 1.73 | 1.75 | 1.78 | 1.80 | 1.82 | 1.84 |
| #59 | 98.57 | 98.71 | 98.85 | 99.00 | 99.14 | 99.28 | 99.42 | 99.56 | 99.70 | 99.84 | 99.98 | 100.13 |
| — | 1.85 | 1.87 | 1.88 | 1.89 | 1.90 | 1.90 | 1.91 | 1.91 | 1.91 | 1.91 | 1.91 | 1.91 |
| #60 | 100.27 | 100.41 | 100.55 | 100.69 | 100.83 | 100.97 | 101.12 | 101.26 | 101.40 | 101.54 | 101.68 | 101.82 |
| — | 1.91 | 1.91 | 1.90 | 1.90 | 1.90 | 1.90 | 1.91 | 1.91 | 1.91 | 1.92 | 1.92 | 1.93 |

TABLE 15

| Widths of the microstrip line | | | | | | | | | | | | |
|---|---|---|---|---|---|---|---|---|---|---|---|---|
| #61 | 101.96 | 102.10 | 102.25 | 102.39 | 102.53 | 102.67 | 102.81 | 102.95 | 103.09 | 103.23 | 103.37 | 103.51 |
| — | 1.94 | 1.95 | 1.97 | 1.98 | 1.99 | 2.01 | 2.03 | 2.05 | 2.07 | 2.08 | 2.10 | 2.12 |
| #62 | 103.65 | 103.79 | 103.93 | 104.08 | 104.22 | 104.36 | 104.50 | 104.64 | 104.78 | 104.92 | 105.06 | 105.20 |
| — | 2.14 | 2.16 | 2.18 | 2.20 | 2.21 | 2.22 | 2.24 | 2.25 | 2.25 | 2.26 | 2.26 | 2.26 |
| #63 | 105.34 | 105.48 | 105.62 | 105.76 | 105.90 | 106.04 | 106.18 | 106.32 | 106.46 | 106.60 | 106.74 | 106.88 |
| — | 2.26 | 2.25 | 2.25 | 2.24 | 2.22 | 2.21 | 2.19 | 2.17 | 2.15 | 2.13 | 2.10 | 2.08 |
| #64 | 107.02 | 107.16 | 107.31 | 107.45 | 107.59 | 107.73 | 107.87 | 108.01 | 108.15 | 108.30 | 108.44 | 108.58 |
| — | 2.05 | 2.02 | 2.00 | 1.97 | 1.94 | 1.91 | 1.89 | 1.86 | 1.84 | 1.82 | 1.79 | 1.77 |
| #65 | 108.72 | 108.86 | 109.01 | 109.15 | 109.29 | 109.43 | 109.57 | 109.72 | 109.86 | 110.00 | 110.14 | 110.28 |
| — | 1.75 | 1.74 | 1.72 | 1.71 | 1.70 | 1.69 | 1.68 | 1.67 | 1.67 | 1.66 | 1.66 | 1.66 |
| #66 | 110.43 | 110.57 | 110.71 | 110.85 | 111.00 | 111.14 | 111.28 | 111.42 | 111.56 | 111.71 | 111.85 | 111.99 |
| — | 1.66 | 1.66 | 1.66 | 1.67 | 1.67 | 1.68 | 1.68 | 1.69 | 1.70 | 1.70 | 1.71 | 1.71 |
| #67 | 112.13 | 112.27 | 112.42 | 112.56 | 112.70 | 112.84 | 112.98 | 113.13 | 113.27 | 113.41 | 113.55 | 113.69 |
| — | 1.72 | 1.72 | 1.73 | 1.73 | 1.74 | 1.74 | 1.74 | 1.74 | 1.74 | 1.74 | 1.74 | 1.74 |
| #68 | 113.83 | 113.08 | 114.12 | 114.26 | 114.40 | 114.54 | 114.69 | 114.83 | 114.97 | 115.11 | 115.25 | 115.40 |
| — | 1.74 | 1.74 | 1.73 | 1.73 | 1.73 | 1.72 | 1.72 | 1.72 | 1.71 | 1.71 | 1.71 | 1.71 |

TABLE 15-continued

| Widths of the microstrip line | | | | | | | | | | | | |
|---|---|---|---|---|---|---|---|---|---|---|---|---|
| #69 | 115.54 | 115.68 | 115.82 | 115.96 | 116.11 | 116.25 | 116.39 | 116.53 | 116.67 | 116.82 | 116.96 | 117.10 |
| — | 1.71 | 1.71 | 1.71 | 1.71 | 1.71 | 1.72 | 1.72 | 1.73 | 1.74 | 1.74 | 1.75 | 1.76 |
| #70 | 117.24 | 117.38 | 117.53 | 117.67 | 117.81 | 117.95 | 118.09 | 118.23 | 118.37 | 118.52 | 118.66 | 118.80 |
| — | 1.78 | 1.79 | 1.80 | 1.82 | 1.83 | 1.85 | 1.86 | 1.88 | 1.89 | 1.91 | 1.93 | 1.94 |
| #71 | 118.94 | 119.08 | 119.22 | 119.36 | 119.50 | 119.64 | 119.79 | 119.93 | 120.07 | 120.21 | 120.35 | 120.49 |
| — | 1.96 | 1.97 | 1.99 | 2.00 | 2.01 | 2.02 | 2.03 | 2.04 | 2.05 | 2.06 | 2.06 | 2.06 |
| #72 | 120.63 | 120.77 | 120.91 | 121.05 | 121.19 | 121.33 | 121.48 | 121.62 | 121.76 | 121.90 | 122.04 | 122.18 |
| — | 2.07 | 2.07 | 2.06 | 2.06 | 2.06 | 2.05 | 2.05 | 2.04 | 2.03 | 2.02 | 2.01 | 2.00 |
| #73 | 122.32 | 122.46 | 122.60 | 122.75 | 122.89 | 123.03 | 123.17 | 123.31 | 123.45 | 123.59 | 123.73 | 123.88 |
| — | 1.99 | 1.98 | 1.97 | 1.96 | 1.95 | 1.94 | 1.93 | 1.92 | 1.91 | 1.90 | 1.90 | 1.89 |
| #74 | 124.02 | 124.16 | 124.30 | 124.44 | 124.58 | 124.72 | 124.87 | 125.01 | 125.15 | 125.29 | 125.43 | 125.57 |
| — | 1.88 | 1.88 | 1.87 | 1.87 | 1.86 | 1.86 | 1.86 | 1.85 | 1.85 | 1.85 | 1.85 | 1.85 |
| #75 | 125.71 | 125.86 | 126.00 | 126.14 | 126.28 | 126.42 | 126.56 | 126.71 | 126.85 | 126.99 | 127.13 | 127.27 |
| — | 1.85 | 1.85 | 1.85 | 1.85 | 1.85 | 1.85 | 1.85 | 1.85 | 1.85 | 1.85 | 1.85 | 1.85 |
| #76 | 127.41 | 127.55 | 127.70 | 127.84 | 127.98 | 128.12 | 128.26 | 128.40 | 128.55 | 128.69 | 128.83 | 128.97 |
| — | 1.84 | 1.84 | 1.84 | 1.83 | 1.83 | 1.82 | 1.82 | 1.81 | 1.80 | 1.80 | 1.79 | 1.78 |
| #77 | 129.11 | 129.25 | 129.40 | 129.54 | 129.68 | 129.82 | 129.96 | 130.11 | 130.25 | 130.39 | 130.53 | 130.67 |
| — | 1.78 | 1.77 | 1.76 | 1.75 | 1.75 | 1.74 | 1.73 | 1.73 | 1.72 | 1.72 | 1.71 | 1.71 |
| #78 | 130.82 | 130.96 | 131.10 | 131.24 | 131.38 | 131.53 | 131.67 | 131.81 | 131.95 | 132.09 | 132.24 | 132.38 |
| — | 1.71 | 1.71 | 1.71 | 1.71 | 1.71 | 1.71 | 1.71 | 1.72 | 1.72 | 1.73 | 1.73 | 1.74 |
| #79 | 132.52 | 132.66 | 132.80 | 132.95 | 133.09 | 133.23 | 133.37 | 133.51 | 133.65 | 133.80 | 133.94 | 134.08 |
| — | 1.75 | 1.76 | 1.76 | 1.77 | 1.78 | 1.79 | 1.80 | 1.81 | 1.82 | 1.83 | 1.84 | 1.85 |
| #80 | 134.22 | 134.36 | 134.50 | 134.64 | 134.79 | 134.93 | 135.07 | 135.21 | 135.35 | 135.49 | 135.63 | 135.77 |
| — | 1.86 | 1.87 | 1.88 | 1.89 | 1.90 | 1.90 | 1.91 | 1.92 | 1.92 | 1.93 | 1.93 | 1.93 |
| #81 | 135.92 | 136.06 | 136.20 | 136.34 | 136.48 | 136.62 | 136.76 | 136.90 | 137.05 | 137.19 | 137.33 | 137.47 |
| — | 1.93 | 1.94 | 1.94 | 1.94 | 1.94 | 1.94 | 1.93 | 1.93 | 1.93 | 1.93 | 1.93 | 1.92 |
| #82 | 137.61 | 137.75 | 137.89 | 138.04 | 138.18 | 138.32 | 138.46 | 138.60 | 138.74 | 138.88 | 139.02 | 139.17 |
| — | 1.92 | 1.92 | 1.92 | 1.92 | 1.91 | 1.91 | 1.91 | 1.91 | 1.91 | 1.91 | 1.91 | 1.91 |
| #83 | 139.31 | 139.45 | 139.59 | 139.73 | 139.87 | 140.01 | 140.15 | 140.30 | 140.44 | 140.58 | 140.72 | 140.86 |
| — | 1.91 | 1.91 | 1.91 | 1.91 | 1.92 | 1.92 | 1.92 | 1.92 | 1.93 | 1.93 | 1.93 | 1.93 |
| #84 | 141.00 | 141.14 | 141.29 | 141.43 | 141.57 | | | | | | | |
| — | 1.93 | 1.93 | 1.93 | 1.94 | 1.94 | | | | | | | |

Figure 23:
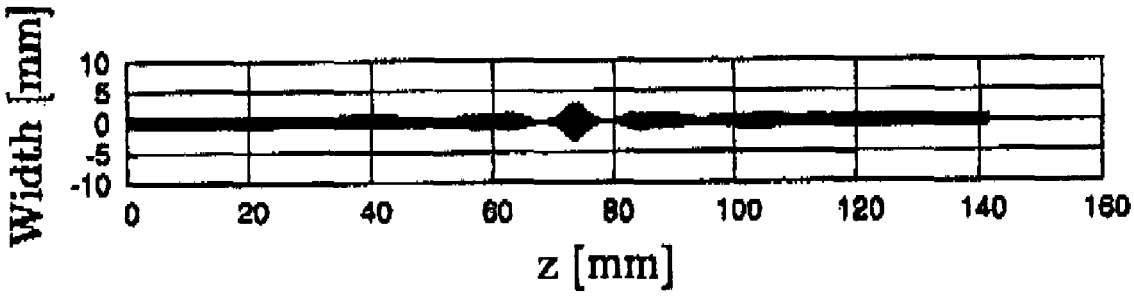
FIG. 23 is a graph showing the surface form of the microstrip line in the reflection-type bandpass filter of the fifth embodiment.

FIG. 23 shows the shape of the microstrip line 5 in the reflection-type bandpass filter 1 of the fifth embodiment. A non-reflecting terminator, or an R=50Ω resistance, is provided at the terminating side (the face at z=141.57 mm) of the reflection-type bandpass filter 1. The thickness of the metal films used in the conducting layer 3 and of the conductor constituting the microstrip line 5 should be adequately greater than the skin depth $\delta s=\sqrt{\{2/(\omega\mu 0\sigma)\}}$ at f=1 GHz. For example if copper is used, the thickness of the conducting layer 3 and of the conductor of the microstrip line 5 should be taken as 2.1 μm or greater. This reflection-type bandpass filter is used in a system where the characteristic impedance is 50Ω.

Figure 24:
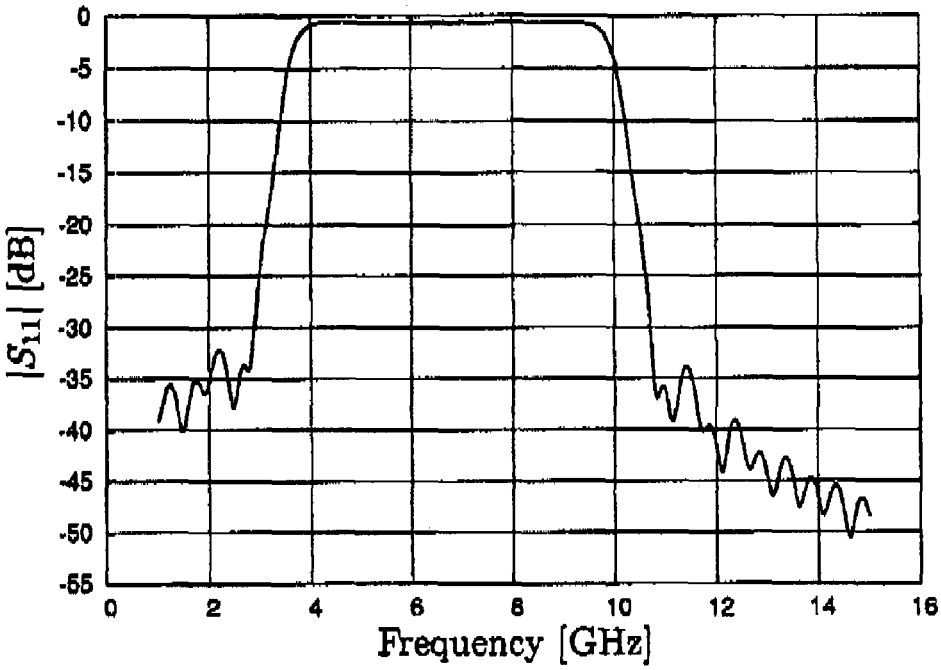
FIG. 24 is a graph showing the amplitude characteristics of the reflective wave in the reflection-type bandpass filter of the fifth embodiment.
Figure 25:
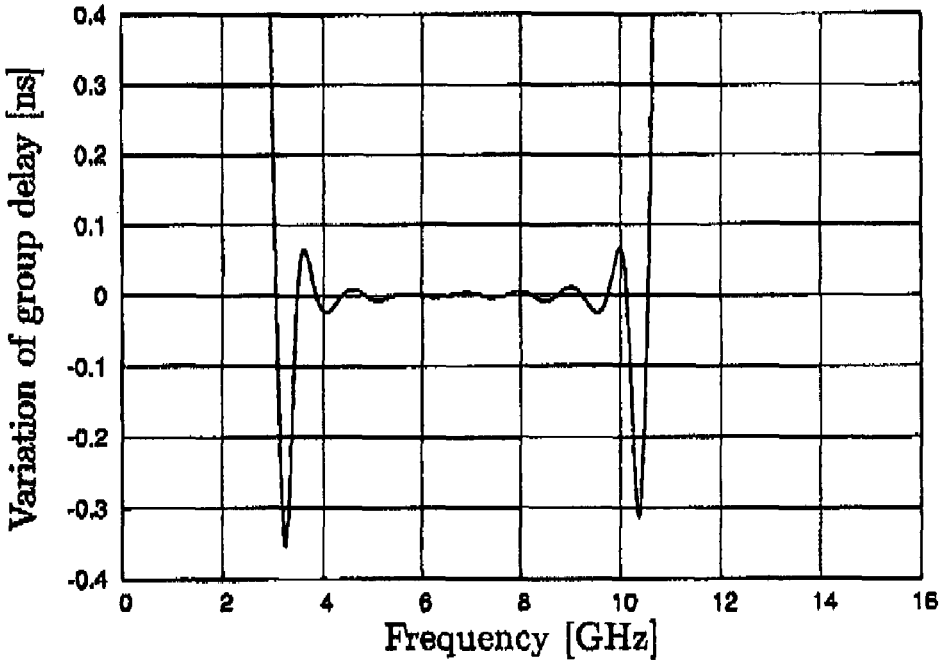
FIG. 25 is a graph showing the group delay frequency characteristics of the reflective wave in the reflection-type bandpass filter of the fifth embodiment.

FIG. 24 and FIG. 25 express the amplitude characteristics and group delay frequency characteristics respectively of the reflective wave (S11) in the bandpass filter of the fifth embodiment. For comparison, the characteristics when the Kaiser window is not used, are also shown. As shown in the figures, in the region of frequency f for which 4.0 GHz≦f≦9.6 GHz, the reflectivity is −1 dB or greater and the variation of the group delay is within ±0.05 ns.

Embodiment 6

A Kaiser window was used for which the reflectivity is 1 at the frequency f in the region 3.7 GHz≦f≦10.0 GHz, and is 0 elsewhere, and for which A=30. Taking 0.3 wavelength at frequency f=1 GHz of the signal transmitted within the microstrip line as the waveguide length, the system characteristic impedance was taken as 50Ω, and the design was carried out.

Figure 26:
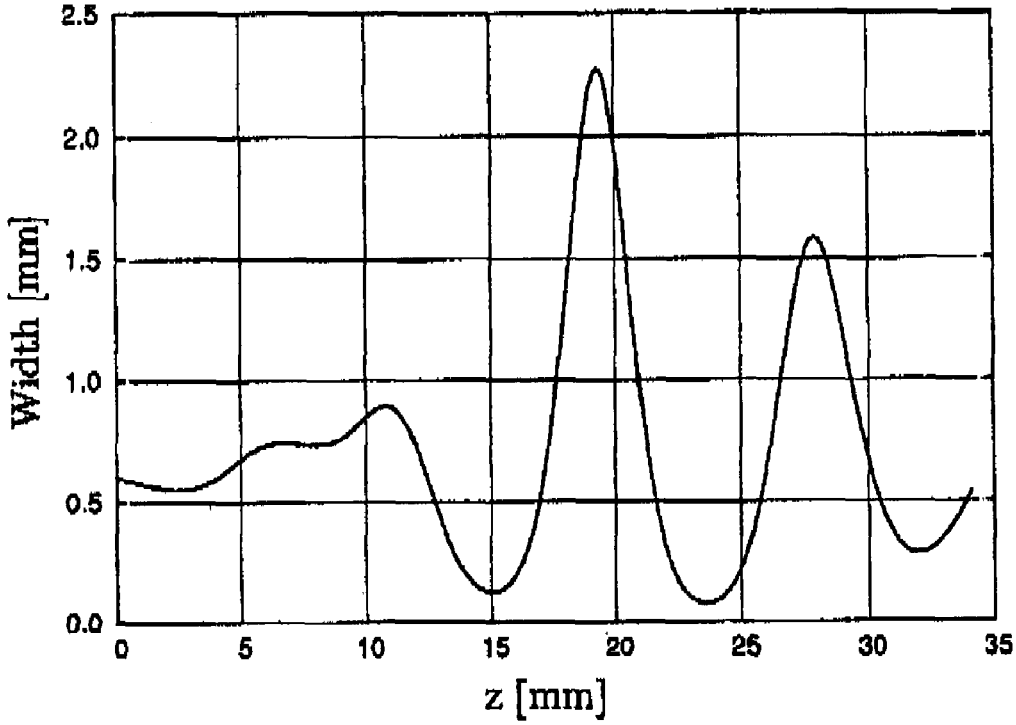
FIG. 26 is a graph showing the distribution in the width direction of the microstrip line in the reflection-type bandpass filter of the sixth embodiment.

FIG. 26 shows the distribution of the width w of the microstrip line 5 in the z-axis direction when a dielectric layer 4 of thickness h=0.635 mm, and relative dielectric constant $\in_r$=10.2 was used. Table 16 lists the widths w of the microstrip line 5.

TABLE 16

| Widths of the microstrip line | | | | | | | | | | | | |
|---|---|---|---|---|---|---|---|---|---|---|---|---|
| | z[mm] | | | | | | | | | | | |
| | 0.00 | 0.11 | 0.23 | 0.34 | 0.46 | 0.57 | 0.68 | 0.80 | 0.91 | 1.03 | 1.14 | 1.25 |
| | w[mm] | | | | | | | | | | | |
| | 0.60 | 0.60 | 0.59 | 0.59 | 0.59 | 0.59 | 0.58 | 0.58 | 0.58 | 0.58 | 0.57 | 0.57 |
| #2 | 1.37 | 1.48 | 1.60 | 1.71 | 1.82 | 1.94 | 2.05 | 2.17 | 2.28 | 2.39 | 2.51 | 2.62 |
| — | 0.57 | 0.56 | 0.56 | 0.56 | 0.56 | 0.55 | 0.55 | 0.55 | 0.55 | 0.55 | 0.55 | 0.55 |
| #3 | 2.74 | 2.85 | 2.97 | 3.08 | 3.19 | 3.31 | 3.42 | 3.54 | 3.65 | 3.76 | 3.88 | 3.99 |
| — | 0.55 | 0.55 | 0.55 | 0.55 | 0.56 | 0.56 | 0.57 | 0.57 | 0.58 | 0.58 | 0.59 | 0.60 |
| #4 | 4.11 | 4.22 | 4.33 | 4.45 | 4.56 | 4.67 | 4.79 | 4.90 | 5.01 | 5.13 | 5.24 | 5.35 |
| — | 0.60 | 0.61 | 0.62 | 0.63 | 0.64 | 0.65 | 0.66 | 0.67 | 0.67 | 0.68 | 0.69 | 0.70 |

TABLE 16-continued

| Widths of the microstrip line | | | | | | | | | | | | |
|---|---|---|---|---|---|---|---|---|---|---|---|---|
| | z[mm] | | | | | | | | | | | |
| | 0.00 | 0.11 | 0.23 | 0.34 | 0.46 | 0.57 | 0.68 | 0.80 | 0.91 | 1.03 | 1.14 | 1.25 |
| | w[mm] | | | | | | | | | | | |
| | 0.60 | 0.60 | 0.59 | 0.59 | 0.59 | 0.59 | 0.58 | 0.58 | 0.58 | 0.58 | 0.57 | 0.57 |
| #5 | 5.47 | 5.58 | 5.69 | 5.80 | 5.92 | 6.03 | 6.14 | 6.25 | 6.37 | 6.48 | 6.59 | 6.71 |
| — | 0.71 | 0.71 | 0.72 | 0.73 | 0.73 | 0.74 | 0.74 | 0.74 | 0.75 | 0.75 | 0.75 | 0.75 |
| #6 | 6.82 | 6.93 | 7.04 | 7.16 | 7.27 | 7.38 | 7.49 | 7.61 | 7.72 | 7.83 | 7.94 | 8.06 |
| — | 0.75 | 0.75 | 0.75 | 0.74 | 0.74 | 0.74 | 0.74 | 0.74 | 0.73 | 0.73 | 0.73 | 0.73 |
| #7 | 8.17 | 8.28 | 8.40 | 8.51 | 8.62 | 8.73 | 8.85 | 8.96 | 9.07 | 9.18 | 9.30 | 9.41 |
| — | 0.73 | 0.73 | 0.74 | 0.74 | 0.74 | 0.75 | 0.75 | 0.76 | 0.77 | 0.78 | 0.79 | 0.79 |
| #8 | 9.52 | 9.63 | 9.75 | 9.86 | 9.97 | 10.08 | 10.19 | 10.30 | 10.42 | 10.53 | 10.64 | 10.75 |
| — | 0.81 | 0.82 | 0.83 | 0.84 | 0.85 | 0.86 | 0.87 | 0.88 | 0.88 | 0.89 | 0.89 | 0.89 |
| #9 | 10.86 | 10.98 | 11.09 | 11.20 | 11.31 | 11.42 | 11.53 | 11.65 | 11.76 | 11.87 | 11.98 | 12.10 |
| — | 0.89 | 0.89 | 0.88 | 0.87 | 0.86 | 0.85 | 0.83 | 0.81 | 0.78 | 0.76 | 0.73 | 0.70 |
| #10 | 12.21 | 12.32 | 12.44 | 12.55 | 12.67 | 12.78 | 12.90 | 13.01 | 13.13 | 13.24 | 13.36 | 13.48 |
| — | 0.66 | 0.63 | 0.59 | 0.56 | 0.52 | 0.48 | 0.45 | 0.41 | 0.38 | 0.35 | 0.32 | 0.29 |
| #11 | 13.60 | 13.71 | 13.83 | 13.95 | 14.07 | 14.19 | 14.31 | 14.43 | 14.55 | 14.67 | 14.79 | 14.91 |
| — | 0.20 | 0.24 | 0.22 | 0.20 | 0.18 | 0.17 | 0.16 | 0.15 | 0.14 | 0.13 | 0.13 | 0.12 |
| #12 | 15.03 | 15.15 | 15.27 | 15.39 | 15.51 | 15.63 | 15.75 | 15.87 | 15.98 | 16.10 | 16.22 | 16.34 |
| — | 0.12 | 0.12 | 0.13 | 0.13 | 0.14 | 0.15 | 0.16 | 0.17 | 0.19 | 0.21 | 0.24 | 0.27 |
| #13 | 16.45 | 16.57 | 16.69 | 16.80 | 16.92 | 17.03 | 17.14 | 17.26 | 17.37 | 17.48 | 17.59 | 17.70 |
| — | 0.30 | 0.34 | 0.39 | 0.44 | 0.50 | 0.56 | 0.63 | 0.71 | 0.80 | 0.89 | 0.98 | 1.08 |
| #14 | 17.81 | 17.92 | 18.03 | 18.14 | 18.25 | 18.36 | 18.46 | 18.57 | 18.68 | 18.79 | 18.89 | 19.00 |
| — | 1.19 | 1.29 | 1.40 | 1.51 | 1.62 | 1.73 | 1.83 | 1.93 | 2.01 | 2.09 | 2.16 | 2.21 |
| #15 | 19.11 | 19.21 | 19.32 | 19.42 | 19.53 | 19.64 | 19.74 | 19.85 | 19.96 | 20.07 | 20.17 | 20.28 |
| — | 2.25 | 2.27 | 2.27 | 2.26 | 2.23 | 2.19 | 2.13 | 2.05 | 1.97 | 1.88 | 1.77 | 1.67 |
| #16 | 20.39 | 20.50 | 20.61 | 20.72 | 20.83 | 20.94 | 21.05 | 21.16 | 21.28 | 21.39 | 21.50 | 21.62 |
| — | 1.55 | 1.44 | 1.33 | 1.21 | 1.10 | 1.00 | 0.90 | 0.80 | 0.71 | 0.63 | 0.55 | 0.48 |
| #17 | 21.74 | 21.85 | 21.97 | 22.09 | 22.20 | 22.32 | 22.44 | 22.56 | 22.68 | 22.80 | 22.92 | 23.04 |
| — | 0.42 | 0.36 | 0.31 | 0.27 | 0.23 | 0.20 | 0.17 | 0.15 | 0.13 | 0.12 | 0.10 | 0.10 |
| #18 | 23.16 | 23.28 | 23.41 | 23.53 | 23.65 | 23.77 | 23.89 | 24.01 | 24.13 | 24.25 | 24.37 | 24.49 |
| — | 0.09 | 0.08 | 0.08 | 0.08 | 0.08 | 0.08 | 0.08 | 0.09 | 0.09 | 0.10 | 0.11 | 0.13 |
| #19 | 24.61 | 24.73 | 24.85 | 24.97 | 25.09 | 25.21 | 25.32 | 25.44 | 25.55 | 25.67 | 25.78 | 25.90 |
| — | 0.14 | 0.16 | 0.19 | 0.21 | 0.25 | 0.28 | 0.32 | 0.37 | 0.42 | 0.47 | 0.53 | 0.59 |
| #20 | 26.01 | 26.12 | 26.24 | 26.35 | 26.46 | 26.57 | 26.68 | 26.79 | 26.90 | 27.01 | 27.12 | 27.23 |
| — | 0.66 | 0.73 | 0.80 | 0.88 | 0.95 | 1.03 | 1.10 | 1.18 | 1.25 | 1.31 | 1.37 | 1.43 |
| #21 | 27.34 | 27.45 | 27.55 | 27.66 | 27.77 | 27.88 | 27.99 | 28.10 | 28.21 | 28.31 | 28.42 | 28.53 |
| — | 1.47 | 1.51 | 1.55 | 1.57 | 1.58 | 1.58 | 1.58 | 1.56 | 1.54 | 1.51 | 1.47 | 1.43 |
| #22 | 28.64 | 28.75 | 28.86 | 28.97 | 29.08 | 29.19 | 29.30 | 29.41 | 29.52 | 29.64 | 29.75 | 29.86 |
| — | 1.38 | 1.33 | 1.27 | 1.21 | 1.15 | 1.08 | 1.02 | 0.96 | 0.90 | 0.84 | 0.78 | 0.73 |
| #23 | 29.98 | 30.09 | 30.20 | 30.32 | 30.43 | 30.55 | 30.66 | 30.78 | 30.89 | 31.01 | 31.13 | 31.24 |
| — | 0.68 | 0.63 | 0.59 | 0.55 | 0.51 | 0.47 | 0.44 | 0.41 | 0.39 | 0.37 | 0.35 | 0.33 |
| #24 | 31.36 | 31.48 | 31.59 | 31.71 | 31.83 | 31.94 | 32.06 | 32.18 | 32.30 | 32.41 | 32.53 | 32.65 |
| — | 0.32 | 0.31 | 0.30 | 0.29 | 0.29 | 0.28 | 0.28 | 0.29 | 0.29 | 0.29 | 0.30 | 0.31 |
| #25 | 32.76 | 32.88 | 33.00 | 33.11 | 33.23 | 33.34 | 33.46 | 33.58 | 33.69 | 33.81 | 33.92 | 34.03 |
| — | 0.32 | 0.33 | 0.34 | 0.36 | 0.37 | 0.39 | 0.41 | 0.43 | 0.45 | 0.47 | 0.50 | 0.52 |
| #26 | 34.15 | | | | | | | | | | | |
| — | 0.54 | | | | | | | | | | | |

Figure 27:
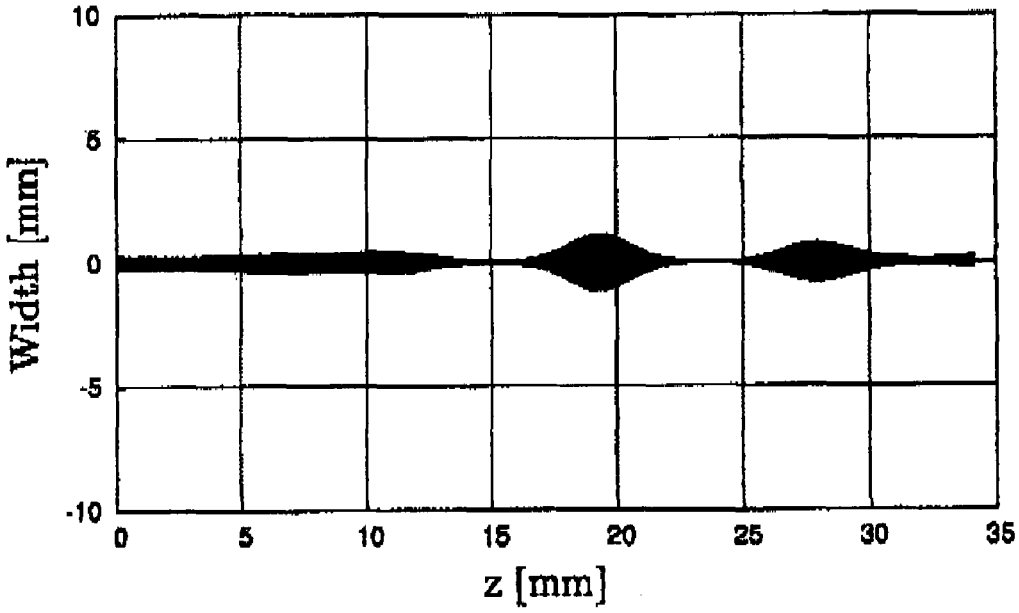
FIG. 27 is a graph showing the surface form of the microstrip line in the reflection-type bandpass filter of the sixth embodiment.

FIG. 27 shows the shape of the microstrip line 5 in the reflection-type band pass filter 1 of the sixth embodiment. A non-reflecting terminator, or an R=50Ω resistance, is provided at the terminating side (the face at z=34.15 mm) of the reflection-type bandpass filter 1. The thickness of the metal films used in the conducting layer 3 and of the conductor constituting the microstrip line 5 should be adequately greater than the skin depth $\delta s=\sqrt{2/(\omega\mu 0\sigma)}$ at f=1 GHz. For example if copper is used, the thickness of the conducting layer 3 and of the conductor of the microstrip line 5 should be taken as 2.1 μm or greater. This reflection-type bandpass filter is used in a system where the characteristic impedance is 50Ω.

Figure 28:
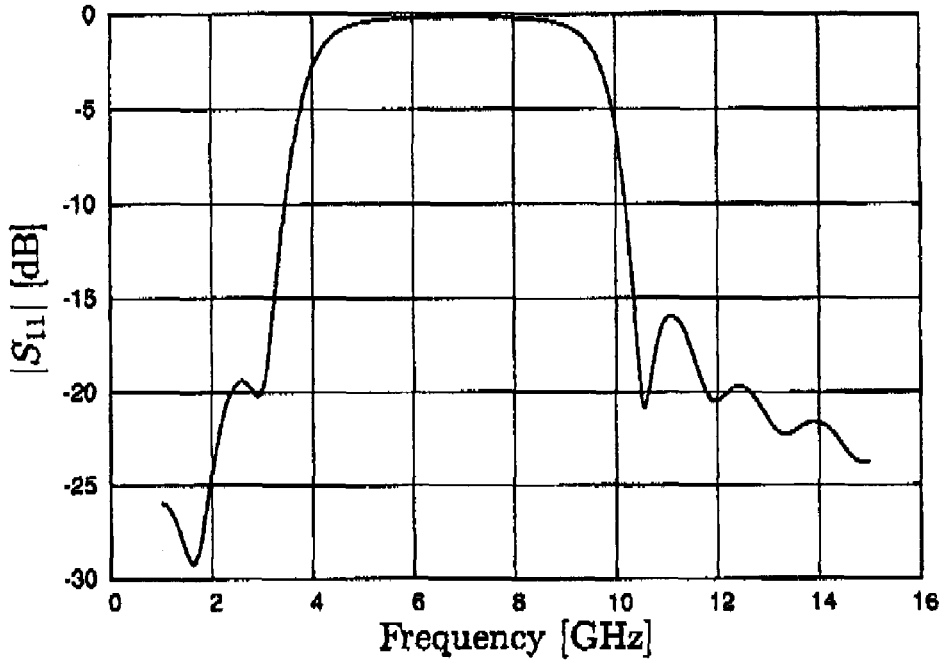
FIG. 28 is a graph showing the amplitude characteristics of the reflective wave in the reflection-type bandpass filter of the sixth embodiment.
Figure 29:
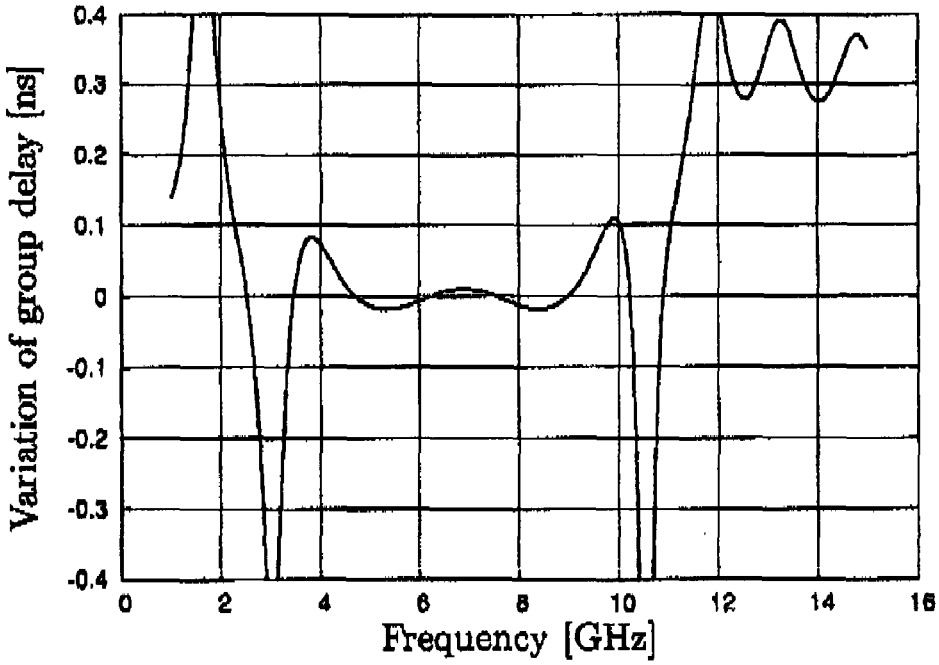
FIG. 29 is a graph showing the group delay frequency characteristics of the reflective wave in the reflection-type bandpass filter of the sixth embodiment.

FIG. 28 and FIG. 29 express the amplitude characteristics and group delay frequency characteristics respectively of the reflective wave (S11) in the bandpass filter of the sixth embodiment. As shown in the figures, in the region of frequency f for which 4.2 GHz≦f≦9.6 GHz, the reflectivity is −2 dB or greater and the variation of the group delay is within ±0.15 ns. In the region f<3.1 GHz and f>10.6 GHz, the reflectivity is −15 dB or lower.

Embodiment 7

A Kaiser window was used for which the reflectivity is 1 at the frequency f in the region 3.3 GHz≦f≦10.4 GHz, and is 0 elsewhere, and for which A=35. Taking one wavelength at frequency f=1 GHz of the signal transmitted within the microstrip line as the waveguide length, the system characteristic impedance was taken as 50Ω, and the design was carried out.

Figure 30:
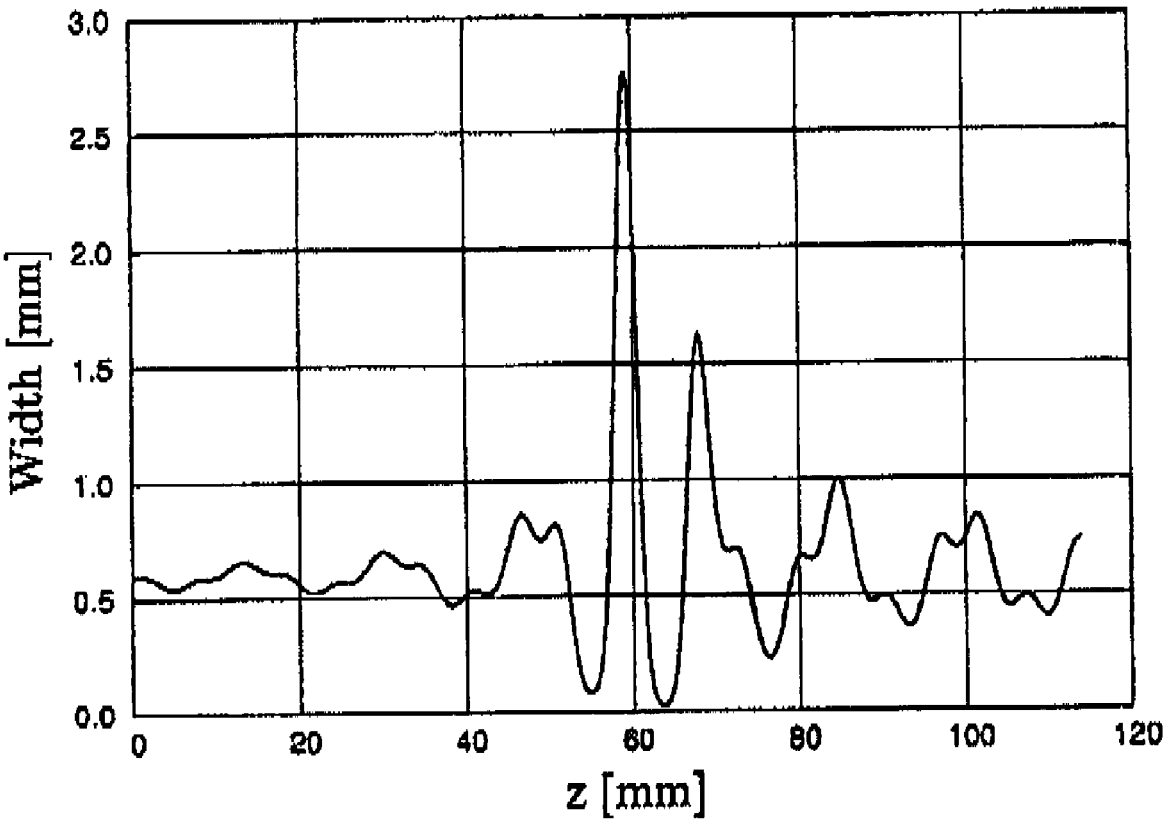
FIG. 30 is a graph showing the distribution in the width direction of the microstrip line in the reflection-type bandpass filter of the seventh embodiment.

FIG. 30 shows the distribution of the width w of the microstrip line 5 in the z-axis direction when a dielectric layer 4 of thickness h=0.635 mm, and relative dielectric constant $\epsilon_r$=10.2 (for example, RT/Duroid (registered trademark) 6010LM) was used. Tables 17 through 19 list the widths w of the microstrip line 5.

TABLE 17

| Widths of the microstrip line | | | | | | | | | | | | |
|---|---|---|---|---|---|---|---|---|---|---|---|---|
| | z[mm] | | | | | | | | | | | |
| | 0.00 | 0.11 | 0.23 | 0.34 | 0.46 | 0.57 | 0.68 | 0.80 | 0.91 | 1.02 | 1.14 | 1.25 |
| | w[mm] | | | | | | | | | | | |
| | 0.60 | 0.60 | 0.60 | 0.59 | 0.59 | 0.59 | 0.59 | 0.59 | 0.59 | 0.59 | 0.59 | 0.59 |
| #2 | 1.37 | 1.48 | 1.59 | 1.71 | 1.82 | 1.94 | 2.05 | 2.16 | 2.28 | 2.39 | 2.50 | 2.62 |
| — | 0.59 | 0.59 | 0.59 | 0.59 | 0.59 | 0.59 | 0.59 | 0.59 | 0.59 | 0.59 | 0.58 | 0.58 |
| #3 | 2.73 | 2.85 | 2.96 | 3.07 | 3.19 | 3.30 | 3.42 | 3.53 | 3.65 | 3.76 | 3.87 | 3.99 |
| — | 0.58 | 0.58 | 0.57 | 0.57 | 0.57 | 0.57 | 0.56 | 0.56 | 0.56 | 0.56 | 0.55 | 0.55 |
| #4 | 4.10 | 4.22 | 4.33 | 4.44 | 4.56 | 4.67 | 4.79 | 4.90 | 5.02 | 5.13 | 5.24 | 5.36 |
| — | 0.55 | 0.55 | 0.55 | 0.55 | 0.54 | 0.54 | 0.54 | 0.54 | 0.54 | 0.54 | 0.54 | 0.54 |
| #5 | 5.47 | 5.59 | 5.70 | 5.82 | 5.93 | 6.04 | 6.16 | 6.27 | 6.39 | 6.50 | 6.61 | 6.73 |
| — | 0.54 | 0.55 | 0.55 | 0.55 | 0.55 | 0.55 | 0.55 | 0.56 | 0.56 | 0.56 | 0.56 | 0.57 |
| #6 | 6.84 | 6.96 | 7.07 | 7.19 | 7.30 | 7.41 | 7.53 | 7.64 | 7.75 | 7.87 | 7.98 | 8.10 |
| — | 0.57 | 0.57 | 0.57 | 0.58 | 0.58 | 0.58 | 0.58 | 0.58 | 0.58 | 0.59 | 0.59 | 0.59 |
| #7 | 8.21 | 8.32 | 8.44 | 8.55 | 8.67 | 8.78 | 8.89 | 9.01 | 9.12 | 9.24 | 9.35 | 9.46 |
| — | 0.59 | 0.59 | 0.59 | 0.59 | 0.59 | 0.59 | 0.59 | 0.59 | 0.59 | 0.59 | 0.59 | 0.59 |
| #8 | 9.58 | 9.69 | 9.80 | 9.92 | 10.03 | 10.15 | 10.26 | 10.37 | 10.49 | 10.60 | 10.72 | 10.83 |
| — | 0.59 | 0.59 | 0.59 | 0.59 | 0.59 | 0.59 | 0.60 | 0.60 | 0.60 | 0.60 | 0.60 | 0.61 |
| #9 | 10.94 | 11.06 | 11.17 | 11.28 | 11.40 | 11.51 | 11.62 | 11.74 | 11.85 | 11.96 | 12.08 | 12.19 |
| — | 0.61 | 0.61 | 0.61 | 0.62 | 0.62 | 0.62 | 0.63 | 0.63 | 0.63 | 0.64 | 0.64 | 0.64 |
| #10 | 12.31 | 12.42 | 12.53 | 12.65 | 12.76 | 12.87 | 12.98 | 13.10 | 13.21 | 13.32 | 13.44 | 13.55 |
| — | 0.65 | 0.65 | 0.65 | 0.66 | 0.66 | 0.66 | 0.66 | 0.66 | 0.66 | 0.66 | 0.66 | 0.66 |
| #11 | 13.66 | 13.78 | 13.89 | 14.00 | 14.12 | 14.23 | 14.34 | 14.46 | 14.57 | 14.69 | 14.80 | 14.91 |
| — | 0.66 | 0.66 | 0.66 | 0.66 | 0.65 | 0.65 | 0.65 | 0.65 | 0.64 | 0.64 | 0.64 | 0.63 |
| #12 | 15.03 | 15.14 | 15.25 | 15.37 | 15.48 | 15.59 | 15.71 | 15.82 | 15.93 | 16.05 | 16.16 | 16.28 |
| — | 0.63 | 0.63 | 0.63 | 0.62 | 0.62 | 0.62 | 0.62 | 0.62 | 0.61 | 0.61 | 0.61 | 0.61 |
| #13 | 16.39 | 16.50 | 16.62 | 16.73 | 16.84 | 16.96 | 17.07 | 17.19 | 17.30 | 17.41 | 17.53 | 17.64 |
| — | 0.61 | 0.61 | 0.61 | 0.61 | 0.61 | 0.61 | 0.61 | 0.61 | 0.61 | 0.61 | 0.61 | 0.61 |
| #14 | 17.75 | 17.87 | 17.98 | 18.09 | 18.21 | 18.32 | 18.44 | 18.55 | 18.66 | 18.78 | 18.89 | 19.01 |
| — | 0.61 | 0.61 | 0.61 | 0.61 | 0.61 | 0.60 | 0.60 | 0.60 | 0.60 | 0.60 | 0.59 | 0.59 |
| #15 | 19.12 | 19.23 | 19.35 | 19.46 | 19.58 | 19.69 | 19.80 | 19.92 | 20.03 | 20.15 | 20.26 | 20.37 |
| — | 0.59 | 0.58 | 0.58 | 0.57 | 0.57 | 0.57 | 0.56 | 0.56 | 0.55 | 0.55 | 0.55 | 0.54 |
| #16 | 20.49 | 20.60 | 20.72 | 20.83 | 20.95 | 21.06 | 21.18 | 21.29 | 21.40 | 21.52 | 21.63 | 21.75 |
| — | 0.54 | 0.54 | 0.53 | 0.53 | 0.53 | 0.52 | 0.52 | 0.52 | 0.52 | 0.52 | 0.52 | 0.52 |
| #17 | 21.86 | 21.98 | 22.09 | 22.21 | 22.32 | 22.43 | 22.55 | 22.66 | 22.78 | 22.89 | 23.01 | 23.12 |
| — | 0.52 | 0.52 | 0.52 | 0.52 | 0.53 | 0.53 | 0.53 | 0.53 | 0.54 | 0.54 | 0.54 | 0.55 |
| #18 | 23.23 | 23.35 | 23.46 | 23.58 | 23.69 | 23.81 | 23.92 | 24.03 | 24.15 | 24.26 | 24.38 | 24.49 |
| — | 0.55 | 0.55 | 0.55 | 0.56 | 0.56 | 0.56 | 0.56 | 0.56 | 0.57 | 0.57 | 0.57 | 0.57 |
| #19 | 24.60 | 24.72 | 24.83 | 24.95 | 25.06 | 25.17 | 25.29 | 25.40 | 25.52 | 25.63 | 25.74 | 25.86 |
| — | 0.57 | 0.57 | 0.57 | 0.57 | 0.57 | 0.57 | 0.57 | 0.57 | 0.57 | 0.57 | 0.57 | 0.57 |
| #20 | 25.97 | 26.09 | 26.20 | 26.31 | 26.43 | 26.54 | 26.66 | 26.77 | 26.88 | 27.00 | 27.11 | 27.23 |
| — | 0.57 | 0.57 | 0.57 | 0.57 | 0.57 | 0.57 | 0.58 | 0.58 | 0.58 | 0.58 | 0.59 | 0.59 |
| #21 | 27.34 | 27.45 | 27.57 | 27.68 | 27.79 | 27.91 | 28.02 | 28.14 | 28.25 | 28.36 | 28.48 | 28.59 |
| — | 0.60 | 0.60 | 0.61 | 0.61 | 0.62 | 0.62 | 0.63 | 0.64 | 0.64 | 0.65 | 0.65 | 0.66 |
| #22 | 28.70 | 28.82 | 28.93 | 29.04 | 29.15 | 29.27 | 29.38 | 29.49 | 29.61 | 29.72 | 29.83 | 29.95 |
| — | 0.67 | 0.67 | 0.68 | 0.68 | 0.69 | 0.69 | 0.69 | 0.69 | 0.70 | 0.70 | 0.70 | 0.70 |
| #23 | 30.06 | 30.17 | 30.28 | 30.40 | 30.51 | 30.62 | 30.74 | 30.85 | 30.96 | 31.08 | 31.19 | 31.30 |
| — | 0.70 | 0.70 | 0.70 | 0.69 | 0.69 | 0.69 | 0.69 | 0.68 | 0.68 | 0.68 | 0.67 | 0.67 |
| #24 | 31.42 | 31.53 | 31.64 | 31.76 | 31.87 | 31.98 | 32.10 | 32.21 | 32.32 | 32.44 | 32.55 | 32.66 |
| — | 0.66 | 0.66 | 0.66 | 0.65 | 0.65 | 0.65 | 0.65 | 0.64 | 0.64 | 0.64 | 0.64 | 0.64 |
| #25 | 32.78 | 32.89 | 33.00 | 33.12 | 33.23 | 33.34 | 33.46 | 33.57 | 33.68 | 33.80 | 33.91 | 34.02 |
| — | 0.64 | 0.64 | 0.64 | 0.64 | 0.64 | 0.64 | 0.64 | 0.64 | 0.64 | 0.64 | 0.64 | 0.64 |
| #26 | 34.14 | 34.25 | 34.37 | 34.48 | 34.59 | 34.71 | 34.82 | 34.93 | 35.05 | 35.16 | 35.27 | 35.39 |
| — | 0.64 | 0.64 | 0.64 | 0.64 | 0.64 | 0.64 | 0.63 | 0.63 | 0.63 | 0.62 | 0.62 | 0.61 |
| #27 | 35.50 | 35.61 | 35.73 | 35.84 | 35.96 | 36.07 | 36.18 | 36.30 | 36.41 | 36.53 | 36.64 | 36.76 |
| — | 0.60 | 0.60 | 0.59 | 0.58 | 0.58 | 0.57 | 0.56 | 0.55 | 0.54 | 0.54 | 0.53 | 0.52 |
| #28 | 36.87 | 36.99 | 37.10 | 37.22 | 37.33 | 37.44 | 37.56 | 37.67 | 37.79 | 37.90 | 38.02 | 38.13 |
| — | 0.51 | 0.51 | 0.50 | 0.49 | 0.49 | 0.48 | 0.48 | 0.48 | 0.47 | 0.47 | 0.47 | 0.47 |
| #29 | 38.25 | 38.36 | 38.48 | 38.59 | 38.71 | 38.82 | 38.94 | 39.05 | 39.17 | 39.28 | 39.40 | 39.51 |
| — | 0.47 | 0.47 | 0.47 | 0.47 | 0.47 | 0.48 | 0.48 | 0.48 | 0.49 | 0.49 | 0.49 | 0.50 |
| #30 | 39.63 | 39.74 | 39.86 | 39.97 | 40.09 | 40.20 | 40.32 | 40.43 | 40.54 | 40.66 | 40.77 | 40.89 |
| — | 0.50 | 0.50 | 0.51 | 0.51 | 0.51 | 0.52 | 0.52 | 0.52 | 0.52 | 0.53 | 0.53 | 0.53 |

TABLE 18

| Widths of the microstrip line | | | | | | | | | | | | |
|---|---|---|---|---|---|---|---|---|---|---|---|---|
| #31 | 41.00 | 41.12 | 41.23 | 41.35 | 41.46 | 41.57 | 41.69 | 41.80 | 41.92 | 42.03 | 42.15 | 42.26 |
| — | 0.53 | 0.53 | 0.52 | 0.52 | 0.52 | 0.52 | 0.52 | 0.52 | 0.52 | 0.51 | 0.51 | 0.51 |
| #32 | 42.38 | 42.49 | 42.61 | 42.72 | 42.83 | 42.95 | 43.06 | 43.18 | 43.29 | 43.41 | 43.52 | 43.63 |
| — | 0.51 | 0.51 | 0.51 | 0.51 | 0.52 | 0.52 | 0.52 | 0.53 | 0.53 | 0.54 | 0.55 | 0.56 |

TABLE 18-continued

| Widths of the microstrip line | | | | | | | | | | | | |
|---|---|---|---|---|---|---|---|---|---|---|---|---|
| #33 | 43.75 | 43.86 | 43.98 | 44.09 | 44.20 | 44.32 | 44.43 | 44.54 | 44.66 | 44.77 | 44.88 | 45.00 |
| — | 0.57 | 0.58 | 0.59 | 0.60 | 0.61 | 0.63 | 0.64 | 0.66 | 0.67 | 0.69 | 0.71 | 0.72 |
| #34 | 45.11 | 45.22 | 45.33 | 45.45 | 45.56 | 45.67 | 45.78 | 45.90 | 46.01 | 46.12 | 46.23 | 46.34 |
| — | 0.74 | 0.75 | 0.77 | 0.78 | 0.80 | 0.81 | 0.82 | 0.83 | 0.84 | 0.84 | 0.85 | 0.85 |
| #35 | 46.46 | 46.57 | 46.68 | 46.79 | 46.90 | 47.02 | 47.13 | 47.24 | 47.35 | 47.46 | 47.58 | 47.69 |
| — | 0.86 | 0.86 | 0.86 | 0.85 | 0.85 | 0.84 | 0.84 | 0.83 | 0.82 | 0.82 | 0.81 | 0.80 |
| #36 | 47.80 | 47.91 | 48.03 | 48.14 | 48.25 | 48.36 | 48.48 | 48.59 | 48.70 | 48.81 | 48.93 | 49.04 |
| — | 0.79 | 0.78 | 0.78 | 0.77 | 0.76 | 0.76 | 0.75 | 0.75 | 0.75 | 0.74 | 0.74 | 0.75 |
| #37 | 49.15 | 49.26 | 49.38 | 49.49 | 49.60 | 49.71 | 49.83 | 49.94 | 50.05 | 50.16 | 50.28 | 50.39 |
| — | 0.75 | 0.75 | 0.75 | 0.76 | 0.77 | 0.77 | 0.78 | 0.78 | 0.79 | 0.80 | 0.80 | 0.81 |
| #38 | 50.50 | 50.61 | 50.72 | 50.84 | 50.95 | 51.06 | 51.17 | 51.29 | 51.40 | 51.51 | 51.62 | 51.74 |
| — | 0.81 | 0.81 | 0.81 | 0.81 | 0.80 | 0.80 | 0.79 | 0.77 | 0.76 | 0.74 | 0.71 | 0.69 |
| #39 | 51.85 | 51.96 | 52.08 | 52.19 | 52.31 | 52.42 | 52.54 | 52.65 | 52.77 | 52.88 | 53.00 | 53.12 |
| — | 0.66 | 0.63 | 0.60 | 0.57 | 0.53 | 0.50 | 0.46 | 0.42 | 0.39 | 0.35 | 0.32 | 0.29 |
| #40 | 53.24 | 53.35 | 53.47 | 53.59 | 53.71 | 53.83 | 53.95 | 54.07 | 54.19 | 54.31 | 54.43 | 54.55 |
| — | 0.26 | 0.23 | 0.21 | 0.19 | 0.17 | 0.15 | 0.13 | 0.12 | 0.11 | 0.10 | 0.09 | 0.09 |
| #41 | 54.67 | 54.79 | 54.92 | 55.04 | 55.16 | 55.28 | 55.40 | 55.52 | 55.64 | 55.76 | 55.88 | 56.00 |
| — | 0.08 | 0.08 | 0.08 | 0.08 | 0.08 | 0.09 | 0.09 | 0.10 | 0.11 | 0.12 | 0.14 | 0.16 |
| #42 | 56.12 | 56.24 | 56.36 | 56.47 | 56.59 | 56.71 | 56.82 | 56.94 | 57.05 | 57.16 | 57.28 | 57.39 |
| — | 0.18 | 0.21 | 0.24 | 0.28 | 0.33 | 0.39 | 0.45 | 0.52 | 0.60 | 0.68 | 0.78 | 0.89 |
| #43 | 57.50 | 57.61 | 57.72 | 57.83 | 57.94 | 58.04 | 58.15 | 58.26 | 58.37 | 58.47 | 58.58 | 58.68 |
| — | 1.00 | 1.12 | 1.24 | 1.38 | 1.52 | 1.66 | 1.80 | 1.94 | 2.08 | 2.21 | 2.34 | 2.45 |
| #44 | 58.79 | 58.90 | 59.00 | 59.11 | 59.21 | 59.32 | 59.42 | 59.53 | 59.63 | 59.74 | 59.84 | 59.95 |
| — | 2.55 | 2.63 | 2.70 | 2.74 | 2.76 | 2.76 | 2.73 | 2.68 | 2.61 | 2.52 | 2.41 | 2.29 |
| #45 | 60.06 | 60.16 | 60.27 | 60.38 | 60.49 | 60.60 | 60.71 | 60.82 | 60.93 | 61.04 | 61.15 | 61.27 |
| — | 2.15 | 2.01 | 1.86 | 1.71 | 1.56 | 1.42 | 1.27 | 1.13 | 1.00 | 0.88 | 0.76 | 0.66 |
| #46 | 61.38 | 61.50 | 61.61 | 61.73 | 61.85 | 61.96 | 62.08 | 62.20 | 62.32 | 62.44 | 62.56 | 62.69 |
| — | 0.56 | 0.47 | 0.40 | 0.33 | 0.27 | 0.22 | 0.18 | 0.15 | 0.12 | 0.10 | 0.08 | 0.06 |
| #47 | 62.81 | 62.93 | 63.05 | 63.18 | 63.30 | 63.42 | 63.55 | 63.67 | 63.79 | 63.92 | 64.04 | 64.16 |
| — | 0.05 | 0.04 | 0.04 | 0.03 | 0.03 | 0.03 | 0.03 | 0.03 | 0.03 | 0.03 | 0.03 | 0.04 |
| #48 | 64.29 | 64.41 | 64.53 | 64.65 | 64.77 | 64.90 | 65.02 | 65.14 | 65.25 | 65.37 | 65.49 | 65.61 |
| — | 0.04 | 0.05 | 0.06 | 0.07 | 0.08 | 0.10 | 0.12 | 0.15 | 0.18 | 0.21 | 0.26 | 0.31 |
| #49 | 65.72 | 65.84 | 65.95 | 66.07 | 66.18 | 66.29 | 66.41 | 66.52 | 66.63 | 66.74 | 66.85 | 66.96 |
| — | 0.36 | 0.42 | 0.49 | 0.50 | 0.64 | 0.72 | 0.80 | 0.88 | 0.97 | 1.05 | 1.14 | 1.22 |
| #50 | 67.07 | 67.18 | 67.29 | 67.40 | 67.51 | 67.61 | 67.72 | 67.83 | 67.94 | 68.05 | 68.16 | 68.26 |
| — | 1.29 | 1.37 | 1.43 | 1.49 | 1.53 | 1.57 | 1.60 | 1.62 | 1.63 | 1.63 | 1.61 | 1.59 |
| #51 | 68.37 | 68.48 | 68.59 | 68.70 | 68.81 | 68.92 | 69.03 | 69.14 | 69.25 | 69.36 | 69.47 | 69.58 |
| — | 1.57 | 1.53 | 1.49 | 1.45 | 1.40 | 1.35 | 1.30 | 1.25 | 1.19 | 1.14 | 1.09 | 1.05 |
| #52 | 69.69 | 69.80 | 69.91 | 70.02 | 70.14 | 70.25 | 70.36 | 70.47 | 70.59 | 70.70 | 70.81 | 70.92 |
| — | 1.00 | 0.96 | 0.92 | 0.88 | 0.85 | 0.82 | 0.80 | 0.77 | 0.75 | 0.74 | 0.72 | 0.71 |
| #53 | 71.04 | 71.15 | 71.26 | 71.38 | 71.49 | 71.60 | 71.72 | 71.83 | 71.94 | 72.05 | 72.17 | 72.28 |
| — | 0.71 | 0.70 | 0.70 | 0.69 | 0.69 | 0.69 | 0.70 | 0.70 | 0.70 | 0.70 | 0.71 | 0.71 |
| #54 | 72.39 | 72.51 | 72.62 | 72.73 | 72.84 | 72.96 | 73.07 | 73.18 | 73.30 | 73.41 | 73.52 | 73.64 |
| — | 0.71 | 0.71 | 0.70 | 0.70 | 0.69 | 0.69 | 0.68 | 0.67 | 0.65 | 0.64 | 0.62 | 0.60 |
| #55 | 73.75 | 73.87 | 73.98 | 74.10 | 74.21 | 74.33 | 74.44 | 74.56 | 74.67 | 74.79 | 74.90 | 75.02 |
| — | 0.58 | 0.55 | 0.53 | 0.51 | 0.48 | 0.46 | 0.44 | 0.41 | 0.39 | 0.37 | 0.35 | 0.33 |
| #56 | 75.14 | 75.26 | 75.37 | 75.49 | 75.61 | 75.73 | 75.84 | 75.96 | 76.08 | 76.20 | 76.32 | 76.43 |
| — | 0.31 | 0.30 | 0.28 | 0.27 | 0.26 | 0.25 | 0.24 | 0.24 | 0.23 | 0.23 | 0.23 | 0.23 |
| #57 | 76.55 | 76.67 | 76.79 | 76.90 | 77.02 | 77.14 | 77.26 | 77.37 | 77.49 | 77.61 | 77.72 | 77.84 |
| — | 0.23 | 0.23 | 0.24 | 0.25 | 0.26 | 0.27 | 0.28 | 0.29 | 0.31 | 0.32 | 0.34 | 0.36 |
| #58 | 77.96 | 78.07 | 78.19 | 78.30 | 78.42 | 78.53 | 78.65 | 78.76 | 78.88 | 78.99 | 79.10 | 79.22 |
| — | 0.38 | 0.40 | 0.42 | 0.44 | 0.46 | 0.48 | 0.51 | 0.53 | 0.55 | 0.57 | 0.58 | 0.60 |
| #59 | 79.33 | 79.45 | 79.56 | 79.67 | 79.79 | 79.90 | 80.01 | 80.13 | 80.24 | 80.35 | 80.46 | 80.58 |
| — | 0.62 | 0.63 | 0.64 | 0.65 | 0.66 | 0.66 | 0.67 | 0.67 | 0.67 | 0.67 | 0.67 | 0.67 |
| #60 | 80.69 | 80.80 | 80.92 | 81.03 | 81.14 | 81.26 | 81.37 | 81.48 | 81.60 | 81.71 | 81.82 | 81.94 |
| — | 0.67 | 0.66 | 0.66 | 0.66 | 0.66 | 0.66 | 0.65 | 0.65 | 0.66 | 0.66 | 0.66 | 0.67 |

TABLE 19

| Widths of the microstrip line | | | | | | | | | | | | |
|---|---|---|---|---|---|---|---|---|---|---|---|---|
| #61 | 82.05 | 82.16 | 82.28 | 82.39 | 82.50 | 82.62 | 82.73 | 82.84 | 82.95 | 83.07 | 83.18 | 83.29 |
| — | 0.67 | 0.68 | 0.69 | 0.70 | 0.71 | 0.73 | 0.74 | 0.76 | 0.77 | 0.79 | 0.81 | 0.83 |
| #62 | 83.40 | 83.51 | 83.63 | 83.74 | 83.85 | 83.96 | 84.07 | 84.18 | 84.29 | 84.40 | 84.52 | 84.63 |
| — | 0.85 | 0.87 | 0.89 | 0.91 | 0.93 | 0.94 | 0.96 | 0.97 | 0.98 | 0.99 | 1.00 | 1.00 |
| #63 | 84.74 | 84.85 | 84.96 | 85.07 | 85.18 | 85.29 | 85.41 | 85.52 | 85.63 | 85.74 | 85.85 | 85.96 |
| — | 1.00 | 1.00 | 1.00 | 0.99 | 0.98 | 0.96 | 0.95 | 0.93 | 0.91 | 0.88 | 0.86 | 0.84 |
| #64 | 86.08 | 86.19 | 86.30 | 86.41 | 86.53 | 86.64 | 86.75 | 86.87 | 86.98 | 87.09 | 87.21 | 87.32 |
| — | 0.81 | 0.79 | 0.76 | 0.73 | 0.71 | 0.68 | 0.66 | 0.64 | 0.62 | 0.60 | 0.58 | 0.56 |
| #65 | 87.44 | 87.55 | 87.67 | 87.78 | 87.89 | 88.01 | 88.12 | 88.24 | 88.35 | 88.47 | 88.58 | 88.70 |
| — | 0.54 | 0.53 | 0.52 | 0.51 | 0.50 | 0.49 | 0.48 | 0.48 | 0.48 | 0.47 | 0.47 | 0.47 |
| #66 | 88.81 | 88.93 | 89.04 | 89.16 | 89.27 | 89.39 | 89.50 | 89.62 | 89.73 | 89.85 | 89.96 | 90.08 |
| — | 0.47 | 0.48 | 0.48 | 0.48 | 0.48 | 0.49 | 0.49 | 0.49 | 0.50 | 0.50 | 0.50 | 0.50 |

TABLE 19-continued

| Widths of the microstrip line | | | | | | | | | | | | |
|---|---|---|---|---|---|---|---|---|---|---|---|---|
| #67 | 90.19 | 90.31 | 90.42 | 90.54 | 90.65 | 90.76 | 90.88 | 90.99 | 91.11 | 91.22 | 91.34 | 91.46 |
| — | 0.50 | 0.50 | 0.50 | 0.50 | 0.49 | 0.49 | 0.48 | 0.48 | 0.47 | 0.46 | 0.46 | 0.45 |
| #68 | 91.57 | 91.69 | 91.80 | 91.92 | 92.03 | 92.15 | 92.26 | 92.38 | 92.50 | 92.61 | 92.73 | 92.84 |
| — | 0.44 | 0.43 | 0.42 | 0.41 | 0.41 | 0.40 | 0.39 | 0.38 | 0.38 | 0.37 | 0.37 | 0.37 |
| #69 | 92.96 | 93.08 | 93.19 | 93.31 | 93.42 | 93.54 | 93.66 | 93.77 | 93.89 | 94.00 | 94.12 | 94.24 |
| — | 0.36 | 0.36 | 0.36 | 0.36 | 0.37 | 0.37 | 0.38 | 0.38 | 0.39 | 0.40 | 0.41 | 0.42 |
| #70 | 94.35 | 94.47 | 94.58 | 94.70 | 94.81 | 94.92 | 95.04 | 95.15 | 95.27 | 95.38 | 95.49 | 95.61 |
| — | 0.44 | 0.45 | 0.47 | 0.48 | 0.50 | 0.52 | 0.54 | 0.56 | 0.57 | 0.59 | 0.61 | 0.63 |
| #71 | 95.72 | 95.84 | 95.95 | 96.06 | 96.17 | 96.29 | 96.40 | 96.51 | 96.63 | 96.74 | 96.85 | 96.96 |
| — | 0.65 | 0.66 | 0.68 | 0.69 | 0.71 | 0.72 | 0.73 | 0.74 | 0.74 | 0.75 | 0.75 | 0.75 |
| #72 | 97.08 | 97.19 | 97.30 | 97.41 | 97.53 | 97.64 | 97.75 | 97.86 | 97.98 | 98.09 | 98.20 | 98.32 |
| — | 0.75 | 0.75 | 0.75 | 0.75 | 0.75 | 0.74 | 0.74 | 0.73 | 0.73 | 0.72 | 0.72 | 0.71 |
| #73 | 98.43 | 98.54 | 98.65 | 98.77 | 98.88 | 98.99 | 99.11 | 99.22 | 99.33 | 99.45 | 99.56 | 99.67 |
| — | 0.71 | 0.71 | 0.70 | 0.70 | 0.70 | 0.70 | 0.71 | 0.71 | 0.71 | 0.72 | 0.72 | 0.73 |
| #74 | 99.78 | 99.90 | 100.01 | 100.12 | 100.23 | 100.35 | 100.46 | 100.57 | 100.68 | 100.80 | 100.91 | 101.02 |
| — | 0.74 | 0.75 | 0.75 | 0.76 | 0.77 | 0.78 | 0.79 | 0.80 | 0.81 | 0.82 | 0.83 | 0.83 |
| #75 | 101.13 | 101.24 | 101.36 | 101.47 | 101.58 | 101.69 | 101.80 | 101.92 | 102.03 | 102.14 | 102.25 | 102.36 |
| — | 0.84 | 0.84 | 0.84 | 0.84 | 0.84 | 0.84 | 0.83 | 0.83 | 0.82 | 0.81 | 0.79 | 0.78 |
| #76 | 102.48 | 102.59 | 102.70 | 102.82 | 102.93 | 103.04 | 103.16 | 103.27 | 103.38 | 103.50 | 103.61 | 103.72 |
| — | 0.76 | 0.75 | 0.73 | 0.71 | 0.69 | 0.68 | 0.66 | 0.64 | 0.62 | 0.60 | 0.58 | 0.57 |
| #77 | 103.84 | 103.95 | 104.07 | 104.18 | 104.30 | 104.41 | 104.53 | 104.64 | 104.76 | 104.87 | 104.99 | 105.10 |
| — | 0.55 | 0.54 | 0.52 | 0.51 | 0.50 | 0.49 | 0.48 | 047 | 0.46 | 0.46 | 0.46 | 0.45 |
| #78 | 105.22 | 105.33 | 105.45 | 105.56 | 105.68 | 105.79 | 105.91 | 106.02 | 106.14 | 106.25 | 106.37 | 106.48 |
| — | 0.45 | 0.45 | 0.45 | 0.45 | 0.45 | 0.46 | 0.46 | 0.46 | 0.47 | 0.47 | 0.47 | 0.48 |
| #79 | 106.60 | 106.71 | 106.83 | 106.94 | 107.06 | 107.17 | 107.29 | 107.40 | 107.52 | 107.63 | 107.75 | 107.86 |
| — | 0.48 | 0.48 | 0.49 | 0.49 | 0.49 | 0.49 | 0.49 | 0.49 | 0.49 | 0.49 | 0.49 | 0.48 |
| #80 | 107.97 | 108.09 | 108.20 | 108.32 | 108.43 | 108.55 | 108.67 | 108.78 | 108.90 | 109.01 | 109.13 | 109.24 |
| — | 0.48 | 0.48 | 0.47 | 0.46 | 0.46 | 0.45 | 0.45 | 0.44 | 0.43 | 0.43 | 0.42 | 0.42 |
| #81 | 109.36 | 109.47 | 109.59 | 109.70 | 109.82 | 109.94 | 110.05 | 110.17 | 110.28 | 110.40 | 110.51 | 110.63 |
| — | 0.41 | 0.41 | 0.41 | 0.41 | 0.41 | 0.41 | 0.41 | 0.41 | 0.42 | 0.42 | 0.43 | 0.43 |
| #82 | 110.74 | 110.86 | 110.97 | 111.09 | 111.20 | 111.32 | 111.43 | 111.55 | 111.66 | 111.78 | 111.89 | 112.00 |
| — | 0.44 | 0.45 | 0.46 | 0.47 | 0.49 | 0.50 | 0.52 | 0.53 | 0.55 | 0.56 | 0.58 | 0.59 |
| #83 | 112.12 | 112.23 | 112.34 | 112.46 | 112.57 | 112.68 | 112.80 | 112.91 | 113.02 | 113.14 | 113.25 | 113.36 |
| — | 0.61 | 0.63 | 0.64 | 0.66 | 0.67 | 0.68 | 0.69 | 0.70 | 0.71 | 0.72 | 0.73 | 0.73 |
| #84 | 113.47 | 113.59 | 113.70 | 113.81 | 113.93 | | | | | | | |
| — | 0.73 | 0.74 | 0.74 | 0.74 | 0.74 | | | | | | | |

Figure 31:
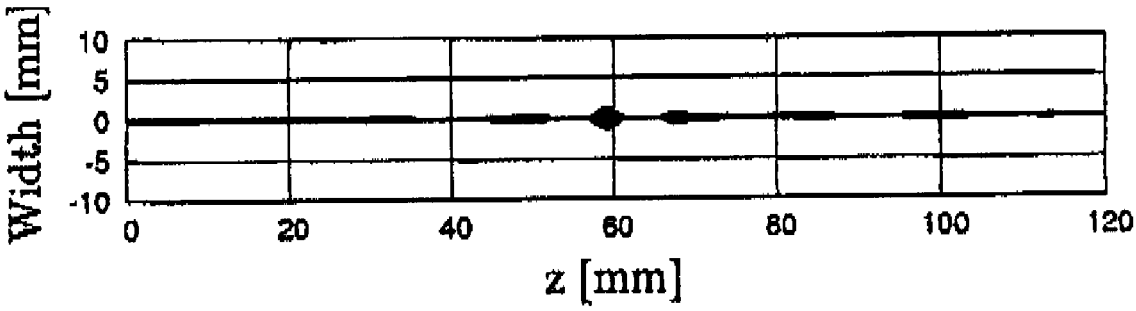
FIG. 31 is a graph showing the surface form of the microstrip line in the reflection-type bandpass filter of the seventh embodiment.

FIG. 31 shows the shape of the microstrip line 5 in the reflection-type bandpass filter 1 of the seventh embodiment. A non-reflecting terminator, or an R=50Ω resistance, is provided at the terminating side (the face at z=113.93 mm) of the reflection-type bandpass filter 1. The thickness of the metal films used in the conducting layer 3 and of the conductor constituting the microstrip line 5 should be adequately greater than the skin depth $\delta s=\sqrt{\{2/(\omega\mu 0\sigma)\}}$ at f=1 GHz. For example if copper is used, the thickness of the conducting layer 3 and of the conductor of the microstrip line 5 should be taken as 2.1 μm or greater. This reflection-type bandpass filter is used in a system where the characteristic impedance is 50Ω.

Figure 32:
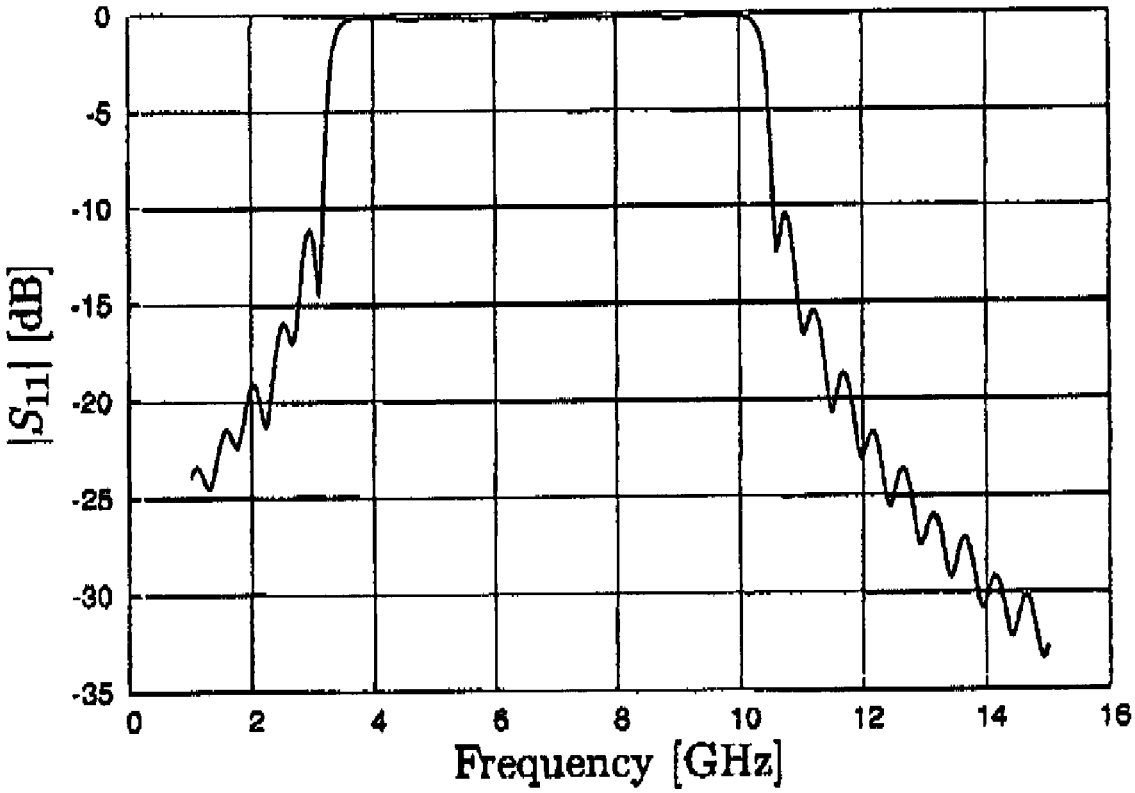
FIG. 32 is a graph showing the amplitude characteristics of the reflective wave in the reflection-type bandpass filter of the seventh embodiment.
Figure 33:
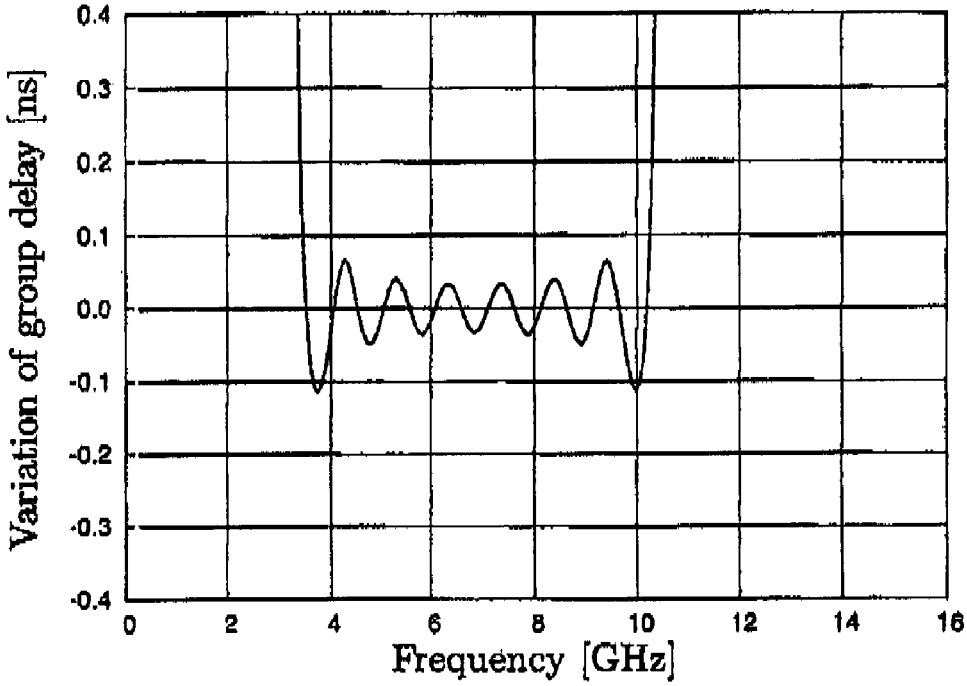
FIG. 33 is a graph showing the group delay frequency characteristics of the reflective wave in the reflection-type bandpass filter of the seventh embodiment.

FIG. 32 and FIG. 33 express the amplitude characteristics and group delay frequency characteristics respectively of the reflective wave (S11) in the bandpass filter of the seventh embodiment. As shown in the figures, in the region of frequency f for which 3.4 GHz≦f≦10.3 GHz, the reflectivity is −0.5 dB or greater and the variation of the group delay is within ±0.1 ns. In the region f<3.1 GHz and f>10.6 GHz, the reflectivity is −10 dB or lower.

Embodiment 8

A Kaiser window was used for which the reflectivity is 1 at the frequency f in the region 3.3 GHz≦f≦10.4 GHz, and is 0 elsewhere, and for which A=35. Taking one wavelength at frequency f=1 GHz of the signal transmitted within the microstrip line as the waveguide length, the system characteristic impedance was taken as 30Ω, and the design was carried out.

Figure 34:
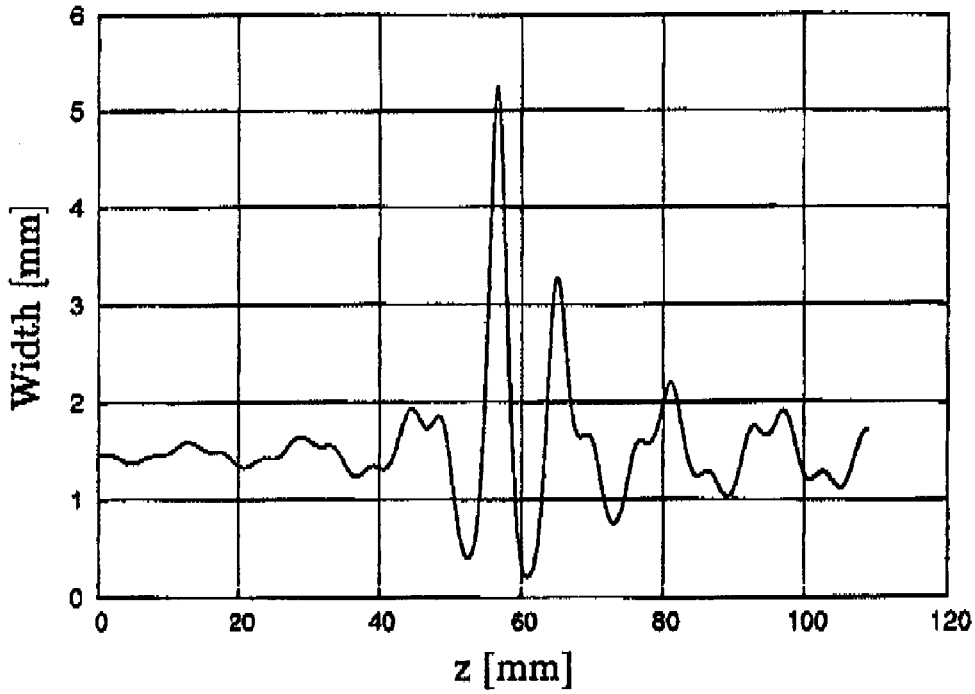
FIG. 34 is a graph showing the distribution in the width direction of the microstrip line in the reflection-type bandpass filter of the eighth embodiment.

FIG. 34 shows the distribution of the width w of the microstrip line 5 in the z-axis direction when a dielectric layer 4 of thickness h=0.635 mm, and relative dielectric constant $\in_r$=10.2 (for example, RT/Duroid (registered trademark) 6010LM) was used. Tables 20 through 22 list the widths w of the microstrip line 5.

TABLE 20

| Widths of the microstrip line | | | | | | | | | | | | |
|---|---|---|---|---|---|---|---|---|---|---|---|---|
| | z[mm] | | | | | | | | | | | |
| | 0.00 | 0.11 | 0.22 | 0.33 | 0.44 | 0.54 | 0.65 | 0.76 | 0.87 | 0.98 | 1.09 | 1.20 |
| | w[mm] | | | | | | | | | | | |
| | 1.47 | 1.47 | 1.47 | 1.47 | 1.47 | 1.47 | 1.47 | 1.47 | 1.47 | 1.47 | 1.47 | 1.47 |
| #2 | 1.31 | 1.42 | 1.52 | 1.63 | 1.74 | 1.85 | 1.96 | 2.07 | 2.18 | 2.29 | 2.40 | 2.50 |
| — | 1.47 | 1.47 | 1.47 | 1.47 | 1.46 | 1.46 | 1.46 | 1.46 | 1.46 | 1.45 | 1.45 | 1.45 |

TABLE 20-continued

| Widths of the microstrip line | | | | | | | | | | | | |
|---|---|---|---|---|---|---|---|---|---|---|---|---|
| | z[mm] | | | | | | | | | | | |
| | 0.00 | 0.11 | 0.22 | 0.33 | 0.44 | 0.54 | 0.65 | 0.76 | 0.87 | 0.98 | 1.09 | 1.20 |
| | w[mm] | | | | | | | | | | | |
| | 1.47 | 1.47 | 1.47 | 1.47 | 1.47 | 1.47 | 1.47 | 1.47 | 1.47 | 1.47 | 1.47 | 1.47 |
| #3 | 2.61 | 2.72 | 2.83 | 2.94 | 3.05 | 3.16 | 3.27 | 3.38 | 3.49 | 3.59 | 3.70 | 3.81 |
| — | 1.44 | 1.44 | 1.43 | 1.43 | 1.42 | 1.42 | 1.41 | 1.41 | 1.40 | 1.40 | 1.40 | 1.39 |
| #4 | 3.92 | 4.03 | 4.14 | 4.25 | 4.36 | 4.47 | 4.58 | 4.69 | 4.80 | 4.91 | 5.01 | 5.12 |
| — | 1.39 | 1.38 | 1.38 | 1.38 | 1.38 | 1.38 | 1.37 | 1.37 | 1.37 | 1.37 | 1.37 | 1.38 |
| #5 | 5.23 | 5.34 | 5.45 | 5.56 | 5.67 | 5.78 | 5.89 | 6.00 | 6.11 | 6.22 | 6.32 | 6.43 |
| — | 1.38 | 1.38 | 1.38 | 1.39 | 1.39 | 1.39 | 1.40 | 1.40 | 1.40 | 1.41 | 1.41 | 1.42 |
| #6 | 6.54 | 6.65 | 6.76 | 6.87 | 6.98 | 7.09 | 7.20 | 7.31 | 7.41 | 7.52 | 7.63 | 7.74 |
| — | 1.42 | 1.43 | 1.43 | 1.43 | 1.44 | 1.44 | 1.45 | 1.45 | 1.45 | 1.45 | 1.45 | 1.46 |
| #7 | 7.85 | 7.96 | 8.07 | 8.18 | 8.29 | 8.40 | 8.50 | 8.61 | 8.72 | 8.83 | 8.94 | 9.05 |
| — | 1.46 | 1.46 | 1.46 | 1.46 | 1.46 | 1.46 | 1.46 | 1.46 | 1.46 | 1.46 | 1.46 | 1.46 |
| #8 | 9.16 | 9.27 | 9.38 | 9.48 | 9.59 | 9.70 | 9.81 | 9.92 | 10.03 | 10.14 | 10.25 | 10.35 |
| — | 1.46 | 1.46 | 1.46 | 1.46 | 1.47 | 1.47 | 1.47 | 1.47 | 1.48 | 1.48 | 1.48 | 1.49 |
| #9 | 10.46 | 10.57 | 10.68 | 10.79 | 10.90 | 11.01 | 11.12 | 11.22 | 11.33 | 11.44 | 11.55 | 11.66 |
| — | 1.49 | 1.50 | 1.50 | 1.51 | 1.52 | 1.52 | 1.53 | 1.54 | 1.54 | 1.55 | 1.55 | 1.56 |
| #10 | 11.77 | 11.88 | 11.98 | 12.09 | 12.20 | 12.31 | 12.42 | 12.53 | 12.63 | 12.74 | 12.85 | 12.96 |
| — | 1.57 | 1.57 | 1.57 | 1.58 | 1.58 | 1.59 | 1.59 | 1.59 | 1.59 | 1.59 | 1.59 | 1.59 |
| #11 | 13.07 | 13.18 | 13.29 | 13.39 | 13.50 | 13.61 | 13.72 | 13.83 | 13.94 | 14.04 | 14.15 | 14.26 |
| — | 1.59 | 1.58 | 1.58 | 1.58 | 1.57 | 1.57 | 1.57 | 1.56 | 1.56 | 1.55 | 1.55 | 1.54 |
| #12 | 14.37 | 14.48 | 14.59 | 14.70 | 14.80 | 14.91 | 15.02 | 15.13 | 15.24 | 15.35 | 15.46 | 15.57 |
| — | 1.54 | 1.53 | 1.53 | 1.52 | 1.52 | 1.51 | 1.51 | 1.51 | 1.50 | 1.50 | 1.50 | 1.50 |
| #13 | 15.67 | 15.78 | 15.89 | 16.00 | 16.11 | 16.22 | 16.33 | 16.44 | 16.54 | 16.65 | 16.76 | 16.87 |
| — | 1.50 | 1.50 | 1.50 | 1.50 | 1.50 | 1.50 | 1.50 | 1.50 | 1.50 | 1.50 | 1.50 | 1.50 |
| #14 | 16.98 | 17.09 | 17.20 | 17.31 | 17.41 | 17.52 | 17.63 | 17.74 | 17.85 | 17.96 | 18.07 | 18.18 |
| — | 1.50 | 1.49 | 1.49 | 1.49 | 1.49 | 1.49 | 1.48 | 1.48 | 1.48 | 1.47 | 1.47 | 1.46 |
| #15 | 18.29 | 18.39 | 18.50 | 18.61 | 18.72 | 18.83 | 18.94 | 19.05 | 19.16 | 19.27 | 19.38 | 19.49 |
| — | 1.45 | 1.45 | 1.44 | 1.43 | 1.43 | 1.42 | 1.41 | 1.40 | 1.40 | 1.39 | 1.38 | 1.37 |
| #16 | 19.60 | 19.70 | 19.81 | 19.92 | 20.03 | 20.14 | 20.25 | 20.36 | 20.47 | 20.58 | 20.69 | 20.80 |
| — | 1.37 | 1.36 | 1.36 | 1.35 | 1.35 | 1.34 | 1.34 | 1.34 | 1.33 | 1.33 | 1.33 | 1.33 |
| #17 | 20.91 | 21.02 | 21.13 | 21.24 | 21.35 | 21.45 | 21.56 | 21.67 | 21.78 | 21.89 | 22.00 | 22.11 |
| — | 1.33 | 1.34 | 1.34 | 1.34 | 1.35 | 1.35 | 1.35 | 1.36 | 1.36 | 1.37 | 1.37 | 1.38 |
| #18 | 22.22 | 22.33 | 22.44 | 22.55 | 22.66 | 22.77 | 22.87 | 22.98 | 23.09 | 23.20 | 23.31 | 23.42 |
| — | 1.38 | 1.39 | 1.39 | 1.40 | 1.40 | 1.41 | 1.41 | 1.41 | 1.42 | 1.42 | 1.42 | 1.42 |
| #19 | 23.53 | 23.64 | 23.75 | 23.86 | 23.97 | 24.07 | 24.18 | 24.29 | 24.40 | 24.51 | 24.62 | 24.73 |
| — | 1.42 | 1.42 | 1.42 | 1.42 | 1.42 | 1.42 | 1.42 | 1.42 | 1.42 | 1.42 | 1.42 | 1.42 |
| #20 | 24.84 | 24.95 | 25.06 | 25.16 | 25.27 | 25.38 | 25.49 | 25.60 | 25.71 | 25.82 | 25.93 | 26.04 |
| — | 1.42 | 1.42 | 1.42 | 1.43 | 1.43 | 1.43 | 1.44 | 1.44 | 1.45 | 1.45 | 1.46 | 1.47 |
| #21 | 26.15 | 26.25 | 26.36 | 26.47 | 26.58 | 26.69 | 26.80 | 26.91 | 27.01 | 27.12 | 27.23 | 27.34 |
| — | 1.47 | 1.48 | 1.49 | 1.50 | 1.51 | 1.52 | 1.53 | 1.54 | 1.56 | 1.57 | 1.58 | 1.59 |
| #22 | 27.45 | 27.56 | 27.67 | 27.77 | 27.88 | 27.99 | 28.10 | 28.21 | 28.31 | 28.42 | 28.53 | 28.64 |
| — | 1.60 | 1.61 | 1.62 | 1.62 | 1.63 | 1.64 | 1.64 | 1.65 | 1.65 | 1.65 | 1.66 | 1.66 |
| #23 | 28.75 | 28.86 | 28.96 | 29.07 | 29.18 | 29.29 | 29.40 | 29.50 | 29.61 | 29.72 | 29.83 | 29.94 |
| — | 1.66 | 1.65 | 1.65 | 1.65 | 1.64 | 1.64 | 1.63 | 1.63 | 1.62 | 1.61 | 1.61 | 1.60 |
| #24 | 30.05 | 30.15 | 30.26 | 30.37 | 30.48 | 30.59 | 30.70 | 30.81 | 30.91 | 31.02 | 31.13 | 31.24 |
| — | 1.59 | 1.59 | 1.58 | 1.58 | 1.57 | 1.57 | 1.56 | 1.56 | 1.55 | 1.55 | 1.55 | 1.55 |
| #25 | 31.35 | 31.46 | 31.57 | 31.67 | 31.78 | 31.89 | 32.00 | 32.11 | 32.22 | 32.33 | 32.43 | 32.54 |
| — | 1.55 | 1.55 | 1.55 | 1.55 | 1.55 | 1.55 | 1.55 | 1.55 | 1.56 | 1.56 | 1.56 | 1.56 |
| #26 | 32.65 | 32.76 | 32.87 | 32.98 | 33.08 | 33.19 | 33.30 | 33.41 | 33.52 | 33.63 | 33.74 | 33.85 |
| — | 1.56 | 1.56 | 1.56 | 1.55 | 1.55 | 1.55 | 1.54 | 1.53 | 1.53 | 1.52 | 1.51 | 1.50 |
| #27 | 33.95 | 34.06 | 34.17 | 34.28 | 34.39 | 34.50 | 34.61 | 34.72 | 34.83 | 34.94 | 35.05 | 35.15 |
| — | 1.49 | 1.48 | 1.46 | 1.45 | 1.43 | 1.42 | 1.41 | 1.39 | 1.38 | 1.36 | 1.35 | 1.33 |
| #28 | 35.26 | 35.37 | 35.48 | 35.59 | 35.70 | 35.81 | 35.92 | 36.03 | 36.14 | 36.25 | 36.36 | 36.47 |
| — | 1.32 | 1.31 | 1.29 | 1.28 | 1.27 | 1.27 | 1.26 | 1.25 | 1.25 | 1.24 | 1.24 | 1.24 |
| #29 | 36.58 | 36.69 | 36.80 | 36.91 | 37.02 | 37.13 | 37.24 | 37.35 | 37.46 | 37.57 | 37.68 | 37.79 |
| — | 1.24 | 1.24 | 1.24 | 1.24 | 1.25 | 1.25 | 1.26 | 1.26 | 1.27 | 1.28 | 1.28 | 1.29 |
| #30 | 37.90 | 38.01 | 38.12 | 38.23 | 38.34 | 38.45 | 38.55 | 38.66 | 38.77 | 38.88 | 38.99 | 39.10 |
| — | 1.30 | 1.30 | 1.31 | 1.32 | 1.32 | 1.33 | 1.33 | 1.34 | 1.34 | 1.34 | 1.34 | 1.34 |

TABLE 21

| Widths of the microstrip line | | | | | | | | | | | | |
|---|---|---|---|---|---|---|---|---|---|---|---|---|
| #31 | 39.21 | 39.32 | 39.43 | 39.54 | 39.65 | 39.76 | 39.87 | 39.98 | 40.09 | 40.20 | 40.31 | 40.42 |
| — | 1.34 | 1.34 | 1.34 | 1.34 | 1.34 | 1.33 | 1.33 | 1.33 | 1.32 | 1.32 | 1.32 | 1.32 |
| #32 | 40.52 | 40.63 | 40.74 | 40.85 | 40.96 | 41.07 | 41.18 | 41.29 | 41.40 | 41.51 | 41.62 | 41.73 |
| — | 1.32 | 1.32 | 1.32 | 1.32 | 1.33 | 1.33 | 1.34 | 1.35 | 1.36 | 1.37 | 1.38 | 1.40 |
| #33 | 41.84 | 41.95 | 42.05 | 42.16 | 42.27 | 42.38 | 42.49 | 42.60 | 42.71 | 42.81 | 42.92 | 43.03 |
| — | 1.42 | 1.44 | 1.46 | 1.48 | 1.50 | 1.53 | 1.55 | 1.58 | 1.61 | 1.64 | 1.67 | 1.70 |

TABLE 21-continued

| Widths of the microstrip line | | | | | | | | | | | | |
|---|---|---|---|---|---|---|---|---|---|---|---|---|
| #34 | 43.14 | 43.25 | 43.35 | 43.46 | 43.57 | 43.68 | 43.78 | 43.89 | 44.00 | 44.11 | 44.21 | 44.32 |
| — | 1.72 | 1.75 | 1.78 | 1.80 | 1.83 | 1.85 | 1.87 | 1.89 | 1.90 | 1.92 | 1.92 | 1.93 |
| #35 | 44.43 | 44.54 | 44.64 | 44.75 | 44.86 | 44.96 | 45.07 | 45.18 | 45.29 | 45.39 | 45.50 | 45.61 |
| — | 1.93 | 1.94 | 1.93 | 1.93 | 1.92 | 1.92 | 1.90 | 1.89 | 1.88 | 1.87 | 1.85 | 1.84 |
| #36 | 45.72 | 45.82 | 45.93 | 46.04 | 46.15 | 46.26 | 46.36 | 46.47 | 46.58 | 46.69 | 46.80 | 46.90 |
| — | 1.82 | 1.81 | 1.79 | 1.78 | 1.77 | 1.76 | 1.75 | 1.74 | 1.74 | 1.74 | 1.74 | 1.74 |
| #37 | 47.01 | 47.12 | 47.23 | 47.33 | 47.44 | 47.55 | 47.66 | 47.77 | 47.87 | 47.98 | 48.09 | 48.20 |
| — | 1.74 | 1.75 | 1.76 | 1.76 | 1.77 | 1.79 | 1.80 | 1.81 | 1.82 | 1.83 | 1.84 | 1.85 |
| #38 | 48.30 | 48.41 | 48.52 | 48.63 | 48.73 | 48.84 | 48.95 | 49.06 | 49.10 | 49.27 | 49.38 | 49.49 |
| — | 1.85 | 1.86 | 1.86 | 1.85 | 1.84 | 1.83 | 1.81 | 1.79 | 1.76 | 1.72 | 1.68 | 1.64 |
| #39 | 49.60 | 49.70 | 49.81 | 49.92 | 50.03 | 50.14 | 50.25 | 50.36 | 50.47 | 50.58 | 50.69 | 50.81 |
| — | 1.59 | 1.54 | 1.48 | 1.42 | 1.35 | 1.29 | 1.22 | 1.15 | 1.09 | 1.02 | 0.96 | 0.89 |
| #40 | 50.92 | 51.03 | 51.14 | 51.26 | 51.37 | 51.48 | 51.60 | 51.71 | 51.83 | 51.94 | 52.06 | 52.17 |
| — | 0.83 | 0.78 | 0.72 | 0.67 | 0.62 | 0.58 | 0.54 | 0.51 | 0.48 | 0.46 | 0.43 | 0.42 |
| #41 | 52.29 | 52.41 | 52.52 | 52.64 | 52.75 | 52.87 | 52.98 | 53.10 | 53.21 | 53.33 | 53.44 | 53.56 |
| — | 0.41 | 0.40 | 0.39 | 0.40 | 0.40 | 0.41 | 0.43 | 0.45 | 0.48 | 0.51 | 0.55 | 0.60 |
| #42 | 53.67 | 53.78 | 53.90 | 54.01 | 54.12 | 54.23 | 54.34 | 54.45 | 54.56 | 54.67 | 54.77 | 54.88 |
| — | 0.65 | 0.72 | 0.79 | 0.88 | 0.97 | 1.08 | 1.20 | 1.33 | 1.47 | 1.63 | 1.80 | 1.99 |
| #43 | 54.99 | 55.09 | 55.20 | 55.30 | 55.41 | 55.51 | 55.62 | 55.72 | 55.82 | 55.92 | 56.03 | 56.13 |
| — | 2.18 | 2.39 | 2.62 | 2.85 | 3.09 | 3.33 | 3.58 | 3.83 | 4.07 | 4.30 | 4.52 | 4.71 |
| #44 | 56.23 | 56.33 | 56.44 | 56.54 | 56.64 | 56.74 | 56.84 | 56.94 | 57.05 | 57.15 | 57.25 | 57.35 |
| — | 4.88 | 5.03 | 5.14 | 5.21 | 5.24 | 5.24 | 5.19 | 5.10 | 4.98 | 4.82 | 4.64 | 4.43 |
| #45 | 57.46 | 57.56 | 57.66 | 57.77 | 57.87 | 57.98 | 58.08 | 58.19 | 58.29 | 58.40 | 58.51 | 58.62 |
| — | 4.19 | 3.95 | 3.69 | 3.43 | 3.17 | 2.91 | 2.66 | 2.42 | 2.19 | 1.97 | 1.77 | 1.58 |
| #46 | 58.73 | 58.84 | 58.95 | 59.06 | 59.17 | 59.28 | 59.40 | 59.51 | 59.63 | 59.74 | 59.86 | 59.97 |
| — | 1.41 | 1.25 | 1.10 | 0.97 | 0.85 | 0.75 | 0.66 | 0.57 | 0.50 | 0.44 | 0.39 | 0.34 |
| #47 | 60.09 | 60.21 | 60.32 | 60.44 | 60.56 | 60.68 | 60.80 | 60.92 | 61.03 | 61.15 | 61.27 | 61.39 |
| — | 0.31 | 0.28 | 0.25 | 0.23 | 0.22 | 0.21 | 0.21 | 0.20 | 0.21 | 0.21 | 0.22 | 0.24 |
| #48 | 61.51 | 61.62 | 61.74 | 61.86 | 61.97 | 62.09 | 62.20 | 62.32 | 62.43 | 62.54 | 62.65 | 62.77 |
| — | 0.26 | 0.29 | 0.32 | 0.35 | 0.40 | 0.45 | 0.51 | 0.57 | 0.65 | 0.73 | 0.82 | 0.92 |
| #49 | 62.88 | 62.99 | 63.10 | 63.21 | 63.31 | 63.42 | 63.53 | 63.64 | 63.74 | 63.85 | 63.96 | 64.06 |
| — | 1.03 | 1.15 | 1.27 | 1.40 | 1.54 | 1.69 | 1.83 | 1.98 | 2.13 | 2.28 | 2.43 | 2.57 |
| #50 | 64.17 | 64.27 | 64.38 | 64.48 | 64.59 | 64.69 | 64.79 | 64.90 | 65.00 | 65.11 | 65.21 | 65.32 |
| — | 2.70 | 2.83 | 2.94 | 3.04 | 3.12 | 3.19 | 3.24 | 3.27 | 3.28 | 3.28 | 3.26 | 3.23 |
| #51 | 65.42 | 65.53 | 65.63 | 65.73 | 65.84 | 65.94 | 66.05 | 66.16 | 66.26 | 66.37 | 66.47 | 66.58 |
| — | 3.18 | 3.12 | 3.05 | 2.97 | 2.89 | 2.80 | 2.71 | 2.62 | 2.53 | 2.44 | 2.35 | 2.27 |
| #52 | 66.69 | 66.79 | 66.90 | 67.01 | 67.11 | 67.22 | 67.33 | 67.44 | 67.54 | 67.65 | 67.76 | 67.87 |
| — | 2.19 | 2.12 | 2.05 | 1.98 | 1.93 | 1.87 | 1.83 | 1.79 | 1.75 | 1.73 | 1.70 | 1.68 |
| #53 | 67.98 | 68.08 | 68.19 | 68.30 | 68.41 | 68.52 | 68.63 | 68.73 | 68.84 | 68.95 | 69.06 | 69.17 |
| — | 1.67 | 1.66 | 1.65 | 1.65 | 1.65 | 1.65 | 1.65 | 1.65 | 1.66 | 1.66 | 1.67 | 1.67 |
| #54 | 69.27 | 59.38 | 69.49 | 69.60 | 69.71 | 69.82 | 69.92 | 70.03 | 70.14 | 70.25 | 70.36 | 70.47 |
| — | 1.67 | 1.67 | 1.67 | 1.66 | 1.65 | 1.64 | 1.62 | 1.60 | 1.57 | 1.54 | 1.51 | 1.47 |
| #55 | 70.58 | 70.68 | 70.79 | 70.90 | 71.01 | 71.12 | 71.23 | 71.34 | 71.45 | 71.57 | 71.68 | 71.79 |
| — | 1.44 | 1.40 | 1.35 | 1.31 | 1.27 | 1.22 | 1.18 | 1.13 | 1.09 | 1.05 | 1.01 | 0.97 |
| #56 | 71.90 | 72.01 | 72.12 | 72.23 | 72.35 | 72.46 | 72.57 | 72.68 | 72.80 | 72.91 | 73.02 | 73.13 |
| — | 0.94 | 0.90 | 0.88 | 0.85 | 0.83 | 0.81 | 0.79 | 0.78 | 0.77 | 0.76 | 0.76 | 0.76 |
| #57 | 73.25 | 73.36 | 73.47 | 73.58 | 73.70 | 73.81 | 73.92 | 74.03 | 74.14 | 74.25 | 74.36 | 74.48 |
| — | 0.77 | 0.78 | 0.79 | 0.80 | 0.82 | 0.84 | 0.87 | 0.89 | 0.92 | 0.96 | 0.99 | 1.03 |
| #58 | 74.59 | 74.70 | 74.81 | 74.92 | 75.03 | 75.14 | 75.25 | 75.36 | 75.47 | 75.57 | 75.68 | 75.79 |
| — | 1.06 | 1.10 | 1.14 | 1.19 | 1.23 | 1.27 | 1.31 | 1.35 | 1.38 | 1.42 | 1.45 | 1.48 |
| #59 | 75.90 | 76.01 | 76.12 | 76.23 | 76.33 | 76.44 | 76.55 | 76.66 | 76.77 | 76.88 | 76.98 | 77.09 |
| — | 1.51 | 1.53 | 1.55 | 1.57 | 1.58 | 1.59 | 1.60 | 1.60 | 1.61 | 1.61 | 1.61 | 1.60 |
| #60 | 77.20 | 77.31 | 77.42 | 77.53 | 77.64 | 77.74 | 77.85 | 77.96 | 78.07 | 78.18 | 78.29 | 78.39 |
| — | 1.60 | 1.59 | 1.59 | 1.59 | 1.58 | 1.58 | 1.58 | 1.58 | 1.58 | 1.58 | 1.59 | 1.60 |

TABLE 22

| Widths of the microstrip line | | | | | | | | | | | | |
|---|---|---|---|---|---|---|---|---|---|---|---|---|
| #61 | 78.50 | 78.61 | 78.72 | 78.83 | 78.94 | 79.04 | 79.15 | 79.26 | 79.37 | 79.47 | 79.58 | 79.69 |
| — | 1.61 | 1.62 | 1.64 | 1.66 | 1.68 | 1.70 | 1.73 | 1.76 | 1.79 | 1.82 | 1.86 | 1.89 |
| #62 | 79.80 | 79.90 | 80.01 | 80.12 | 80.22 | 80.33 | 80.44 | 80.54 | 80.65 | 80.76 | 80.86 | 80.97 |
| — | 1.93 | 1.96 | 2.00 | 2.03 | 2.06 | 2.09 | 2.12 | 2.14 | 2.16 | 2.18 | 2.19 | 2.19 |
| #63 | 81.08 | 81.18 | 81.29 | 81.40 | 81.50 | 81.61 | 81.72 | 81.82 | 81.93 | 82.04 | 82.15 | 82.25 |
| — | 2.19 | 2.19 | 2.18 | 2.17 | 2.15 | 2.12 | 2.09 | 2.06 | 2.02 | 1.99 | 1.94 | 1.90 |
| #64 | 82.36 | 82.47 | 82.58 | 82.68 | 82.79 | 82.90 | 83.01 | 83.12 | 83.23 | 83.34 | 83.44 | 83.55 |
| — | 1.86 | 1.81 | 1.76 | 1.72 | 1.67 | 1.63 | 1.59 | 1.55 | 1.51 | 1.47 | 1.44 | 1.41 |
| #65 | 83.66 | 83.77 | 83.88 | 83.99 | 84.10 | 84.21 | 84.32 | 84.43 | 84.54 | 84.65 | 84.76 | 84.87 |
| — | 1.38 | 1.35 | 1.33 | 1.31 | 1.29 | 1.28 | 1.27 | 1.26 | 1.25 | 1.25 | 1.25 | 1.25 |
| #66 | 84.98 | 85.09 | 85.20 | 85.31 | 85.42 | 85.53 | 85.64 | 85.75 | 85.86 | 85.97 | 86.08 | 86.19 |
| — | 1.25 | 1.25 | 1.25 | 1.26 | 1.27 | 1.27 | 1.28 | 1.28 | 1.29 | 1.29 | 1.29 | 1.30 |
| #67 | 86.29 | 86.40 | 86.51 | 86.62 | 86.73 | 86.84 | 86.95 | 87.06 | 87.17 | 87.28 | 87.39 | 87.50 |
| — | 1.30 | 1.30 | 1.29 | 1.29 | 1.28 | 1.28 | 1.27 | 1.26 | 1.24 | 1.23 | 1.21 | 1.20 |

TABLE 22-continued

| Widths of the microstrip line | | | | | | | | | | | | |
|---|---|---|---|---|---|---|---|---|---|---|---|---|
| #68 | 87.61 | 87.72 | 87.83 | 87.94 | 88.05 | 88.16 | 88.27 | 88.39 | 88.50 | 88.61 | 88.72 | 88.83 |
| — | 1.18 | 1.17 | 1.15 | 1.13 | 1.12 | 1.10 | 1.09 | 1.08 | 1.07 | 1.06 | 1.05 | 1.04 |
| #69 | 88.94 | 89.05 | 89.16 | 89.27 | 89.38 | 89.49 | 89.60 | 89.71 | 89.83 | 89.94 | 90.05 | 90.16 |
| — | 1.04 | 1.04 | 1.04 | 1.04 | 1.05 | 1.05 | 1.07 | 1.08 | 1.09 | 1.11 | 1.13 | 1.16 |
| #70 | 90.27 | 90.38 | 90.49 | 90.60 | 90.71 | 90.81 | 90.92 | 91.03 | 91.14 | 91.25 | 91.36 | 91.47 |
| — | 1.18 | 1.21 | 1.24 | 1.27 | 1.30 | 1.33 | 1.36 | 1.40 | 1.43 | 1.47 | 1.50 | 1.53 |
| #71 | 91.58 | 91.69 | 91.79 | 91.90 | 92.01 | 92.12 | 92.23 | 92.33 | 92.44 | 92.55 | 92.66 | 92.77 |
| — | 1.56 | 1.59 | 1.62 | 1.65 | 1.67 | 1.69 | 1.71 | 1.72 | 1.73 | 1.74 | 1.75 | 1.75 |
| #72 | 92.87 | 92.98 | 93.09 | 93.20 | 93.30 | 93.41 | 93.52 | 93.63 | 93.74 | 93.84 | 93.95 | 94.06 |
| — | 1.75 | 1.75 | 1.75 | 1.75 | 1.74 | 1.73 | 1.72 | 1.71 | 1.71 | 1.70 | 1.69 | 1.68 |
| #73 | 94.17 | 94.28 | 94.39 | 94.49 | 94.60 | 94.71 | 94.82 | 94.93 | 95.03 | 95.14 | 95.25 | 95.36 |
| — | 1.68 | 1.67 | 1.67 | 1.66 | 1.66 | 1.67 | 1.67 | 1.67 | 1.68 | 1.69 | 1.70 | 1.71 |
| #74 | 95.47 | 95.57 | 95.68 | 95.79 | 95.90 | 96.00 | 96.11 | 96.22 | 96.33 | 96.43 | 96.54 | 96.65 |
| — | 1.73 | 1.74 | 1.76 | 1.77 | 1.79 | 1.81 | 1.82 | 1.84 | 1.86 | 1.87 | 1.88 | 1.89 |
| #75 | 96.76 | 96.86 | 96.97 | 97.08 | 97.19 | 97.29 | 97.40 | 97.51 | 97.62 | 97.72 | 97.83 | 97.94 |
| — | 1.90 | 1.91 | 1.91 | 1.91 | 1.91 | 1.90 | 1.89 | 1.88 | 1.87 | 1.85 | 1.83 | 1.80 |
| #76 | 98.05 | 98.15 | 98.26 | 98.37 | 98.48 | 98.59 | 98.70 | 98.80 | 98.91 | 99.02 | 99.13 | 99.24 |
| — | 1.77 | 1.75 | 1.71 | 1.68 | 1.65 | 1.62 | 1.58 | 1.55 | 1.51 | 1.48 | 1.45 | 1.42 |
| #77 | 99.35 | 99.46 | 99.57 | 99.68 | 99.79 | 99.90 | 100.01 | 100.12 | 100.23 | 100.34 | 100.45 | 100.56 |
| — | 1.39 | 1.36 | 1.34 | 1.31 | 1.29 | 1.27 | 1.26 | 1.24 | 1.23 | 1.22 | 1.21 | 1.21 |
| #78 | 100.67 | 100.78 | 100.89 | 101.00 | 101.11 | 101.22 | 101.33 | 101.44 | 101.55 | 101.66 | 101.76 | 101.87 |
| — | 1.20 | 1.20 | 1.20 | 1.20 | 1.21 | 1.21 | 1.22 | 1.23 | 1.23 | 1.24 | 1.25 | 1.25 |
| #79 | 101.98 | 102.09 | 102.20 | 102.31 | 102.42 | 102.53 | 102.64 | 102.75 | 102.86 | 102.97 | 103.08 | 103.19 |
| — | 1.26 | 1.27 | 1.27 | 1.28 | 1.28 | 1.28 | 1.28 | 1.28 | 1.28 | 1.28 | 1.27 | 1.27 |
| #80 | 103.30 | 103.41 | 103.52 | 103.63 | 103.74 | 103.85 | 103.96 | 104.07 | 104.18 | 104.29 | 104.40 | 104.51 |
| — | 1.26 | 1.25 | 1.24 | 1.23 | 1.22 | 1.21 | 1.20 | 1.18 | 1.17 | 1.16 | 1.15 | 1.14 |
| #81 | 104.62 | 104.73 | 104.84 | 104.95 | 105.06 | 105.17 | 105.28 | 105.39 | 105.50 | 105.61 | 105.73 | 105.84 |
| — | 1.14 | 1.13 | 1.13 | 1.12 | 1.12 | 1.12 | 1.13 | 1.13 | 1.14 | 1.15 | 1.16 | 1.17 |
| #82 | 105.95 | 106.06 | 106.17 | 106.27 | 106.38 | 106.49 | 106.60 | 106.71 | 106.82 | 106.93 | 107.04 | 107.15 |
| — | 1.19 | 1.21 | 1.23 | 1.25 | 1.27 | 1.30 | 1.33 | 1.35 | 1.38 | 1.41 | 1.44 | 1.47 |
| #83 | 107.26 | 107.37 | 107.48 | 107.58 | 107.69 | 107.80 | 107.91 | 108.02 | 108.12 | 108.23 | 108.34 | 108.45 |
| — | 1.50 | 1.53 | 1.55 | 1.58 | 1.60 | 1.62 | 1.65 | 1.66 | 1.68 | 1.69 | 1.70 | 1.71 |
| #84 | 108.56 | 108.66 | 108.77 | 108.88 | 108.99 | | | | | | | |
| — | 1.72 | 1.72 | 1.72 | 1.72 | 1.72 | | | | | | | |

Figure 35:
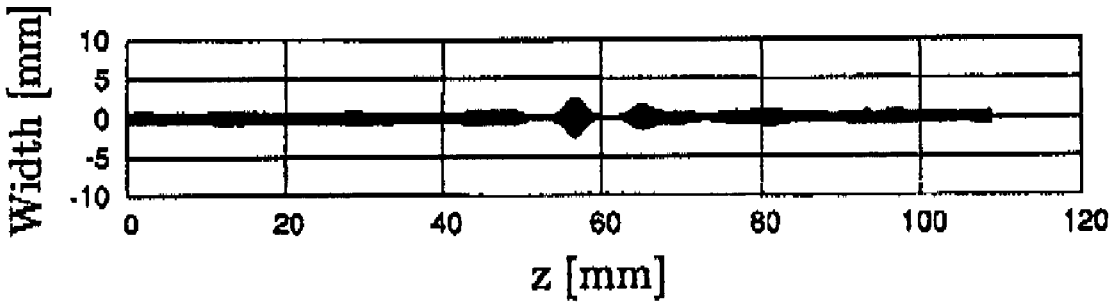
FIG. 35 is a graph showing the surface form of the microstrip line in the reflection-type bandpass filter of the eighth embodiment.

FIG. 35 shows the shape of the microstrip line 5 in the reflection-type bandpass filter 1 of the eighth embodiment. A non-reflecting terminator, or an R=30Ω resistance, is provided at the terminating side (the face at z=108.99 mm) of the reflection-type bandpass filter 1. The thickness of the metal films used in the conducting layer 3 and of the conductor constituting the microstrip line 5 should be adequately greater than the skin depth $\delta s=\sqrt{\{2/(\omega\mu 0\sigma)\}}$ at f=1 GHz. For example if copper is used, the thickness of the conducting layer 3 and of the conductor of the microstrip line 5 should be taken as 2.1 μm or greater. This reflection-type bandpass filter is used in a system where the characteristic impedance is 30Ω.

Figure 36:
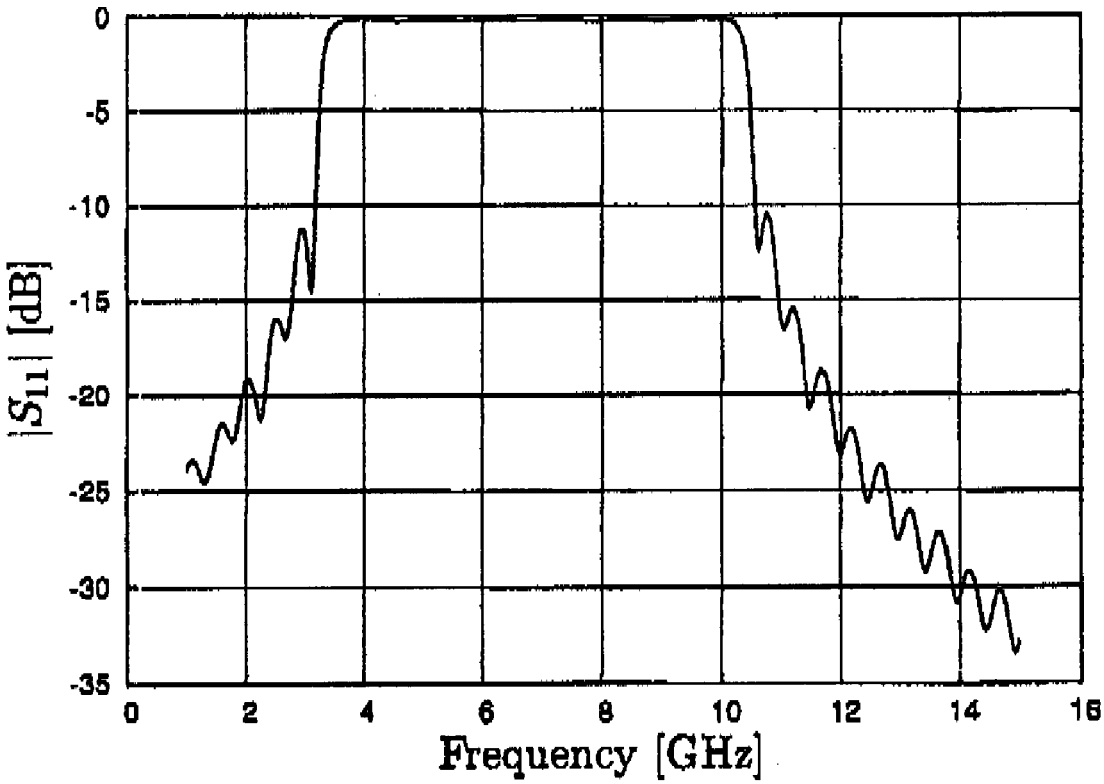
FIG. 36 is a graph showing the amplitude characteristics of the reflective wave in the reflection-type bandpass filter of the eighth embodiment.
Figure 37:
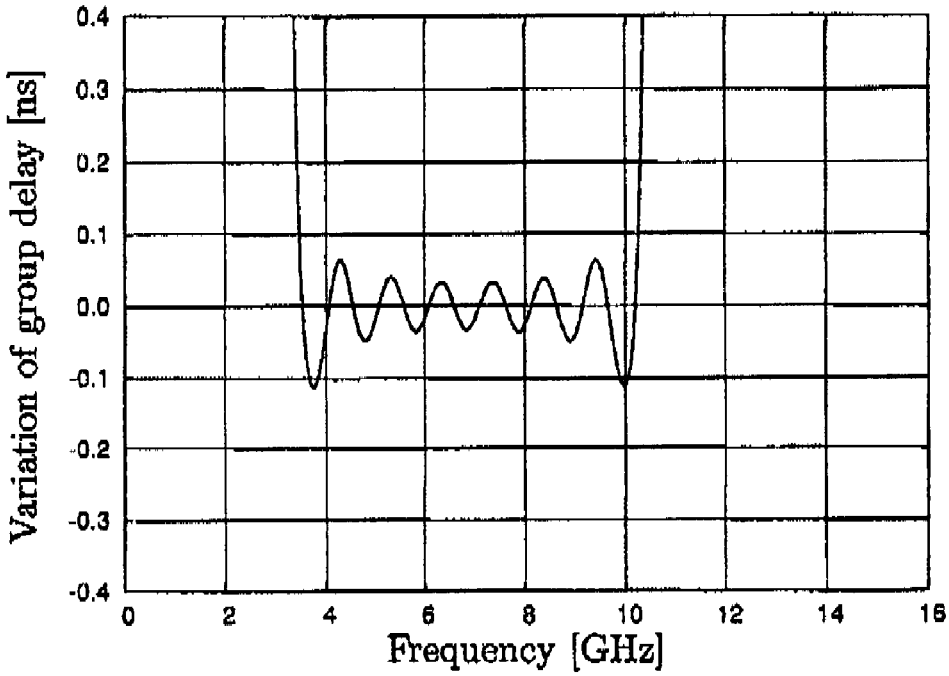
FIG. 37 is a graph showing the group delay frequency characteristics of the reflective wave in the reflection-type bandpass filter of the eighth embodiment.

FIG. 36 and FIG. 37 express the amplitude characteristics and group delay frequency characteristics respectively of the reflective wave (S11) in the bandpass filter of the eighth embodiment. As shown in the figures, in the region of frequency f for which 3.4 GHz≦f≦10.3 GHz, the reflectivity is −0.5 dB or greater and the variation of the group delay is within ±0.1 ns. In the region f<3.1 GHz and f>10.6 GHz, the reflectivity is −10 dB or lower.

Embodiment 9

A Kaiser window was used for which the reflectivity is 0.95 at the frequency f in the region 3.3 GHz≦f≦10.4 GHz, and is 0 elsewhere, and for which A=35. Taking one wavelength at frequency f=1 GHz of the signal transmitted within the microstrip line as the waveguide length, the system characteristic impedance was taken as 50Ω, and the design was carried out.

Figure 38:
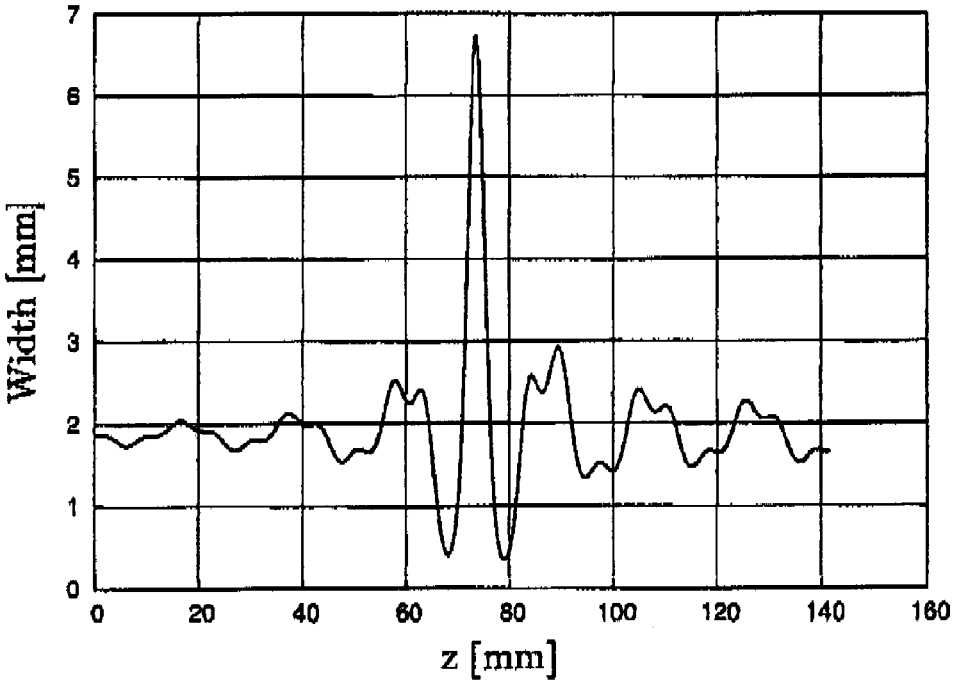
FIG. 38 is a graph showing the distribution in the width direction of the microstrip line in the reflection-type bandpass filter of the ninth embodiment.

FIG. 38 shows the distribution of the width w of the microstrip line 5 in the z-axis direction when a dielectric layer 4 of thickness h=1.27 mm, and relative dielectric constant $\in_r$=6.15 (for example, RT/Duroid (registered trademark) 6006) was used. Tables 23 through 25 list the widths w of the microstrip line 5.

TABLE 23

| Widths of the microstrip line | | | | | | | | | | | | |
|---|---|---|---|---|---|---|---|---|---|---|---|---|
| | z[mm] | | | | | | | | | | | |
| | 0.00 | 0.14 | 0.28 | 0.42 | 0.57 | 0.71 | 0.85 | 0.99 | 1.13 | 1.27 | 1.41 | 1.56 |
| | w[mm] | | | | | | | | | | | |
| | 1.87 | 1.87 | 1.87 | 1.87 | 1.87 | 1.87 | 1.87 | 1.87 | 1.87 | 1.87 | 1.87 | 1.87 |
| #2 | 1.70 | 1.84 | 1.98 | 2.12 | 2.26 | 2.41 | 2.55 | 2.69 | 2.83 | 2.97 | 3.11 | 3.25 |
| — | 1.87 | 1.86 | 1.86 | 1.86 | 1.86 | 1.86 | 1.85 | 1.85 | 1.85 | 1.84 | 1.84 | 1.83 |
| #3 | 3.40 | 3.54 | 3.68 | 3.82 | 3.96 | 4.10 | 4.25 | 4.39 | 4.53 | 4.67 | 4.81 | 4.96 |
| — | 1.83 | 1.82 | 1.82 | 1.81 | 1.80 | 1.80 | 1.79 | 1.78 | 1.78 | 1.77 | 1.76 | 1.76 |

TABLE 23-continued

| Widths of the microstrip line | | | | | | | | | | | | |
|---|---|---|---|---|---|---|---|---|---|---|---|---|
| | z[mm] | | | | | | | | | | | |
| | 0.00 | 0.14 | 0.28 | 0.42 | 0.57 | 0.71 | 0.85 | 0.99 | 1.13 | 1.27 | 1.41 | 1.56 |
| | w[mm] | | | | | | | | | | | |
| | 1.87 | 1.87 | 1.87 | 1.87 | 1.87 | 1.87 | 1.87 | 1.87 | 1.87 | 1.87 | 1.87 | 1.87 |
| #4 | 5.10 | 5.24 | 5.38 | 5.52 | 5.66 | 5.81 | 5.95 | 6.09 | 6.23 | 6.37 | 6.52 | 6.66 |
| — | 1.75 | 1.75 | 1.74 | 1.74 | 1.74 | 1.73 | 1.73 | 1.73 | 1.73 | 1.73 | 1.73 | 1.73 |
| #5 | 6.80 | 6.94 | 7.08 | 7.23 | 7.37 | 7.51 | 7.65 | 7.79 | 7.93 | 8.08 | 8.22 | 8.36 |
| — | 1.74 | 1.74 | 1.74 | 1.75 | 1.75 | 1.76 | 1.76 | 1.77 | 1.78 | 1.78 | 1.79 | 1.79 |
| #6 | 8.50 | 8.64 | 8.79 | 8.93 | 9.07 | 9.21 | 9.35 | 9.49 | 9.63 | 9.78 | 9.92 | 10.06 |
| — | 1.80 | 1.81 | 1.81 | 1.82 | 1.82 | 1.83 | 1.83 | 1.84 | 1.84 | 1.84 | 1.85 | 1.85 |
| #7 | 10.20 | 10.34 | 10.48 | 10.63 | 10.77 | 10.91 | 11.05 | 11.19 | 11.33 | 11.47 | 11.62 | 11.76 |
| — | 1.85 | 1.85 | 1.85 | 1.85 | 1.85 | 1.85 | 1.85 | 1.85 | 1.85 | 1.85 | 1.85 | 1.85 |
| #8 | 11.90 | 12.04 | 12.18 | 12.32 | 12.47 | 12.61 | 12.75 | 12.89 | 13.03 | 13.17 | 13.31 | 13.46 |
| — | 1.85 | 1.86 | 1.86 | 1.86 | 1.86 | 1.86 | 1.87 | 1.87 | 1.88 | 1.88 | 1.89 | 1.89 |
| #9 | 13.60 | 13.74 | 13.88 | 14.02 | 14.16 | 14.30 | 14.44 | 14.59 | 14.73 | 14.87 | 15.01 | 15.15 |
| — | 1.90 | 1.91 | 1.92 | 1.93 | 1.93 | 1.94 | 1.95 | 1.96 | 1.97 | 1.98 | 1.99 | 1.99 |
| #10 | 15.29 | 15.43 | 15.57 | 15.71 | 15.85 | 16.00 | 16.14 | 16.28 | 16.42 | 16.56 | 16.70 | 16.84 |
| — | 2.00 | 2.01 | 2.02 | 2.02 | 2.03 | 2.03 | 2.03 | 2.04 | 2.04 | 2.04 | 2.04 | 2.04 |
| #11 | 16.98 | 17.12 | 17.26 | 17.40 | 17.55 | 17.69 | 17.83 | 17.97 | 18.11 | 18.25 | 18.39 | 18.53 |
| — | 2.03 | 2.03 | 2.03 | 2.02 | 2.02 | 2.01 | 2.00 | 2.00 | 1.99 | 1.98 | 1.97 | 1.97 |
| #12 | 18.67 | 18.82 | 18.96 | 19.10 | 19.24 | 19.38 | 19.52 | 19.66 | 19.80 | 19.95 | 20.09 | 20.23 |
| — | 1.96 | 1.95 | 1.95 | 1.94 | 1.93 | 1.93 | 1.92 | 1.92 | 1.92 | 1.91 | 1.91 | 1.91 |
| #13 | 20.37 | 20.51 | 20.65 | 20.79 | 20.94 | 21.08 | 21.22 | 21.36 | 21.50 | 21.64 | 21.78 | 21.92 |
| — | 1.91 | 1.91 | 1.90 | 1.90 | 1.90 | 1.90 | 1.90 | 1.90 | 1.90 | 1.91 | 1.91 | 1.90 |
| #14 | 22.07 | 22.21 | 22.35 | 22.49 | 22.63 | 22.77 | 22.91 | 23.06 | 23.20 | 23.34 | 23.48 | 23.62 |
| — | 1.90 | 1.90 | 1.90 | 1.90 | 1.90 | 1.89 | 1.89 | 1.88 | 1.88 | 1.87 | 1.86 | 1.85 |
| #15 | 23.76 | 23.90 | 24.05 | 24.19 | 24.33 | 24.47 | 24.61 | 24.75 | 24.90 | 25.04 | 25.18 | 25.32 |
| — | 1.85 | 1.84 | 1.83 | 1.82 | 1.81 | 1.80 | 1.78 | 1.77 | 1.76 | 1.75 | 1.74 | 1.73 |
| #16 | 25.46 | 25.61 | 25.75 | 25.89 | 26.03 | 26.17 | 26.32 | 26.46 | 26.60 | 26.74 | 26.89 | 27.03 |
| — | 1.72 | 1.71 | 1.71 | 1.70 | 1.69 | 1.69 | 1.68 | 1.68 | 1.68 | 1.68 | 1.68 | 1.68 |
| #17 | 27.17 | 27.31 | 27.45 | 27.60 | 27.74 | 27.88 | 28.02 | 28.16 | 28.31 | 28.45 | 28.59 | 28.73 |
| — | 1.68 | 1.68 | 1.68 | 1.69 | 1.69 | 1.70 | 1.70 | 1.71 | 1.72 | 1.73 | 1.73 | 1.74 |
| #18 | 28.87 | 29.02 | 29.16 | 29.30 | 29.44 | 29.58 | 29.72 | 29.87 | 30.01 | 30.15 | 30.29 | 30.43 |
| — | 1.75 | 1.75 | 1.76 | 1.77 | 1.77 | 1.78 | 1.79 | 1.79 | 1.79 | 1.80 | 1.80 | 1.80 |
| #19 | 30.57 | 30.72 | 30.86 | 31.00 | 31.14 | 31.28 | 31.43 | 31.57 | 31.71 | 31.85 | 31.99 | 32.13 |
| — | 1.80 | 1.80 | 1.80 | 1.80 | 1.80 | 1.80 | 1.80 | 1.80 | 1.80 | 1.80 | 1.80 | 1.80 |
| #20 | 32.28 | 32.42 | 32.56 | 32.70 | 32.84 | 32.98 | 33.13 | 33.27 | 33.41 | 33.55 | 33.69 | 33.83 |
| — | 1.80 | 1.80 | 1.80 | 1.81 | 1.81 | 1.81 | 1.82 | 1.83 | 1.83 | 1.84 | 1.85 | 1.86 |
| #21 | 33.97 | 34.12 | 34.26 | 34.40 | 34.54 | 34.68 | 34.82 | 34.96 | 35.10 | 35.25 | 35.39 | 35.53 |
| — | 1.87 | 1.88 | 1.90 | 1.91 | 1.93 | 1.94 | 1.96 | 1.97 | 1.99 | 2.00 | 2.02 | 2.03 |
| #22 | 35.67 | 35.81 | 35.95 | 36.09 | 36.23 | 36.37 | 35.51 | 36.65 | 36.79 | 36.93 | 37.08 | 37.22 |
| — | 2.05 | 2.06 | 2.07 | 2.09 | 2.10 | 2.11 | 2.11 | 2.12 | 2.12 | 2.13 | 2.13 | 2.13 |
| #23 | 37.36 | 37.50 | 37.64 | 37.78 | 37.92 | 38.06 | 38.20 | 38.34 | 38.48 | 38.62 | 38.76 | 38.90 |
| — | 2.13 | 2.13 | 2.12 | 2.12 | 2.11 | 2.11 | 2.10 | 2.09 | 2.08 | 2.07 | 2.06 | 2.05 |
| #24 | 39.05 | 39.19 | 39.33 | 39.47 | 39.61 | 39.75 | 39.89 | 40.03 | 40.17 | 40.31 | 40.46 | 40.60 |
| — | 2.04 | 2.03 | 2.03 | 2.02 | 2.01 | 2.00 | 2.00 | 1.99 | 1.99 | 1.98 | 1.98 | 1.98 |
| #25 | 40.74 | 40.88 | 41.02 | 41.16 | 41.30 | 41.44 | 41.58 | 41.73 | 41.87 | 42.01 | 42.15 | 42.29 |
| — | 1.98 | 1.98 | 1.98 | 1.98 | 1.98 | 1.98 | 1.98 | 1.99 | 1.99 | 1.99 | 1.99 | 1.99 |
| #26 | 42.43 | 42.57 | 42.71 | 42.85 | 43.00 | 43.14 | 43.28 | 43.42 | 43.56 | 43.70 | 43.84 | 43.98 |
| — | 1.99 | 1.99 | 1.99 | 1.99 | 1.98 | 1.98 | 1.97 | 1.96 | 1.95 | 1.94 | 1.92 | 1.91 |
| #27 | 44.13 | 44.27 | 44.41 | 44.55 | 44.69 | 44.83 | 44.97 | 45.12 | 45.26 | 45.40 | 45.54 | 45.68 |
| — | 1.89 | 1.87 | 1.86 | 1.84 | 1.82 | 1.80 | 1.78 | 1.76 | 1.73 | 1.71 | 1.69 | 1.67 |
| #28 | 45.83 | 45.97 | 46.11 | 46.25 | 46.40 | 46.54 | 46.68 | 46.82 | 46.97 | 47.11 | 47.25 | 47.39 |
| — | 1.66 | 1.64 | 1.62 | 1.61 | 1.59 | 1.58 | 1.57 | 1.56 | 1.55 | 1.55 | 1.54 | 1.54 |
| #29 | 47.54 | 47.68 | 47.82 | 47.97 | 48.11 | 48.25 | 48.39 | 48.54 | 48.68 | 48.82 | 48.96 | 49.11 |
| — | 1.54 | 1.54 | 1.54 | 1.55 | 1.55 | 1.56 | 1.57 | 1.58 | 1.59 | 1.59 | 1.60 | 1.62 |
| #30 | 49.25 | 49.39 | 49.53 | 49.67 | 49.82 | 49.96 | 50.10 | 50.24 | 50.39 | 50.53 | 50.67 | 50.81 |
| — | 1.63 | 1.64 | 1.64 | 1.65 | 1.66 | 1.67 | 1.68 | 1.68 | 1.69 | 1.69 | 1.69 | 1.69 |

TABLE 24

| Widths of the microstrip line | | | | | | | | | | | | |
|---|---|---|---|---|---|---|---|---|---|---|---|---|
| #31 | 50.95 | 51.10 | 51.24 | 51.38 | 51.52 | 51.66 | 51.81 | 51.95 | 52.09 | 52.23 | 52.38 | 52.52 |
| — | 1.69 | 1.69 | 1.69 | 1.68 | 1.68 | 1.68 | 1.67 | 1.67 | 1.66 | 1.66 | 1.66 | 1.65 |
| #32 | 52.66 | 52.80 | 52.94 | 53.09 | 53.23 | 53.37 | 53.51 | 53.65 | 53.80 | 53.94 | 54.08 | 54.22 |
| — | 1.65 | 1.65 | 1.66 | 1.66 | 1.66 | 1.67 | 1.68 | 1.69 | 1.71 | 1.73 | 1.75 | 1.77 |
| #33 | 54.36 | 54.51 | 54.65 | 54.79 | 54.93 | 55.07 | 55.21 | 55.35 | 55.49 | 55.63 | 55.78 | 55.92 |
| — | 1.79 | 1.82 | 1.85 | 1.88 | 1.91 | 1.95 | 1.99 | 2.03 | 2.07 | 2.11 | 2.15 | 2.19 |
| #34 | 56.06 | 56.20 | 56.34 | 56.48 | 56.62 | 56.76 | 56.90 | 57.04 | 57.18 | 57.32 | 57.45 | 57.59 |
| — | 2.23 | 2.27 | 2.30 | 2.34 | 2.37 | 2.40 | 2.43 | 2.45 | 2.48 | 2.49 | 2.51 | 2.52 |

TABLE 24-continued

| Widths of the microstrip line | | | | | | | | | | | | |
|---|---|---|---|---|---|---|---|---|---|---|---|---|
| #35 | 57.73 | 57.87 | 58.01 | 58.15 | 58.29 | 58.43 | 58.57 | 58.71 | 58.85 | 58.99 | 59.13 | 59.27 |
| — | 2.52 | 2.52 | 2.52 | 2.51 | 2.50 | 2.49 | 2.48 | 2.46 | 2.44 | 2.42 | 2.40 | 2.38 |
| #36 | 59.41 | 59.55 | 59.69 | 59.83 | 59.97 | 60.11 | 60.25 | 60.39 | 60.53 | 60.67 | 60.81 | 60.95 |
| — | 2.36 | 2.34 | 2.32 | 2.30 | 2.29 | 2.27 | 2.26 | 2.25 | 2.25 | 2.24 | 2.24 | 2.25 |
| #37 | 61.09 | 61.23 | 61.37 | 61.51 | 61.65 | 61.79 | 61.93 | 62.07 | 62.21 | 62.35 | 62.49 | 62.63 |
| — | 2.25 | 2.26 | 2.27 | 2.28 | 2.30 | 2.31 | 2.33 | 2.34 | 2.36 | 2.38 | 2.39 | 2.40 |
| #38 | 62.77 | 62.91 | 63.05 | 63.19 | 63.33 | 63.47 | 63.61 | 63.75 | 63.89 | 64.03 | 64.17 | 64.31 |
| — | 2.41 | 2.41 | 2.41 | 2.40 | 2.39 | 2.37 | 2.35 | 2.31 | 2.27 | 2.22 | 2.17 | 2.11 |
| #39 | 64.46 | 64.60 | 64.74 | 64.88 | 65.02 | 65.16 | 65.31 | 65.45 | 65.59 | 65.74 | 65.88 | 66.03 |
| — | 2.04 | 1.96 | 1.88 | 1.79 | 1.70 | 1.61 | 1.52 | 1.43 | 1.33 | 1.24 | 1.15 | 1.06 |
| #40 | 66.17 | 66.32 | 66.46 | 66.61 | 66.76 | 66.90 | 67.05 | 67.20 | 67.35 | 67.50 | 67.65 | 67.80 |
| — | 0.98 | 0.90 | 0.83 | 0.76 | 0.70 | 0.65 | 0.60 | 0.55 | 0.52 | 0.48 | 0.46 | 0.44 |
| #41 | 67.95 | 68.09 | 68.24 | 68.39 | 68.54 | 68.69 | 68.84 | 68.99 | 69.14 | 69.29 | 69.43 | 69.58 |
| — | 0.42 | 0.41 | 0.41 | 0.41 | 0.42 | 0.43 | 0.45 | 0.48 | 0.51 | 0.56 | 0.61 | 0.67 |
| #42 | 69.73 | 69.87 | 70.02 | 70.16 | 70.31 | 70.45 | 70.60 | 70.74 | 70.88 | 71.02 | 71.16 | 71.30 |
| — | 0.75 | 0.83 | 0.93 | 1.05 | 1.18 | 1.33 | 1.49 | 1.67 | 1.87 | 2.09 | 2.32 | 2.58 |
| #43 | 71.44 | 71.58 | 71.71 | 71.85 | 71.99 | 72.12 | 72.26 | 72.39 | 72.53 | 72.66 | 72.80 | 72.93 |
| — | 2.85 | 3.13 | 3.43 | 3.74 | 4.05 | 4.38 | 4.70 | 5.02 | 5.32 | 5.61 | 5.88 | 6.12 |
| #44 | 73.06 | 73.20 | 73.33 | 73.46 | 73.59 | 73.73 | 73.86 | 73.99 | 74.13 | 74.26 | 74.39 | 74.53 |
| — | 6.33 | 6.50 | 6.62 | 6.70 | 6.73 | 6.71 | 6.64 | 6.52 | 6.35 | 6.15 | 5.91 | 5.64 |
| #45 | 74.66 | 74.80 | 74.93 | 75.07 | 75.21 | 75.34 | 75.48 | 75.62 | 75.76 | 75.90 | 76.04 | 76.18 |
| — | 5.34 | 5.03 | 4.71 | 4.38 | 4.05 | 3.73 | 3.41 | 3.11 | 2.82 | 2.55 | 2.29 | 2.05 |
| #46 | 76.32 | 76.46 | 76.60 | 76.75 | 76.89 | 77.04 | 77.18 | 77.33 | 77.48 | 77.62 | 77.77 | 77.92 |
| — | 1.83 | 1.62 | 1.44 | 1.27 | 1.12 | 0.99 | 0.87 | 0.77 | 0.68 | 0.61 | 0.55 | 0.49 |
| #47 | 78.07 | 78.22 | 78.37 | 78.52 | 78.67 | 78.82 | 78.97 | 79.12 | 79.27 | 79.42 | 79.57 | 79.72 |
| — | 0.45 | 0.42 | 0.39 | 0.37 | 0.36 | 0.35 | 0.35 | 0.35 | 0.36 | 0.37 | 0.39 | 0.41 |
| #48 | 79.87 | 80.02 | 80.17 | 80.31 | 80.46 | 80.61 | 80.75 | 80.90 | 81.05 | 81.19 | 81.34 | 81.48 |
| — | 0.44 | 0.48 | 0.52 | 0.57 | 0.63 | 0.69 | 0.76 | 0.84 | 0.92 | 1.01 | 1.10 | 1.20 |
| #49 | 81.62 | 81.77 | 81.91 | 82.05 | 82.19 | 82.34 | 82.48 | 82.62 | 82.76 | 82.90 | 83.04 | 83.18 |
| — | 1.30 | 1.41 | 1.52 | 1.62 | 1.73 | 1.83 | 1.93 | 2.03 | 2.12 | 2.20 | 2.28 | 2.34 |
| #50 | 83.32 | 83.46 | 83.60 | 83.74 | 83.88 | 84.02 | 84.16 | 84.30 | 84.43 | 84.57 | 84.71 | 84.85 |
| — | 2.40 | 2.45 | 2.49 | 2.52 | 2.55 | 2.56 | 2.57 | 2.57 | 2.57 | 2.56 | 2.54 | 2.53 |
| #51 | 84.99 | 85.13 | 85.27 | 85.41 | 85.55 | 85.69 | 85.83 | 85.97 | 86.11 | 86.25 | 86.39 | 86.53 |
| — | 2.51 | 2.49 | 2.47 | 2.45 | 2.43 | 2.41 | 2.40 | 2.39 | 2.38 | 2.38 | 2.38 | 2.39 |
| #52 | 86.67 | 86.81 | 86.95 | 87.09 | 87.23 | 87.37 | 87.51 | 87.65 | 87.79 | 87.93 | 88.07 | 88.20 |
| — | 2.39 | 2.41 | 2.43 | 2.45 | 2.47 | 2.50 | 2.54 | 2.57 | 2.61 | 2.64 | 2.68 | 2.72 |
| #53 | 88.34 | 88.48 | 88.62 | 88.76 | 88.90 | 89.04 | 89.18 | 89.31 | 89.45 | 89.59 | 89.73 | 89.87 |
| — | 2.76 | 2.79 | 2.83 | 2.85 | 2.88 | 2.90 | 2.91 | 2.92 | 2.92 | 2.92 | 2.90 | 2.88 |
| #54 | 90.01 | 90.15 | 90.28 | 90.42 | 90.56 | 90.70 | 90.84 | 90.98 | 91.12 | 91.26 | 91.40 | 91.54 |
| — | 2.86 | 2.82 | 2.78 | 2.73 | 2.68 | 2.62 | 2.55 | 2.49 | 2.42 | 2.34 | 2.27 | 2.20 |
| #55 | 91.68 | 91.82 | 91.96 | 92.11 | 92.25 | 92.39 | 92.53 | 92.67 | 92.82 | 92.96 | 93.10 | 93.24 |
| — | 2.12 | 2.05 | 1.98 | 1.91 | 1.84 | 1.78 | 1.72 | 1.67 | 1.61 | 1.57 | 1.52 | 1.49 |
| #56 | 93.39 | 93.53 | 93.67 | 93.82 | 93.96 | 94.10 | 94.25 | 94.39 | 94.53 | 94.68 | 94.82 | 94.96 |
| — | 1.45 | 1.42 | 1.40 | 1.38 | 1.36 | 1.35 | 1.34 | 1.34 | 1.33 | 1.34 | 1.34 | 1.35 |
| #57 | 95.11 | 95.25 | 95.39 | 95.54 | 95.68 | 95.82 | 95.97 | 96.11 | 96.25 | 96.40 | 96.54 | 96.68 |
| — | 1.36 | 1.37 | 1.38 | 1.39 | 1.41 | 1.42 | 1.44 | 1.45 | 1.47 | 1.48 | 1.49 | 1.50 |
| #58 | 96.82 | 96.97 | 97.11 | 97.25 | 97.40 | 97.54 | 97.68 | 97.82 | 97.97 | 98.11 | 98.25 | 98.40 |
| — | 1.51 | 1.52 | 1.52 | 1.53 | 1.53 | 1.53 | 1.52 | 1.52 | 1.51 | 1.51 | 1.50 | 1.49 |
| #59 | 98.54 | 98.68 | 98.82 | 98.97 | 99.11 | 99.25 | 99.40 | 99.54 | 99.68 | 99.83 | 99.97 | 100.11 |
| — | 1.48 | 1.47 | 1.46 | 1.45 | 1.44 | 1.43 | 1.42 | 1.42 | 1.42 | 1.42 | 1.42 | 1.42 |
| #60 | 100.26 | 100.40 | 100.54 | 100.68 | 100.83 | 100.97 | 101.11 | 101.26 | 101.40 | 101.54 | 101.68 | 101.82 |
| — | 1.43 | 1.44 | 1.45 | 1.46 | 1.48 | 1.50 | 1.53 | 1.56 | 1.59 | 1.62 | 1.66 | 1.69 |

TABLE 25

| Widths of the microstrip line | | | | | | | | | | | | |
|---|---|---|---|---|---|---|---|---|---|---|---|---|
| #61 | 101.97 | 102.11 | 102.25 | 102.39 | 102.53 | 102.67 | 102.81 | 102.96 | 103.10 | 103.24 | 103.38 | 103.52 |
| — | 1.73 | 1.78 | 1.82 | 1.87 | 1.91 | 1.96 | 2.00 | 2.05 | 2.09 | 2.14 | 2.18 | 2.22 |
| #62 | 103.66 | 103.80 | 103.94 | 104.08 | 104.22 | 104.36 | 104.50 | 104.64 | 104.78 | 104.92 | 105.06 | 105.20 |
| — | 2.25 | 2.29 | 2.32 | 2.34 | 2.37 | 2.38 | 2.40 | 2.41 | 2.41 | 2.42 | 2.41 | 2.41 |
| #63 | 105.34 | 105.48 | 105.62 | 105.76 | 105.90 | 106.04 | 106.18 | 106.32 | 106.46 | 106.60 | 106.74 | 106.88 |
| — | 2.40 | 2.39 | 2.38 | 2.36 | 2.35 | 2.33 | 2.31 | 2.29 | 2.27 | 2.26 | 2.24 | 2.22 |
| #64 | 107.02 | 107.16 | 107.30 | 107.44 | 107.58 | 107.72 | 107.86 | 108.00 | 108.14 | 108.28 | 108.42 | 108.56 |
| — | 2.21 | 2.19 | 2.18 | 2.17 | 2.16 | 2.16 | 2.15 | 2.15 | 2.15 | 2.15 | 2.15 | 2.16 |
| #65 | 108.71 | 108.85 | 108.99 | 109.13 | 109.27 | 109.41 | 109.55 | 109.69 | 109.83 | 109.97 | 110.11 | 110.25 |
| — | 2.16 | 2.17 | 2.17 | 2.18 | 2.19 | 2.20 | 2.20 | 2.21 | 2.21 | 2.21 | 2.22 | 2.21 |
| #66 | 110.39 | 110.53 | 110.67 | 110.81 | 110.95 | 111.09 | 111.23 | 111.37 | 111.51 | 111.66 | 111.80 | 111.94 |
| — | 2.21 | 2.21 | 2.20 | 2.19 | 2.17 | 2.16 | 2.14 | 2.12 | 2.09 | 2.07 | 2.04 | 2.01 |
| #67 | 112.08 | 112.22 | 112.36 | 112.50 | 112.64 | 112.79 | 112.93 | 113.07 | 113.21 | 113.35 | 113.50 | 113.64 |
| — | 1.98 | 1.94 | 1.91 | 1.87 | 1.84 | 1.81 | 1.77 | 1.74 | 1.71 | 1.68 | 1.65 | 1.62 |
| #68 | 113.78 | 113.92 | 114.07 | 114.21 | 114.35 | 114.49 | 114.64 | 114.78 | 114.92 | 115.07 | 115.21 | 115.35 |
| — | 1.60 | 1.57 | 1.55 | 1.53 | 1.52 | 1.50 | 1.49 | 1.48 | 1.48 | 1.47 | 1.47 | 1.47 |

TABLE 25-continued

| Widths of the microstrip line | | | | | | | | | | | | |
|---|---|---|---|---|---|---|---|---|---|---|---|---|
| #69 | 115.49 | 115.64 | 115.78 | 115.92 | 116.07 | 116.21 | 116.35 | 116.49 | 116.64 | 116.78 | 116.92 | 117.06 |
| — | 1.47 | 1.48 | 1.49 | 1.49 | 1.50 | 1.51 | 1.53 | 1.54 | 1.55 | 1.56 | 1.58 | 1.59 |
| #70 | 117.21 | 117.35 | 117.49 | 117.63 | 117.78 | 117.92 | 118.06 | 118.20 | 118.34 | 118.49 | 118.63 | 118.77 |
| — | 1.60 | 1.61 | 1.63 | 1.64 | 1.64 | 1.65 | 1.66 | 1.66 | 1.67 | 1.67 | 1.67 | 1.67 |
| #71 | 118.91 | 119.06 | 119.20 | 119.34 | 119.48 | 119.62 | 119.77 | 119.91 | 120.05 | 120.19 | 120.34 | 120.48 |
| — | 1.67 | 1.67 | 1.67 | 1.66 | 1.66 | 1.65 | 1.65 | 1.65 | 1.64 | 1.64 | 1.64 | 1.64 |
| #72 | 120.62 | 120.76 | 120.90 | 121.05 | 121.19 | 121.33 | 121.47 | 121.62 | 121.76 | 121.90 | 122.04 | 122.18 |
| — | 1.64 | 1.64 | 1.64 | 1.65 | 1.66 | 1.66 | 1.68 | 1.69 | 1.70 | 1.72 | 1.74 | 1.76 |
| #73 | 122.33 | 122.47 | 122.61 | 122.75 | 122.89 | 123.03 | 123.17 | 123.32 | 123.46 | 123.60 | 123.74 | 123.88 |
| — | 1.78 | 1.81 | 1.83 | 1.86 | 1.89 | 1.92 | 1.94 | 1.97 | 2.00 | 2.03 | 2.06 | 2.09 |
| #74 | 124.02 | 124.16 | 124.30 | 124.44 | 124.58 | 124.72 | 124.86 | 125.00 | 125.14 | 125.28 | 125.42 | 125.56 |
| — | 2.12 | 2.14 | 2.17 | 2.19 | 2.21 | 2.23 | 2.24 | 2.26 | 2.27 | 2.27 | 2.28 | 2.28 |
| #75 | 125.70 | 125.84 | 125.98 | 126.12 | 126.26 | 126.40 | 126.54 | 126.68 | 126.83 | 126.97 | 127.11 | 127.25 |
| — | 2.28 | 2.28 | 2.27 | 2.26 | 2.26 | 2.24 | 2.23 | 2.22 | 2.20 | 2.19 | 2.18 | 2.16 |
| #76 | 127.39 | 127.53 | 127.67 | 127.81 | 127.95 | 128.09 | 128.23 | 128.37 | 128.51 | 128.65 | 128.79 | 128.94 |
| — | 2.15 | 2.13 | 2.12 | 2.11 | 2.09 | 2.08 | 2.07 | 2.07 | 2.06 | 2.06 | 2.05 | 2.05 |
| #77 | 129.08 | 129.22 | 129.36 | 129.50 | 129.64 | 129.78 | 129.92 | 130.06 | 130.20 | 130.34 | 130.49 | 130.63 |
| — | 2.05 | 2.05 | 2.05 | 2.05 | 2.06 | 2.06 | 2.06 | 2.07 | 2.07 | 2.07 | 2.08 | 2.08 |
| #78 | 130.77 | 130.91 | 131.05 | 131.19 | 131.33 | 131.47 | 131.61 | 131.75 | 131.89 | 132.03 | 132.18 | 132.32 |
| — | 2.08 | 2.08 | 2.08 | 2.07 | 2.07 | 2.06 | 2.05 | 2.04 | 2.03 | 2.01 | 2.00 | 1.98 |
| #79 | 132.46 | 132.60 | 132.74 | 132.88 | 133.02 | 133.16 | 133.31 | 133.45 | 133.59 | 133.73 | 133.87 | 134.02 |
| — | 1.96 | 1.94 | 1.92 | 1.89 | 1.87 | 1.84 | 1.82 | 1.79 | 1.77 | 1.74 | 1.72 | 1.69 |
| #80 | 134.16 | 134.30 | 134.44 | 134.58 | 134.73 | 134.87 | 135.01 | 135.16 | 135.30 | 135.44 | 135.58 | 135.73 |
| — | 1.67 | 1.65 | 1.63 | 1.61 | 1.59 | 1.58 | 1.57 | 1.55 | 1.54 | 1.54 | 1.53 | 1.53 |
| #81 | 135.87 | 136.01 | 136.15 | 136.30 | 136.44 | 136.58 | 136.72 | 136.87 | 137.01 | 137.15 | 137.29 | 137.44 |
| — | 1.53 | 1.53 | 1.53 | 1.53 | 1.54 | 1.54 | 1.55 | 1.56 | 1.57 | 1.58 | 1.59 | 1.60 |
| #82 | 137.58 | 137.72 | 137.86 | 138.01 | 138.15 | 138.29 | 138.43 | 138.58 | 138.72 | 138.86 | 139.00 | 139.14 |
| — | 1.61 | 1.62 | 1.64 | 1.65 | 1.65 | 1.66 | 1.67 | 1.68 | 1.68 | 1.69 | 1.69 | 1.69 |
| #83 | 139.29 | 139.43 | 139.57 | 139.71 | 139.85 | 140.00 | 140.14 | 140.28 | 140.42 | 140.57 | 140.71 | 140.85 |
| — | 1.69 | 1.69 | 1.69 | 1.68 | 1.68 | 1.68 | 1.67 | 1.67 | 1.66 | 1.66 | 1.66 | 1.65 |
| #84 | 140.99 | 141.13 | 141.28 | 141.42 | 141.56 | | | | | | | |
| — | 1.65 | 1.65 | 1.65 | 1.65 | 1.66 | | | | | | | |

Figure 39:
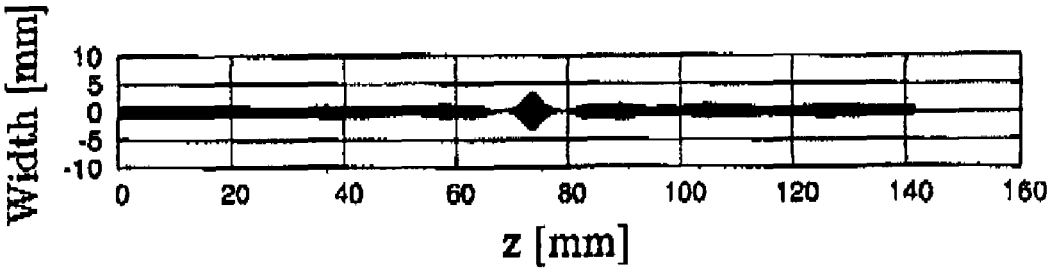
FIG. 39 is a graph showing the surface form of the microstrip line in the reflection-type bandpass filter of the ninth embodiment.

FIG. 39 shows the shape of the microstrip line 5 in the reflection-type bandpass filter 1 of the ninth embodiment. A non-reflecting terminator, or an R=50Ω resistance, is provided at the terminating side (the face at z=141.56 mm) of the reflection-type bandpass filter 1. The thickness of the metal films used in the conducting layer 3 and of the conductor constituting the microstrip line 5 should be adequately greater than the skin depth $\delta s=\sqrt{\{2/(\omega\mu 0\sigma)\}}$ at f=1 GHz. For example if copper is used, the thickness of the conducting layer 3 and of the conductor of the microstrip line 5 should be taken as 2.1 μm or greater. This reflection-type bandpass filter is used in a system where the characteristic impedance is 50Ω.

Figure 40:
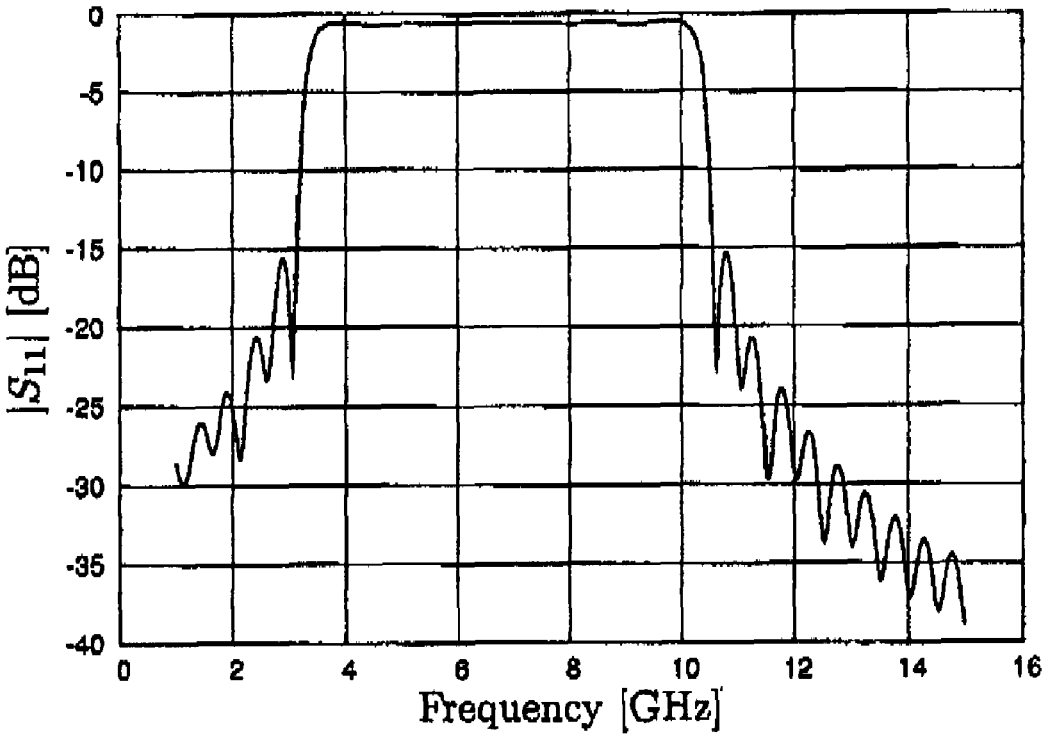
FIG. 40 is a graph showing the amplitude characteristics of the reflective wave in the reflection-type bandpass filter of the ninth embodiment.
Figure 41:
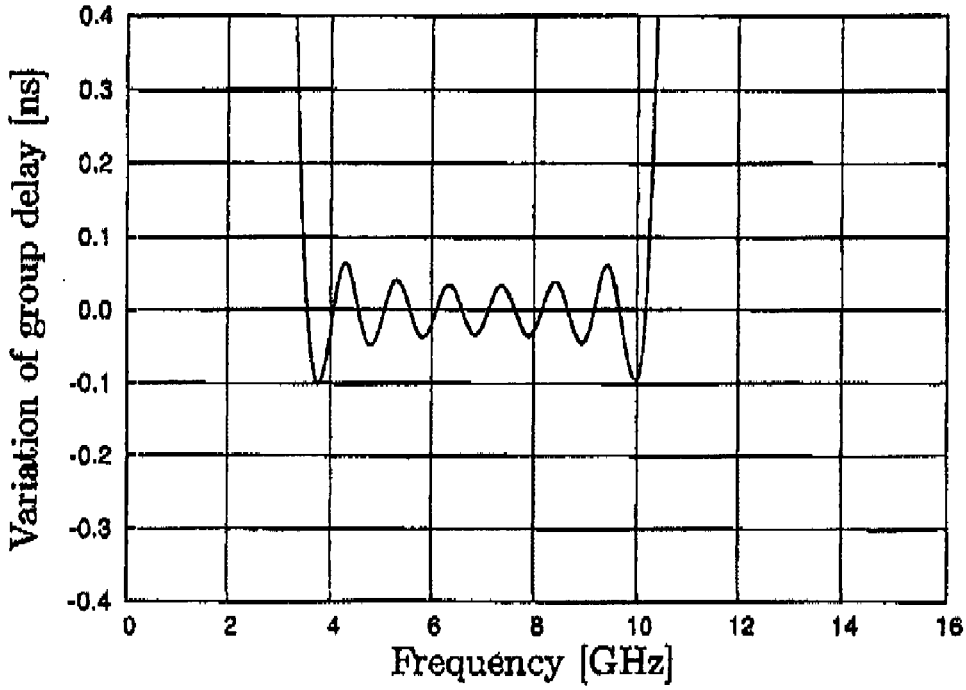
FIG. 41 is a graph showing the group delay frequency characteristics of the reflective wave in the reflection-type bandpass filter of the ninth embodiment.

FIG. 40 and FIG. 41 express the amplitude characteristics and group delay frequency characteristics respectively of the reflective wave (S11) in the bandpass filter of the ninth embodiment. As shown in the figures, in the region of frequency f for which 3.6 GHz≦f≦10.1 GHz, the reflectivity is −1 dB or greater and the variation of the group delay is within ±0.1 ns. In the region f<3.1 GHz and f>10.6 GHz, the reflectivity is −15 dB or lower.

Embodiment 10

A Kaiser window was used for which the reflectivity is 1 at the frequency f in the region 3.6 GHz≦f≦10.1 GHz, and is 0 elsewhere, and for which A=35. Taking one wavelength at frequency f=1 GHz of the signal transmitted within the microstrip line as the waveguide length, the system characteristic impedance was taken as 50Ω, and the design was carried out.

Figure 42:
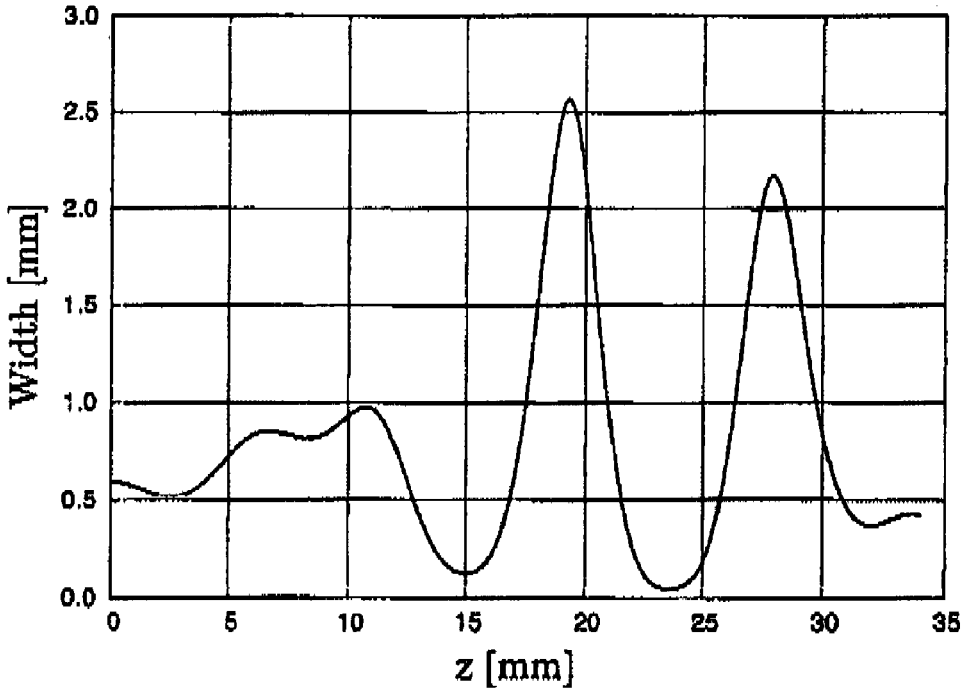
FIG. 42 is a graph showing the distribution in the width direction of the microstrip line in the reflection-type bandpass filter of the tenth embodiment.

FIG. 42 shows the distribution of the width w of the microstrip line 5 in the z-axis direction when a dielectric layer 4 of thickness h=0.635 mm, and relative dielectric constant $\in_r$=0.2 (for example, RT/Duroid (registered trademark) 6010LM) was used. Table 26 lists the widths w of the microstrip line 5.

TABLE 26

| Widths of the microstrip line | | | | | | | | | | | | |
|---|---|---|---|---|---|---|---|---|---|---|---|---|
| | z[mm] | | | | | | | | | | | |
| | 0.00 | 0.11 | 0.23 | 0.34 | 0.46 | 0.57 | 0.68 | 0.80 | 0.91 | 1.03 | 1.14 | 1.25 |
| | w[mm] | | | | | | | | | | | |
| | 0.60 | 0.59 | 0.59 | 0.59 | 0.59 | 0.58 | 0.58 | 0.57 | 0.57 | 0.57 | 0.56 | 0.56 |
| #2 | 1.37 | 1.48 | 1.60 | 1.71 | 1.83 | 1.94 | 2.05 | 2.17 | 2.28 | 2.40 | 2.51 | 2.63 |
| — | 0.55 | 0.55 | 0.54 | 0.54 | 0.53 | 0.53 | 0.52 | 0.52 | 0.52 | 0.52 | 0.52 | 0.52 |
| #3 | 2.74 | 2.86 | 2.97 | 3.08 | 3.20 | 3.31 | 3.43 | 3.54 | 3.66 | 3.77 | 3.88 | 4.00 |
| — | 0.52 | 0.52 | 0.52 | 0.53 | 0.53 | 0.54 | 0.55 | 0.55 | 0.56 | 0.57 | 0.58 | 0.60 |

TABLE 26-continued

| | Widths of the microstrip line | | | | | | | | | | | |
|---|---|---|---|---|---|---|---|---|---|---|---|---|
| | z[mm] | | | | | | | | | | | |
| | 0.00 | 0.11 | 0.23 | 0.34 | 0.46 | 0.57 | 0.68 | 0.80 | 0.91 | 1.03 | 1.14 | 1.25 |
| | w[mm] | | | | | | | | | | | |
| | 0.60 | 0.59 | 0.59 | 0.59 | 0.59 | 0.58 | 0.58 | 0.57 | 0.57 | 0.57 | 0.56 | 0.56 |
| #4 | 4.11 | 4.22 | 4.34 | 4.45 | 4.56 | 4.68 | 4.79 | 4.90 | 5.02 | 5.13 | 5.24 | 5.35 |
| — | 0.61 | 0.62 | 0.64 | 0.65 | 0.66 | 0.68 | 0.70 | 0.71 | 0.73 | 0.74 | 0.76 | 0.77 |
| #5 | 5.47 | 5.58 | 5.69 | 5.80 | 5.92 | 6.03 | 6.14 | 6.25 | 6.36 | 6.48 | 6.59 | 6.70 |
| — | 0.78 | 0.79 | 0.81 | 0.82 | 0.83 | 0.83 | 0.84 | 0.84 | 0.85 | 0.85 | 0.85 | 0.85 |
| #6 | 6.81 | 6.92 | 7.04 | 7.15 | 7.26 | 7.37 | 7.48 | 7.60 | 7.71 | 7.82 | 7.93 | 8.04 |
| — | 0.85 | 0.85 | 0.85 | 0.85 | 0.84 | 0.84 | 0.83 | 0.83 | 0.83 | 0.82 | 0.82 | 0.82 |
| #7 | 8.16 | 8.27 | 8.38 | 8.49 | 8.61 | 8.72 | 8.83 | 8.94 | 9.05 | 9.17 | 9.28 | 9.39 |
| — | 0.82 | 0.82 | 0.82 | 0.82 | 0.82 | 0.82 | 0.83 | 0.83 | 0.84 | 0.85 | 0.86 | 0.87 |
| #8 | 9.50 | 9.61 | 9.72 | 9.84 | 9.95 | 10.06 | 10.17 | 10.28 | 10.39 | 10.50 | 10.62 | 10.73 |
| — | 0.88 | 0.89 | 0.90 | 0.91 | 0.92 | 0.93 | 0.95 | 0.95 | 0.96 | 0.97 | 0.97 | 0.98 |
| #9 | 10.84 | 10.95 | 11.06 | 11.17 | 11.28 | 11.39 | 11.51 | 11.62 | 11.73 | 11.84 | 11.95 | 12.07 |
| — | 0.97 | 0.97 | 0.96 | 0.96 | 0.94 | 0.93 | 0.91 | 0.88 | 0.86 | 0.83 | 0.79 | 0.76 |
| #10 | 12.18 | 12.29 | 12.41 | 12.52 | 12.63 | 12.75 | 12.86 | 12.98 | 13.09 | 13.21 | 13.33 | 13.44 |
| — | 0.72 | 0.68 | 0.64 | 0.60 | 0.56 | 0.52 | 0.48 | 0.44 | 0.41 | 0.37 | 0.34 | 0.31 |
| #11 | 13.56 | 13.68 | 13.80 | 13.91 | 14.03 | 14.15 | 14.27 | 14.39 | 14.51 | 14.63 | 14.75 | 14.87 |
| — | 0.28 | 0.25 | 0.23 | 0.21 | 0.19 | 0.17 | 0.16 | 0.15 | 0.14 | 0.13 | 0.13 | 0.13 |
| #12 | 14.99 | 15.11 | 15.23 | 15.35 | 15.47 | 15.59 | 15.71 | 15.83 | 15.95 | 16.07 | 16.18 | 16.30 |
| — | 0.12 | 0.12 | 0.13 | 0.13 | 0.14 | 0.15 | 0.16 | 0.18 | 0.19 | 0.22 | 0.24 | 0.28 |
| #13 | 16.42 | 16.53 | 16.65 | 16.76 | 16.88 | 16.99 | 17.11 | 17.22 | 17.33 | 17.44 | 17.55 | 17.66 |
| — | 0.31 | 0.36 | 0.41 | 0.46 | 0.53 | 0.60 | 0.67 | 0.76 | 0.85 | 0.95 | 1.06 | 1.17 |
| #14 | 17.77 | 17.88 | 17.99 | 18.10 | 18.21 | 18.31 | 18.42 | 18.53 | 18.63 | 18.74 | 18.85 | 18.95 |
| — | 1.28 | 1.41 | 1.53 | 1.66 | 1.78 | 1.91 | 2.02 | 2.14 | 2.24 | 2.34 | 2.42 | 2.48 |
| #15 | 19.06 | 19.16 | 19.27 | 19.37 | 19.48 | 19.59 | 19.69 | 19.80 | 19.90 | 20.01 | 20.12 | 20.23 |
| — | 2.53 | 2.56 | 2.57 | 2.55 | 2.52 | 2.47 | 2.41 | 2.32 | 2.22 | 2.11 | 1.99 | 1.87 |
| #16 | 20.33 | 20.44 | 20.55 | 20.66 | 20.77 | 20.88 | 20.99 | 21.10 | 21.22 | 21.33 | 21.44 | 21.56 |
| — | 1.74 | 1.60 | 1.47 | 1.34 | 1.21 | 1.08 | 0.96 | 0.85 | 0.75 | 0.65 | 0.56 | 0.48 |
| #17 | 21.67 | 21.79 | 21.91 | 22.03 | 22.14 | 22.26 | 22.38 | 22.50 | 22.62 | 22.75 | 22.87 | 22.99 |
| — | 0.41 | 0.35 | 0.29 | 0.24 | 0.20 | 0.17 | 0.14 | 0.12 | 0.10 | 0.09 | 0.07 | 0.06 |
| #18 | 23.11 | 23.23 | 23.36 | 23.48 | 23.60 | 23.72 | 23.85 | 23.97 | 24.09 | 24.21 | 24.33 | 24.46 |
| — | 0.06 | 0.05 | 0.05 | 0.05 | 0.05 | 0.05 | 0.05 | 0.05 | 0.06 | 0.06 | 0.07 | 0.08 |
| #19 | 24.58 | 24.70 | 24.82 | 24.94 | 25.05 | 25.17 | 25.29 | 25.41 | 25.52 | 25.64 | 25.75 | 25.87 |
| — | 0.10 | 0.11 | 0.14 | 0.16 | 0.19 | 0.23 | 0.28 | 0.33 | 0.38 | 0.45 | 0.52 | 0.60 |
| #20 | 25.98 | 26.09 | 26.20 | 26.31 | 26.42 | 26.53 | 26.64 | 26.75 | 26.86 | 26.97 | 27.08 | 27.19 |
| — | 0.69 | 0.78 | 0.88 | 0.98 | 1.09 | 1.20 | 1.31 | 1.42 | 1.53 | 1.64 | 1.74 | 1.83 |
| #21 | 27.29 | 27.40 | 27.51 | 27.61 | 27.72 | 27.83 | 27.93 | 28.04 | 28.15 | 28.25 | 28.36 | 28.47 |
| — | 1.92 | 2.00 | 2.06 | 2.11 | 2.14 | 2.16 | 2.17 | 2.16 | 2.14 | 2.10 | 2.05 | 1.99 |
| #22 | 28.57 | 28.68 | 28.79 | 28.90 | 29.01 | 29.12 | 29.22 | 29.33 | 29.44 | 29.55 | 29.67 | 29.78 |
| — | 1.92 | 1.84 | 1.76 | 1.67 | 1.58 | 1.49 | 1.40 | 1.31 | 1.22 | 1.13 | 1.05 | 0.98 |
| #23 | 29.89 | 30.00 | 30.11 | 30.23 | 30.34 | 30.45 | 30.57 | 30.68 | 30.80 | 30.91 | 31.03 | 31.14 |
| — | 0.90 | 0.84 | 0.78 | 0.72 | 0.67 | 0.62 | 0.58 | 0.54 | 0.51 | 0.48 | 0.46 | 0.43 |
| #24 | 31.26 | 31.37 | 31.49 | 31.60 | 31.72 | 31.84 | 31.95 | 32.07 | 32.18 | 32.30 | 32.42 | 32.53 |
| — | 0.42 | 0.40 | 0.39 | 0.38 | 0.38 | 0.37 | 0.37 | 0.37 | 0.37 | 0.38 | 0.38 | 0.39 |
| #25 | 32.65 | 32.76 | 32.88 | 32.99 | 33.11 | 33.23 | 33.34 | 33.46 | 33.57 | 33.69 | 33.80 | 33.92 |
| — | 0.39 | 0.40 | 0.40 | 0.41 | 0.42 | 0.42 | 0.43 | 0.43 | 0.43 | 0.43 | 0.43 | 0.43 |
| #26 | 34.03 | | | | | | | | | | | |
| — | 0.42 | | | | | | | | | | | |

Figure 43:
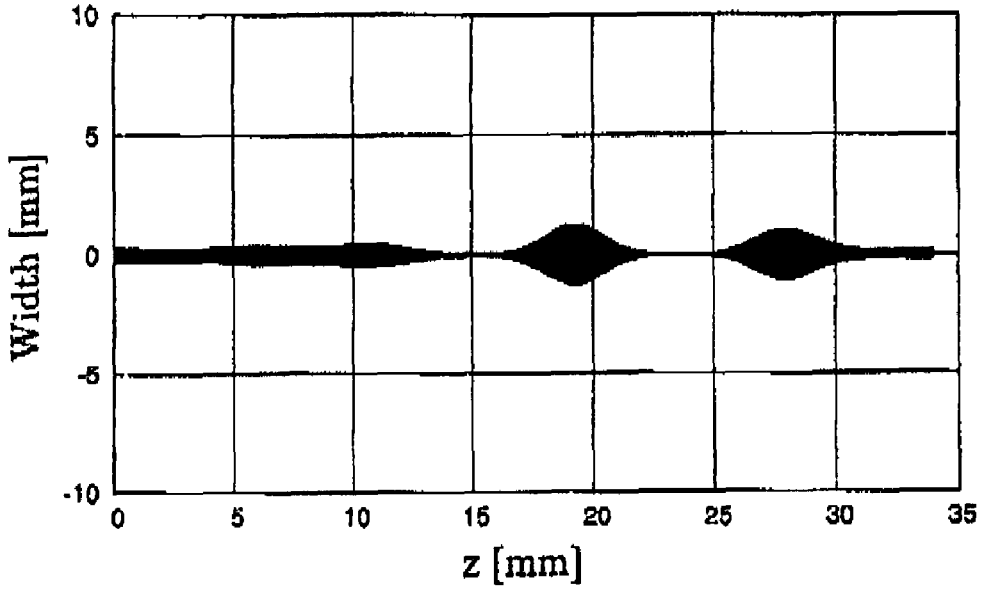
FIG. 43 is a graph showing the surface form of the microstrip line in the reflection-type bandpass filter of the tenth embodiment.

FIG. 43 shows the shape of the microstrip line 5 in the reflection-type bandpass filter 1 of the tenth embodiment. A non-reflecting terminator, or an R=50Ω resistance, is provided at the terminating side (the face at z=34.03 mm) of the reflection-type bandpass filter 1. The thickness of the metal films used in the conducting layer 3 and of the conductor constituting the microstrip line 5 should be adequately greater than the skin depth $\delta s=\sqrt{\{2/(\omega\mu 0\sigma)\}}$ at f=1 GHz. For example if copper is used, the thickness of the conducting layer 3 and of the conductor of the microstrip line 5 should be taken as 2.1 μm or greater. This reflection-type bandpass filter is used in a system where the characteristic impedance is 50Ω.

Figure 44:
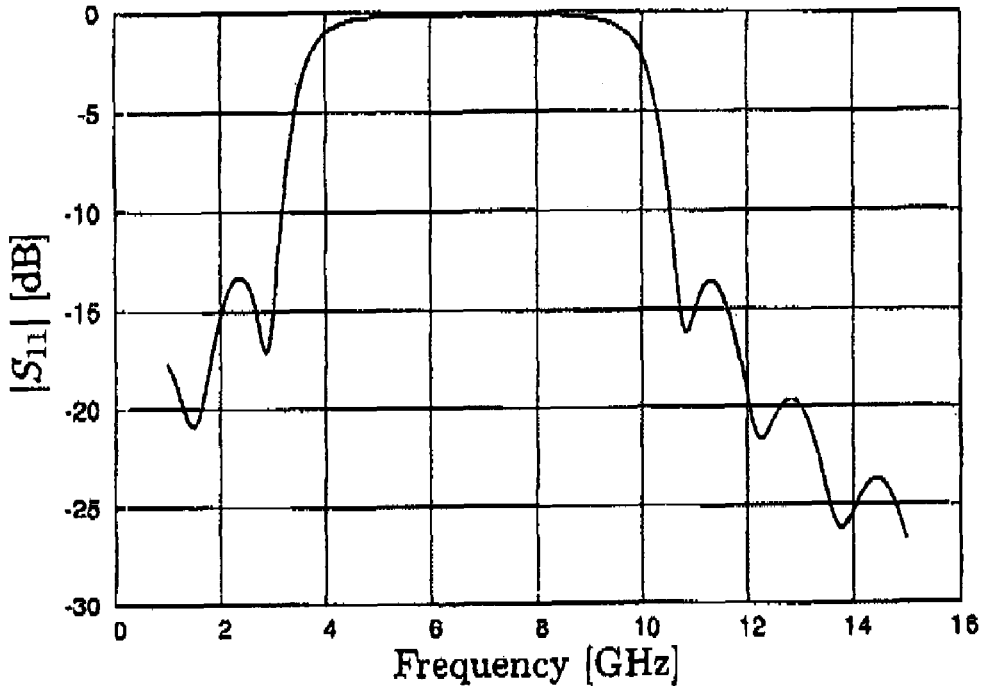
FIG. 44 is a graph showing the amplitude characteristics of the reflective wave in the reflection-type bandpass filter of the tenth embodiment.
Figure 45:
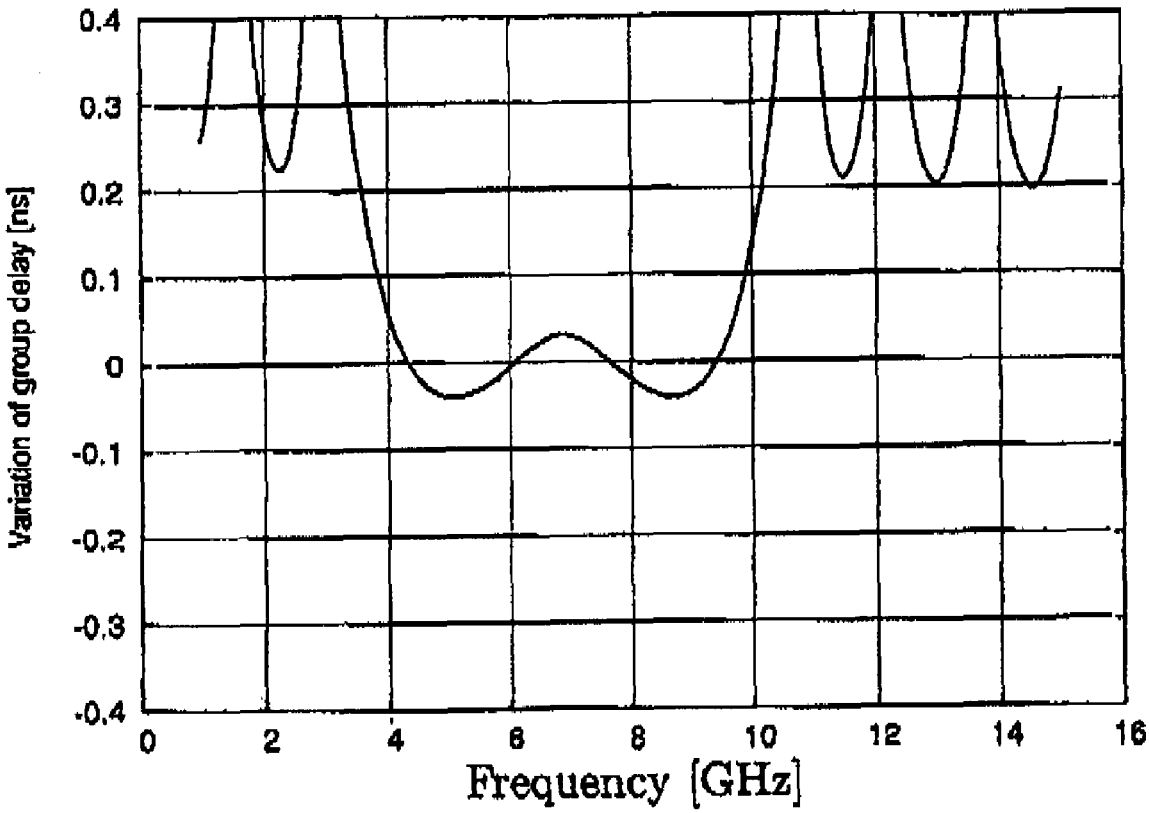
FIG. 45 is a graph showing the group delay frequency characteristics of the reflective wave in the reflection-type bandpass filter of the tenth embodiment.

FIG. 44 and FIG. 45 express the amplitude characteristics and group delay frequency characteristics respectively of the reflective wave (S11) in the bandpass filter of the tenth embodiment. As shown in the figures, in the region of frequency f for which 3.9 GHz≦f≦9.8 GHz, the reflectivity is −2 dB or greater and the variation of the group delay is within ±0.15 ns. In the region f<3.1 GHz and f>10.6 GHz, the reflectivity is −13 dB or lower.

Exemplary embodiments related to the present invention have been described above; however, the present invention is not restricted to the examples given herein. Additions to the configuration, omissions, replacements and other changes may be effected to the present invention without departing from the spirit and scope of the present invention. It is to be understood that the present invention is not to be limited to the explanations given above, but is limited only by the scope of the appended claims and their legal equivalents.

What is claimed is:

1. A reflection-type bandpass filter for ultra-wideband radio data communications, the reflection-type bandpass filter comprising:

a substrate formed by laminating a conducting layer and a dielectric layer; and a microstrip line comprising a conductor of a non-uniform width and provided on the dielectric layer, wherein a width distribution of the microstrip line in a lengthwise direction is set such that an absolute value of a difference in reflectivity at a frequency f in regions f<3.1 GHz and f>10.6 GHz and a reflectivity in a region 3.7 GHz≦f≦10.0 GHz is not less than 10 dB, and a variation of a group delay in the region 3.7 GHz≦f≦10.0 GHz is between −0.2 ns and 0.2 ns; and wherein the width distribution of the microstrip line is set using a design method based on an inverse problem leading to a potential from spectral data in a Zakharov-Shabat equation.

2. A reflection-type bandpass filter for ultra-wideband radio data communications, the reflection-type bandpass filter comprising:

a substrate formed by laminating a conducting layer and a dielectric layer; and a microstrip line comprising a conductor of a non-uniform width and provided on the dielectric layer, wherein a width distribution of the microstrip line in a lengthwise direction is set such that an absolute value of a difference in reflectivity at a frequency f in regions f<3.1 GHz and f>10.6 GHz and a reflectivity in a region 4.0 GHz≦f≦9.8 GHz is not less than 10 dB, and a variation of a group delay in the region 4.0 GHz≦f≦9.8 GHz is between −0.1 ns and 0.1 ns; and wherein the width distribution of the microstrip line is set using a design method based on an inverse problem leading to a potential from spectral data in a Zakharov-Shabat equation.

3. A reflection-type bandpass filter for ultra-wideband radio data communications, the reflection-type bandpass filter comprising:

a substrate formed by laminating a conducting layer and a dielectric layer; and a microstrip line comprising a conductor of a non-uniform width and provided on the dielectric layer, wherein a width distribution of the microstrip line in a lengthwise direction is set such that an absolute value of a difference in reflectivity at a frequency f in regions f<3.1 GHz and f>10.6 GHz and a reflectivity in a region 3.5 GHz≦f≦10.1 GHz is not less than 10 dB, and a variation of a group delay in the region 3.5 GHz≦f≦10.1 GHz is between −0.2 ns and 0.2 ns; and wherein the width distribution of the microstrip line is set using a design method based on an inverse problem leading to a potential from spectral data in a Zakharov-Shabat equation.

4. A reflection-type bandpass filter for ultra-wideband radio data communications, the reflection-type bandpass filter comprising:

a substrate formed by laminating a conducting layer and a dielectric layer; and a microstrip line comprising a conductor of a non-uniform width and provided on the dielectric layer, wherein a width distribution of the microstrip line in a lengthwise direction is set such that an absolute value of a difference in reflectivity at a frequency f in regions f<3.1 GHz and f>10.6 GHz and a reflectivity in a region 4.0 GHz≦f≦9.6 GHz is not less than 10 dB, and a variation of a group delay in the region 4.0 GHz≦f≦9.6 GHz is between −0.07 ns and 0.07 ns and wherein the width distribution of the microstrip line is set using a design method based on an inverse problem leading to a potential from spectral data in a Zakharov-Shabat equation.

5. A reflection-type bandpass filter for ultra-wideband radio data communications, the reflection-type bandpass filter comprising:

a substrate formed by laminating a conducting layer and a dielectric layer; and a microstrip line comprising a conductor of a non-uniform width and provided on the dielectric layer, wherein a width distribution of the microstrip line in a lengthwise direction is set such that an absolute value of a difference in reflectivity at a frequency f in regions f<3.1 GHz and f>10.6 GHz and a reflectivity in a region 4.2 GHz≦f≦9.5 GHz is not less than 10 dB, and a variation of a group delay in the region 4.2 GHz≦f≦9.5 GHz is between −0.2 ns and 0.2 ns; and wherein the width distribution of the microstrip line is set using a design method based on an inverse problem leading to a potential from spectral data in a Zakharov-Shabat equation.

6. The reflection-type bandpass filter according to claim 1, wherein a characteristic impedance of an input terminal transmission line of the reflection-type bandpass filter is not less than 10Ω and not greater than 200Ω.

7. The reflection-type bandpass filter according to claim 6, wherein a resistance having the same impedance as the characteristic impedance, or a non-reflecting terminator, is provided on a terminating side of the reflection-type bandpass filter.

8. The reflection-type bandpass filter according to claim 1, wherein the conducting layer of the substrate and the conductor of the microstrip line are made of a metal plate of a thickness not less than a skin depth at a frequency f of 1 GHz.

9. The reflection-type bandpass filter according to claim 1, wherein the dielectric layer of the substrate has a thickness that is not less than 0.5 mm and not greater than 5 mm, a relative dielectric constant that is not less than 1 and not greater than 200, a width that is not less than 2 mm and not greater than 100 mm, and a length that is not less than 2 mm and not greater than 300 mm.

10. The reflection-type bandpass filter according to claim 1, wherein the width distribution of the microstrip line is set using a window function method.

11. The reflection-type bandpass filter according to claim 1, wherein the width distribution of the microstrip line is set using a Kaiser window function method.

* * * * *